US011884483B1

(12) United States Patent
Hassell et al.

(10) Patent No.: US 11,884,483 B1
(45) Date of Patent: Jan. 30, 2024

(54) COLLAPSIBLE CONTAINER WITH SLIDABLE RETRACTABLE WALL

(71) Applicant: Rehrig Pacific Company, Los Angeles, CA (US)

(72) Inventors: Jon P. Hassell, Atlanta, GA (US); William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 17/459,683

(22) Filed: Aug. 27, 2021

Related U.S. Application Data

(60) Provisional application No. 63/118,346, filed on Nov. 25, 2020, provisional application No. 63/108,269, filed on Oct. 30, 2020, provisional application No. 63/079,801, filed on Sep. 17, 2020, provisional application No. 63/071,084, filed on Aug. 27, 2020.

(51) Int. Cl.
*B65D 21/08* (2006.01)
*B65D 88/52* (2006.01)

(52) U.S. Cl.
CPC ..... *B65D 88/522* (2013.01)

(58) Field of Classification Search
CPC .. B65D 88/522; B65D 88/52; B65D 11/1833; B65D 11/18; B65D 25/005; B65D 19/12; B65D 1/225; B65D 21/086
USPC ..... 220/1.5, 6, 7, 4.28, 666; 206/600
See application file for complete search history.

(56) References Cited

U.S. PATENT DOCUMENTS

| | | | |
|---|---|---|---|
| 2,780,381 | A | 2/1957 | Coit, Jr. |
| 3,360,180 | A | 12/1967 | Venturi |
| 3,372,829 | A | 3/1968 | Averill |
| 3,835,792 | A | 9/1974 | Wharton |
| 3,981,410 | A | 9/1976 | Schurch |
| 4,023,698 | A | 5/1977 | Joseph |
| 4,043,476 | A | 8/1977 | Joseph |
| 4,406,380 | A | 9/1983 | Paige |
| 4,662,532 | A | 5/1987 | Anderson et al. |

(Continued)

FOREIGN PATENT DOCUMENTS

| | | |
|---|---|---|
| DE | 4319099 A1 | 12/1994 |
| EP | 1225131 | 5/2004 |

(Continued)

*Primary Examiner* — John K Fristoe, Jr.
*Assistant Examiner* — Elizabeth J Volz
(74) *Attorney, Agent, or Firm* — Carlson, Gaskey & Olds, P.C.

(57) ABSTRACT

In multiple embodiments, a collapsible container includes a base and a plurality of walls pivotably connected to edges of the base and collapsible onto the base. The plurality of walls include a retractable first wall. The first wall includes a frame having a lower horizontal portion and a pair of upstanding vertical portions extending upward from the lower horizontal portion to define an access opening therebetween. An upper beam is slidably coupled to the vertical portions and movable between a first position away from the lower horizontal portion of the frame and a second position proximate the lower horizontal portion of the frame. In some embodiments, the first wall includes a mid-beam coupled to the upper beam. The mid-beam is spaced away from the upper beam and spaced away from the lower horizontal portion of the frame when the upper beam is in the first position.

33 Claims, 105 Drawing Sheets

(56) References Cited

U.S. PATENT DOCUMENTS

| | | | |
|---|---|---|---|
| 4,674,647 | A | 6/1987 | Gyenge et al. |
| 4,765,480 | A | 8/1988 | Malmanger |
| 5,016,772 | A | 5/1991 | Wilk |
| 5,161,709 | A | 11/1992 | Oestreich, Jr. |
| 5,562,224 | A | 10/1996 | Pascal et al. |
| 5,660,291 | A | 8/1997 | Dash |
| 6,015,056 | A | 1/2000 | Overholt et al. |
| 6,044,998 | A | 4/2000 | Schearer et al. |
| 6,056,177 | A | 5/2000 | Schneider |
| 6,098,827 | A | 8/2000 | Overholt et al. |
| 6,209,742 | B1 | 4/2001 | Overholt et al. |
| 6,290,081 | B1 | 9/2001 | Merey |
| 6,305,566 | B1 | 10/2001 | Pigott et al. |
| 6,601,724 | B1 | 8/2003 | Koefelda et al. |
| 6,691,885 | B2 | 2/2004 | Brown |
| 6,918,502 | B1 | 7/2005 | Overholt et al. |
| 7,011,225 | B2 | 3/2006 | Oster et al. |
| 7,264,122 | B2 | 9/2007 | Koefelda et al. |
| 8,863,971 | B2 | 10/2014 | Cavalcante et al. |
| 9,475,638 | B2 | 10/2016 | Cavalcante et al. |
| 10,077,152 | B2 | 9/2018 | Cavalcante et al. |
| 10,988,308 | B2 | 4/2021 | Cavalcante et al. |
| 2002/0070215 | A1 | 6/2002 | Walsh et al. |
| 2003/0000950 | A1 | 1/2003 | Murakami et al. |
| 2004/0020821 | A1 | 2/2004 | Koefelda et al. |
| 2004/0200833 | A1 | 10/2004 | Dubois et al. |
| 2006/0231555 | A1 | 10/2006 | Smyers et al. |
| 2006/0260976 | A1 | 11/2006 | Apps |
| 2007/0158345 | A1 | 7/2007 | Booth et al. |
| 2009/0134157 | A1 | 5/2009 | Meers |
| 2012/0111859 | A1* | 5/2012 | Pils ..... B65D 11/1833 220/4.28 |
| 2013/0001223 | A1 | 1/2013 | Cavalcante et al. |
| 2015/0028027 | A1 | 1/2015 | Cavalcante et al. |
| 2017/0129694 | A1 | 3/2017 | Cavalcante et al. |
| 2019/0023485 | A1 | 1/2019 | Cavalcante et al. |
| 2020/0247583 | A1* | 8/2020 | Sekowski ..... B65D 21/0209 |
| 2021/0206564 | A1 | 7/2021 | Cavalcante et al. |

FOREIGN PATENT DOCUMENTS

| | | | |
|---|---|---|---|
| EP | 1524170 | A2 | 4/2005 |
| EP | 1935792 | A1 | 6/2008 |
| EP | 2062827 | A1 | 5/2009 |
| FR | 1227059 | | 8/1960 |
| FR | 2810020 | A1 | 12/2001 |
| GB | 2357078 | A | 6/2001 |
| GB | 2360762 | A | 10/2001 |
| GB | 2431922 | A | 5/2007 |
| GB | 2449502 | A | 11/2008 |
| WO | 9521773 | A1 | 8/1995 |
| WO | 9840199 | A1 | 9/1998 |
| WO | 03008275 | A2 | 1/2003 |
| WO | 2006010311 | A1 | 2/2006 |
| WO | 2008145977 | A1 | 12/2008 |

* cited by examiner

COLLAPSIBLE CONTAINER WITH SLIDABLE RETRACTABLE WALL

BACKGROUND

Currently, some grocery items may be shipped to stores in metal crates or cardboard boxes. The grocery items must be unloaded and placed onto shelves for the customers to select and purchase. This requires labor for handling the grocery items in the store.

The assignee of the present application has developed several collapsible containers with retractable front walls. The front wall of the container can be reconfigured to a retracted position while another identical container is stacked on it. Retracting the front wall provides access to the grocery items within the container without the need to unload the grocery items onto a shelf. A stack of such containers can be placed on a floor or in a refrigerated area, the front walls can be retracted, and the consumers can retrieve grocery items directly from the containers.

SUMMARY

Several designs of a collapsible container with a retractable front wall are disclosed herein. It should be noted that the term "front" is arbitrary and can refer to any of the walls. There are some applications where it is preferable that one of the long walls is retractable, as is the case in all of the examples disclosed herein; however, the short walls could also be retractable. Further, more than one wall could be retractable.

In multiple embodiments, a collapsible container includes a base and a plurality of walls pivotably connected to edges of the base and collapsible onto the base. The plurality of walls include a retractable first wall. The first wall includes a frame having a lower horizontal portion and a pair of upstanding vertical portions extending upward from the lower horizontal portion to define an access opening therebetween. An upper beam is slidably coupled to the vertical portions and movable between a first position away from the lower horizontal portion of the frame and a second position proximate the lower horizontal portion of the frame.

In some embodiments, the first wall includes a mid-beam coupled to the upper beam. The mid-beam is spaced away from the upper beam and spaced away from the lower horizontal portion of the frame when the upper beam is in the first position.

The mid-beam may be slidably coupled to the vertical portions of the frame.

In some embodiments, the collapsible container further includes arms pivotably connected to the upper beam and to the mid-beam. The arms may be pivotably connected to the mid-beam and the lower horizontal portion of the frame.

The collapsible container may further include a lower beam hingeably connected to the lower horizontal portion of the frame. The lower beam, the mid-beam and the upper beam may be pivotable outward relative to the lower horizontal portion of the frame.

The upper beam may be selectively connectable to the mid-beam. The first wall may be collapsible onto the pair of opposed walls.

The base may include a pair of opposed short edges and a pair of opposed long edges. The pair of opposed walls may be pivotably connected to the base at the short edges and the first wall may be pivotably connected at one of the opposed long edges.

The upper beam may have a U-shaped portion having a door pivotably mounted therein.

The pair of opposed walls may have handle openings therethrough for carrying the container when loaded with items.

In several of the collapsible containers disclosed herein, the walls that are perpendicular to the retractable wall are configured to be collapsed onto the base prior to the retractable wall and the wall opposite the retractable wall. The retractable wall and the wall opposite the retractable wall may be the "long" walls along long edges of the base, and the perpendicular walls may be the "short" walls along the short edges of the base.

DETAILED DESCRIPTION

Figure 1:
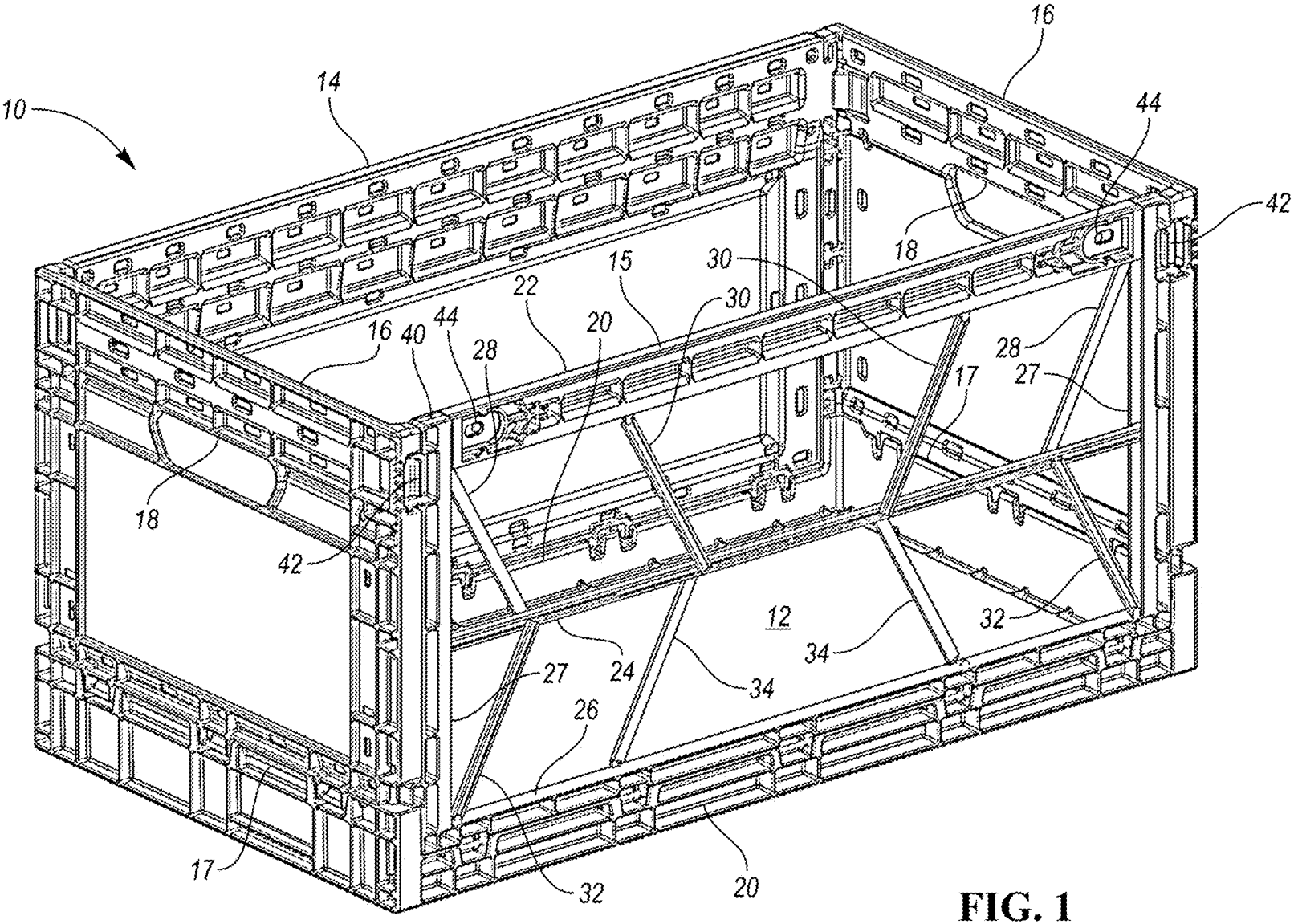
FIG. 1 is a perspective view of a collapsible container according to a first embodiment.

A collapsible container 10 according to a first embodiment is shown in FIG. 1. The collapsible container 10 includes a base 12. A rear wall 14 and a front wall 15 (or "first wall") are pivotably connected to front and rear upstanding flanges 20 at front and rear edges of the base 12. A pair of opposed end walls 16 extend upward from hinges pivotably connecting them to upstanding end flanges 17 projecting upward from end edges of the base 12. Each end wall 16 includes a handle opening 18 therethrough.

The front wall 15 includes a U-shaped frame 40 secured to the end walls 16 by latches 42 of a known type. The U-shaped frame 40 includes a lower horizontal portion 26 and vertical portions 27 extending upward from opposite ends of the lower horizontal portion 26. The lower horizontal portion 26 is hingeably connected to the front upstanding flange 20.

The container 10 is a collapsible container, i.e. the walls 14, 15, 16 can be collapsed onto the base 12 when empty for efficient shipping and storage. In this embodiment, the end flanges 17 are taller than the front and rear upstanding flanges 20 and the end walls 16 are outward of the front wall 15 and the rear wall 14, so the front wall 15 and the rear wall 14 would be collapsed onto the base 12 first (in either order), and then the end walls 16 would be collapsed onto the front wall 15 and rear wall 14.

The front wall 15 is also retractable. In the front wall 15, an upper beam 22 is slidably coupled to both of the vertical portions 27 of the frame 40. Latches 44 selectively secure the upper beam 22 in place at the upper ends of the vertical portions 27 of the frame 40 away from the lower horizontal portion 26 as shown in FIG. 1, which is the deployed, closed position. A mid-beam 24 is also slidably coupled at each end in a track formed on the inner surfaces of the vertical portions 27 of the frame 40.

A plurality of arms are pivotably and slidably connected to the lower horizontal portion 26 of the frame 40, the mid-beam 24 and the upper beam 22. A pair of upper outer arms 28 and a pair of upper inner arms 30 are pivotably connected to the upper beam 22 and pivotably and slidably connected to the mid-beam 24. The upper outer arms 28 are positioned outward of the upper inner arms 30. The upper outer arms 28 are positioned on an interior side of the mid-beam 24. The upper inner arms 30 are positioned on an exterior side of the mid-beam 24. The upper outer arms 28 and upper inner arms 30 are angled inward as they extend downward from the upper beam 22 in the deployed, closed position shown in FIG. 1.

A pair of lower outer arms 32 and a pair of lower inner arms 34 are pivotably connected to the lower horizontal portion 26 of the frame 40 and pivotably and slidably connected to the mid-beam 24. The lower outer arms 32 are positioned outward of the lower inner arms 34. The lower outer arms 32 are positioned on the exterior side of the mid-beam 24 and connected to the lower ends of the upper outer arms 28 through the mid-beam 24. The lower inner arms 34 are positioned on an exterior side of the mid-beam 24 and are connected to the lower ends of the upper inner arms 30 through the mid-beam 24. The lower inner arms 34 and the lower outer arms 32 angle inward as they extend upward from the lower horizontal portion 26 of the frame 40 in the deployed, closed position shown in FIG. 1.

Figure 2:
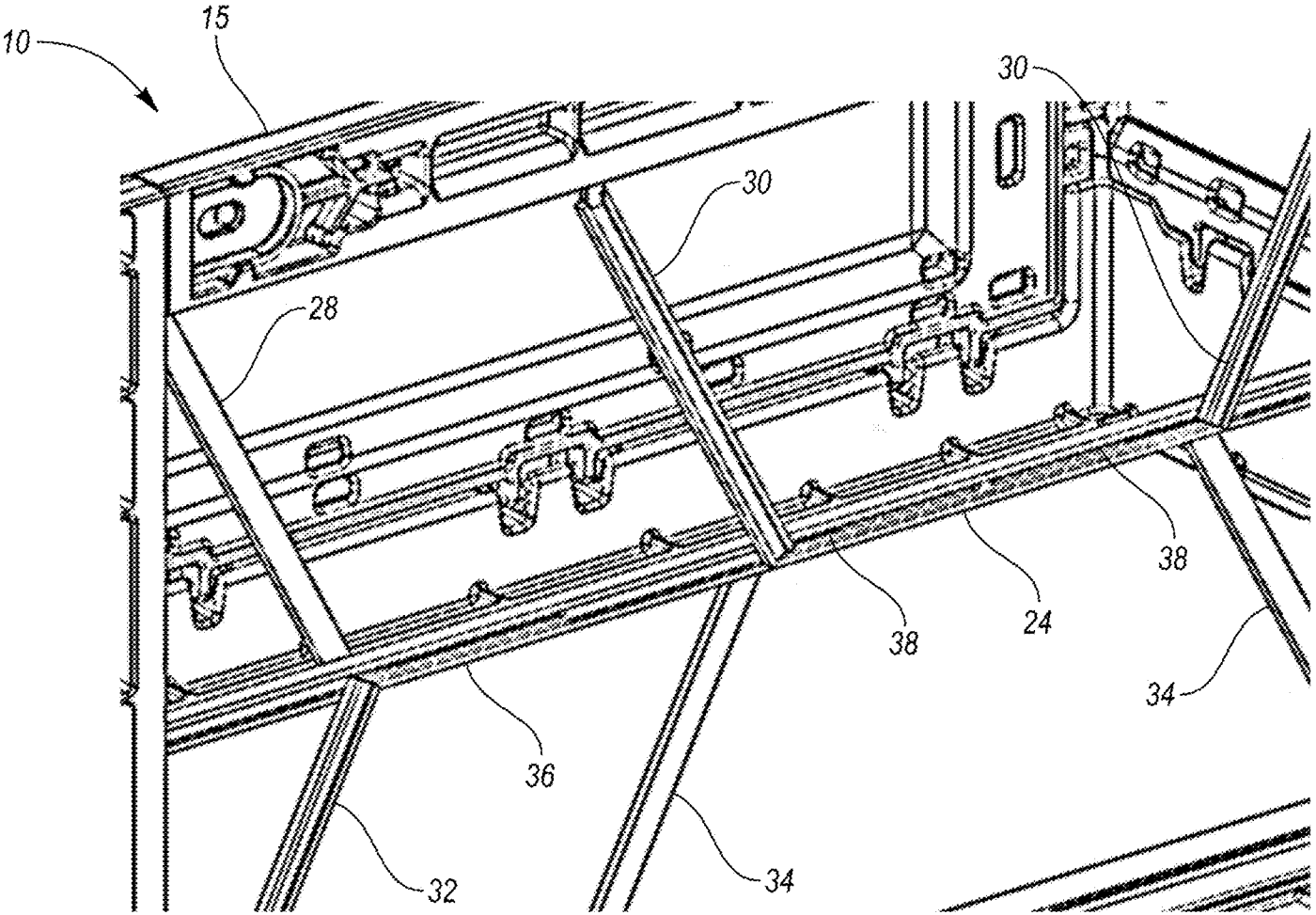
FIG. 2 is an enlarged view of a portion of the mid-beam of the container of FIG. 1.
Figure 3:
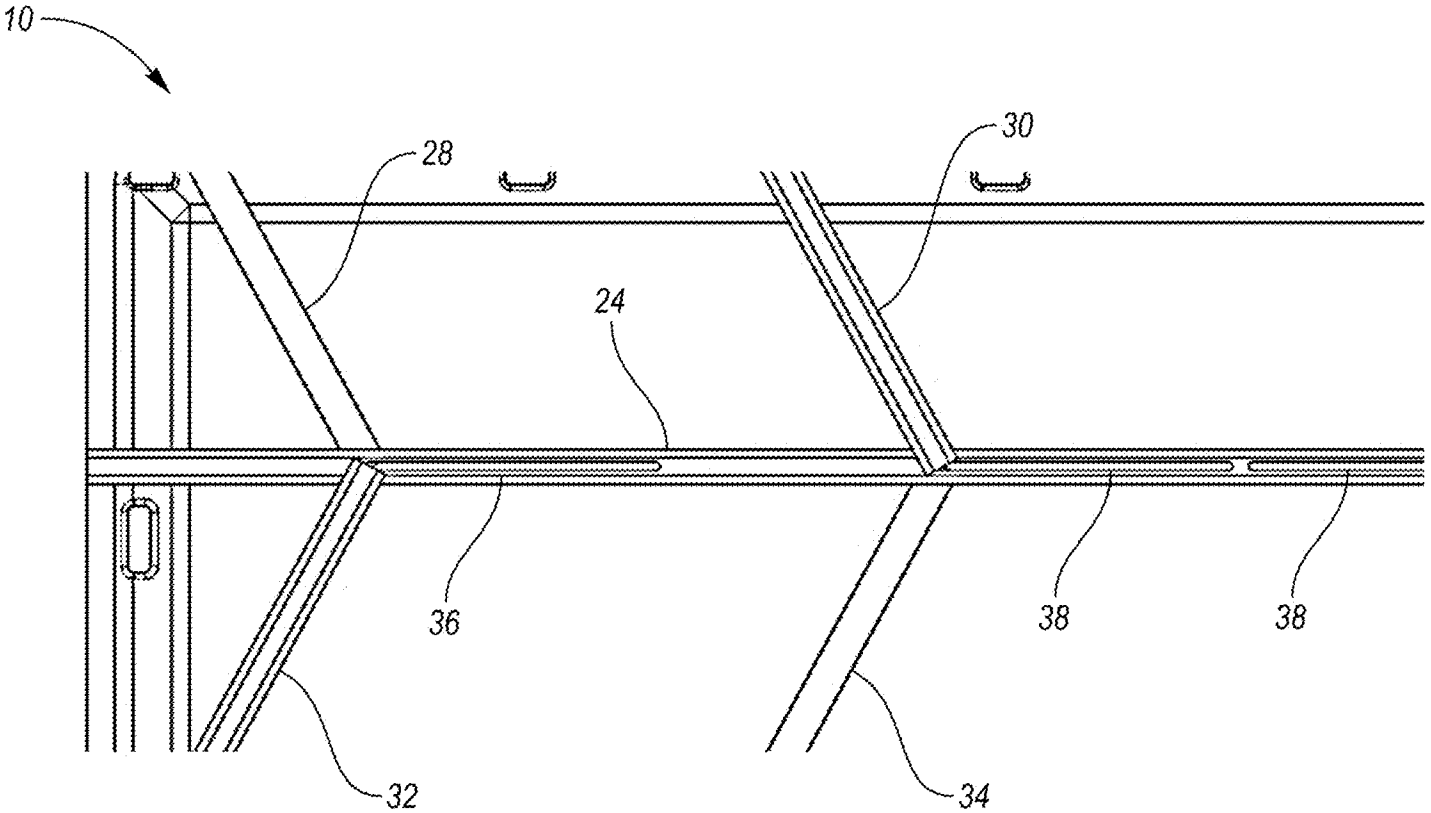
FIG. 3 is an enlarged view of a portion of the mid-beam of FIG. 1.

FIGS. 2 and 3 are enlarged views of a portion of the mid-beam 24 of FIG. 1. The mid-beam 24 includes a plurality of elongated apertures 36, 38 therethrough. The upper outer arms 28 connect to the lower outer arms 32 through the elongated apertures 36 and are thus slidably and pivotably connected to the mid-beam 24. The upper inner arms 30 connect to the lower inner arms 34 through the elongated apertures 38 and are thus slidably and pivotably connected to the mid-beam 24.

Figure 4:
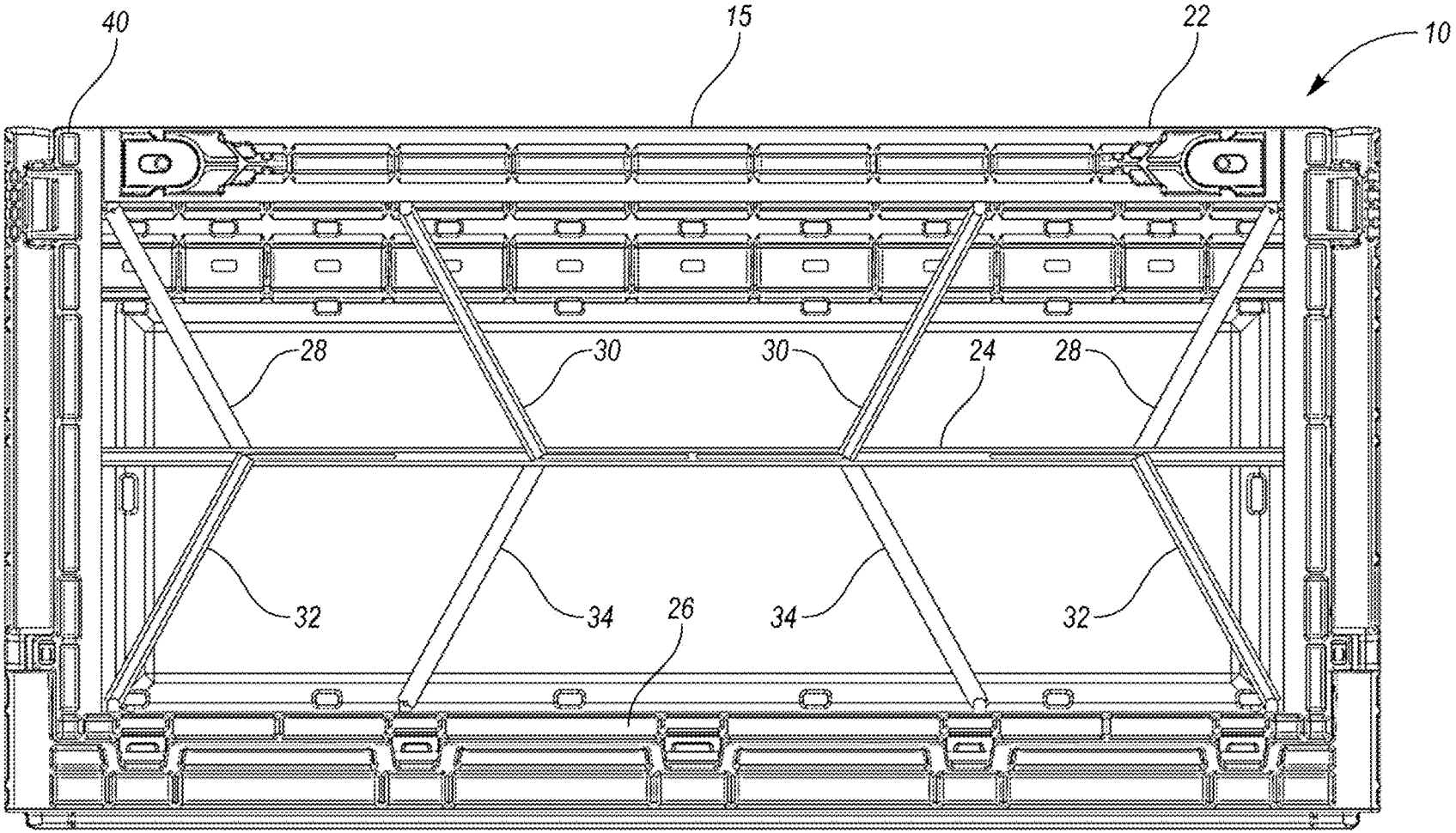
FIG. 4 is a front view of the container of FIG. 1 with the front wall in the closed, deployed position.

FIG. 4 is a front view of the container 10 of FIG. 1, with the front wall 15 in the closed, deployed position. The access opening to the container 10 defined by the frame 40 is substantially blocked by the front wall 15 in the closed, deployed position, by the upper beam 22, the mid-beam 24 and the arms 28, 30, 32, 34, at least for larger items such as egg cartons or other grocery items.

Figure 5:
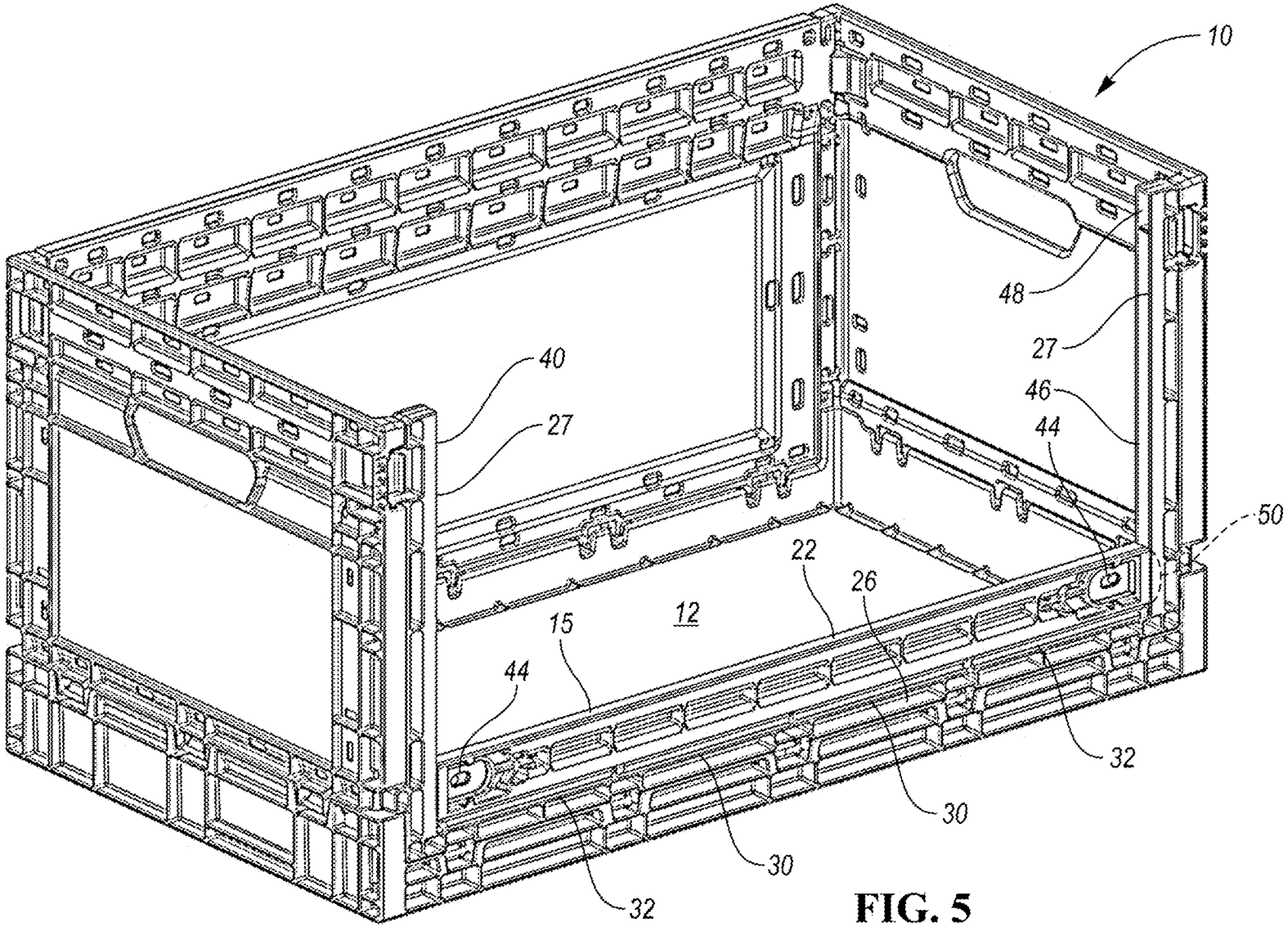
FIG. 5 shows the container of FIG. 1 with the front wall in the retracted position.

FIG. 5 shows the front wall 15 in the retracted position. The upper beam 22 is slid downward relative to the frame 40. After releasing the latches 44, the upper beam 22 is slid downward in the tracks 46 formed in the vertical portions 27 of the frame 40. The arms 28, 30, 32, 34 pivot and slide until they are in a horizontal plane (parallel to the base 12) with the mid-beam 24, with the lower outer arms 32 and upper inner arms 30 outward of the mid-beam 24 and the upper outer arms 28 and lower inner arms 34 inward of the mid-beam 24. The latches 44 are then secured to the vertical portions 27 of the frame 40 in the retracted position.

Figure 6:
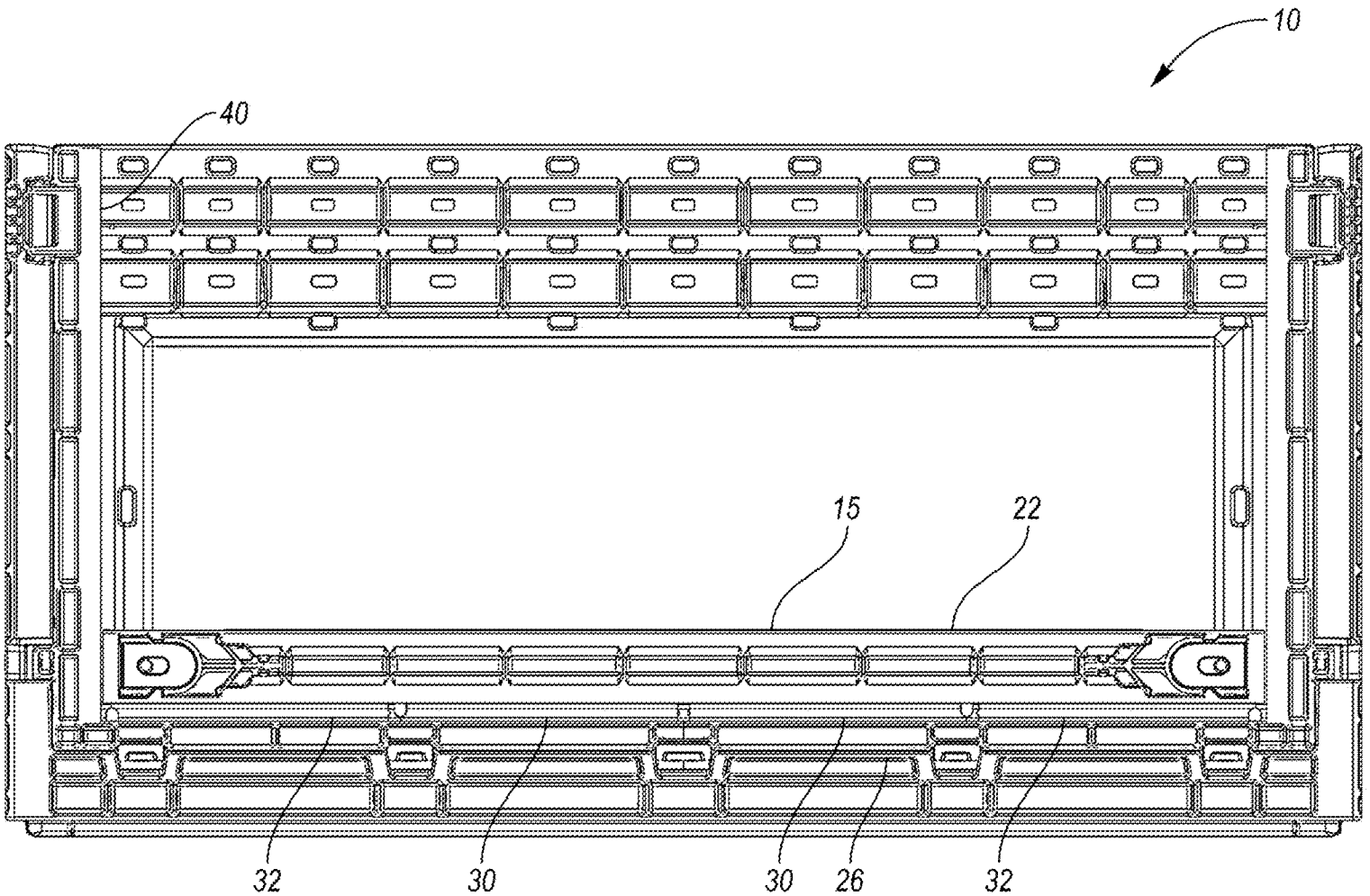
FIG. 6 is a front view of the container of FIG. 5.

FIG. 6 is a front view of the container 10 of FIG. 5, with the front wall 15 in the retracted position. Notably, the front wall 15 can be retracted even when another loaded container 10 is already stacked thereon. In the retracted configuration, goods can be easily removed from the container 10 through the frame 40 even when another loaded container 10 is stacked thereon.

Figure 7:
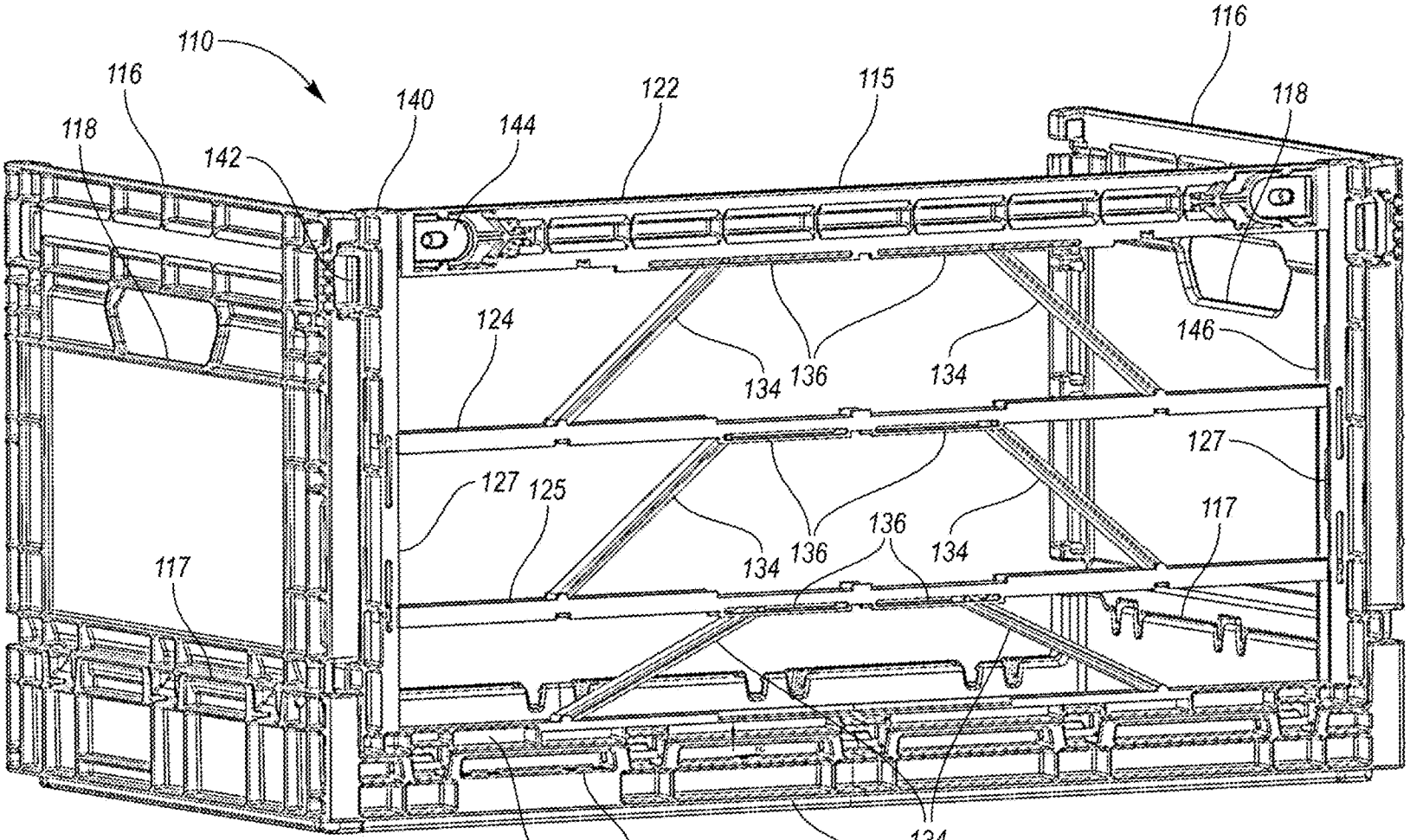
FIG. 7 is a perspective view of a collapsible container according to a second embodiment, with the rear wall removed.

FIG. 7 shows a container 110 according to a second embodiment. In the Figures, the rear wall has been removed for clear illustration, but it would be identical to that of FIG. 1 and would be pivotably connected to a rear upstanding flange 120 at a rear edge of the base 112. The collapsible container 110 includes a base 112. The front wall 115 (or "first wall") is pivotably connected to a front upstanding flange 120 at a front edge of the base 112. A pair of opposed end walls 116 extend upward from hinges pivotably connecting them to upstanding end flanges 117 projecting upward from end edges of the base 112. Each end wall 116 includes a handle opening 118 therethrough.

The front wall 115 includes a U-shaped frame 140 secured to the end walls 116 by latches 142 which could be of a known type. The U-shaped frame 140 includes a lower horizontal portion 126 and vertical portions 127 extending upward from opposite ends of the lower horizontal portion 126. The lower horizontal portion 126 is hingeably connected to the front upstanding flange 120.

The container 110 is a collapsible container, i.e. the walls can be collapsed onto the base 112 when empty for efficient shipping and storage. In this embodiment, the end flanges 117 are taller than the front and rear upstanding flanges 120 and the end walls 116 are outward of the front wall 115 and the rear wall 114, so the front wall 115 and the rear wall would be collapsed onto the base 112 first (in either order), and then the end walls 116 would be collapsed onto the front wall 115 and rear wall 114.

The front wall 115 is also retractable. In the front wall 115, an upper beam 122 is slidably connected to both of the vertical portions 127 of the frame 140. Latches 144 selectively secure the upper beam 122 in place at the upper ends of the vertical portions 127 of the frame 140 away from the lower horizontal portion 126 as shown in FIG. 7, which is the deployed, closed position. A second beam 124 and third beam 125 are also slidably connected at each end to the vertical portions 127 of the frame 140.

A plurality of arms 134 are pivotably and slidably connected to the lower horizontal portion 126 of the frame 140, the second beam 124, the third beam 125 and the upper beam 122. A pair of arms 134 are pivotably connected to the second beam 124 and pivotably and slidably connected to the upper beam 122. A pair of arms 134 are pivotably connected to the third beam 125 and pivotably and slidably connected to the second beam 124. A pair of arms 134 are pivotably connected to the horizontal portion 126 of the frame 140 and pivotably and slidably connected to the third beam 125. Alternatively, the pivotable vs pivotable/slidable connects of the ends of the arms 134 could be reversed, or the arms could be pivotable and slidable at both ends. In the deployed, closed position shown in FIG. 7, all of the arms 134 angle inward as they extend upward. Alternatively, the arms 134 could angle outward as they extend upward.

Figure 8:
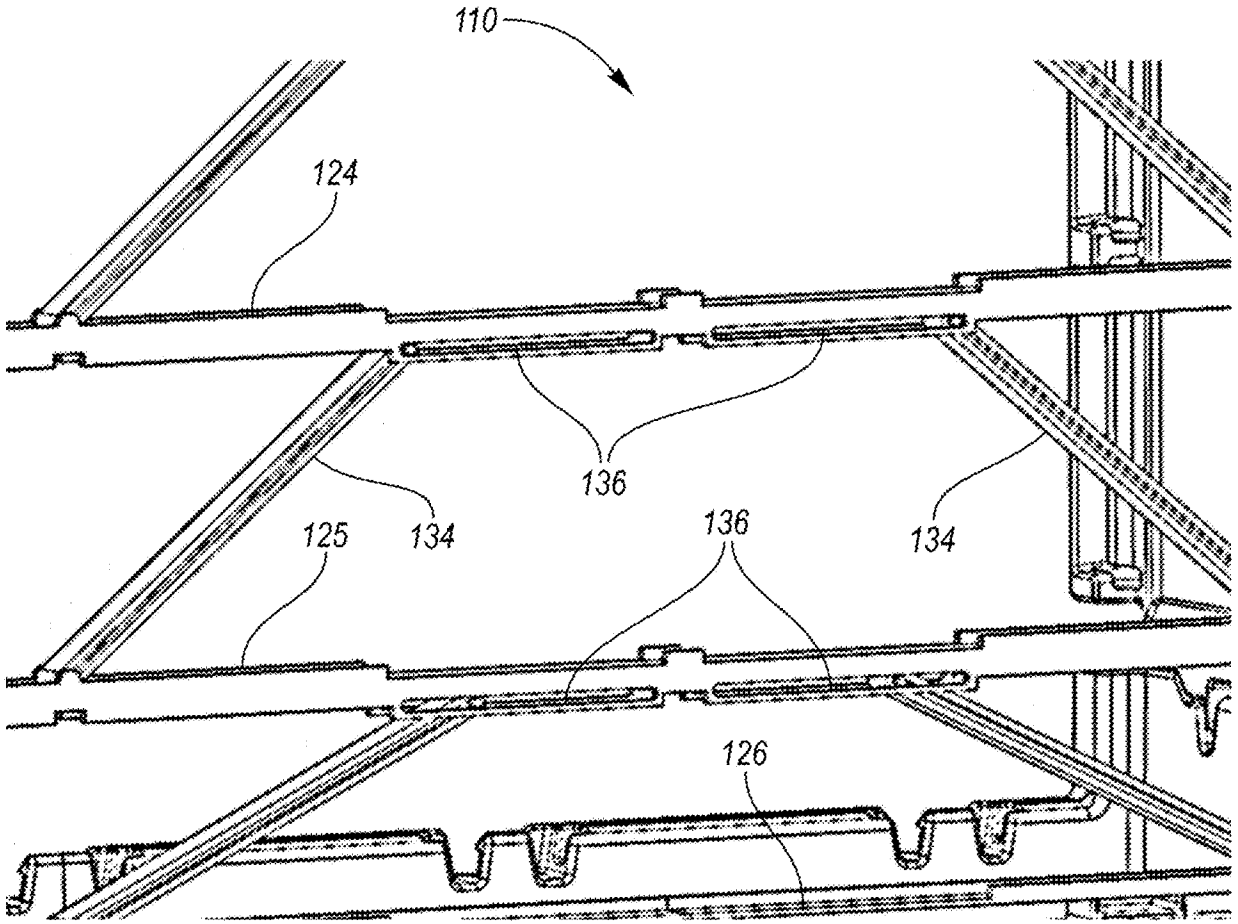
FIG. 8 is an enlarged view of a portion of the second beam and the third beam of the container of FIG. 7.
Figure 9:
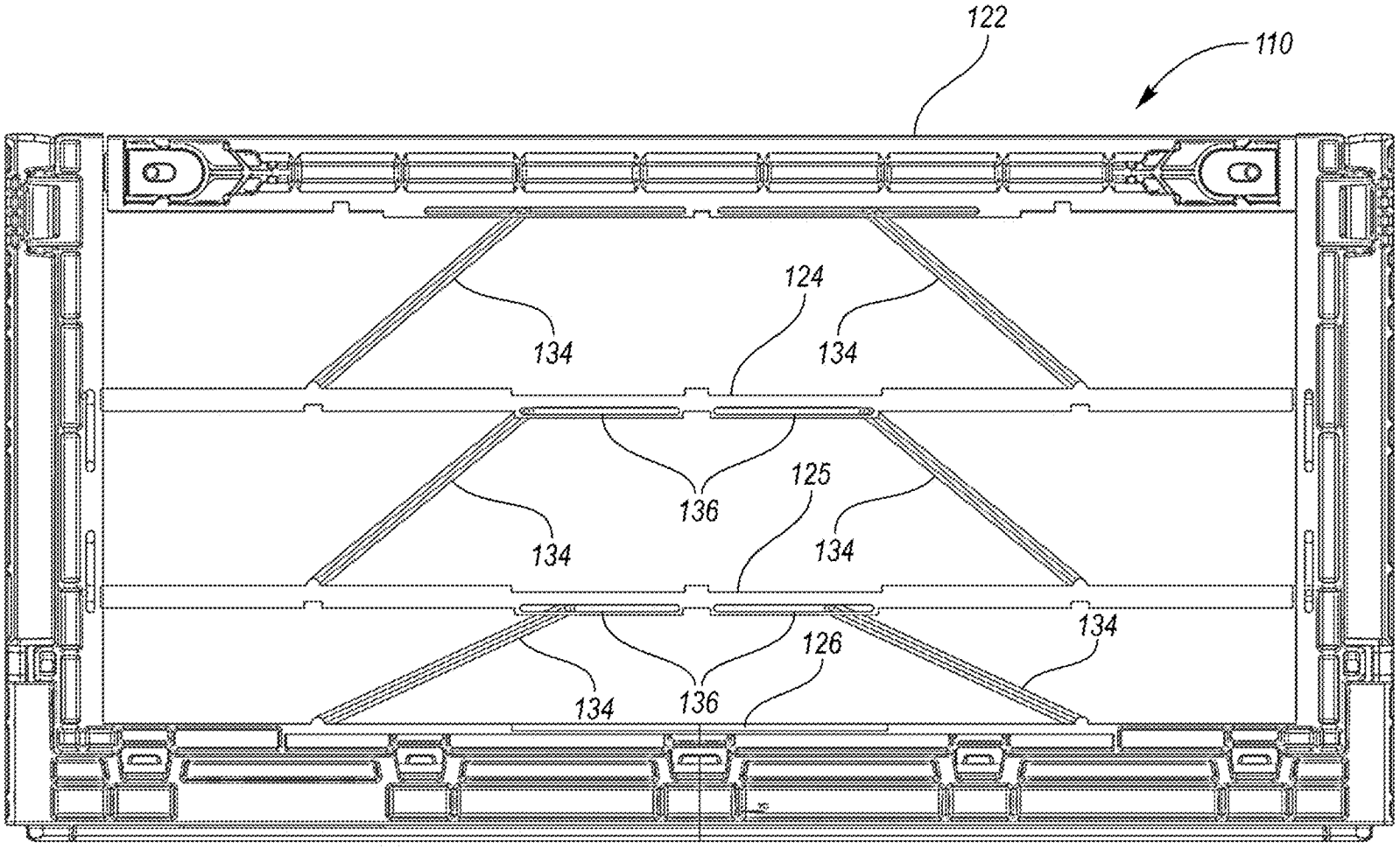
FIG. 9 is a front view of the container of FIG. 7.

FIG. 8 is an enlarged view of a portion of the second beam 124 and third beam 125. The arms 134 are pivotably and slidably connected to elongated apertures 136 in the second beam 124 and the third beam 125. FIG. 9 is a front view of the container 110 of FIG. 7. In the deployed, closed position, the front wall 115 retains goods in the container 110 during shipping. The arms 134 and the beams 122, 124, 125 substantially block the access opening defined by the frame 140.

Figure 10:
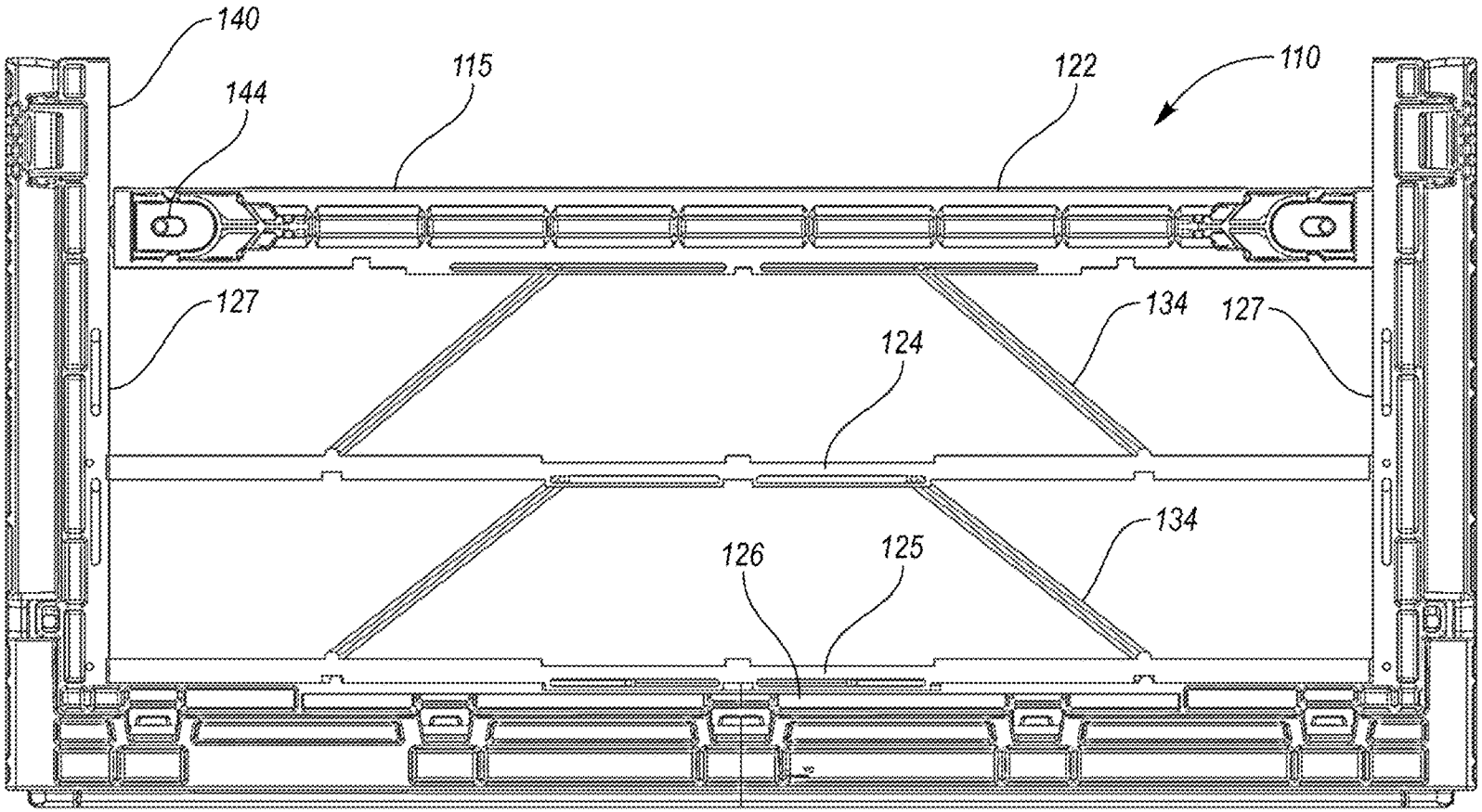
FIG. 10 shows a container of FIG. 9 with the front wall partially retracted.

In FIG. 10, the front wall 115 is partially retracted. The latches 144 are released so that the upper beam 122 can slide downward in the tracks in the vertical portions 127 of the frame 140. The second beam 124 and third beam 125 slide downward. The third beam 125 slides downward onto the horizontal portion 126 of the frame 140, with the arms 134 below the third beam 125 being received in a recess on the underside of the third beam 125.

Figure 11:
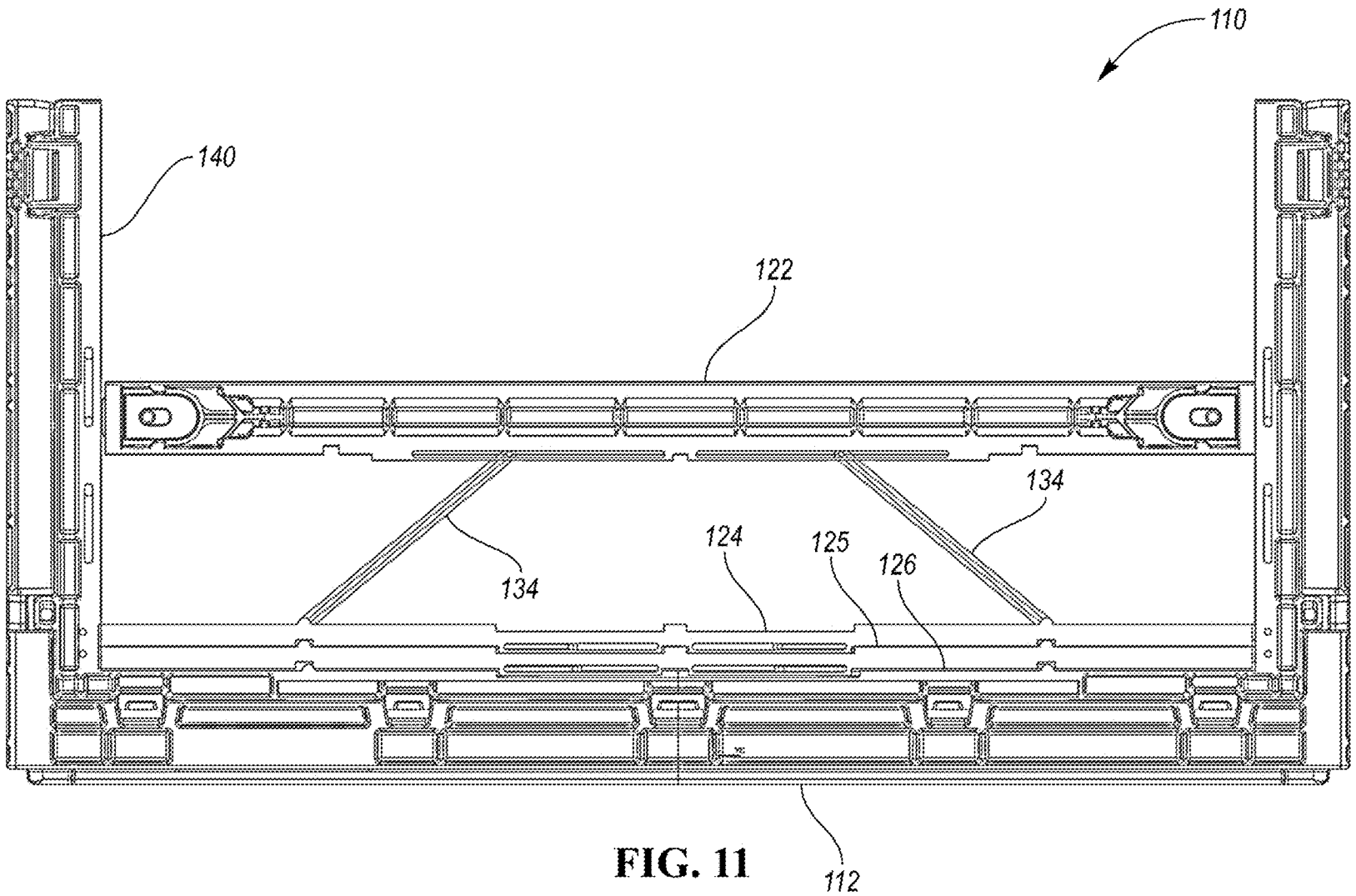
FIG. 11 shows the container of FIG. 9 with the front wall further partially retracted.

In FIG. 11, the front wall 115 is further partially retracted. The second beam 124 slides downward onto the third beam 125, with the arms 134 below the second beam 124 being received inside the second beam 124.

Figure 12:
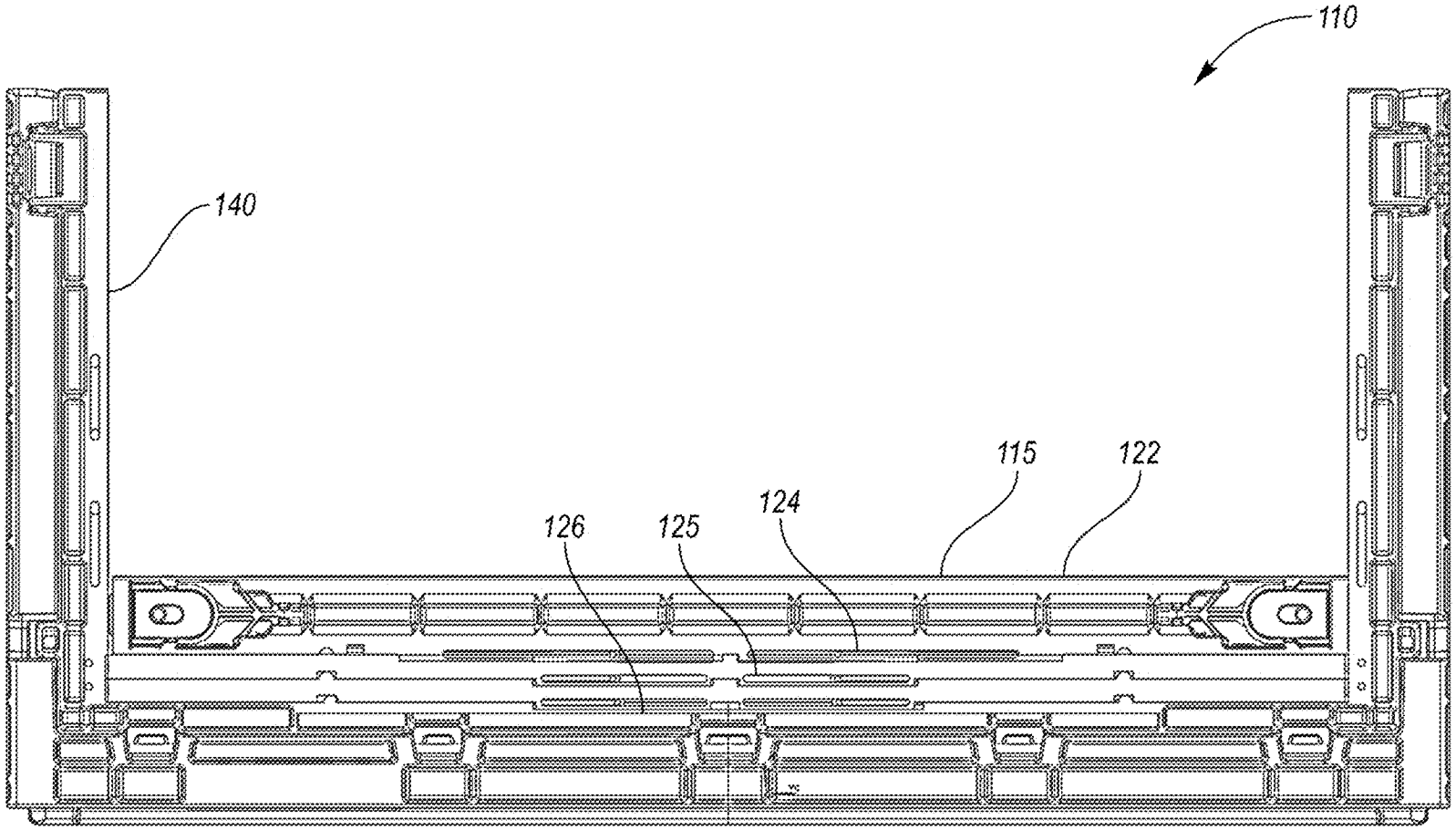
FIG. 12 shows the container of FIG. 9 with the front wall fully retracted.

In FIG. 12, the front wall 115 is fully retracted. The upper beam 122 slides downward onto the second beam 124, with the arms 134 below the upper beam 122 being received inside the upper beam 122.

Figure 13:
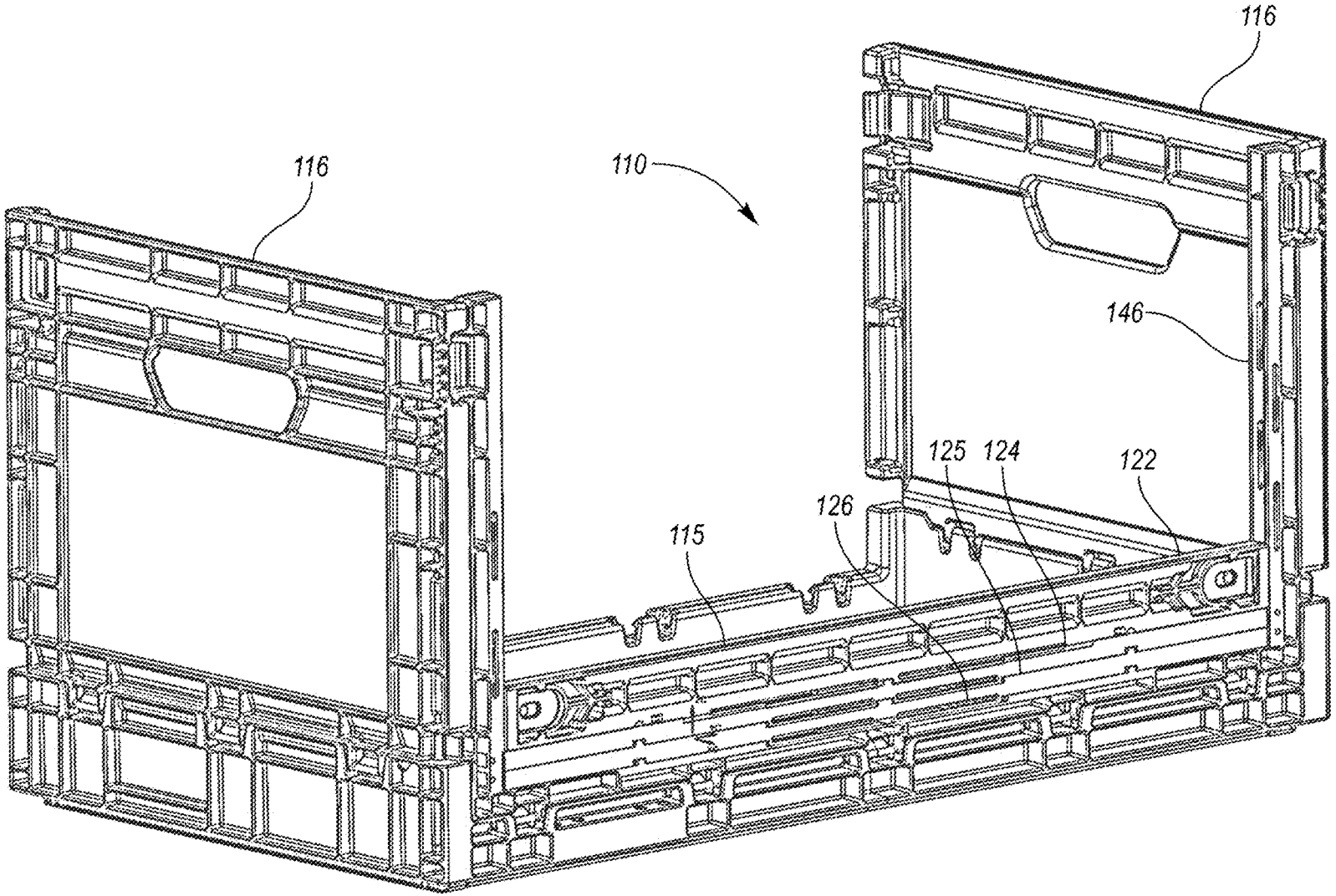
FIG. 13 is a perspective view of the container of FIG. 12.
Figure 14:
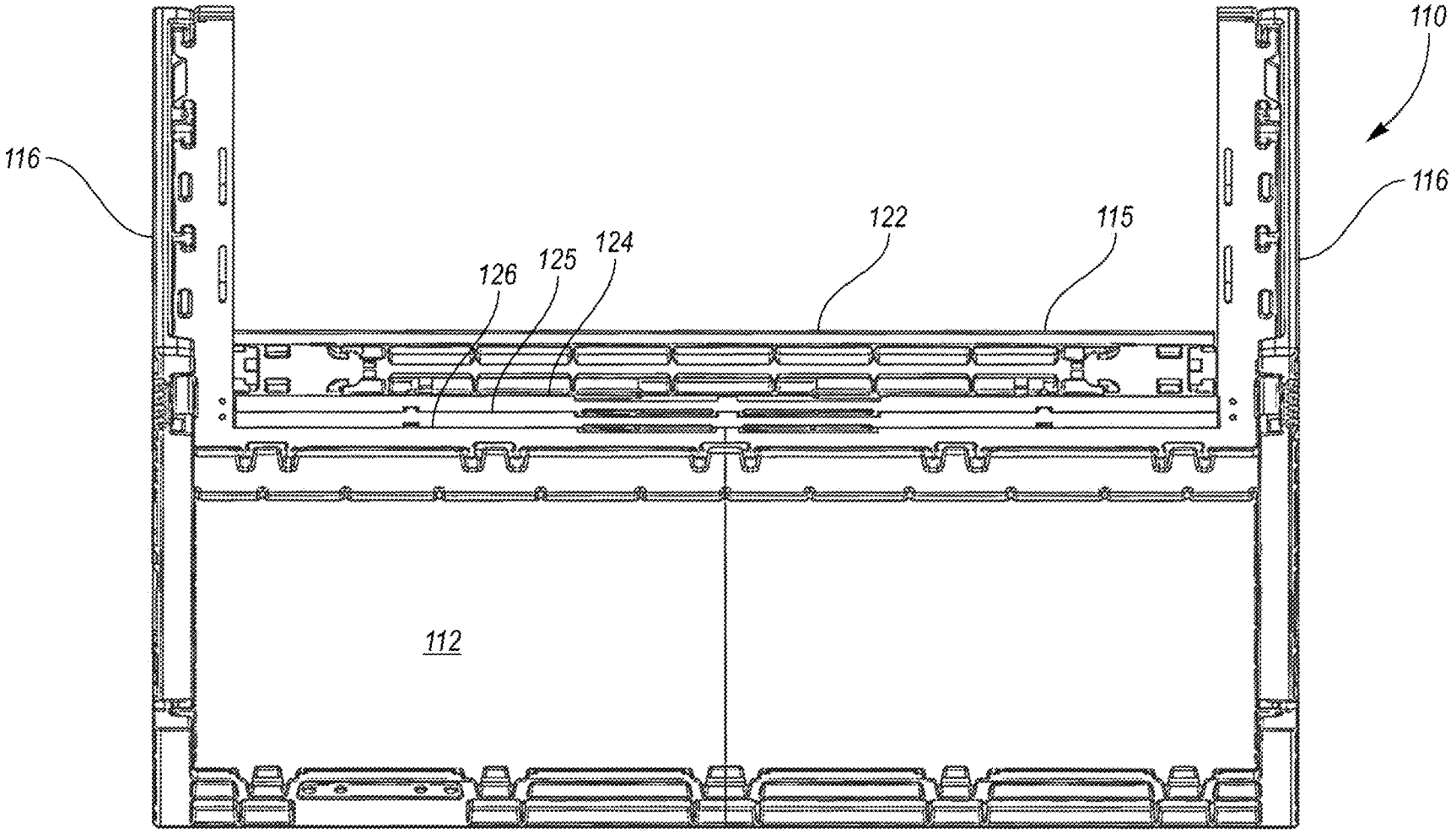
FIG. 14 is a rear perspective view of the container of FIG. 13.

FIG. 13 is a front perspective view of the container 110 of FIG. 12, with the front wall 115 in the retracted configuration. FIG. 14 is a rear perspective view of the container of FIG. 12. In the retracted configuration, goods can be removed from the container 110 through the opening defined by the frame 140 even when another loaded container 110 is stacked thereon. Notably, the front wall 115 can be retracted even when another loaded container 110 is already stacked thereon.

Figure 15:
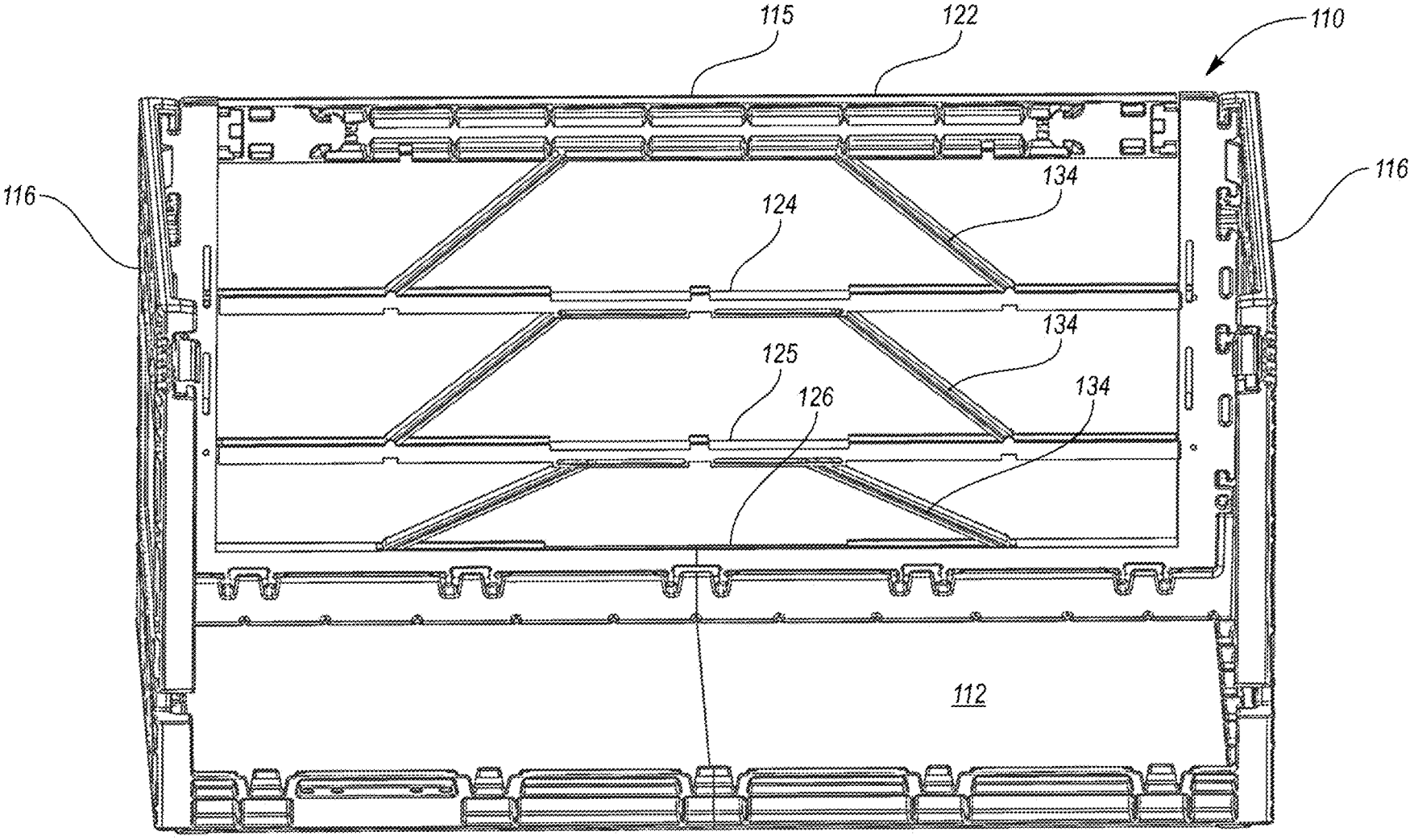
FIG. 15 is a rear perspective view of the container of FIG. 7, with the front wall in the deployed, closed position.

FIG. 15 is a rear perspective view of the container 110 of FIG. 7, with the front wall in the deployed, closed position to retain goods in the container 110 during shipping.

Figure 16:
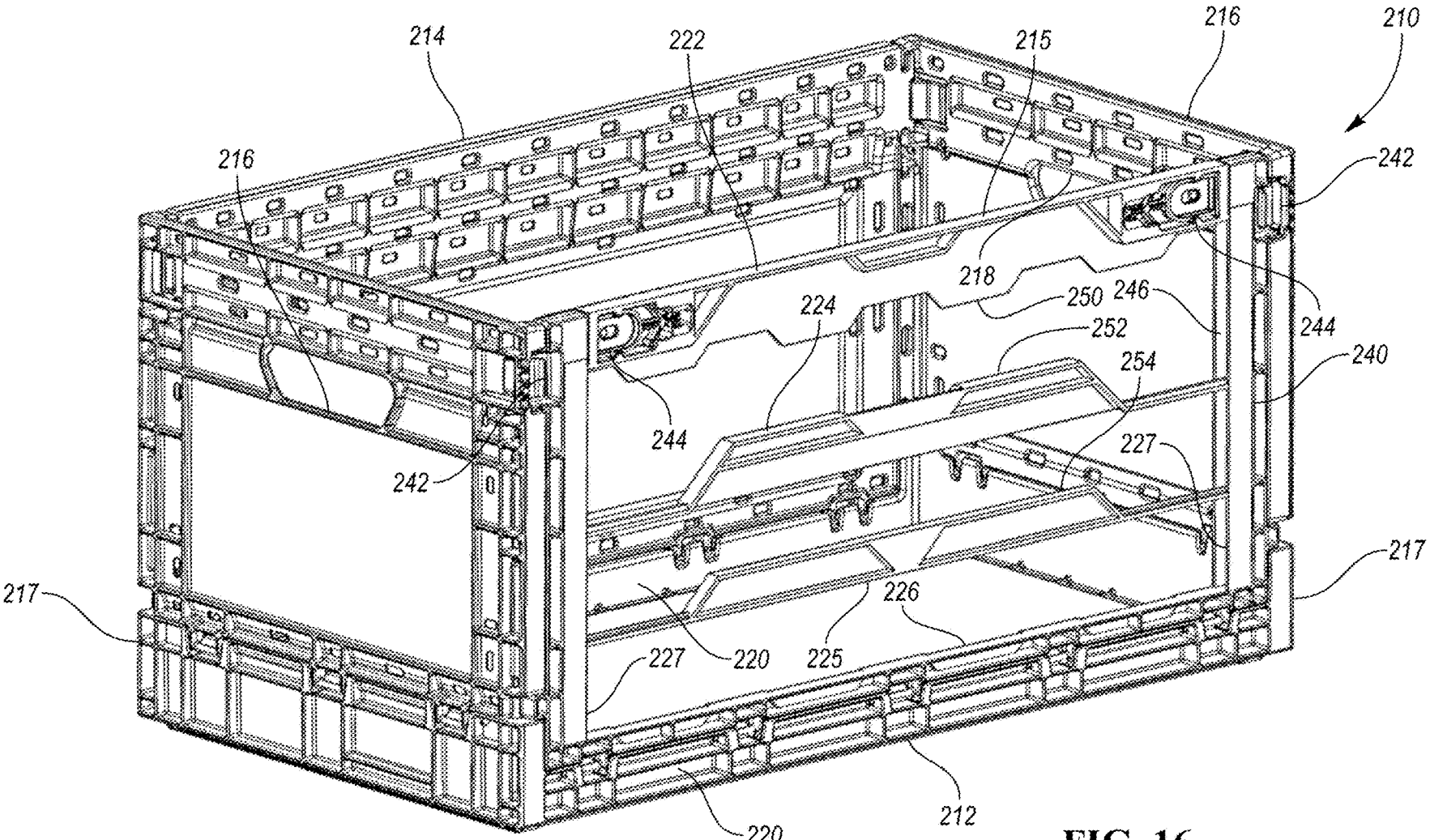
FIG. 16 is a perspective view of a collapsible container according to a third embodiment.

A collapsible container 210 according to a third embodiment is shown in FIG. 16. The collapsible container 210 includes a base 212. A rear wall 214 and a front wall 215 (or "first wall") are pivotably connected to front and rear upstanding flanges 220 at front and rear edges of the base 212. A pair of opposed end walls 216 extend upward from hinges pivotably connecting them to upstanding end flanges 217 projecting upward from end edges of the base 212. Each end wall 216 includes a handle opening 218 therethrough.

The front wall 215 includes a U-shaped frame 240 secured to the end walls 216 by latches 242 of a known type. The U-shaped frame 240 includes a lower horizontal portion 226 and vertical portions 227 extending upward from opposite ends of the lower horizontal portion 226. The lower horizontal portion 226 is hingeably connected to the front upstanding flange 220.

The container 210 is a collapsible container, i.e. the walls 214, 215, 216 can be collapsed onto the base 212 when empty for efficient shipping and storage. In this embodiment, the end flanges 217 are taller than the front and rear upstanding flanges 220 and the end walls 216 are outward of the front wall 215 and the rear wall 214, so the front wall 215 and the rear wall 214 would be collapsed onto the base 212 first (in either order), and then the end walls 216 would be collapsed onto the front wall 215 and rear wall 214.

The front wall 215 is also retractable. In the front wall 215, an upper beam 222 is slidably connected to both of the vertical portions 227 of the frame 240. Latches 244 selectively secure the upper beam 222 in place at the upper ends of the vertical portions 227 of the frame 240 as shown in FIG. 16, which is the deployed, closed position. A mid beam 224 and a lower beam 225 are also slidably connected at each end to the vertical portions 227 of the frame 240. The upper beam 222, mid beam 224 and lower beam 225 are received in vertical channels or tracks 246 formed in each of the vertical portions 227 of the frame 240, such that they can slide vertically relative to the vertical portions 227 of the frame 240. The upper beam 222, mid beam 224 and lower beam 225 each include complementary interlocking panel portions 250, 252, 254, respectively.

Figure 17:
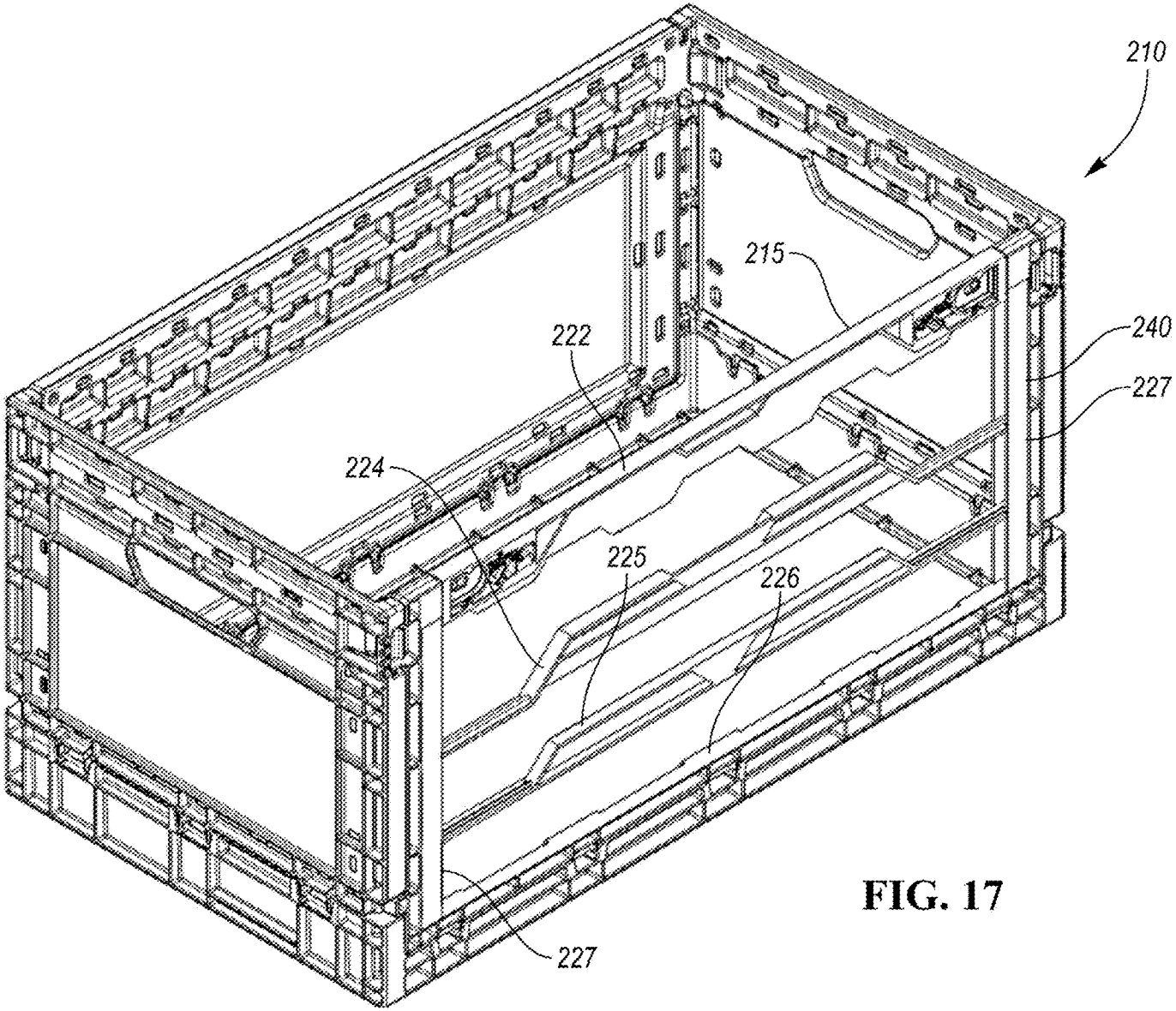
FIG. 17 is an upper perspective view of the container of FIG. 16.
Figure 18:
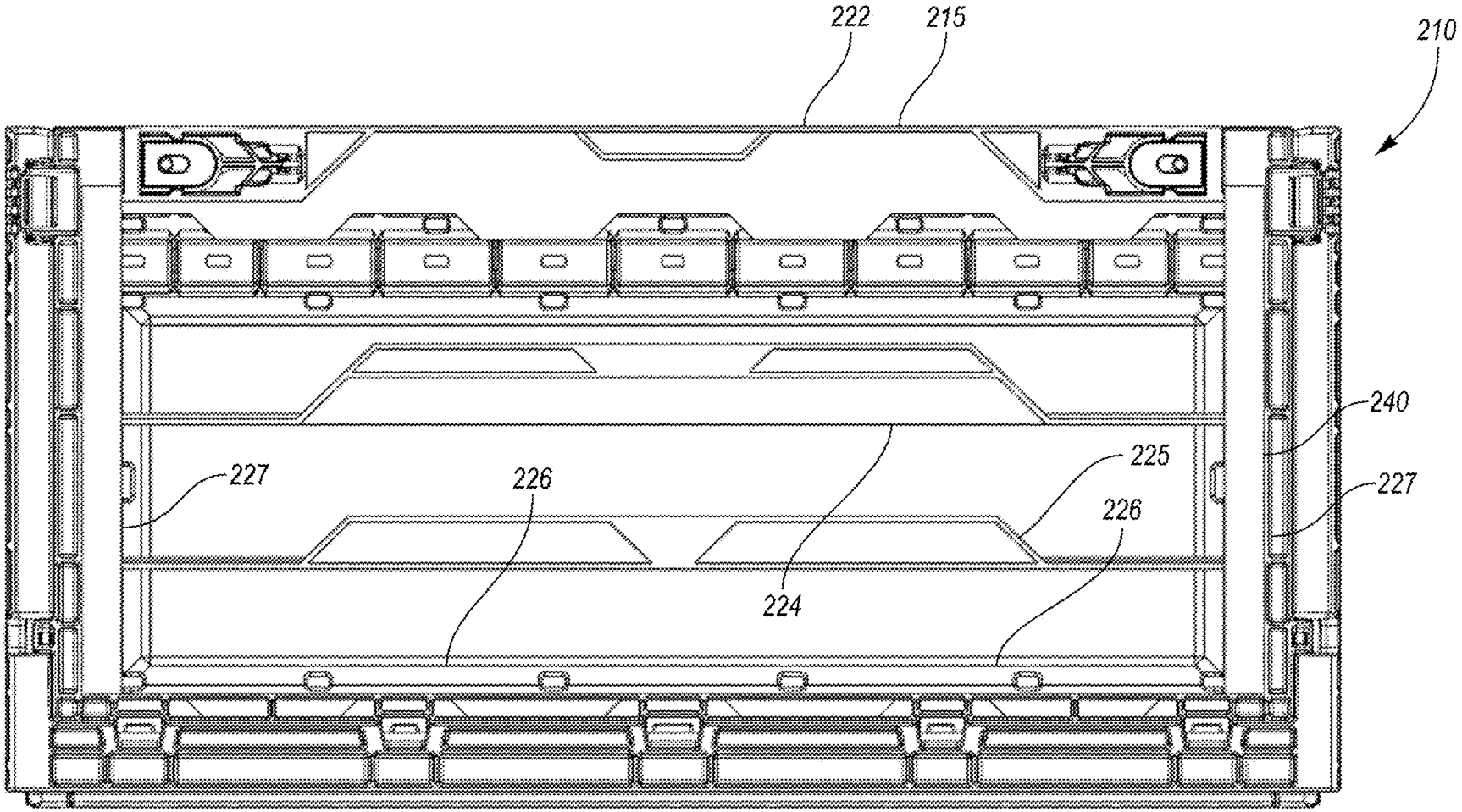
FIG. 18 is a front view of the container of FIG. 16.
Figure 20:
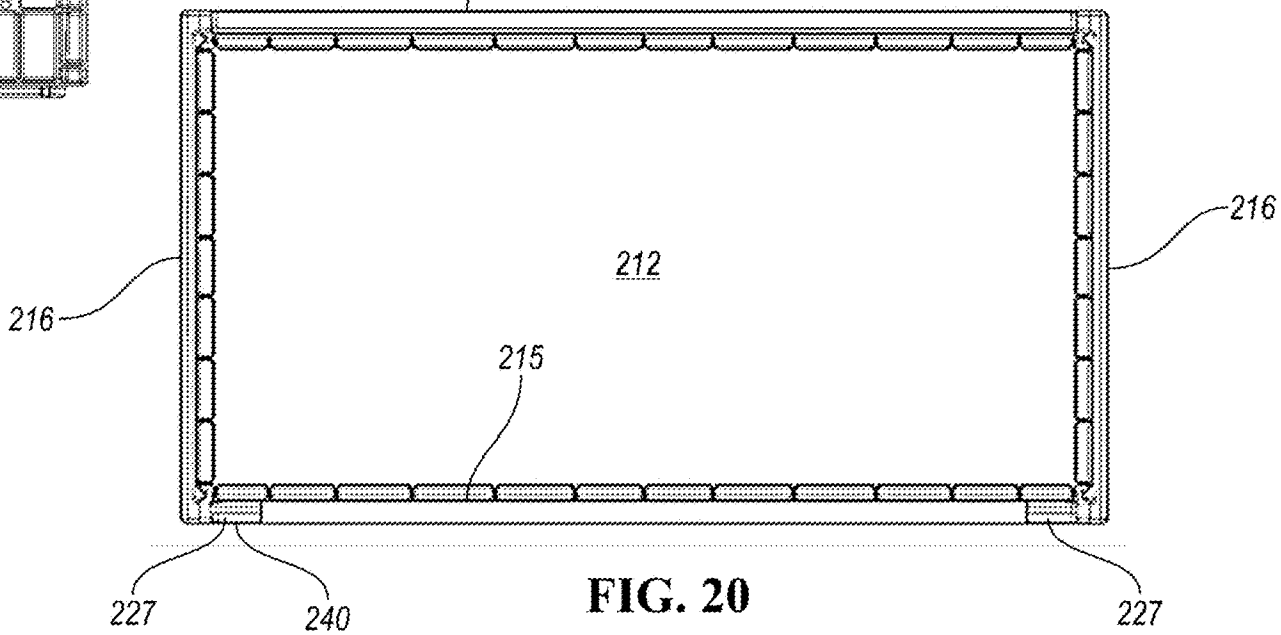
FIG. 20 is a top view of the container of FIG. 16.
Figure 19:
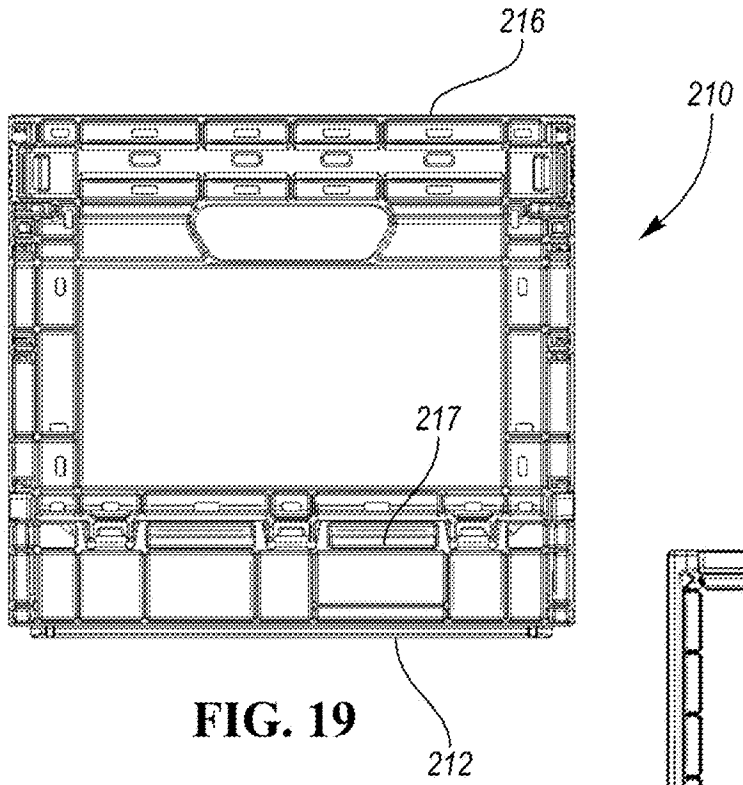
FIG. 19 is an end view of the container of FIG. 16.

FIG. 17 is upper perspective view of the container 210 in the upright, assembled position with the front wall 215 in the deployed, closed position. FIG. 18 is a front view of the container 210 of FIG. 16. FIG. 19 is an end view of the container of FIG. 16. FIG. 20 is a top view of the container 210 of FIG. 16.

Figure 21:
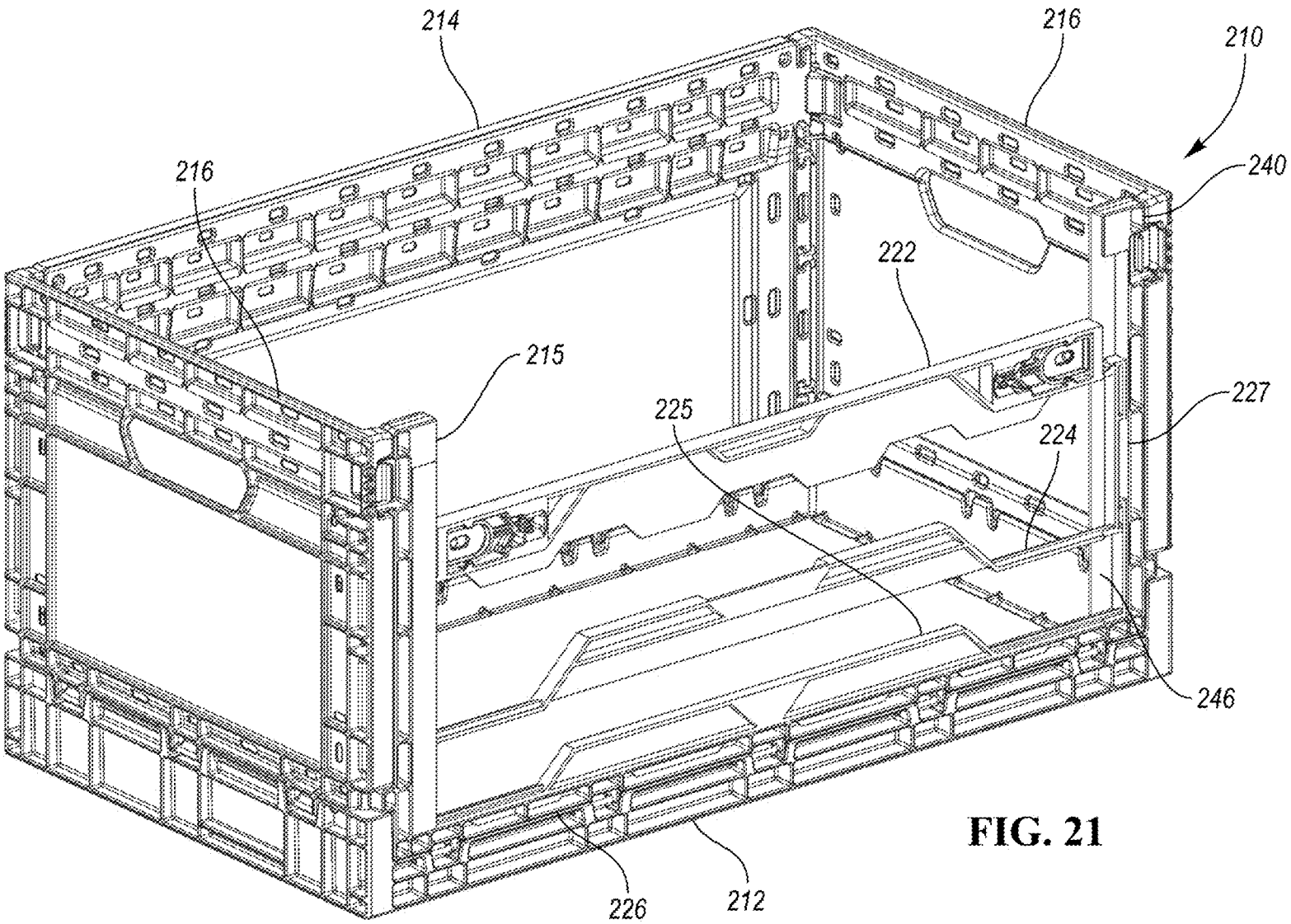
FIG. 21 shows the container of FIG. 16 with the front wall partially retracted.

FIG. 21 shows the container 210 with the front wall 215 partially retracted. In FIG. 21, the front portion of the right vertical portion 227 of the frame 240 has been removed for illustration. After releasing the latches 244, the upper beam 222 is slid downward by the user in the tracks 246 formed in the vertical portions 227 of the frame 240. The lower beam 225 has been moved down by gravity onto the horizontal portion 226 of the frame 240 (or alternatively would be pushed down by the upper beam 222). The mid beam 224 has also been moved down by gravity relative to the frame 240 (or alternatively would be pushed down by the upper beam 222).

Figure 22:
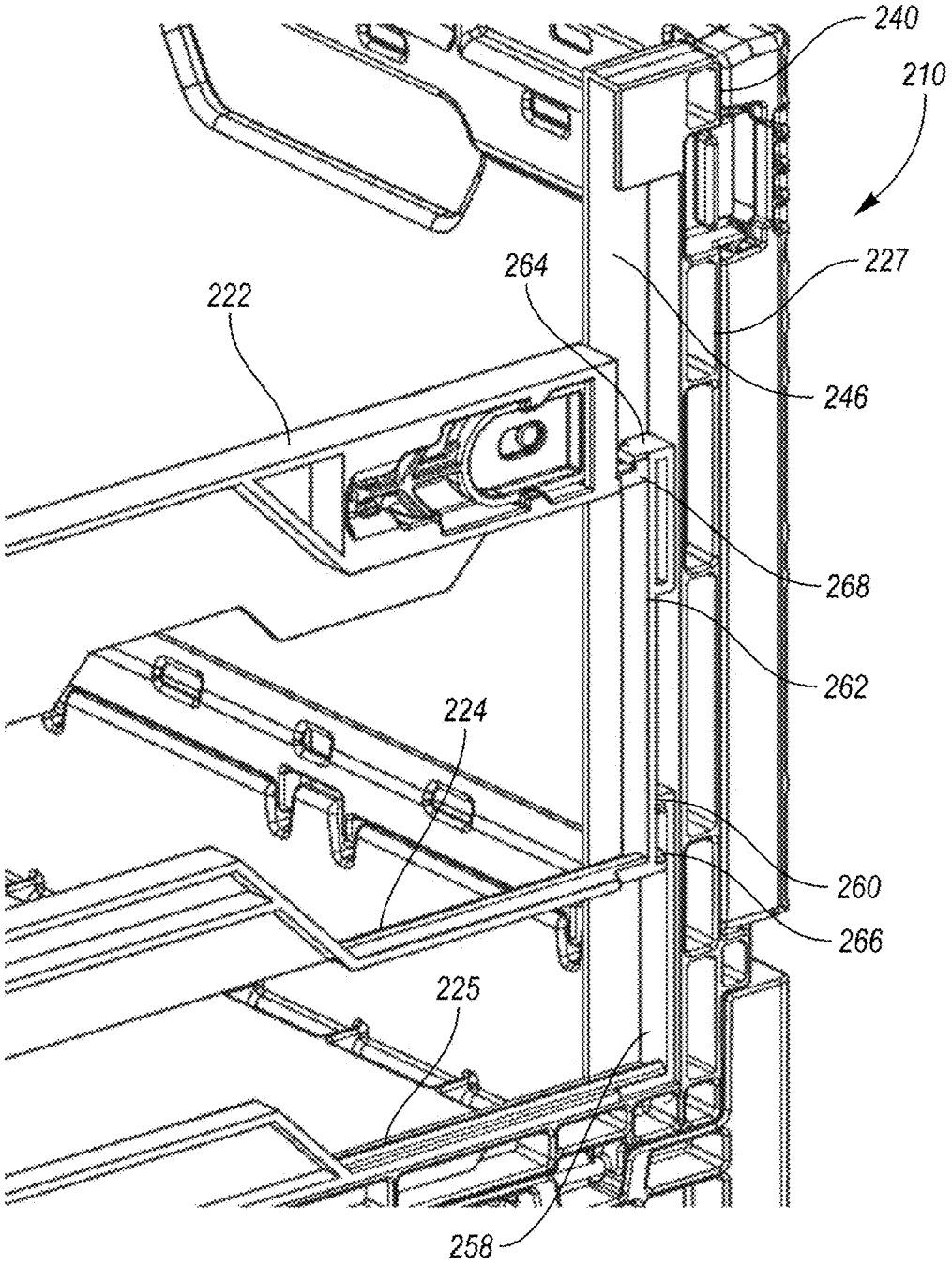
FIG. 22 is an enlarged view of the right vertical portion of the frame of FIG. 21.

FIG. 22 is an enlarged view of the right vertical portion 227 of the frame 240 of FIG. 21, again with the front portion of the vertical portion 227 removed for visibility. The left side of the front wall 215 (FIG. 21) would be a mirror image. The lower beam 225 includes a vertical portion 258 extending upward at an outer end thereof and slidably captured within the track 246 of the vertical portion 227 of the frame 240. At an upper end of the vertical portion 258 is an inwardly-turned hook portion 260. Similarly, the mid beam 224 includes a vertical portion 262 extending upward at an outer end thereof and slidably captured within the track 246 of the vertical portion 227 of the frame 240. At an upper end of the vertical portion 262 is an inwardly-turned hook portion 264. The vertical portion 262 of the mid portion is inward of the vertical portion 258 of the lower beam 225.

A tab 266 projects outward at a lower end of the vertical portion 262 of the mid beam 224 toward the vertical portion 258 of the lower beam 225 and below inwardly-turned hook portion 260. A tab 268 projects outward at a lower end of the upper beam 222 toward the vertical portion 262 of the mid beam 224 and below inwardly-turned hook portion 264.

Figure 23:
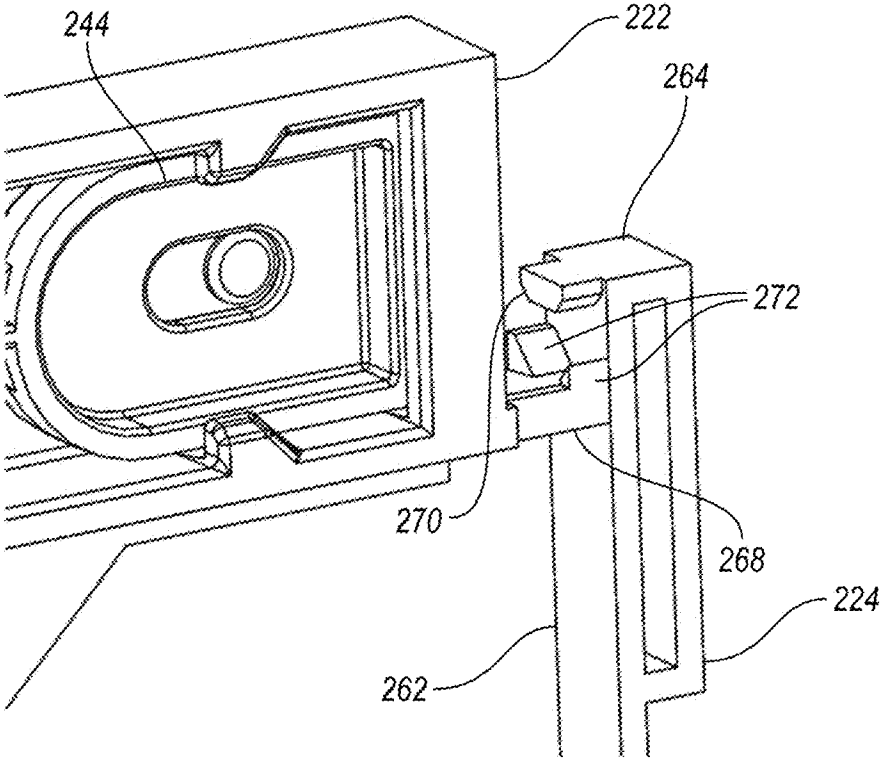
FIG. 23 is a further enlarged view of the engagement between the upper portion and the mid portion of the container of FIG. 22.

FIG. 23 is a further enlarged view of the engagement between the upper beam 222 and the mid beam 224. The inwardly-turned hook portion 264 has interlocking features 270 on an underside thereof that are complementary to interlocking features 272 on an upper surface of the tab 268.

Figure 24:
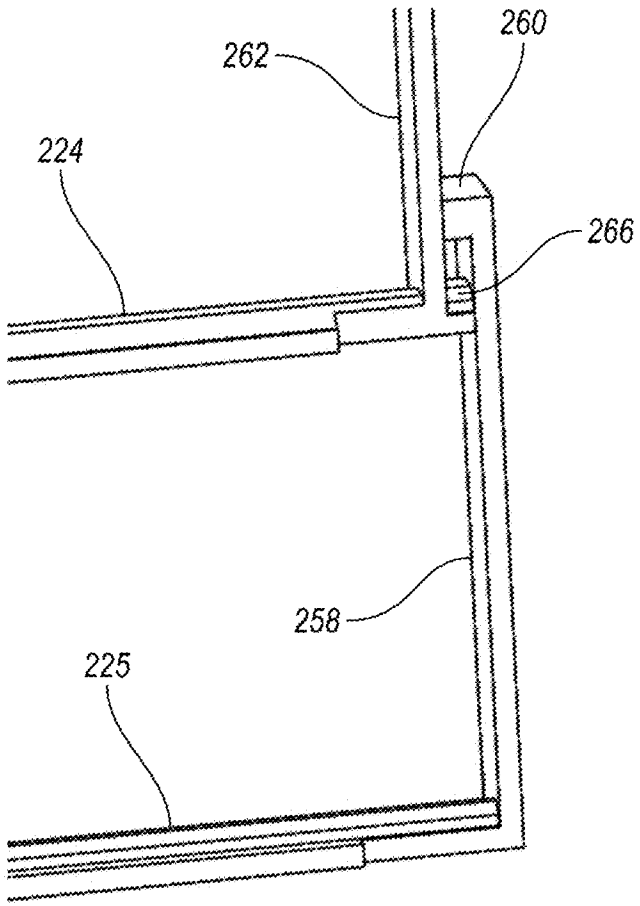
FIG. 24 is an enlarged view of the engagement portion between the mid portion and the lower portion of the container of FIG. 22.

FIG. 24 is a further enlarged view of the engagement between the mid beam 224 and the lower beam 225. The inwardly-turned hook portion 260 may have interlocking features on an underside thereof that are complementary to interlocking features on an upper surface of the tab 266.

Figure 25:
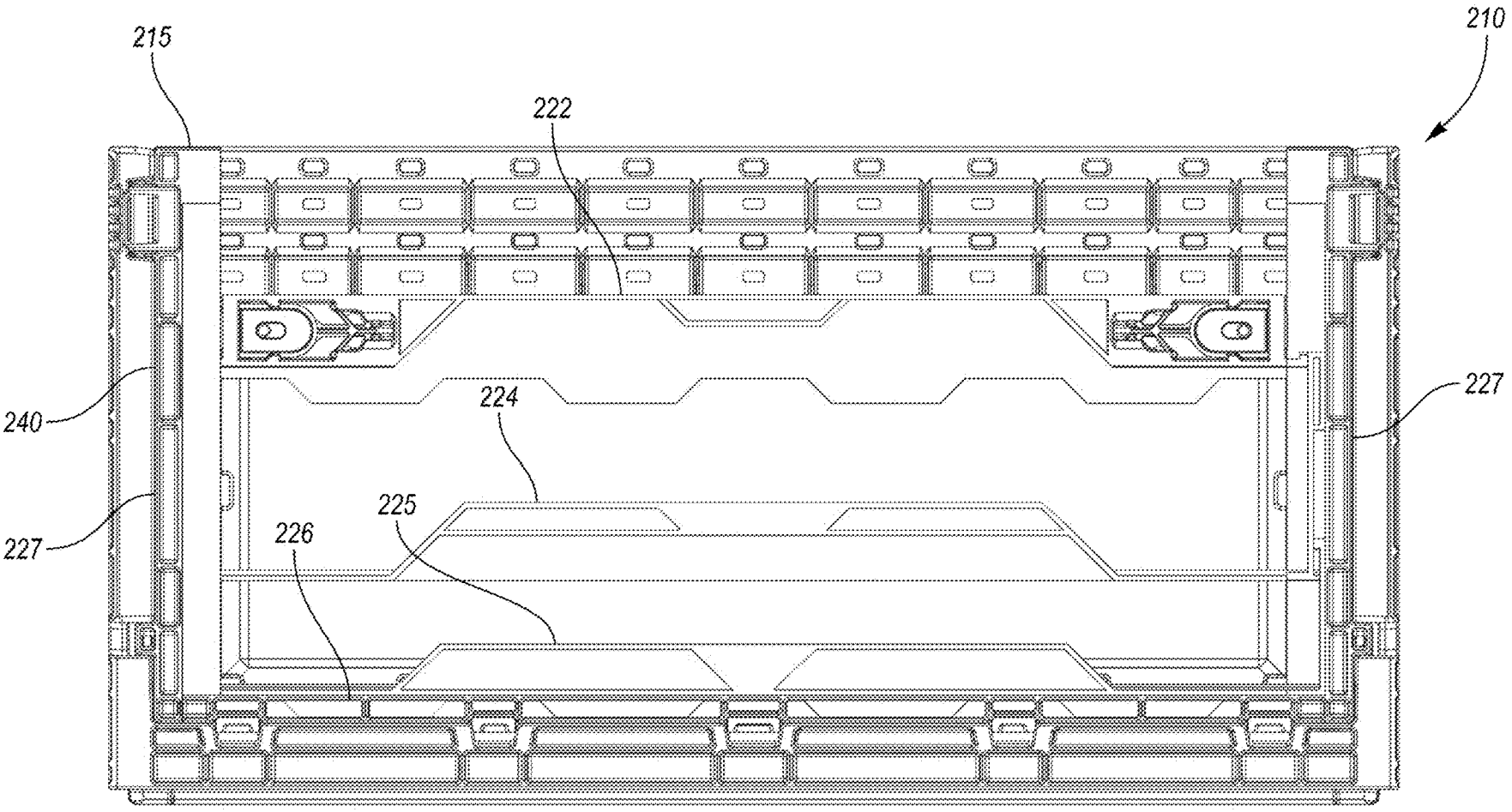
FIG. 25 is a front view of the container of FIG. 21.

FIG. 25 is a front view of the container 210 of FIG. 21.

Figure 26:
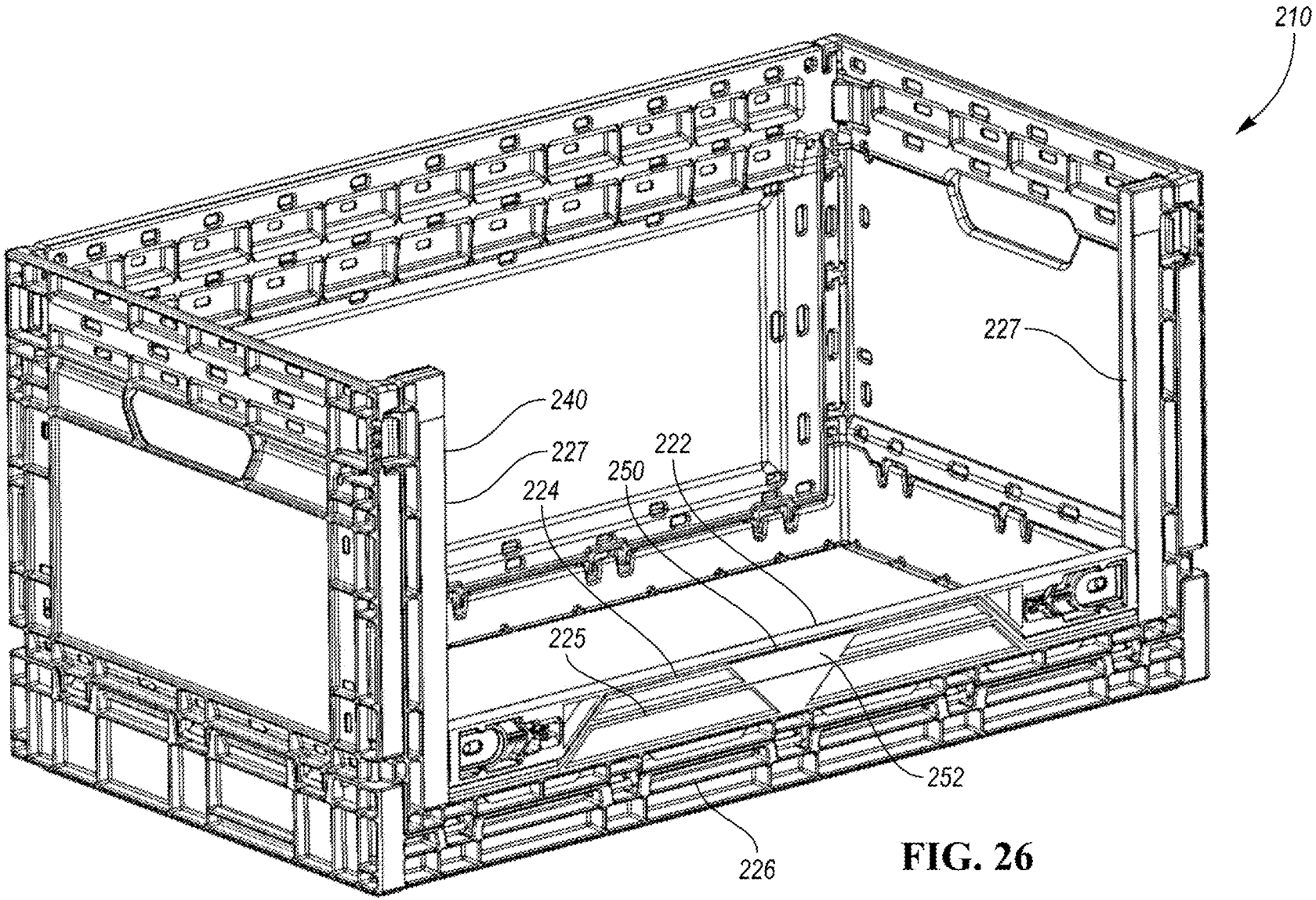
FIG. 26 is a perspective view of the container of FIG. 16 with the front wall in a fully retracted position.
Figure 27:
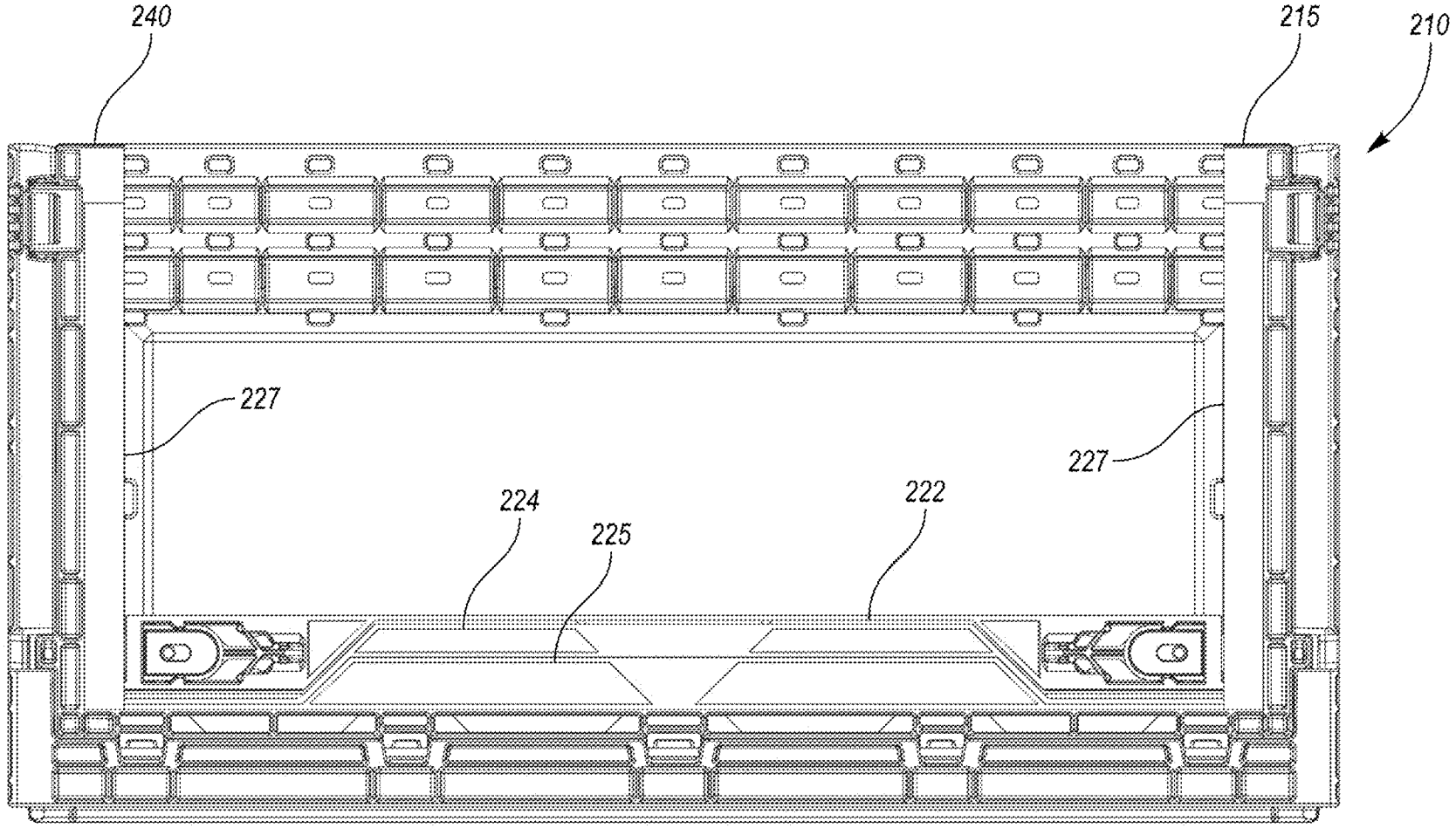
FIG. 27 is a front view of the container of FIG. 26.

FIGS. 26 and 27 show the container 210 with the front wall 215 in a retracted, open position. The lower beam 225 has been slid down onto the horizontal portion 226 of the frame 240. The mid beam 224 has been slid down onto the lower beam 225. The upper beam 222 has been slid down onto the mid beam 224. The interlocking panel portions 250, 252, 254 interlock, with some portions inward of other portions and some portions outward of other portions. This creates significant overlap among the upper beam 222 and the mid beam 224 and lower beam 225. In the retracted configuration, goods can be removed from the container 210 even when another loaded container 210 is stacked thereon. Notably, the front wall 215 can be retracted even when another loaded container 210 is already stacked thereon.

Figure 28:
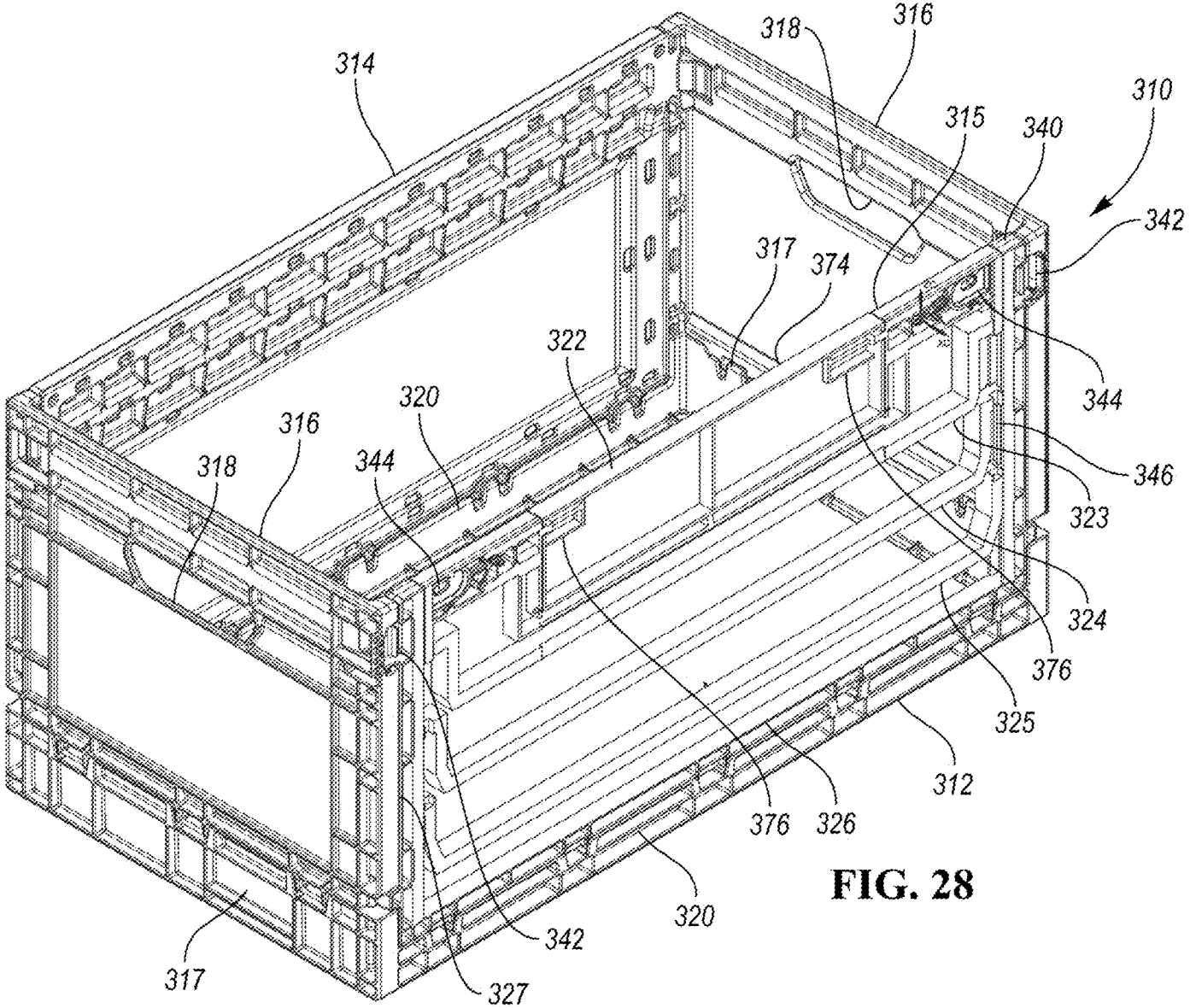
FIG. 28 is a perspective view of a collapsible container according to a fourth embodiment.

A collapsible container 310 according to a fourth embodiment is shown in FIG. 28. The collapsible container 310 includes a base 312. A rear wall 314 and a front wall 315 (or "first wall") are pivotably connected to front and rear upstanding flanges 320 at front and rear edges of the base 312. A pair of opposed end walls 316 extend upward from hinges pivotably connecting them to upstanding end flanges 317 projecting upward from end edges of the base 312. Each end wall 316 includes a handle opening 318 therethrough.

The front wall 315 includes a U-shaped frame 340 secured to the end walls 316 by latches 342 of a known type. The U-shaped frame 340 includes a lower horizontal portion 326 and vertical portions 327 extending upward from opposite ends of the lower horizontal portion 326. The lower horizontal portion 326 is hingeably connected to the front upstanding flange 320.

The container 310 is a collapsible container, i.e. the walls 314, 315, 316 can be collapsed onto the base 312 when empty for efficient shipping and storage. In this embodiment, the end flanges 317 are taller than the front and rear upstanding flanges 320 and the end walls 316 are outward of the front wall 315 and the rear wall 314, so the front wall 315 and the rear wall 314 would be collapsed onto the base 312 first (in either order), and then the end walls 316 would be collapsed onto the front wall 315 and rear wall 314.

The front wall 315 is also retractable. In the front wall 315, an upper beam 322 is slidably connected to both of the vertical portions 327 of the frame 340. Latches 344 selectively secure the upper beam 322 in place at the upper ends of the vertical portions 327 of the frame 340 as shown in FIG. 28, which is the deployed, closed position. A pair of mid beam 323, 324 and a lower portion 325 are also slidably connected at each end to the vertical portions 327 of the frame 340. The upper beam 322, mid beams 323, 324 and lower portion 325 are received in vertical channels or tracks 346 formed in each of the vertical portions 327 of the frame 340, such that they can slide vertically relative to the vertical portions 327 of the frame 340.

The upper beam 322 optionally includes a pivotably mounted door 374. In the example shown, the door 374 is pivotably mounted to the remainder of the upper beam 322 by hinges below the door 374. The door 374 is latched in the closed position (shown) to the remainder of the upper beam 322 by latches 376.

Figure 29:
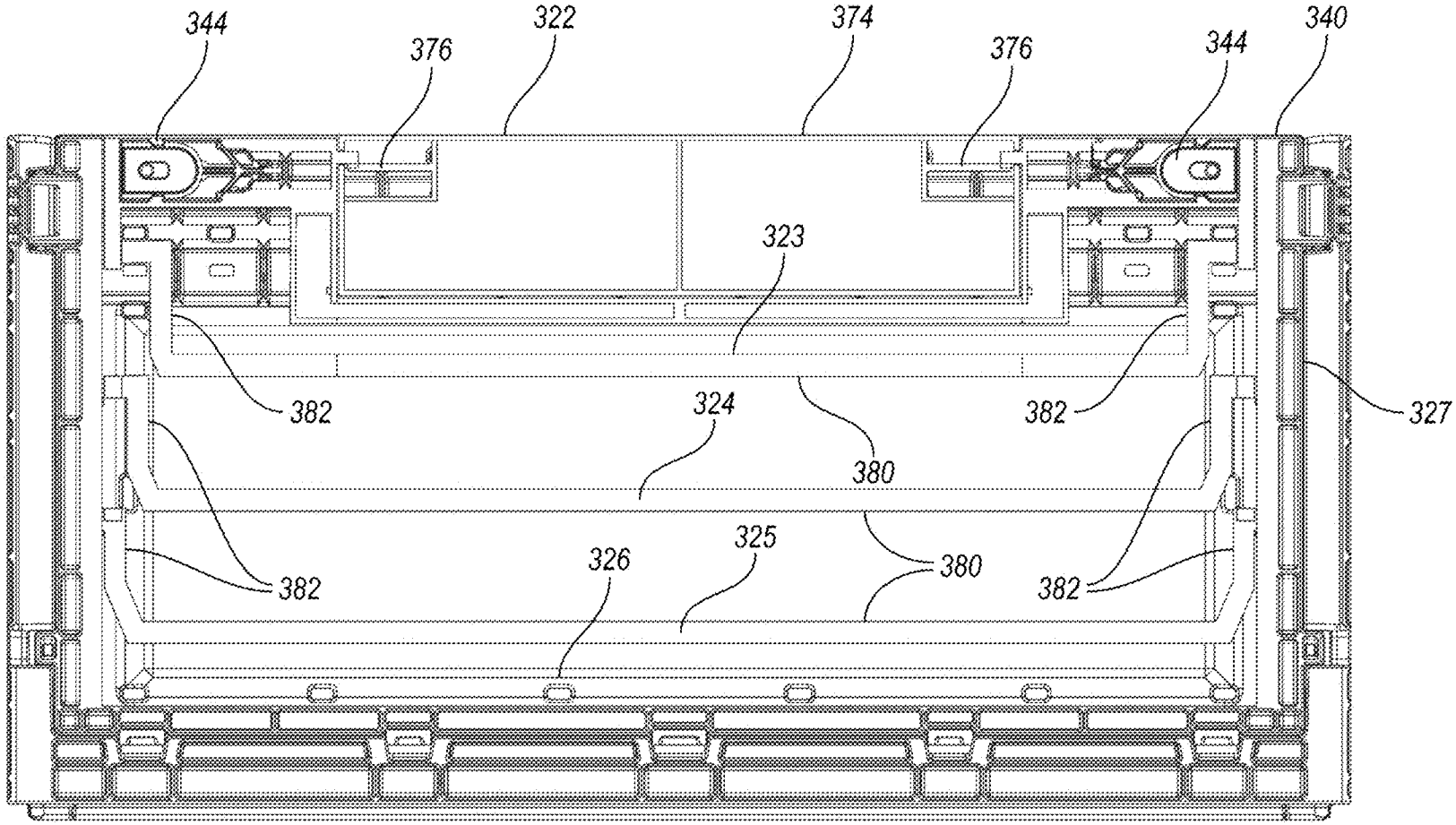
FIG. 29 is a front view of the container of FIG. 28.

Referring to FIG. 29, the mid beams 323, 324 and lower portion 325 each include nestable U-shaped portions including a horizontal member 380 and a vertical portion 382 at each end of the horizontal member 380. The door 374 is hingeably connected to the horizontal member 380. The door 374 is latched in the closed position (shown) to the vertical portions 382 by latches 376.

Figure 30:
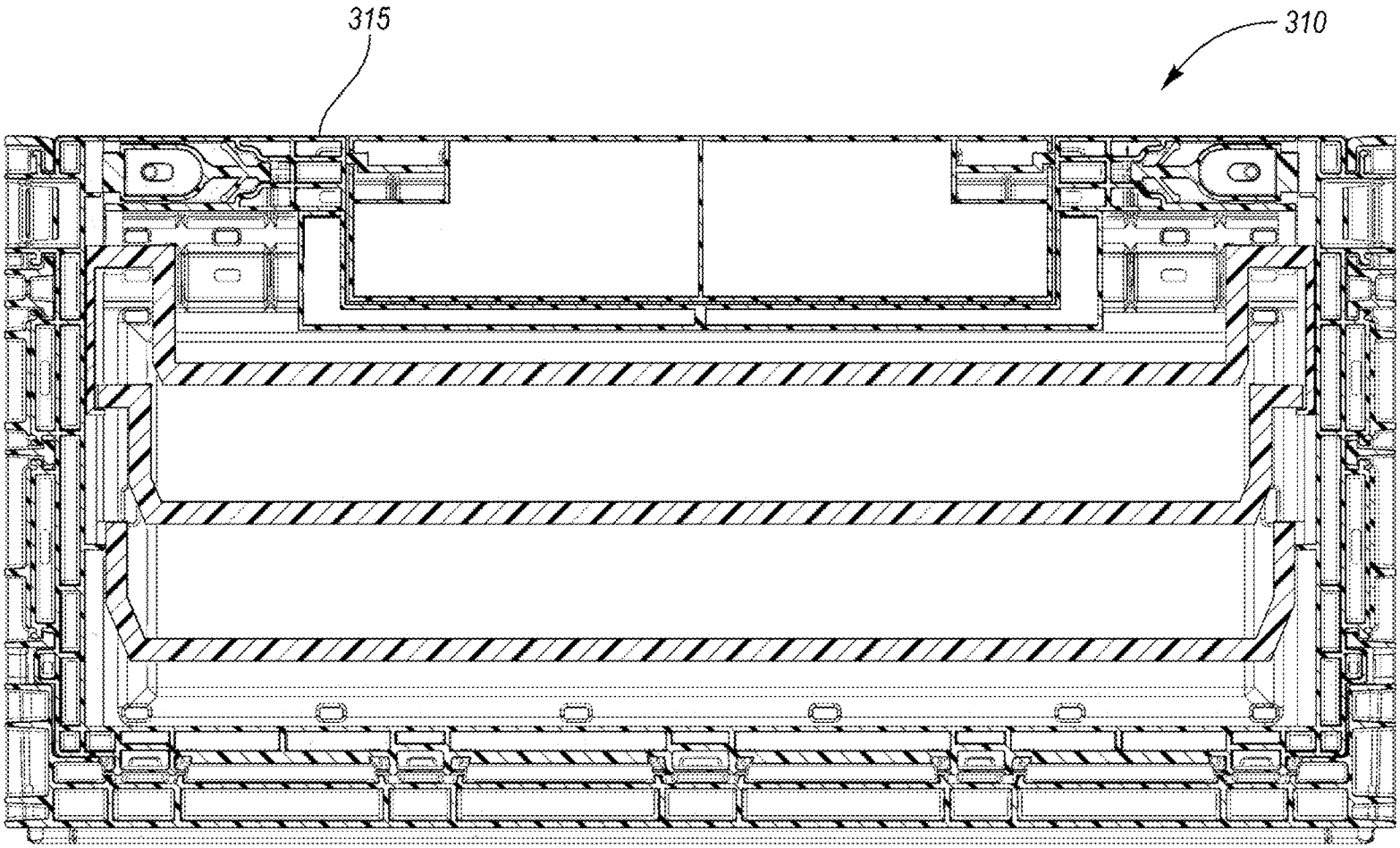
FIG. 30 is a section view to the front wall of FIG. 29.
Figure 31:
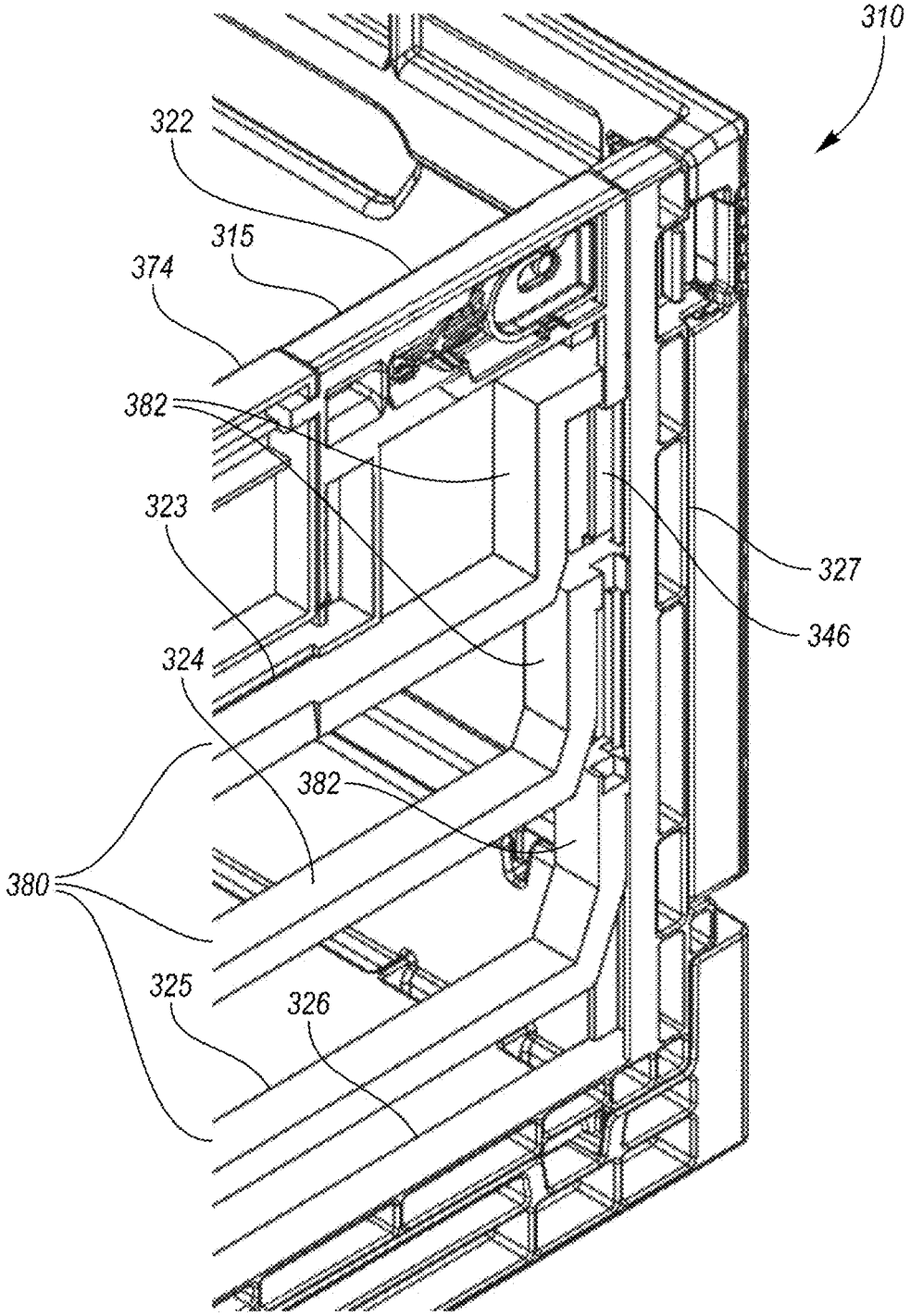
FIG. 31 is an enlarged view of one end of the front wall of the container of FIG. 28.

FIG. 30 is a vertical section through the front wall 315 to show the interconnection of the upper beam 322, mid beams 323, 324 and lower portion 325. FIG. 31 is an enlarged view of one end of the front wall 315 (the other side would be mirror image), showing the upper beam 322, mid beams 323, 324 and lower portion 325 slidably captured in the track 346.

Figure 33:
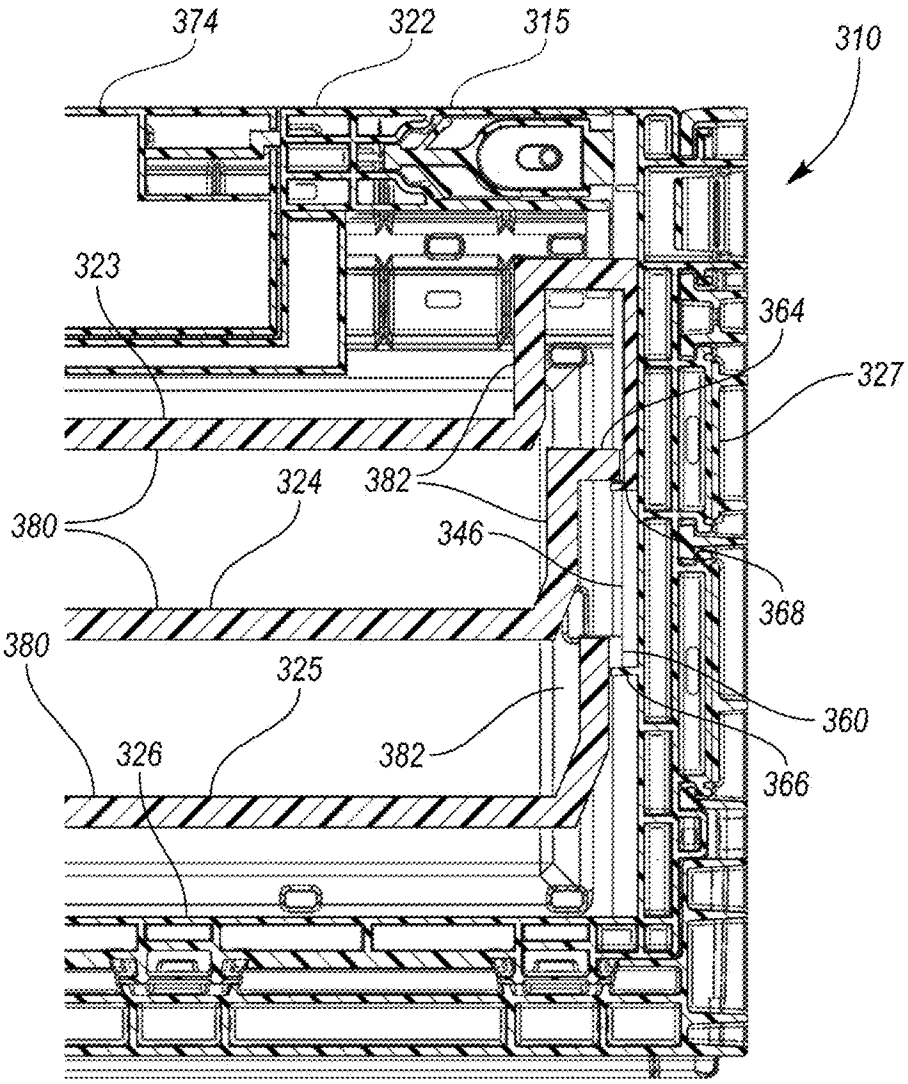
FIG. 33 is a section view through the end of the front wall of FIG. 32.
Figure 32:
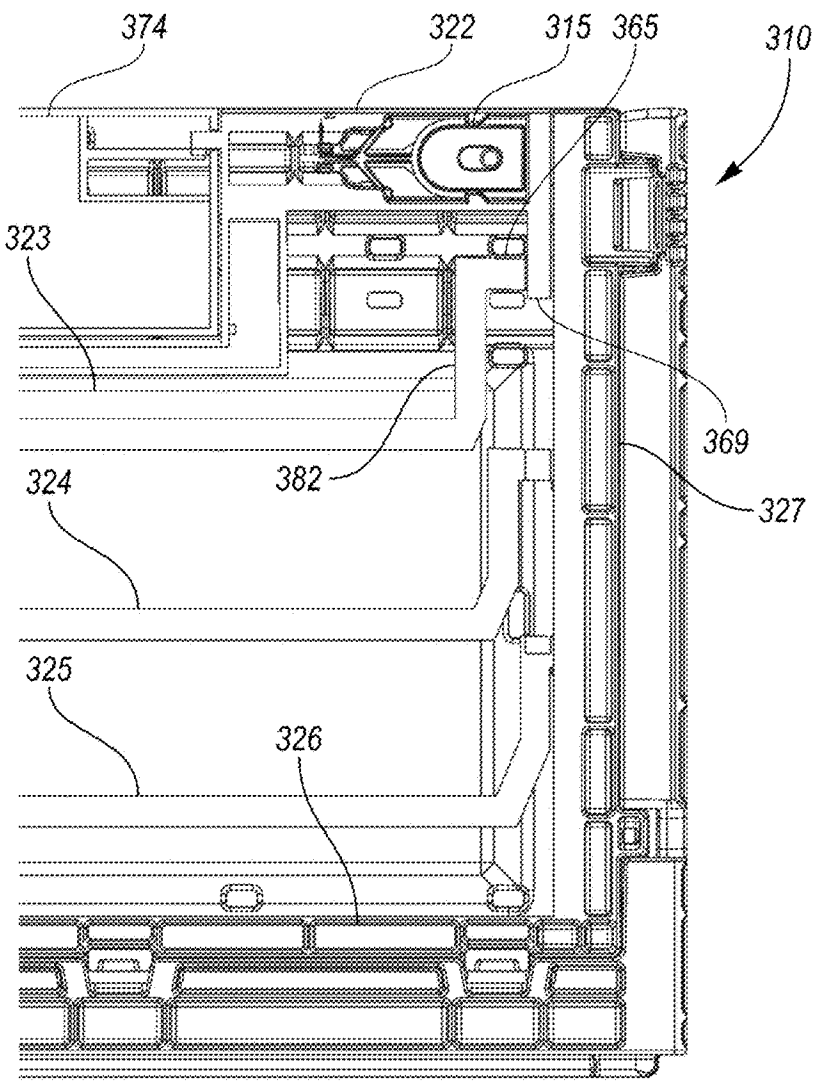
FIG. 32 is an enlarged front view of one end of the front wall of the container of FIG. 29, with the front wall of the track removed for illustration.

FIG. 32 show an enlarged front view of one end of the front wall 315 with the front wall of the track 346 removed for illustration. FIG. 33 is a section view through the front wall 315 of FIG. 32. Referring to FIG. 32, a tab 365 projects outward from an upper end of the vertical portion 382 of the upper mid beam 323. A tab 369 projects inward from a downward extension from the upper beam 322 and below the tab 365 of the upper mid beam 323. When the upper beam 322 is raised by a user, the tab 369 will lift the tab 365 and thereby lift the upper mid beam 323 to the position shown.

Referring to FIG. 33, similarly, the upper mid beam 323 has a tab 368 projecting inward below a tab 364 projecting outward from the lower mid beam 324. When the upper mid beam 323 is raised, the tab 368 will lift the tab 364 and thereby lift the lower mid beam 323 to the position shown.

The lower mid beam 324 has a tab 366 projecting inward below a tab 360 projecting outward from the vertical portion 382 of the lower portion 325. When the lower mid beam 324 is raised, the tab 366 will lift the tab 360 and thereby lift the lower portion 325 to the position shown.

Figure 34:
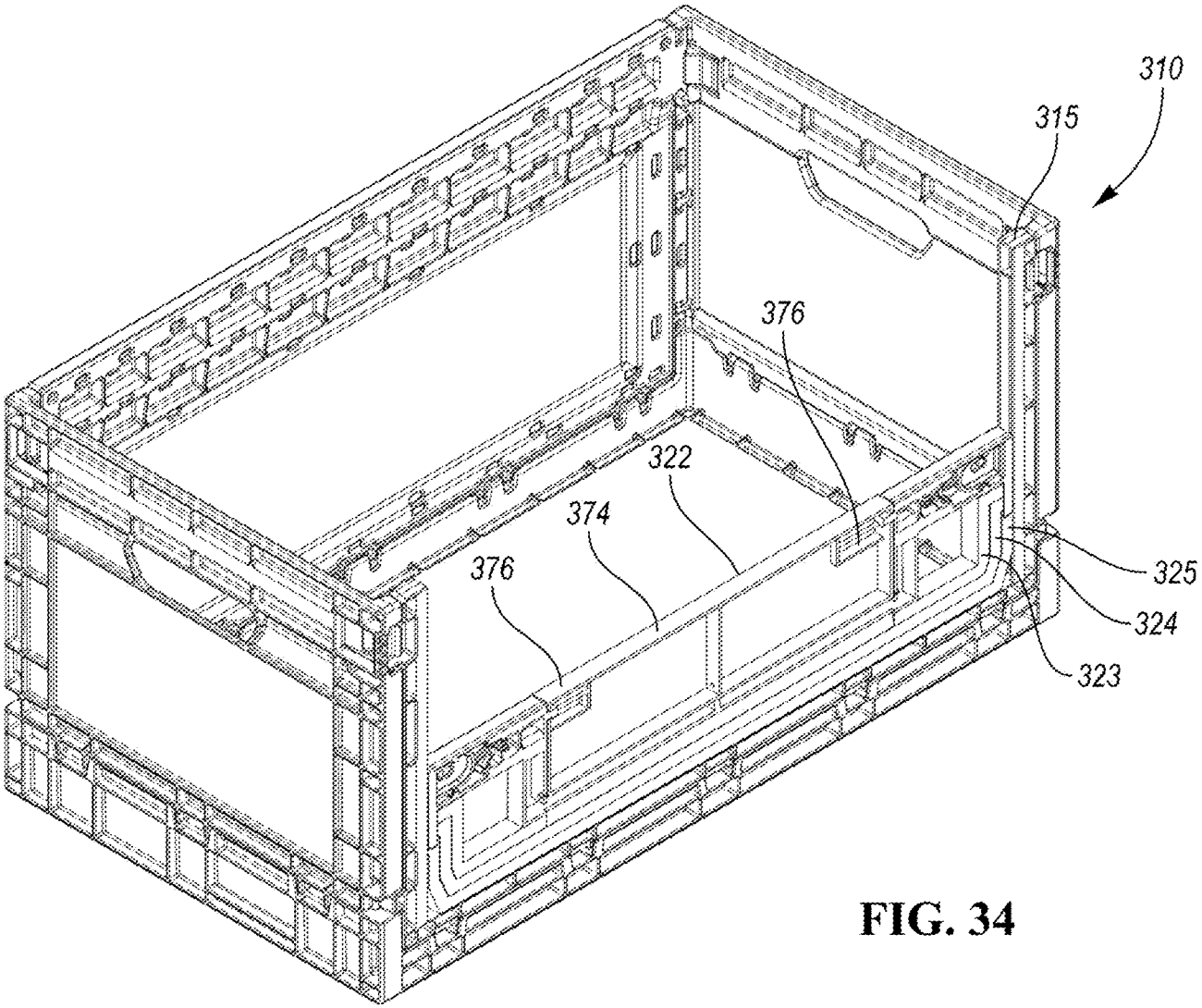
FIG. 34 is a perspective view of the container of FIG. 28 with the front wall in a partially retracted position.
Figure 35:
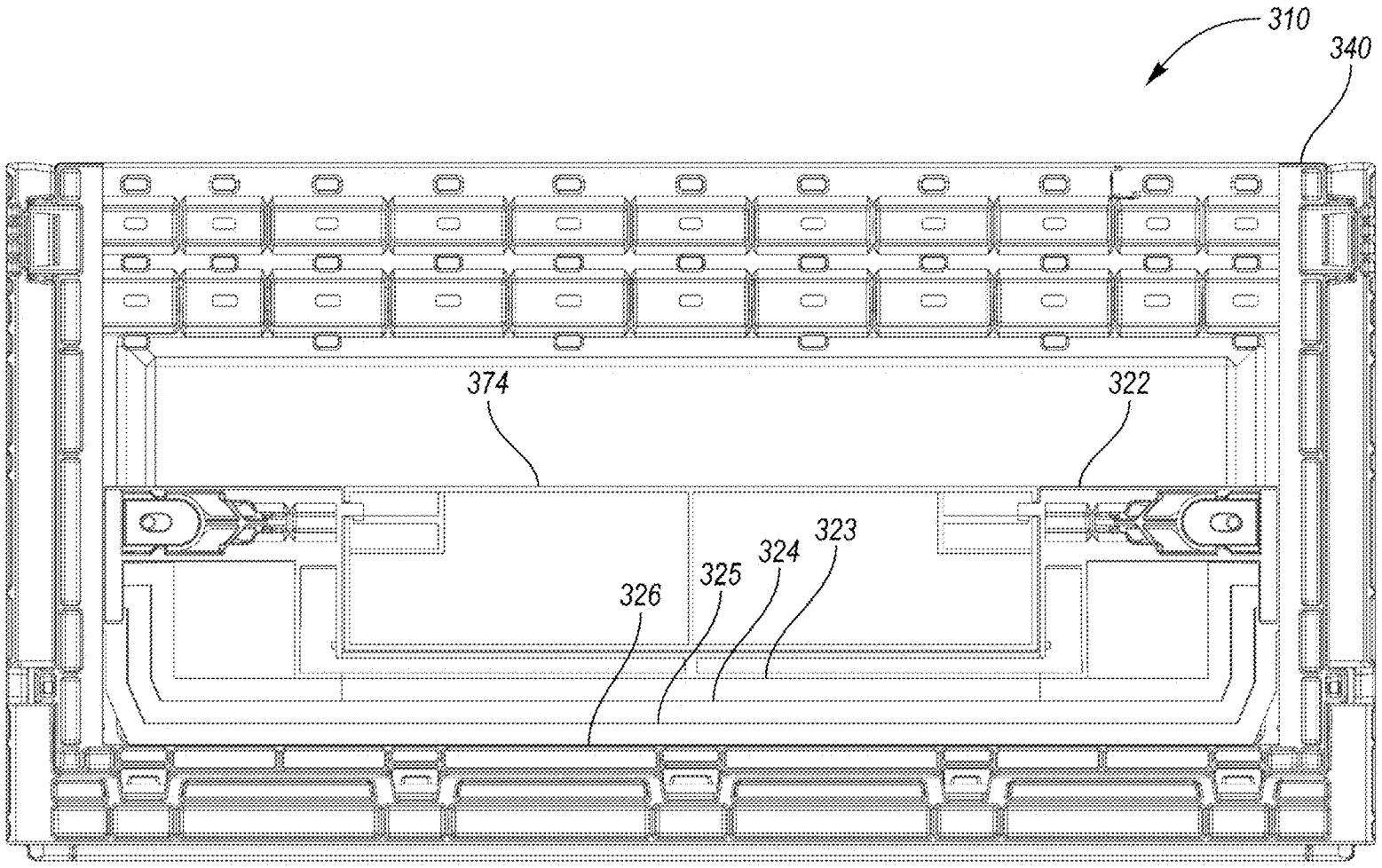
FIG. 35 is a front view of the container of FIG. 34.

As shown in FIGS. 34-35, after releasing the latches 344, the upper beam 322 is slid downward by the user in the tracks 346 formed in the vertical portions 327 of the frame 340. The mid beams 323, 324 and lower portion 325 are moved down by gravity onto the horizontal portion 326 of the frame 340 (or alternatively would be pushed down by the upper beam 322). This provides an opening through the front wall 315 between the vertical portions 327 of the frame 340 and above the upper beam 322.

Figure 36:
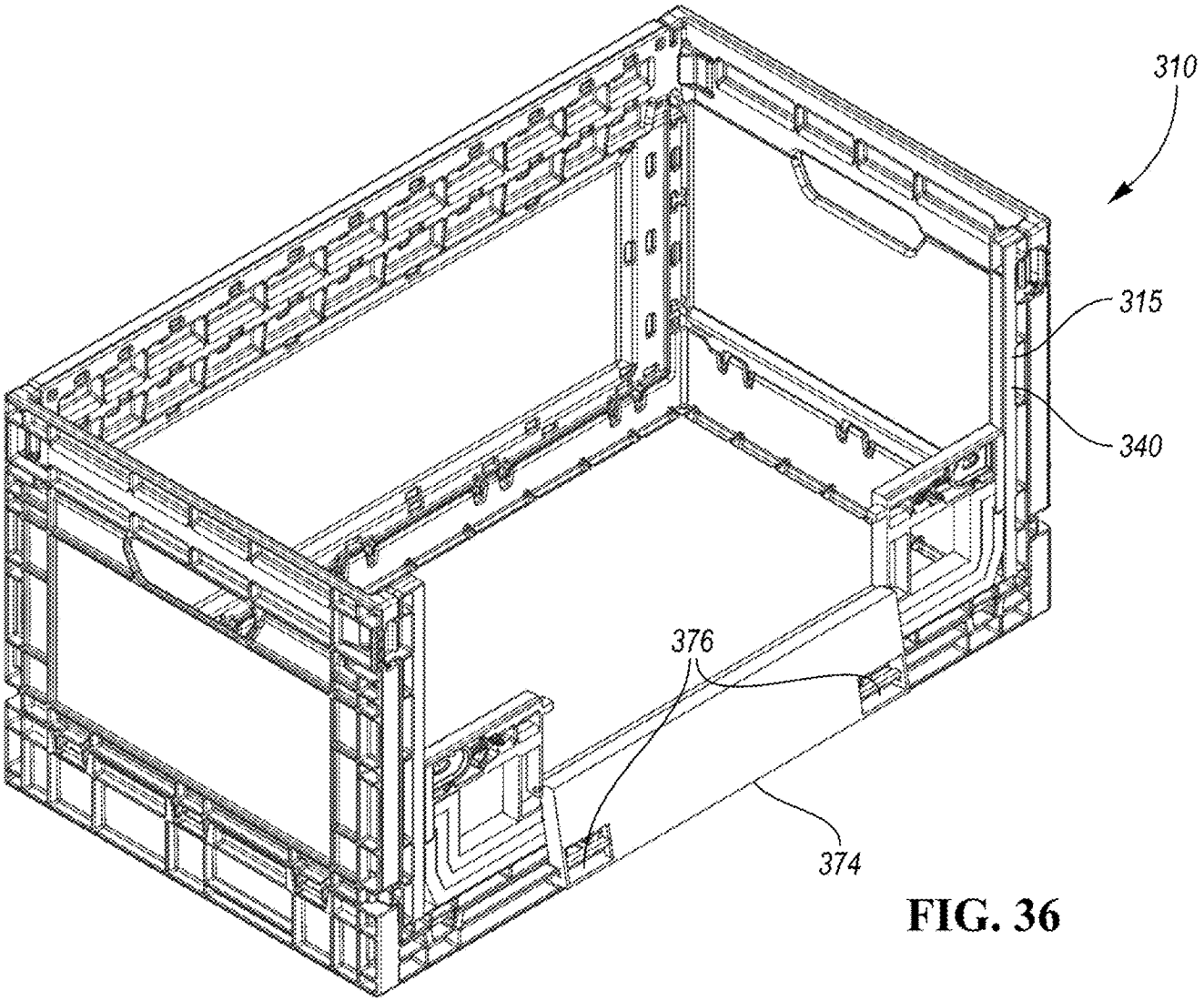
FIG. 36 is a perspective view of container of FIG. 34 with the front wall in a fully retracted position.
Figure 37:
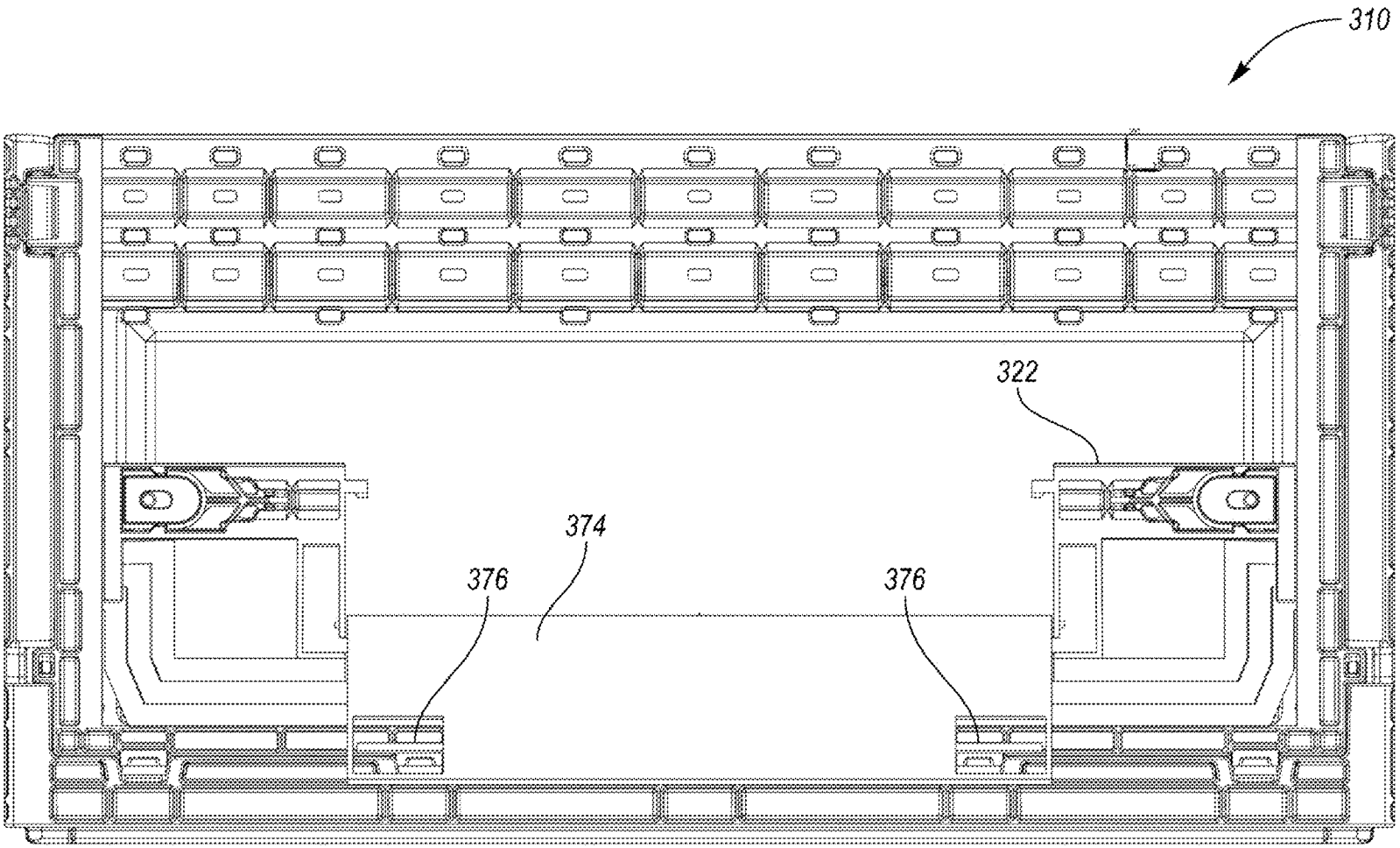
FIG. 37 is a front view of the container of FIG. 36.
Figure 38:
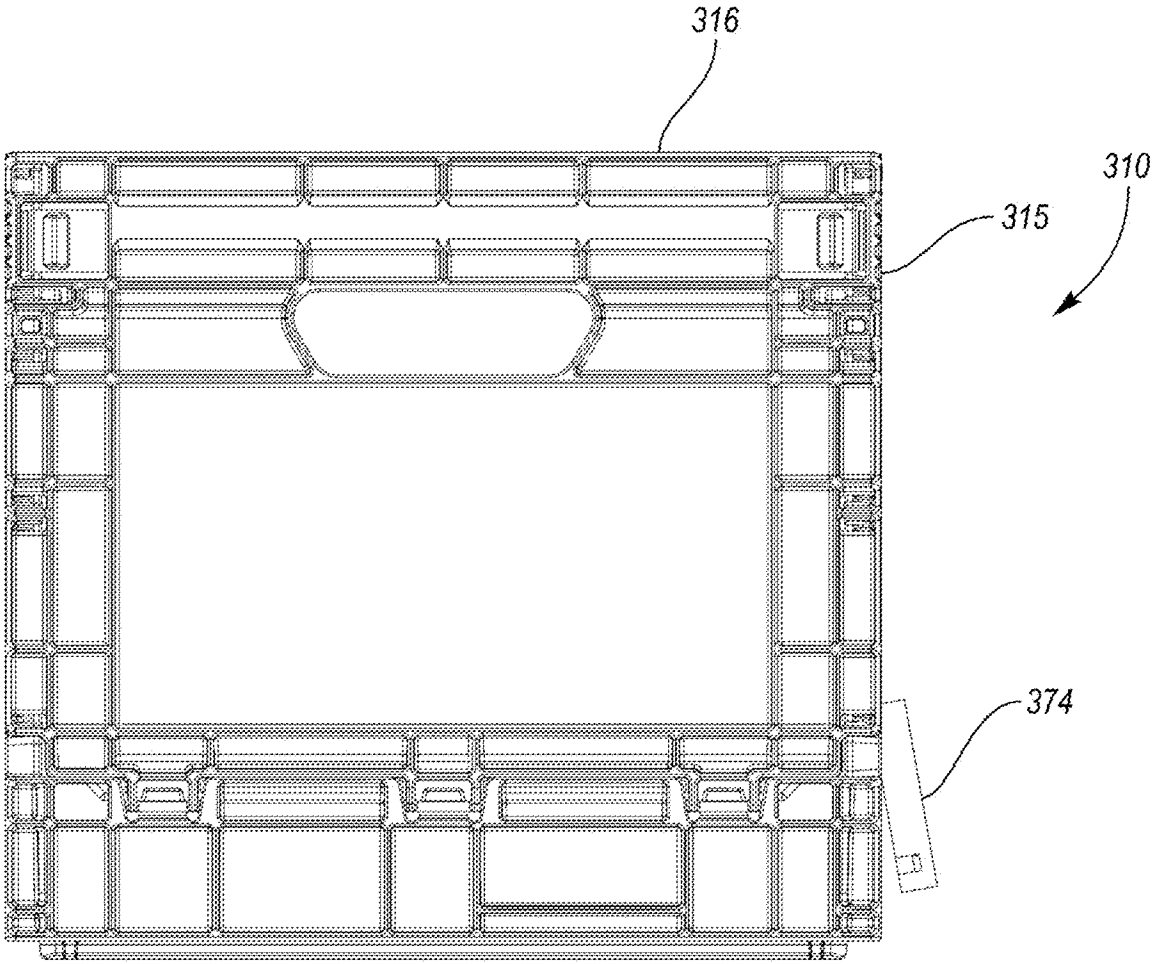
FIG. 38 is an end view of the container of FIG. 36.

Optionally, after releasing the latches 376, the door 374 in the upper beam 322 can be pivoted outward as shown in FIGS. 36-38. This provides a larger opening into the front wall of the container 310.

In the retracted configuration, goods can be removed from the container 310 even when another loaded container 310 is stacked thereon. Notably, the front wall 315 can be retracted even when another loaded container 310 is already stacked thereon.

Figure 39:
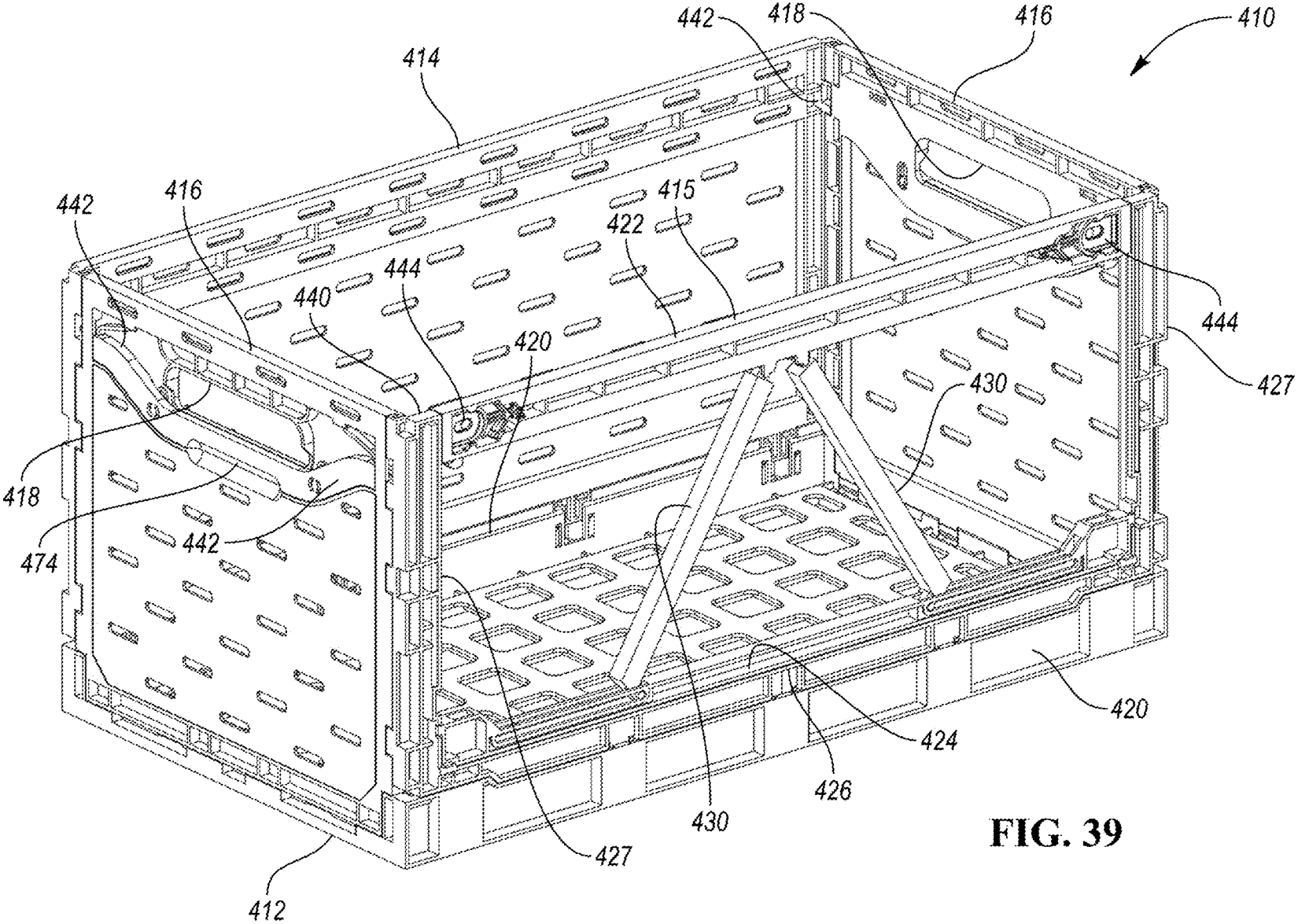
FIG. 39 is a perspective view of a collapsible container according to a fifth embodiment.

A collapsible container 410 according to a fifth embodiment is shown in FIG. 39. The collapsible container 410 includes a base 412. A rear wall 414 and a front wall 415 (or "first wall") are pivotably connected to front and rear upstanding flanges 420 at front and rear edges of the base 412. A pair of opposed end walls 16 extend upward from hinges pivotably connecting them to end edges of the base 412. Each end wall 416 includes a handle opening 418 therethrough.

The front wall 415 includes a U-shaped frame 440 secured to the end walls 416 by latches 442 on the end walls 416. The latches 442 are releasable by lifting a latch release handle 474. The U-shaped frame 440 includes a lower horizontal portion 426 and vertical portions 427 extending upward from opposite ends of the lower horizontal portion 426. The lower horizontal portion 426 is hingeably connected to the front upstanding flange 420.

The container 410 is a collapsible container, i.e. the walls 414, 415, 416 can be collapsed onto the base 412 when empty for efficient shipping and storage. In this embodiment, the end flanges 417 are vertically shorter than the front and rear upstanding flanges 420 and the end walls 416 are between the front wall 415 and the rear wall 414, so the end walls 416 would be collapsed onto the base 412 first (in either order), and then the front wall 415 and the rear wall 414 (in either order) would be collapsed onto the end walls 416.

The front wall 415 is also retractable. In the front wall 415, an upper beam 422 is slidably connected to both of the vertical portions 427 of the frame 440. Latches 444 selectively secure the upper beam 422 in place at the upper ends of the vertical portions 427 of the frame 440 as shown in FIG. 39, which is the deployed, closed position. A lower beam 424 is hingeably connected to the lower horizontal portion 426 of the frame 440.

A plurality of arms are pivotably and slidably connected to the lower beam 424 and the upper beam 422. In this example, a pair of arms 430 are pivotably connected to the upper beam 422 and pivotably and slidably connected to the lower beam 424. The arms 428 are angled outward as they extend downward from the upper beam 422 in the deployed, closed position shown in FIG. 39. Alternatively, the arms 428 could angle inward. Alternatively, the arms 428 could be pivotably connected to the lower beam 424 and pivotably and slidably connected to the upper beam 422, or pivotably and slidably connected to the upper beam 422 and the lower beam 424.

Figure 40:
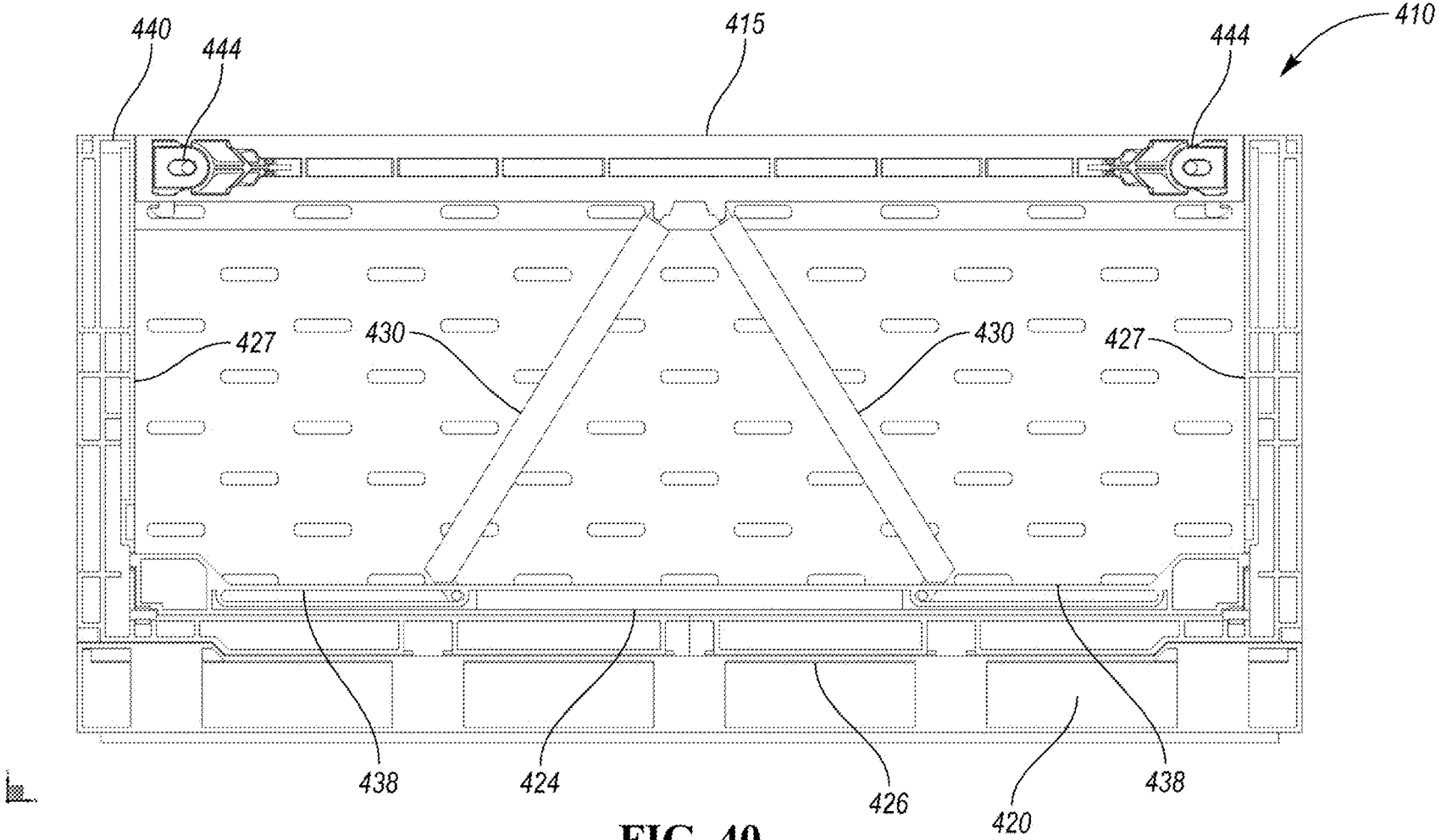
FIG. 40 is a front view of the container of FIG. 39.

FIG. 40 is a front view of the container of FIG. 39. The lower beam 424 includes a pair of horizontal elongated apertures 438 therethrough. The arms 430 have integral pins slidably captured in the elongated apertures 438 and are thus slidably and pivotably connected to the lower beam 424.

Figure 41:
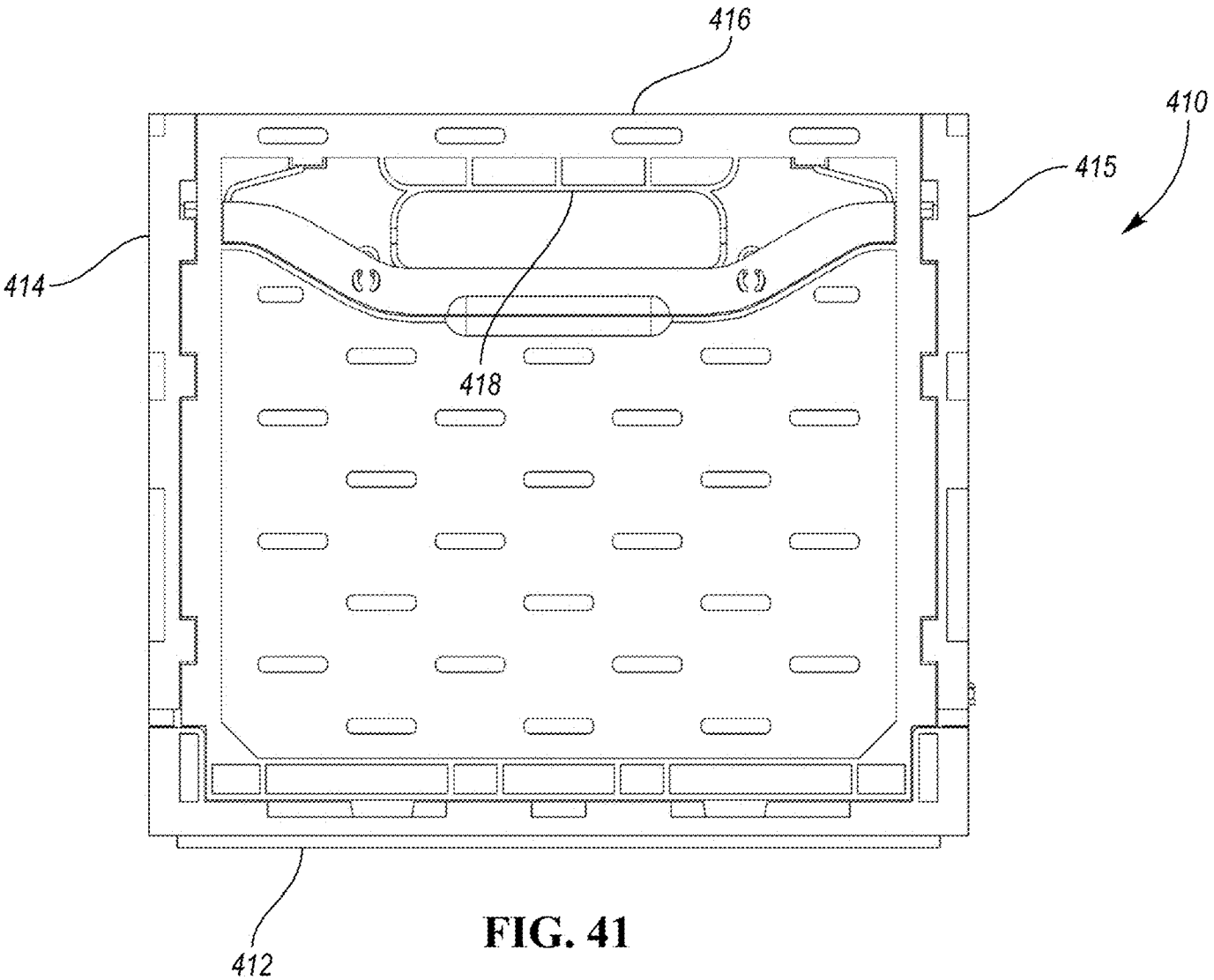
FIG. 41 is an end view of the container of FIG. 39.

FIG. 41 is an end view of the container 410 of FIG. 39.

Figure 42:
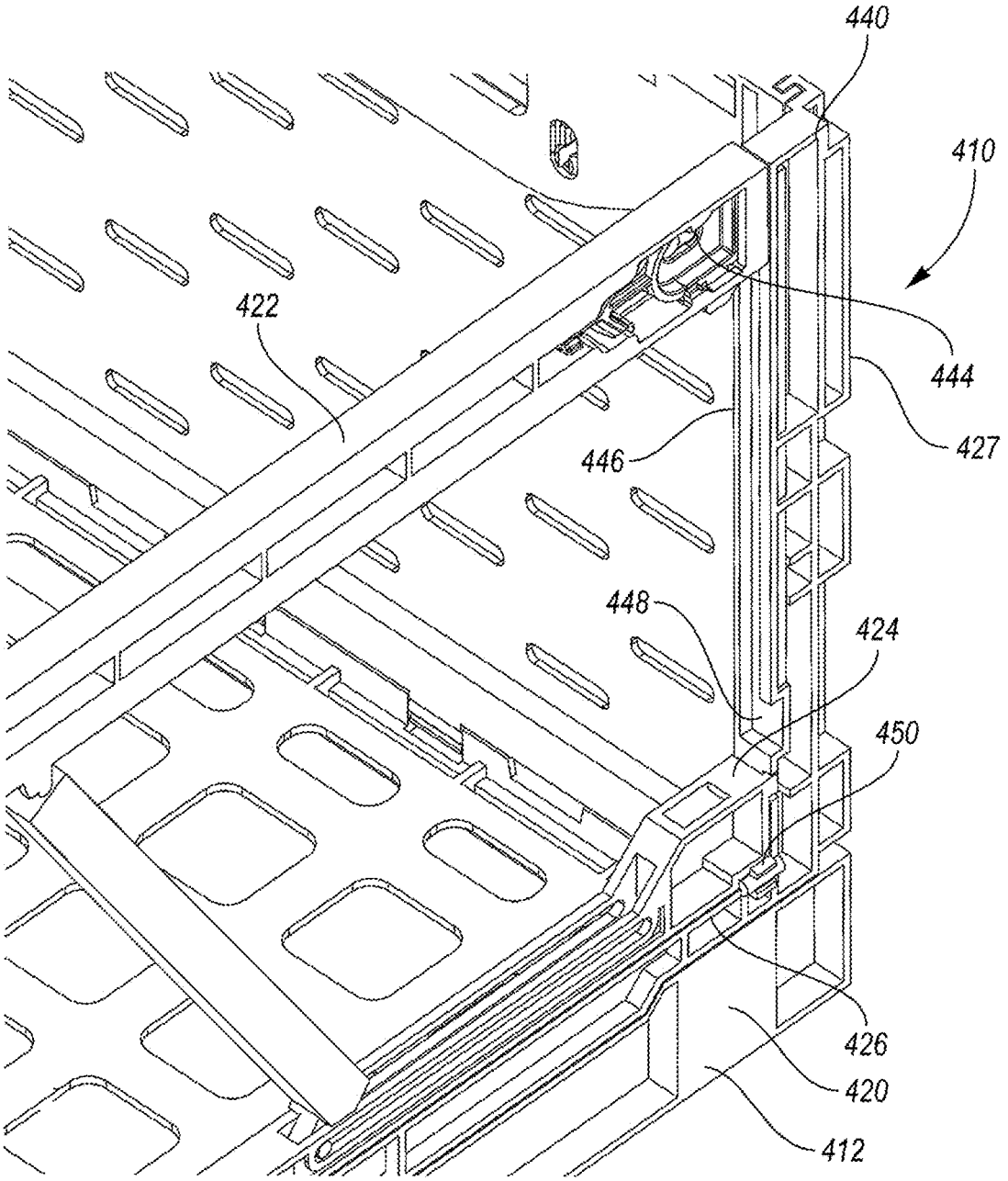
FIG. 42 is an enlarged perspective view of one end of the front wall of FIG. 39.

FIG. 42 is an enlarged perspective view of one end of the front wall 415 of FIG. 39. The other end of the front wall 415 would be mirror image. The vertical portion 427 includes a vertical track 446 in which the upper beam 422 is slidably captured. At the bottom of the vertical track 446 is an opening 448 toward the front of the container 410. The lower beam 424 is connected by a hinge 450 to the horizontal portion 426 of the frame 440.

Figure 43:
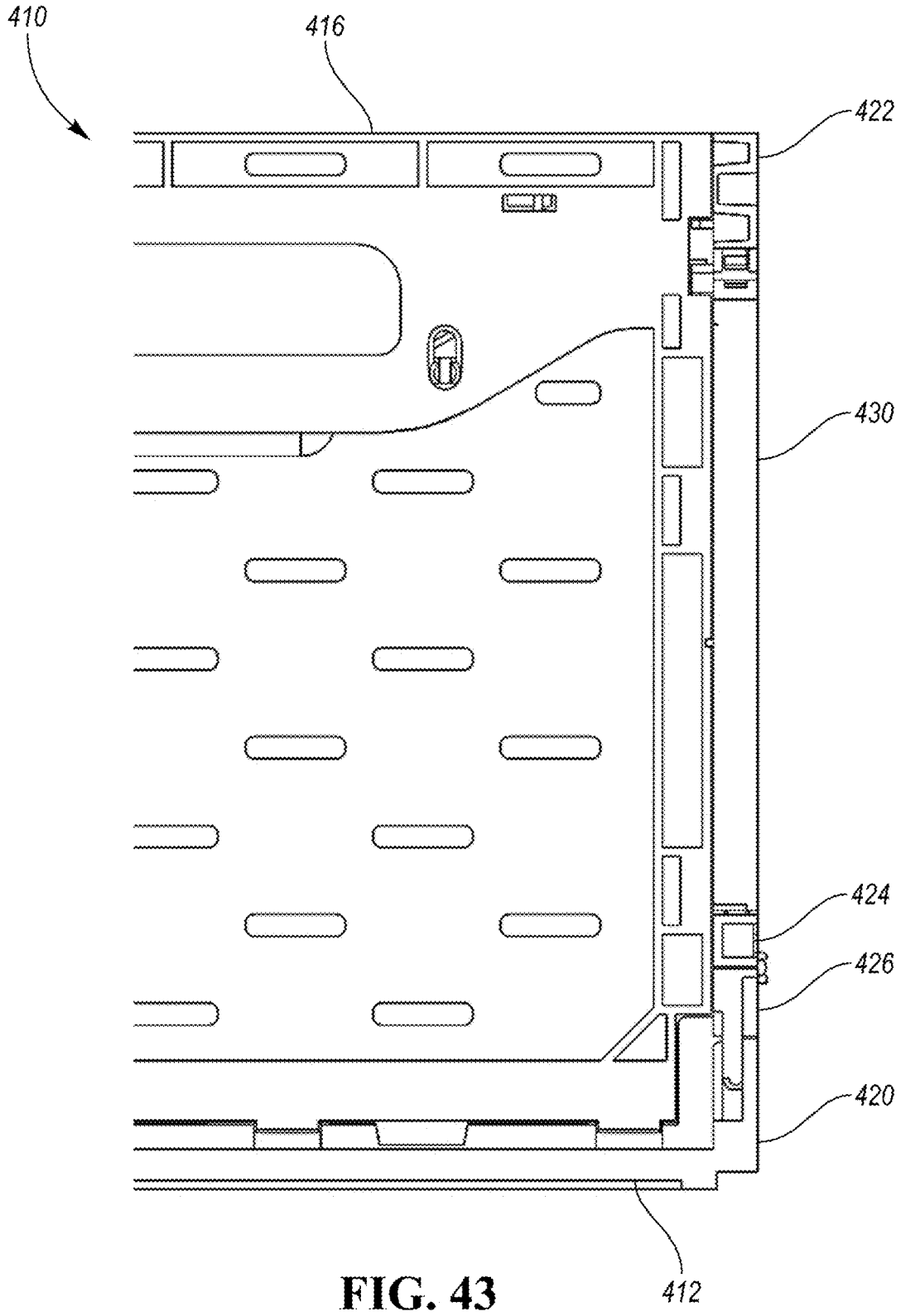
FIG. 43 is a section view through the front wall of FIG. 39.

FIG. 43 is a section view through the front wall 415 of FIG. 39.

Figure 44:
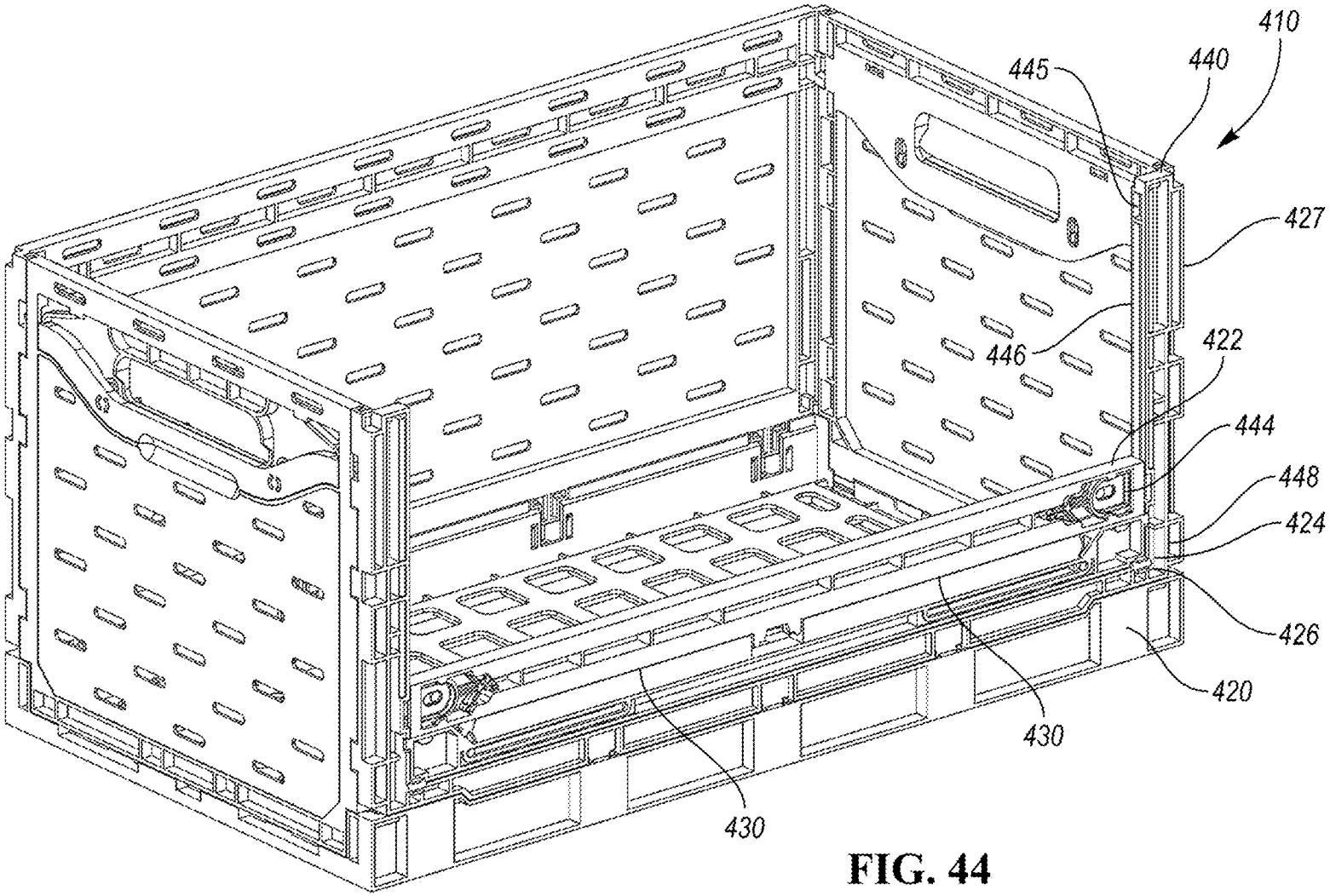
FIG. 44 is a perspective view of the container of FIG. 39 with the front wall in the partially retracted position.

In FIG. 44, the latches 444 have been released from complementary apertures 445 formed in the vertical portions 427 of the frame 440. The upper beam 422 is slid downward in the tracks 446 formed in the vertical portions 427 of the frame 440. The arms 430 pivot and slide until they are in a horizontal plane (parallel to the base 412) with the lower beam 424.

Figure 45:
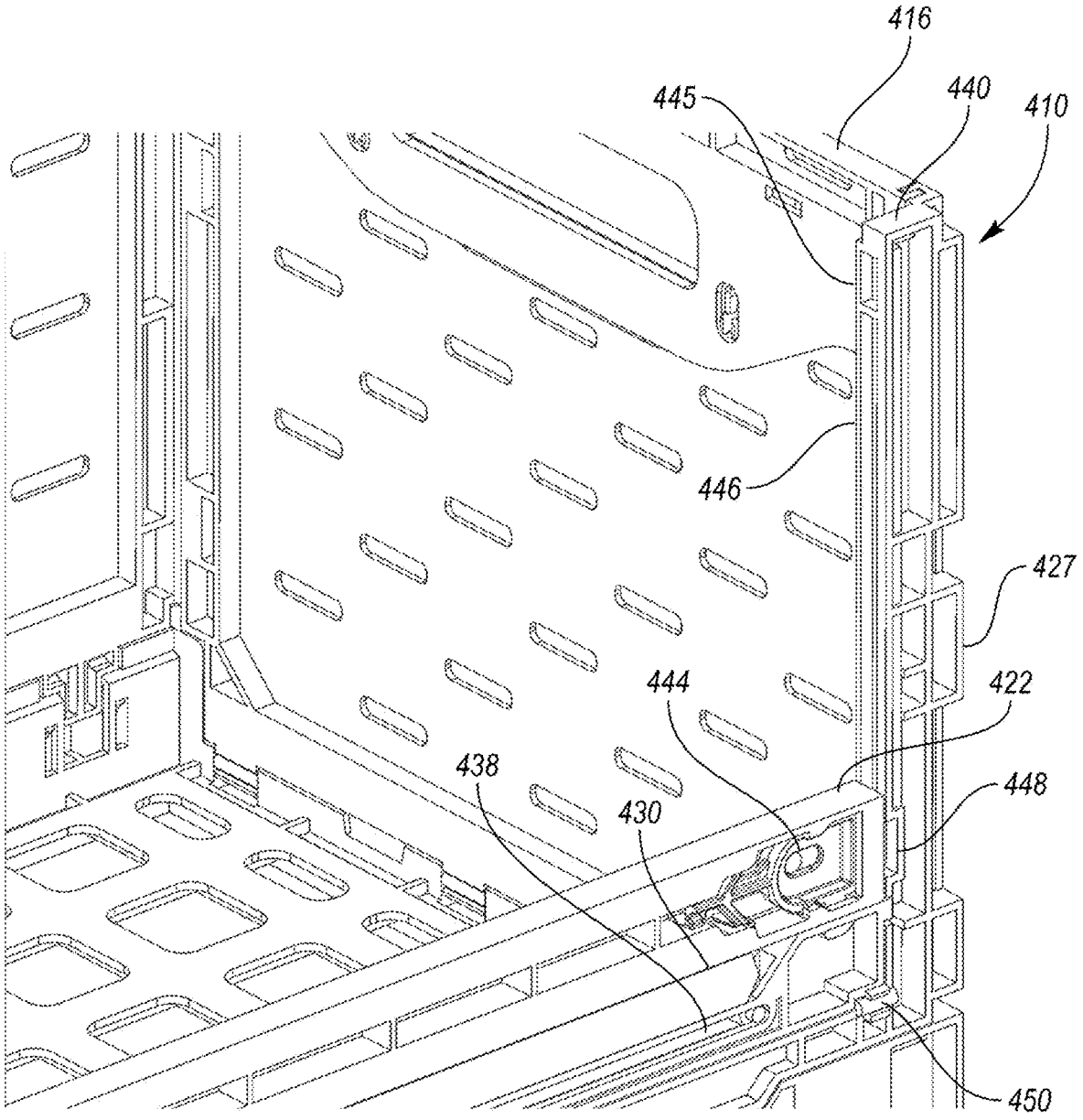
FIG. 45 is an enlarged view of one end of the front wall of FIG. 44.
Figure 46:
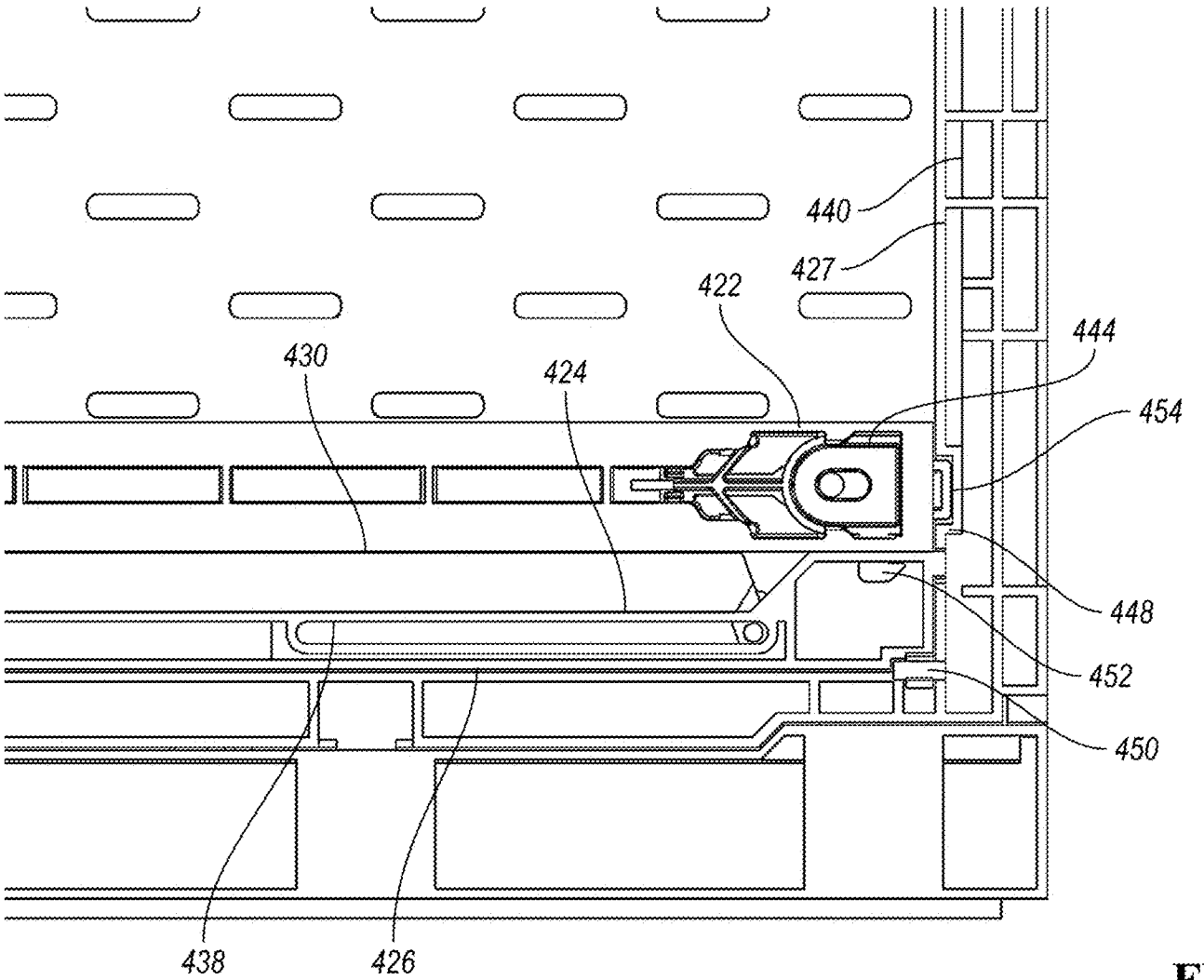
FIG. 46 is a front view of the portion of the front wall of FIG. 45.
Figure 47:
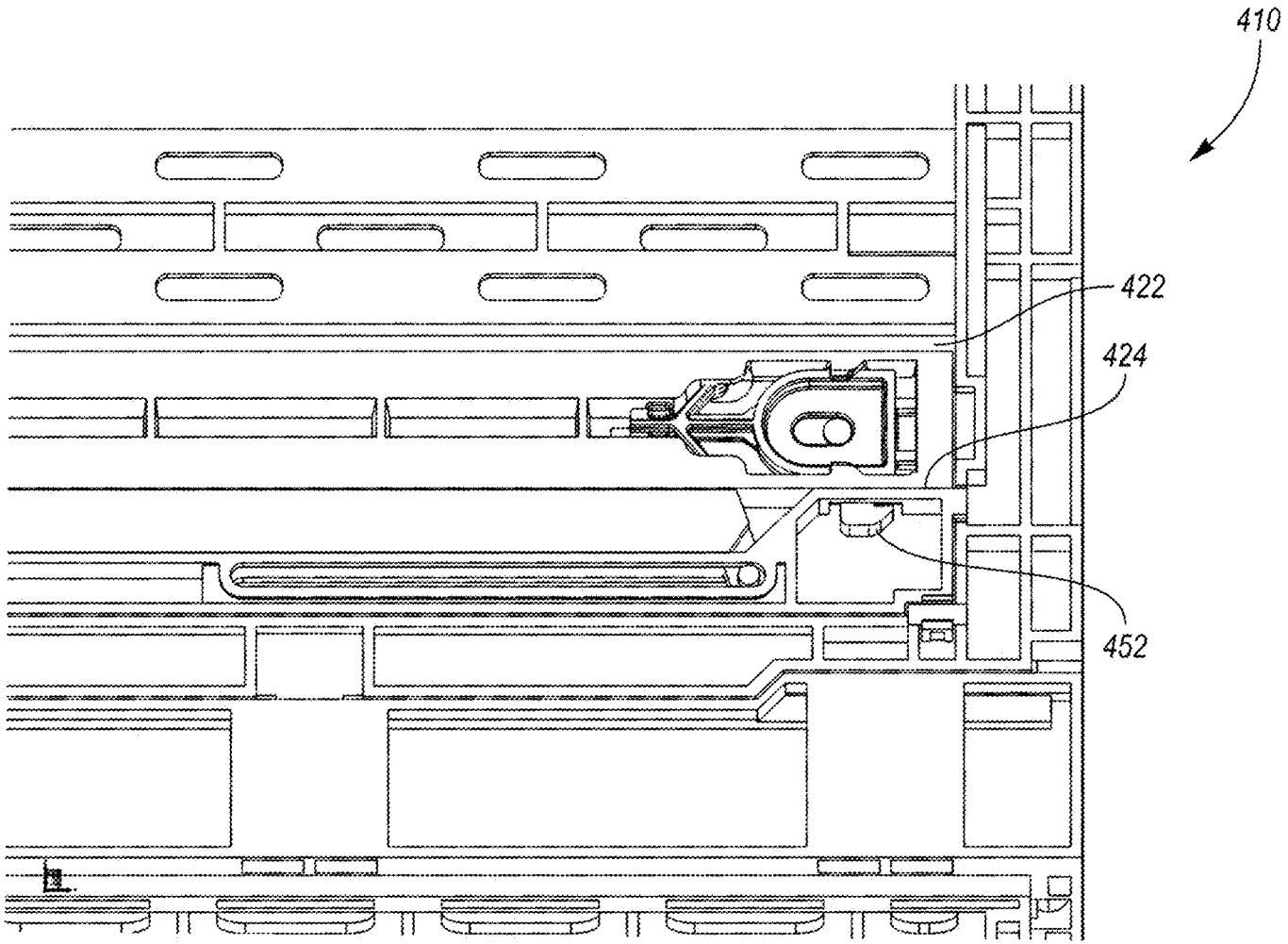
FIG. 47 is a bottom perspective view of the end of the front wall of FIG. 46.

FIGS. 45 and 46 are enlarged views of one end of the front wall 415 of FIG. 44. The latch 444 is slid down in the track 446 until the tab 454 of the upper beam 422 aligns with the opening 448 in the track 446. Referring to FIGS. 46 and 47, the latch 444 includes an integral lower latch portion 452 that snap-connects to the lower beam 424 when the upper beam 422 is moved onto it.

Figure 48:
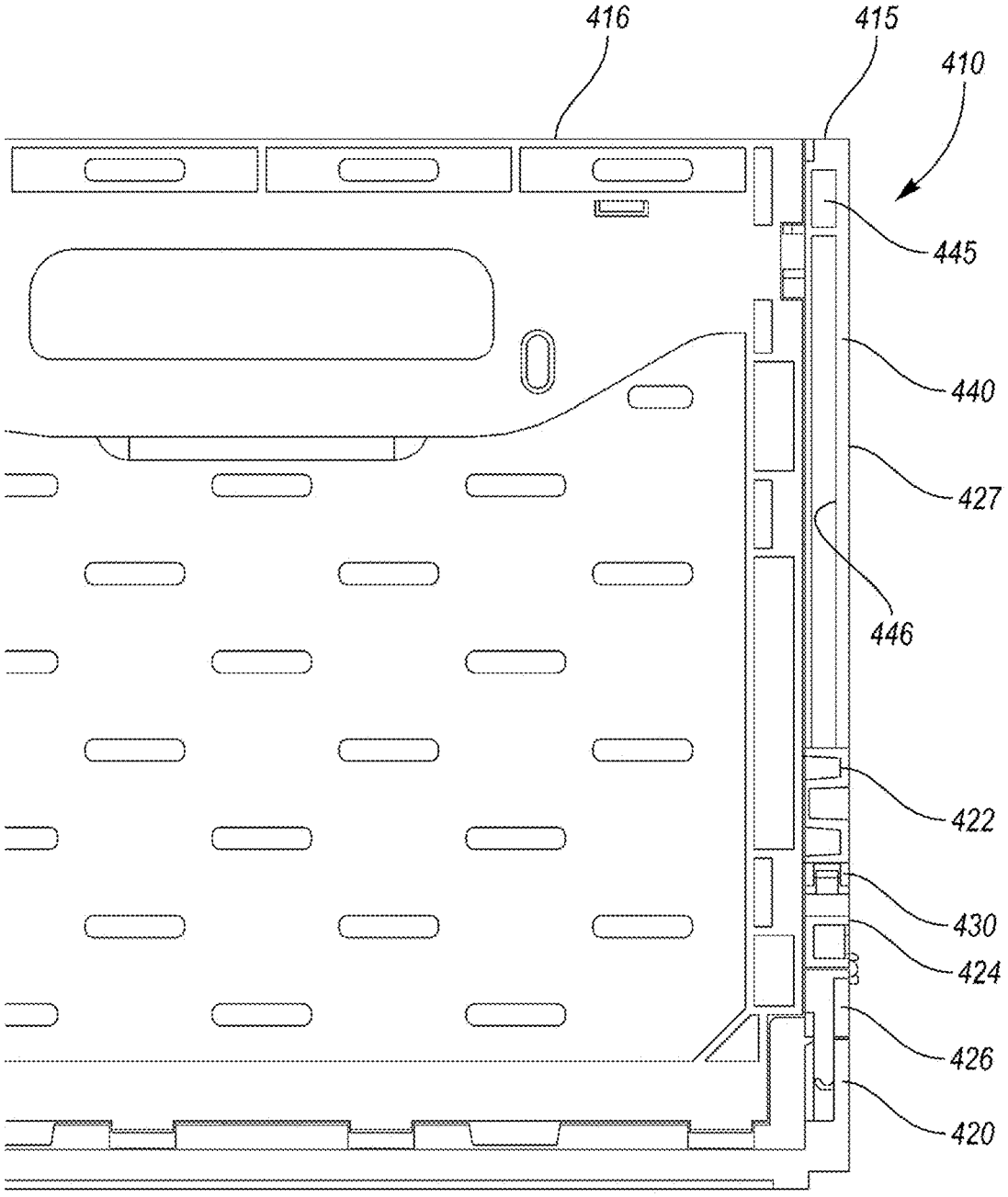
FIG. 48 is a section view through the front wall of FIG. 46.

FIG. 48 is a section view through the front wall 415 of FIG. 46 showing the upper beam 422 on top of the arm 430 which is on top of the lower beam 424 which is on top of the horizontal portion 426 of the frame 440.

Figure 49:
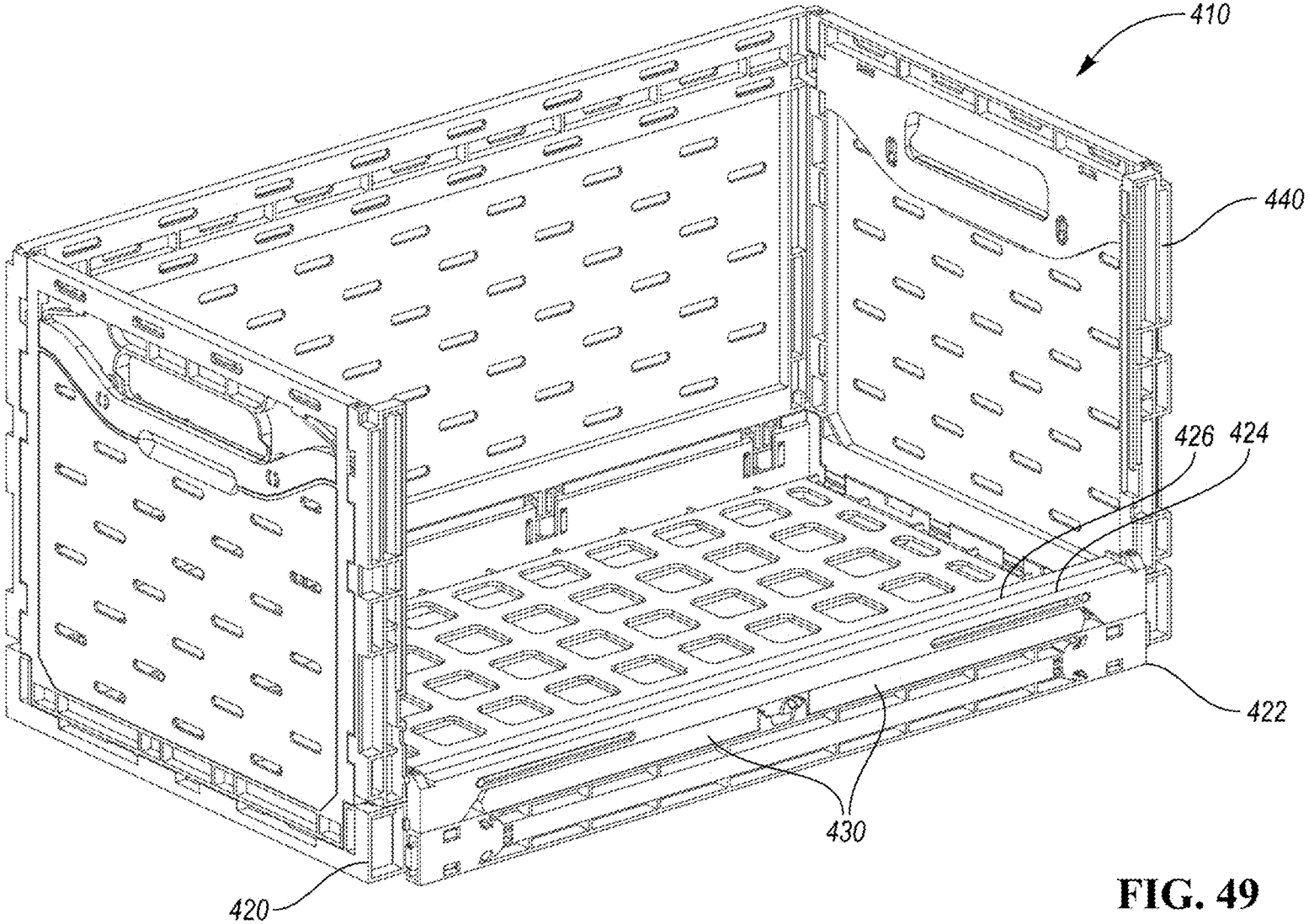
FIG. 49 is a perspective view of the container of FIG. 39 with the front wall in the full retracted position.
Figure 50:
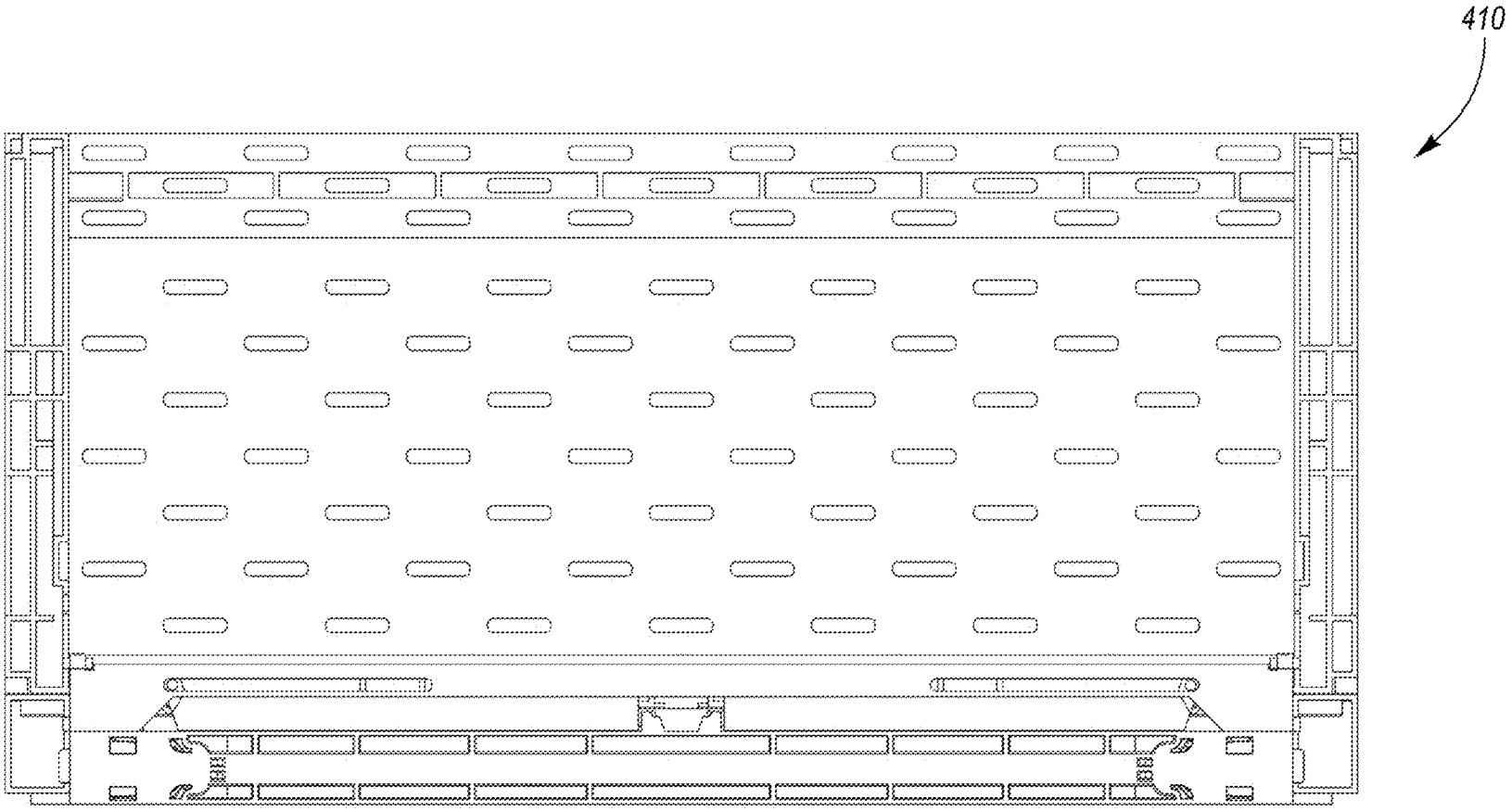
FIG. 50 is a front view of the container of FIG. 49.
Figure 51:
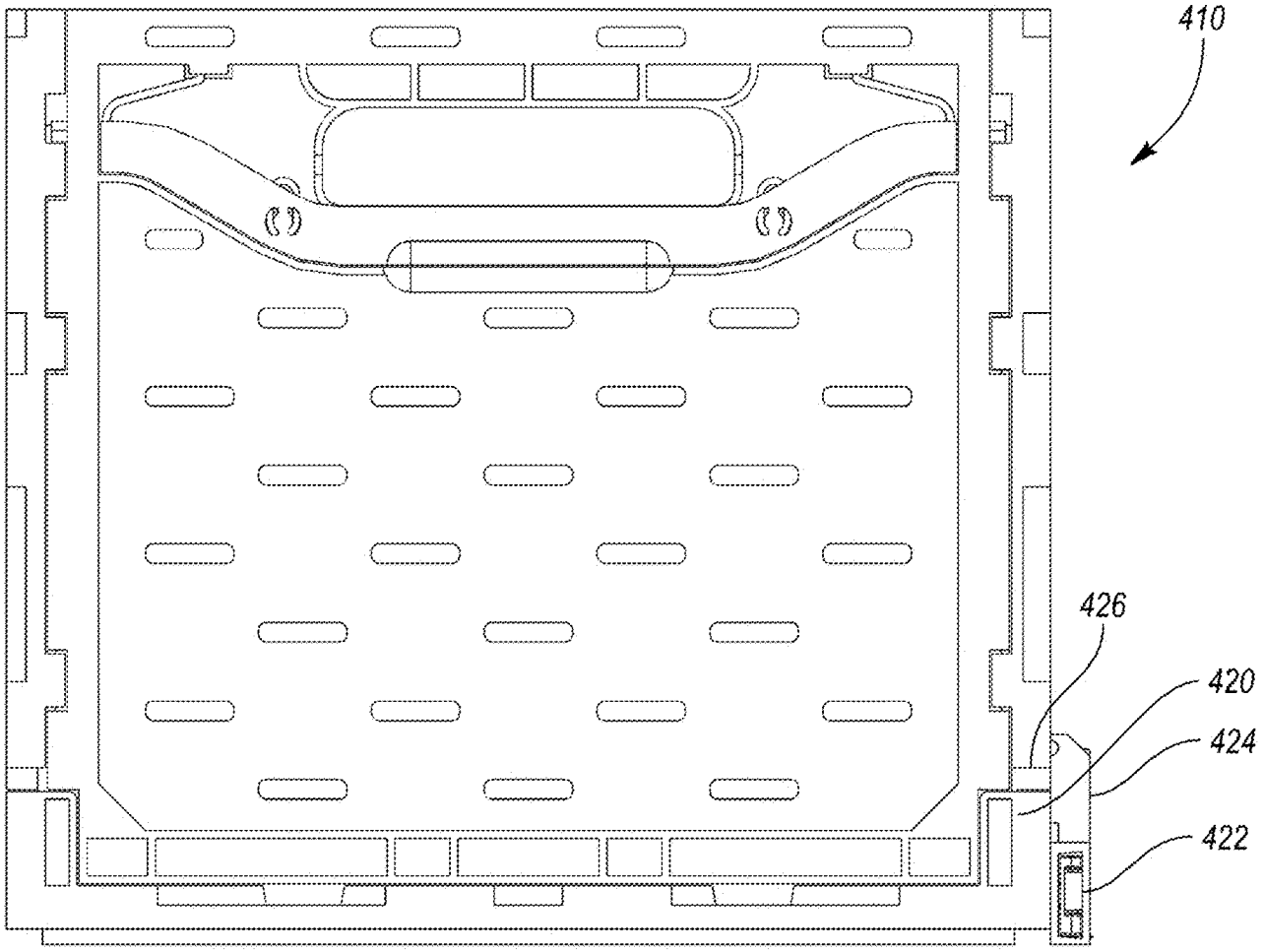
FIG. 51 is an end view of the container of FIG. 49.

As shown in FIG. 49, the upper beam 422, arms 430 and lower beam 424 can then be pivoted outward and downward to the fully retracted position flush against the horizontal portion 426 of the frame 440 and the flange 420. FIG. 50 is a front view of the container 410 of FIG. 49. FIG. 51 is an end view of the container 410 of FIG. 49.

Figure 52:
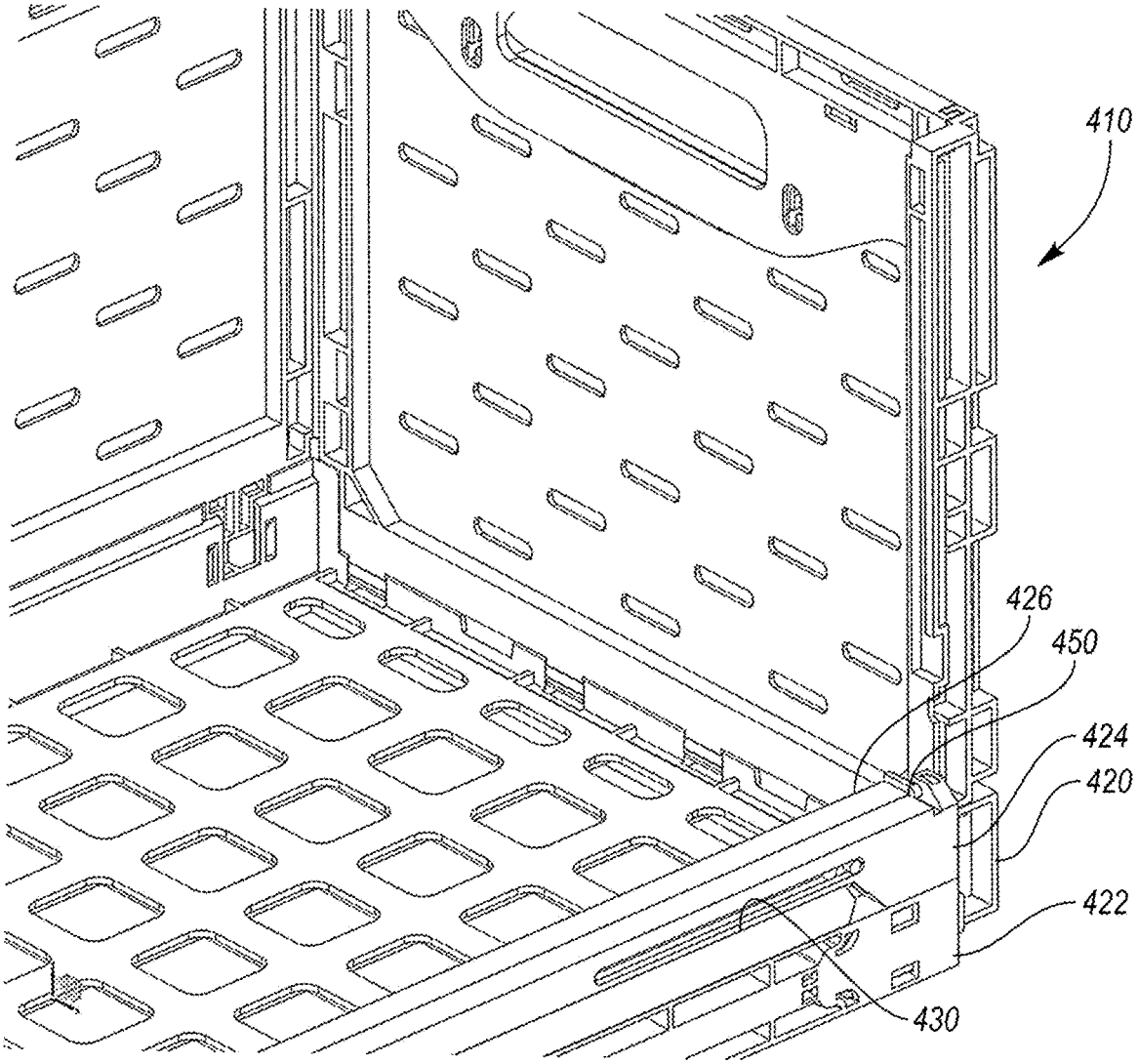
FIG. 52 is an enlarged view of one end of the front wall of FIG. 49.
Figure 53:
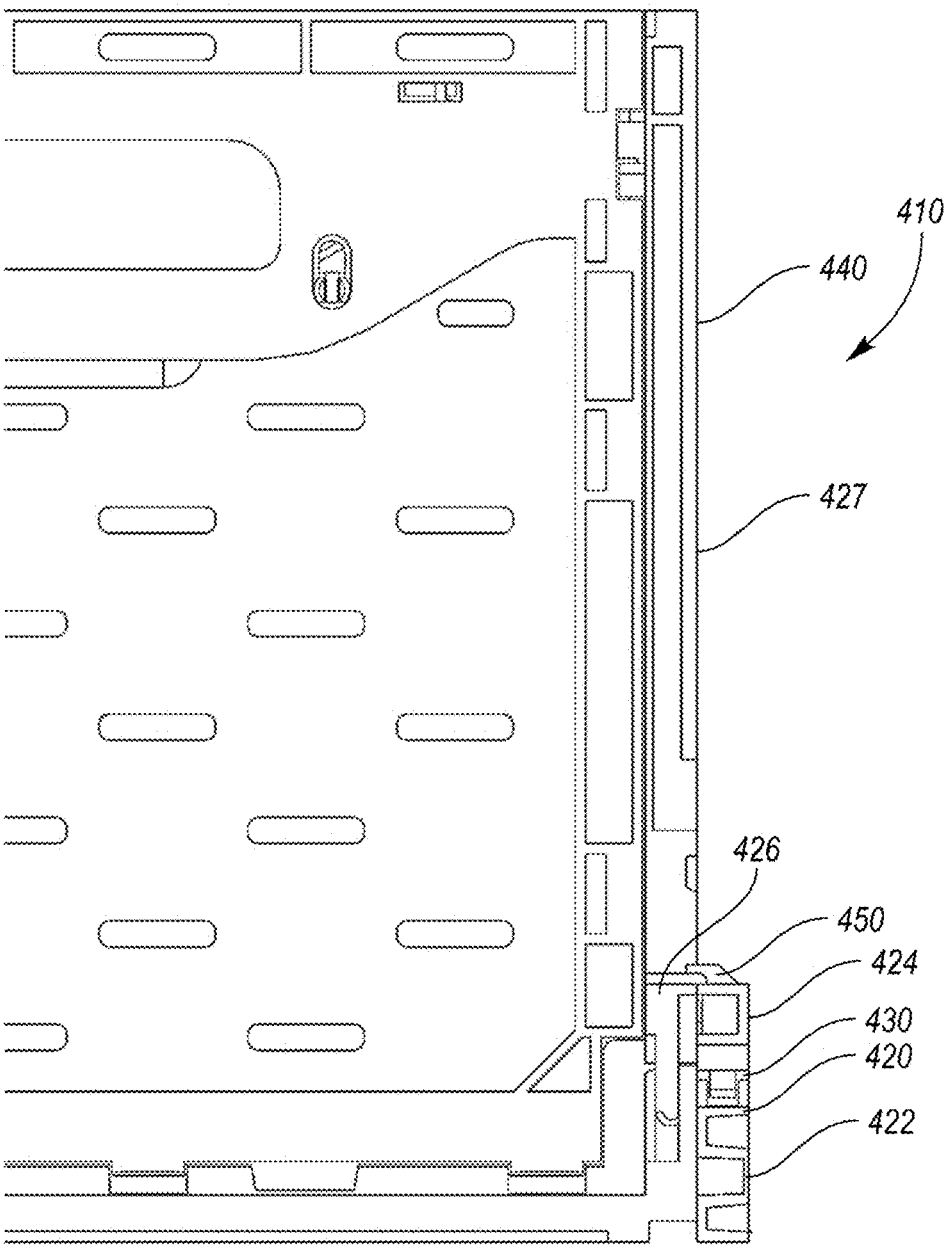
FIG. 53 is a section view through the front wall of FIG. 49.

FIG. 52 is an enlarged view of one end of the front wall 415 of FIG. 49. FIG. 53 is a section view through the front wall 415 of FIG. 49.

In the fully retracted configuration, goods can be removed from the container 410 even when another loaded container 410 is stacked thereon. Notably, the front wall 415 can be moved to the retracted position even when another loaded container 410 is already stacked thereon.

Figure 54:
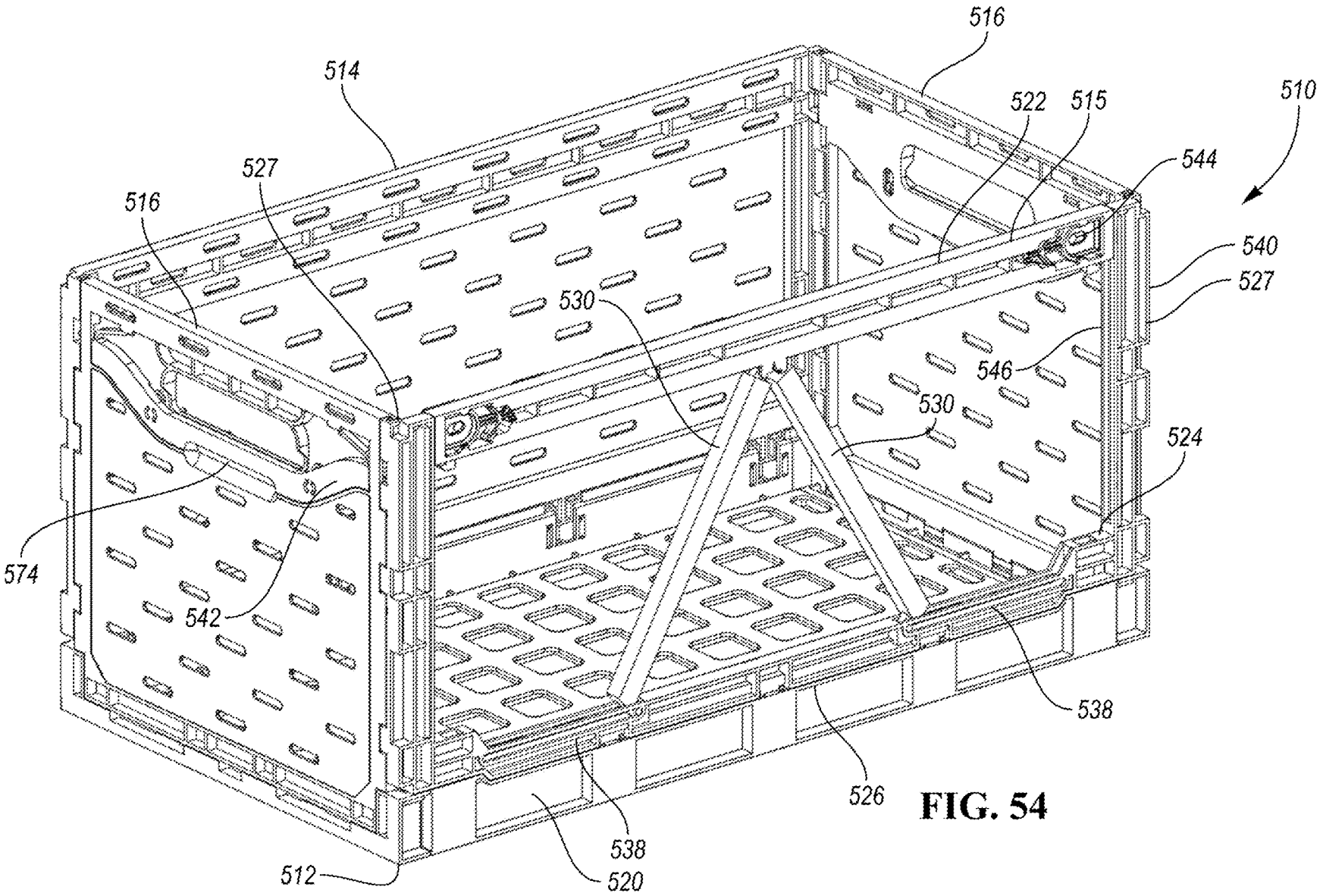
FIG. 54 is a perspective view of a container according to a sixth embodiment.

FIG. 54 shows a container 510 according to a sixth embodiment. The rear wall 514 and end walls 516 may be identical to those of FIG. 39. The collapsible container 510 includes a base 512. The front wall 515 (or "first wall") is pivotably connected to a front upstanding flange 520 at a front edge of the base 512.

The front wall 515 includes a U-shaped frame 540 secured to the end walls 516 by latches 542 mounted on the end walls 516 and releasable by a latch release handle 574. The U-shaped frame 540 includes a lower horizontal portion 526 and vertical portions 527 extending upward from opposite ends of the lower horizontal portion 526. The lower horizontal portion 526 is hingeably connected to the front upstanding flange 520.

The container 510 is a collapsible container, i.e. the walls can be collapsed onto the base 512 when empty for efficient shipping and storage. In this embodiment, the end walls 516 are hingeably connected to the base 512 in a plane lower than are the front wall 515 and rear wall 514 and the end walls 516 are between the front wall 515 and the rear wall 514, so the end walls 516 would be collapsed onto the base 512 first (in either order), and then the front wall 515 and the rear wall 514 (in either order) would be collapsed onto the end walls 516.

The front wall 515 is also retractable. In the front wall 515, an upper beam 522 is slidably connected to both of the vertical portions 527 of the frame 540. Latches 544 selectively secure the upper beam 522 in place at the upper ends of the vertical portions 527 of the frame 540 as shown in FIG. 54, which is the deployed, closed position.

Figure 55:
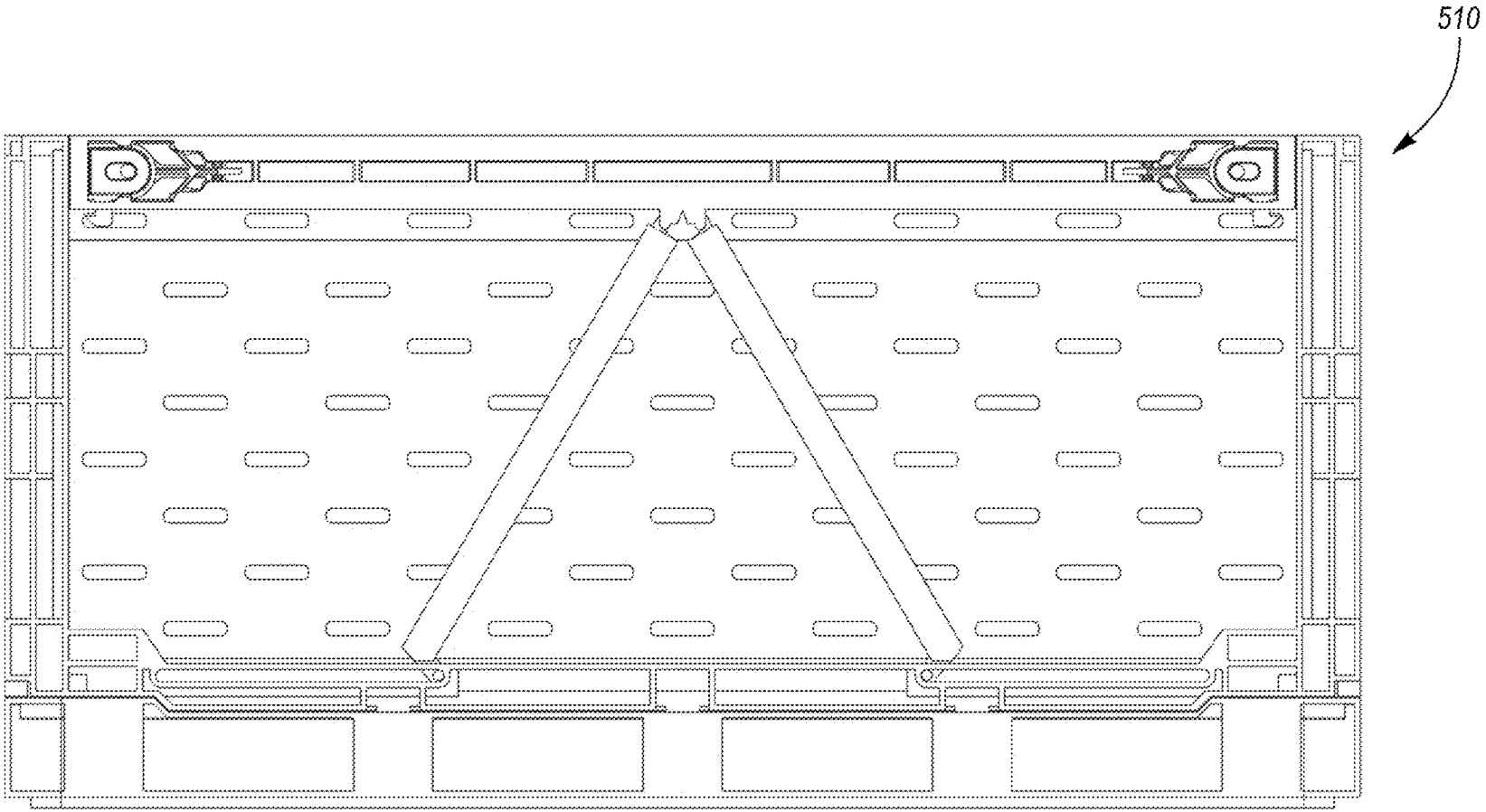
FIG. 55 is a front view of the container of FIG. 54.

A plurality of arms 530 (two, in this example) are pivotably and slidably connected to elongated apertures 538 the lower horizontal portion 526 of the frame 540 and pivotably connected to the upper beam 522 (or vice versa). In the deployed, closed position shown in FIG. 54, the arms 530 angle inward as they extend upward (but alternatively, vice versa). FIG. 55 is a front view of the container 510 of FIG. 54.

Figure 56:
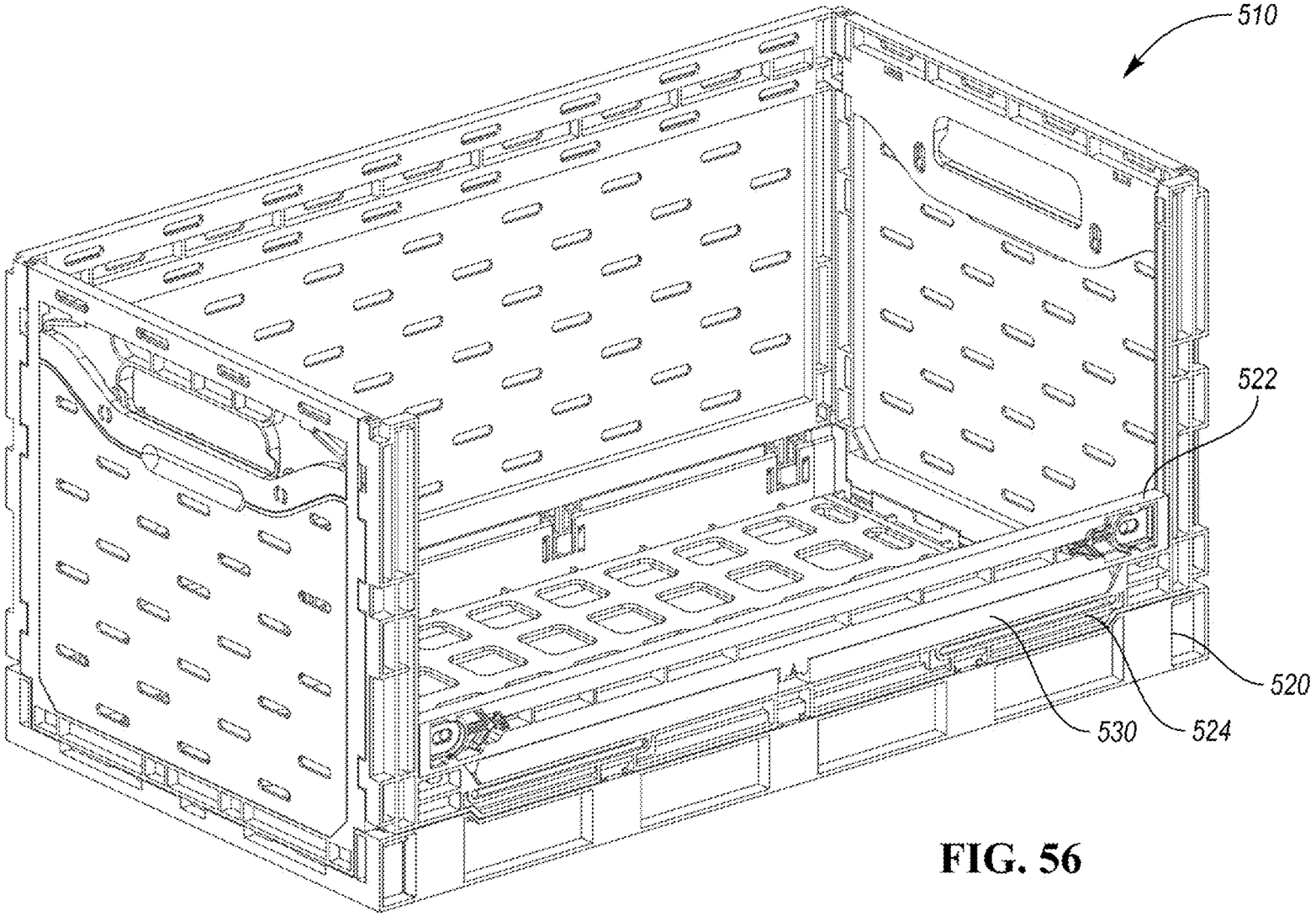
FIG. 56 shows the container of FIG. 54 with the front wall in the retracted position.
Figure 57:
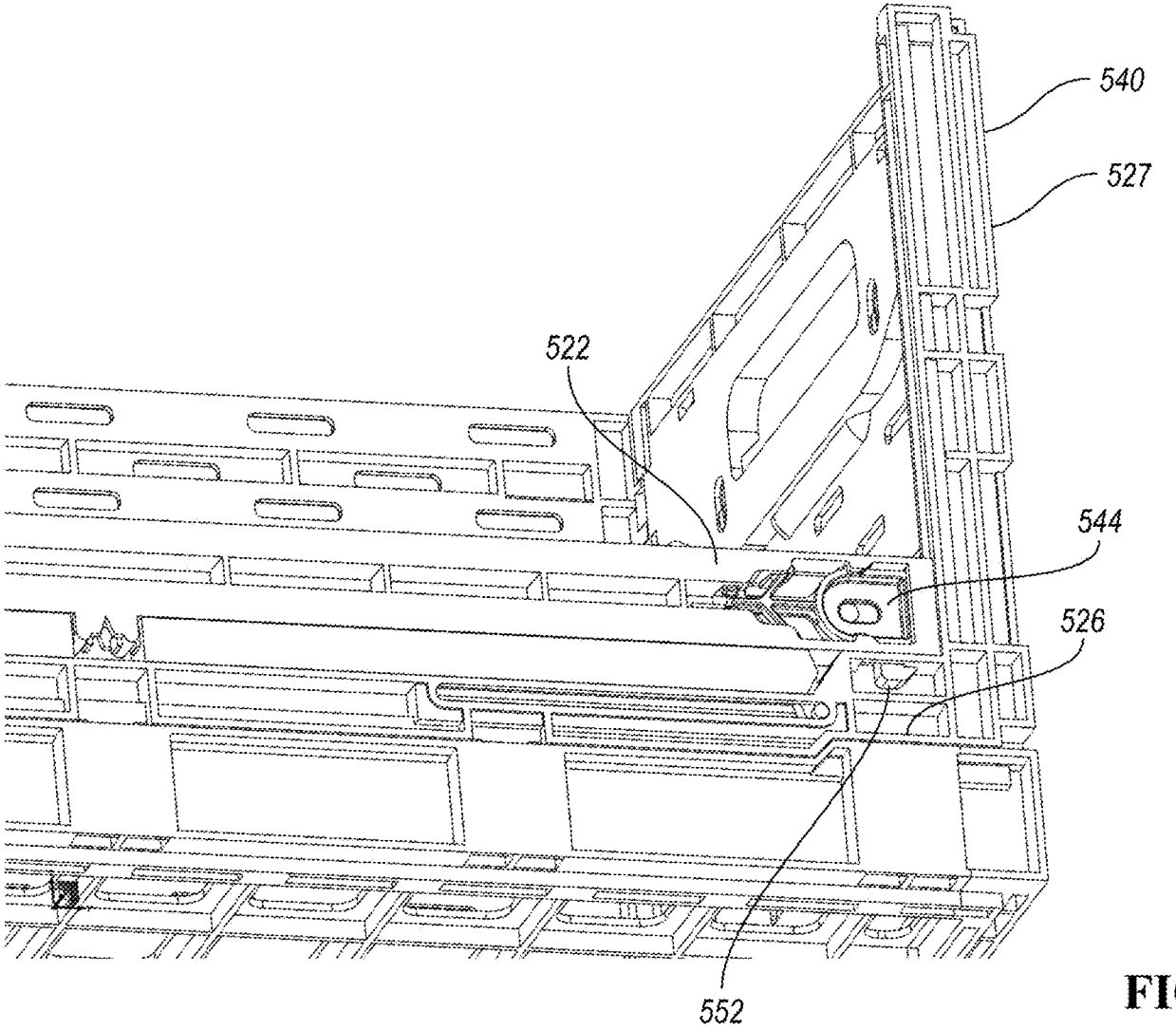
FIG. 57 is a bottom perspective view of the front wall of FIG. 56.

In FIG. 56, the front wall 515 is retracted. The latches 544 are released so that the upper beam 522 can be slid downward in the tracks 46 in the vertical portions 527 of the frame 540 onto the horizontal portion 524 of the frame 540. Referring to FIG. 57, the latch 544 includes an integral lower latch portion 552 that snap-connects to the horizontal portion 526 of the frame 540 when the upper beam 522 is moved onto it.

Figure 58:
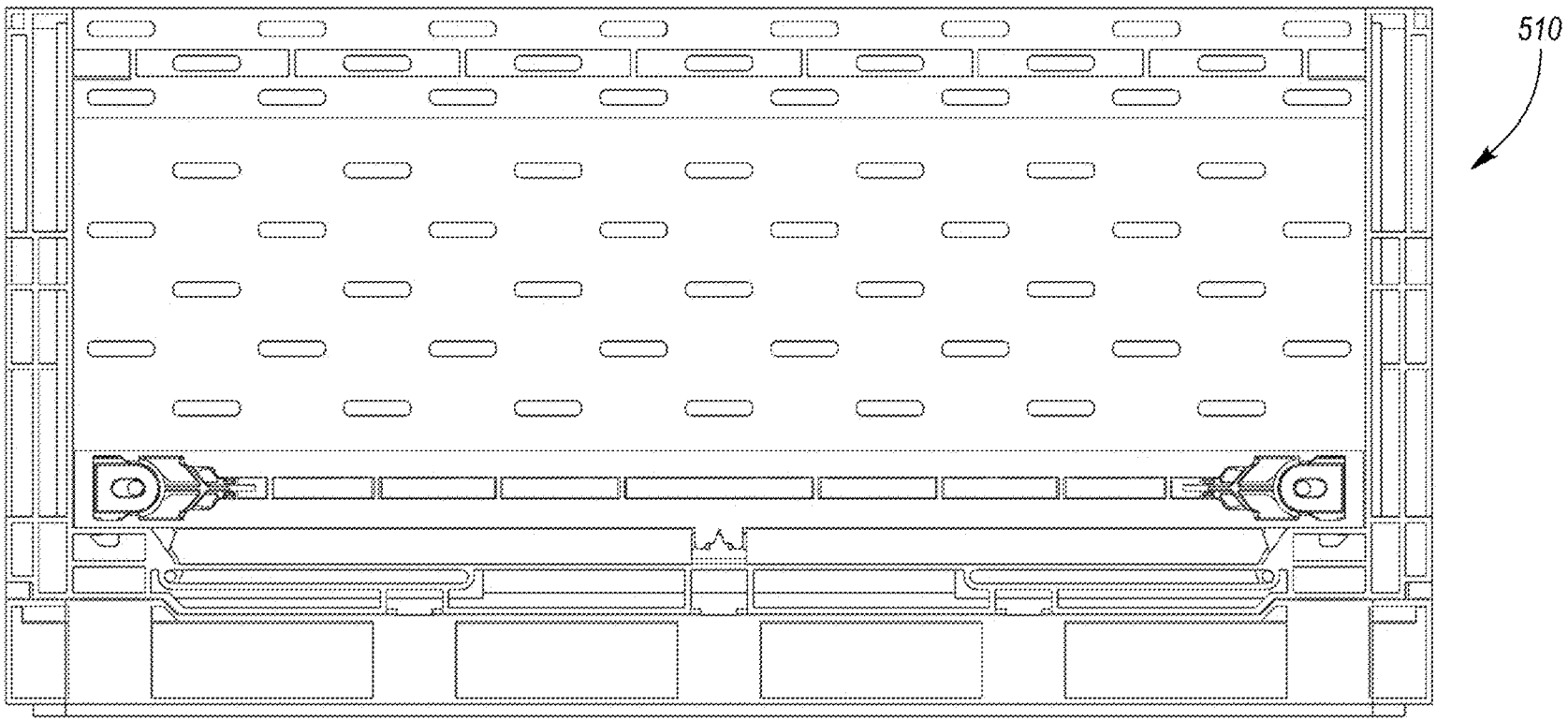
FIG. 58 is a front view of the container of FIG. 56.

FIG. 58 is a front view of the container 510 with the front wall in the retracted position.

Figure 59:
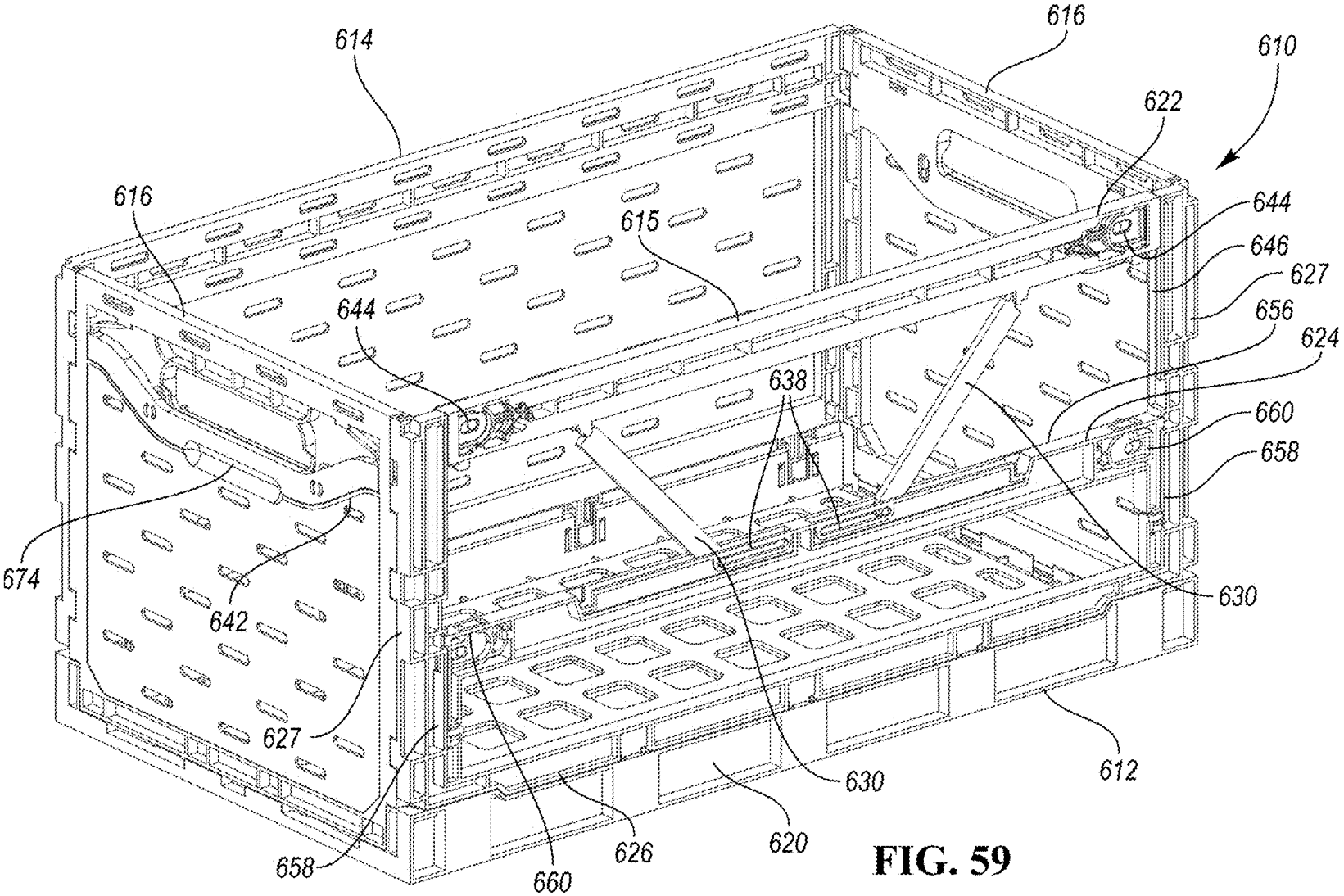
FIG. 59 is a perspective view of a collapsible container according to a seventh embodiment.

A collapsible container 610 according to a seventh embodiment is shown in FIG. 59. The collapsible container 610 includes a base 612, a rear wall 614 and end walls 616, as before.

The front wall 615 (or "first wall") includes a U-shaped frame 640 secured to the end walls 616 by latches 642 mounted on the end walls 616 and releasable by a latch release handle 674. The U-shaped frame 640 includes a lower horizontal portion 626 and vertical portions 627 extending upward from opposite ends of the lower horizontal portion 626. The lower horizontal portion 626 is hingeably connected to the front upstanding flange 620.

The container 610 is a collapsible container, i.e. the walls 614, 615, 616 can be collapsed onto the base 612 when empty for efficient shipping and storage. In this embodiment, the end walls 616 are hingeably connected to the base 612 in a plane lower than are the front wall 615 and rear wall 614 and the end walls 616 are between the front wall 615 and the rear wall 614, so the end walls 616 would be collapsed onto the base 612 first (in either order), and then the front wall 615 and the rear wall 614 (in either order) would be collapsed onto the end walls 616.

The front wall 615 is also retractable. In the front wall 615, an upper beam 622 is slidably connected to both of the vertical portions 627 of the frame 640. Latches 644 selectively secure the upper beam 622 in place at the upper ends of the vertical portions 627 of the frame 640 as shown in FIG. 59, which is the deployed, closed position. A mid beam 624 includes a horizontal portion 656 and vertical arms 658 connected at each end to the vertical portions 627 of the frame 640. The mid beam 624 is latched to the vertical portions 627 by latches 660.

Figure 60:
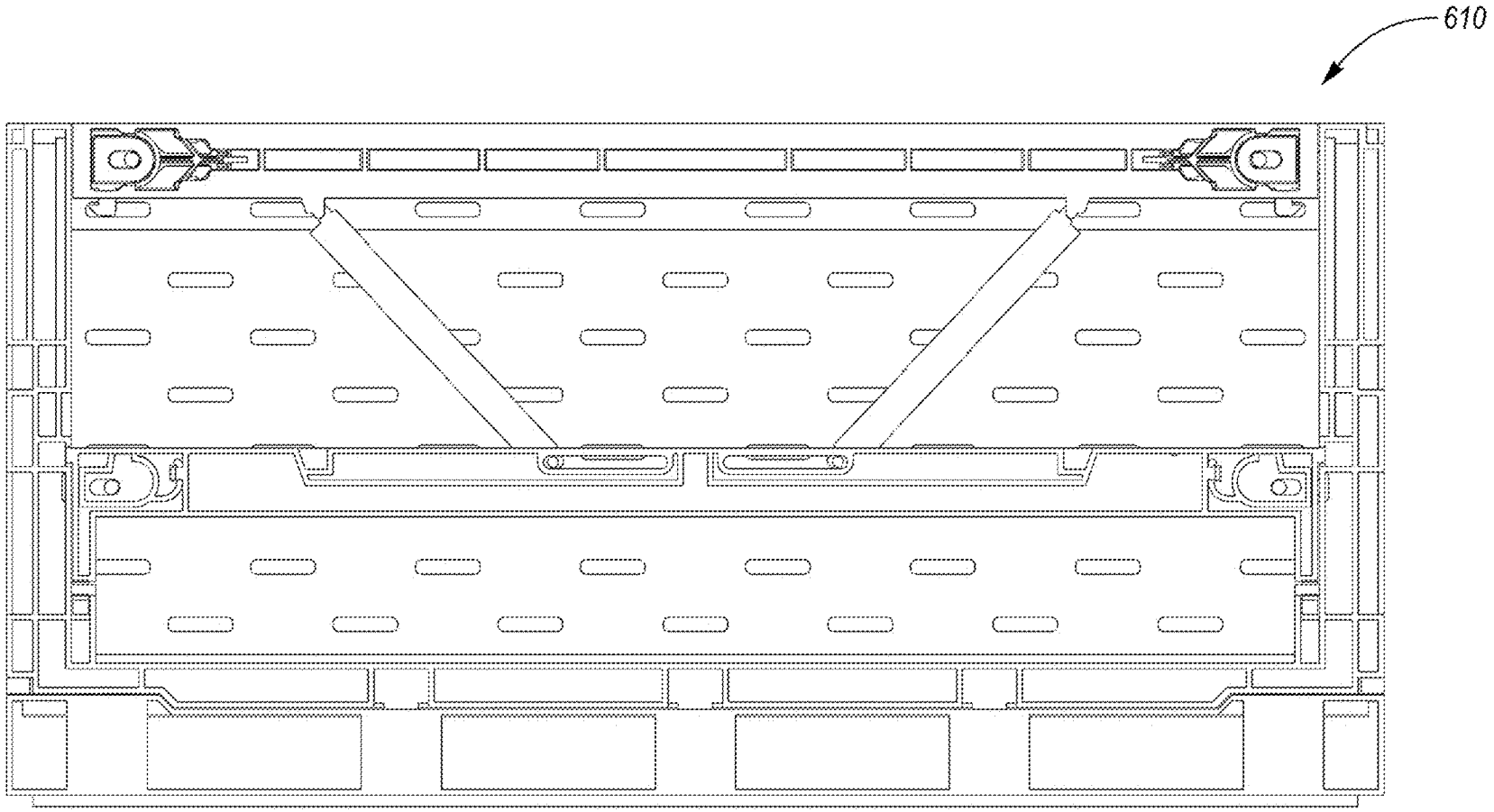
FIG. 60 is a front view of the collapsible container of FIG. 59.
Figure 61:
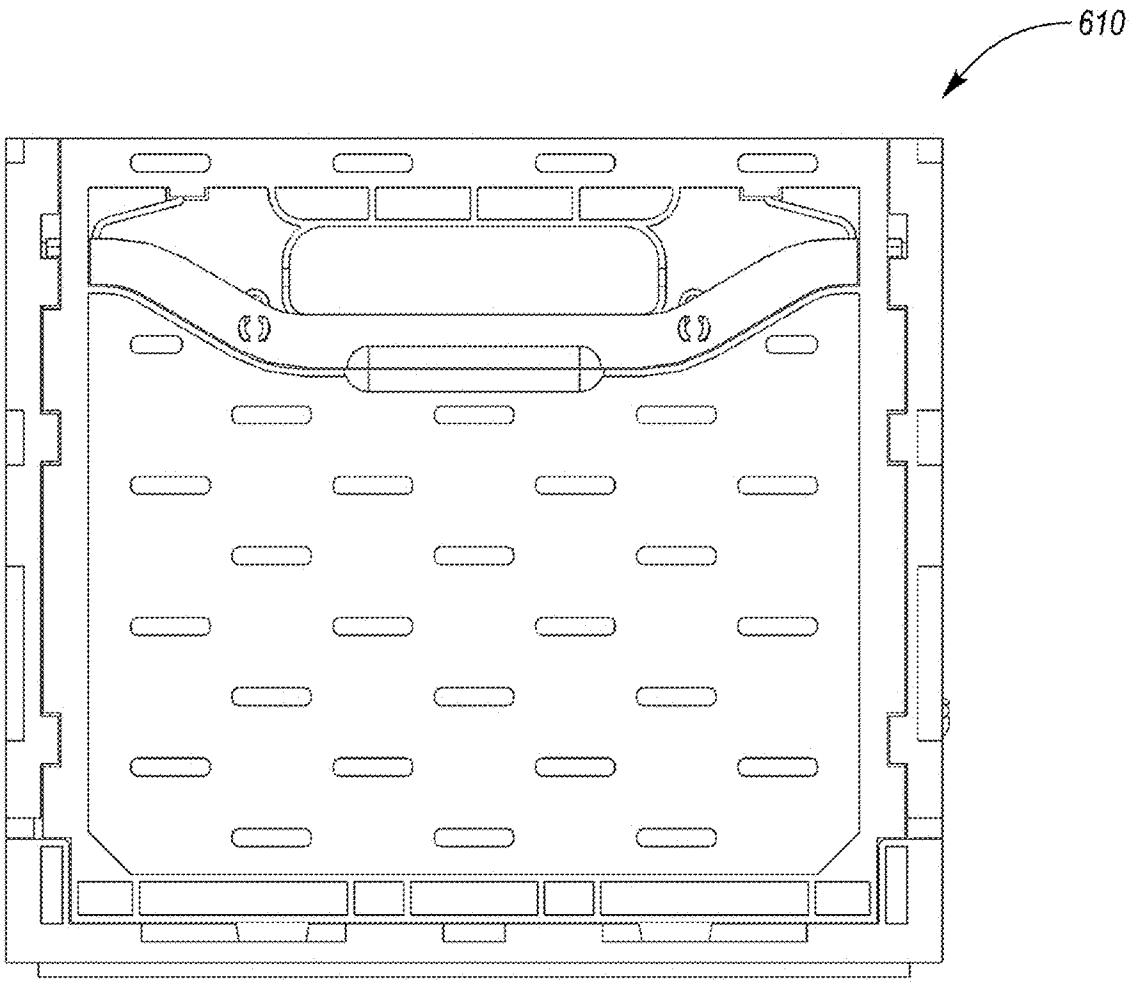
FIG. 61 is an end view of the collapsible container of FIG. 59.

FIG. 60 is a front view of the container 610 of FIG. 59. FIG. 61 is an end view of the container 610 of FIG. 59.

Figure 62:
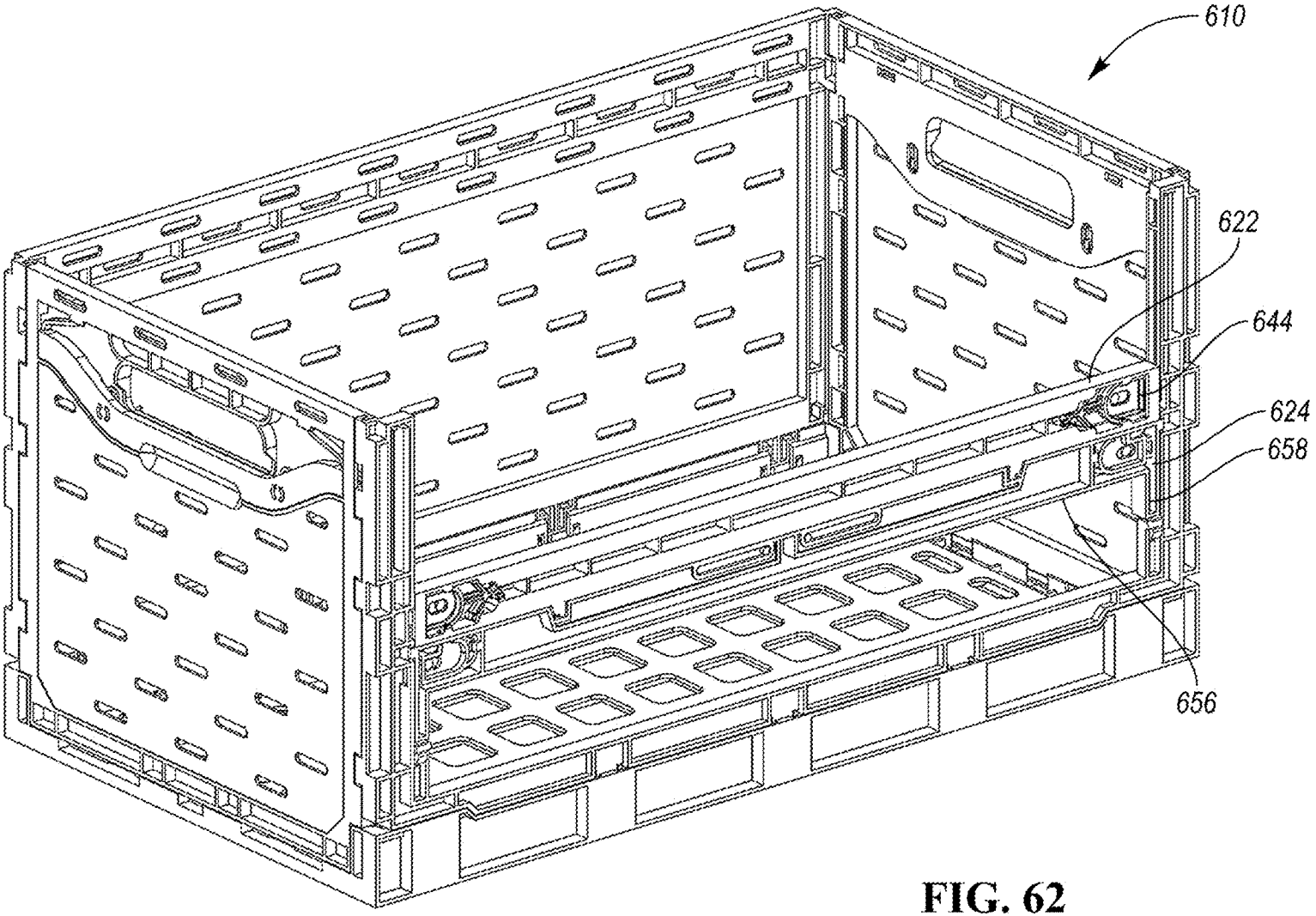
FIG. 62 shows the container of FIG. 59 with the front wall in a partially retracted position.
Figure 63:
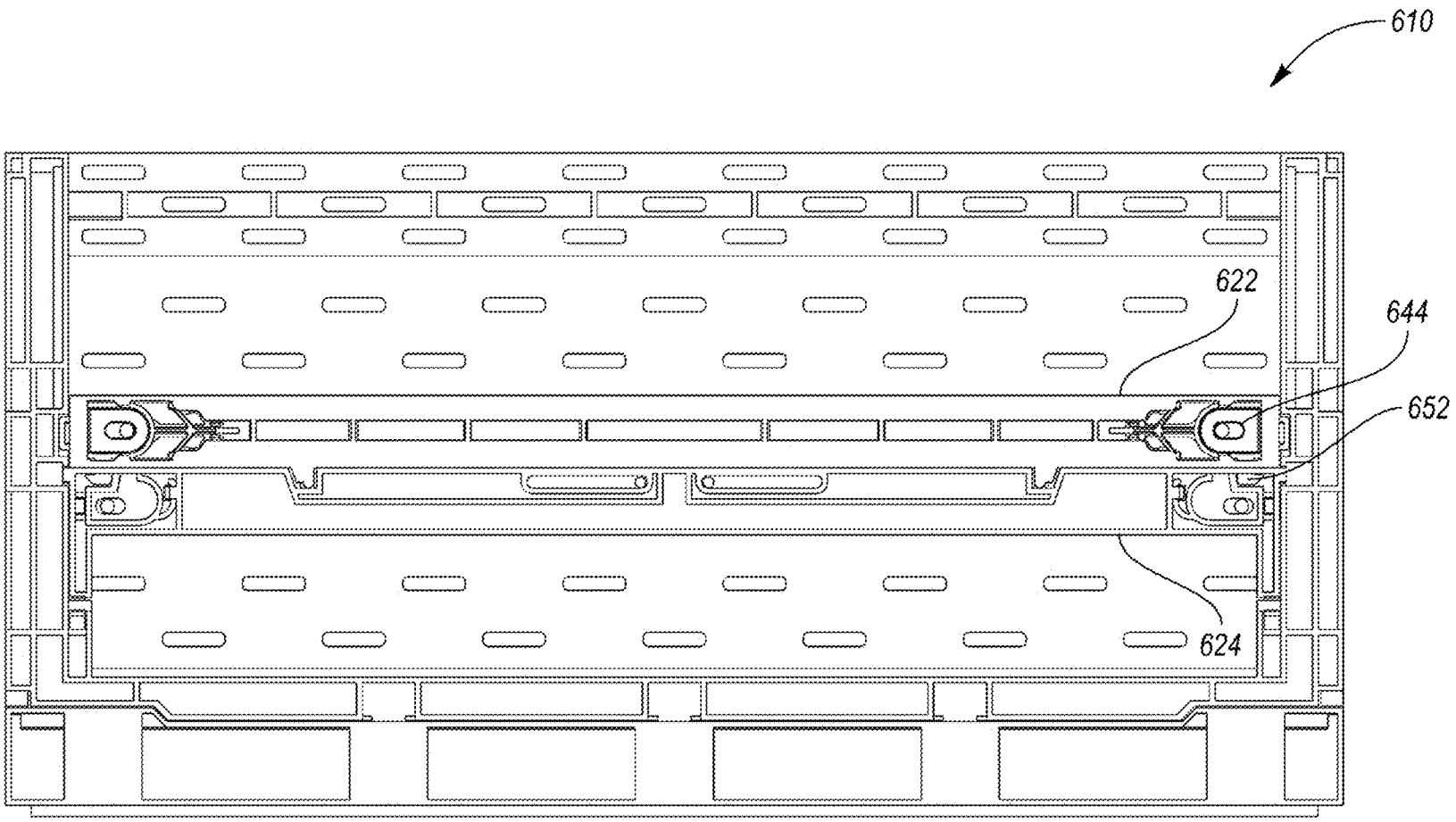
FIG. 63 is a front view of the container of FIG. 62.
Figure 64:
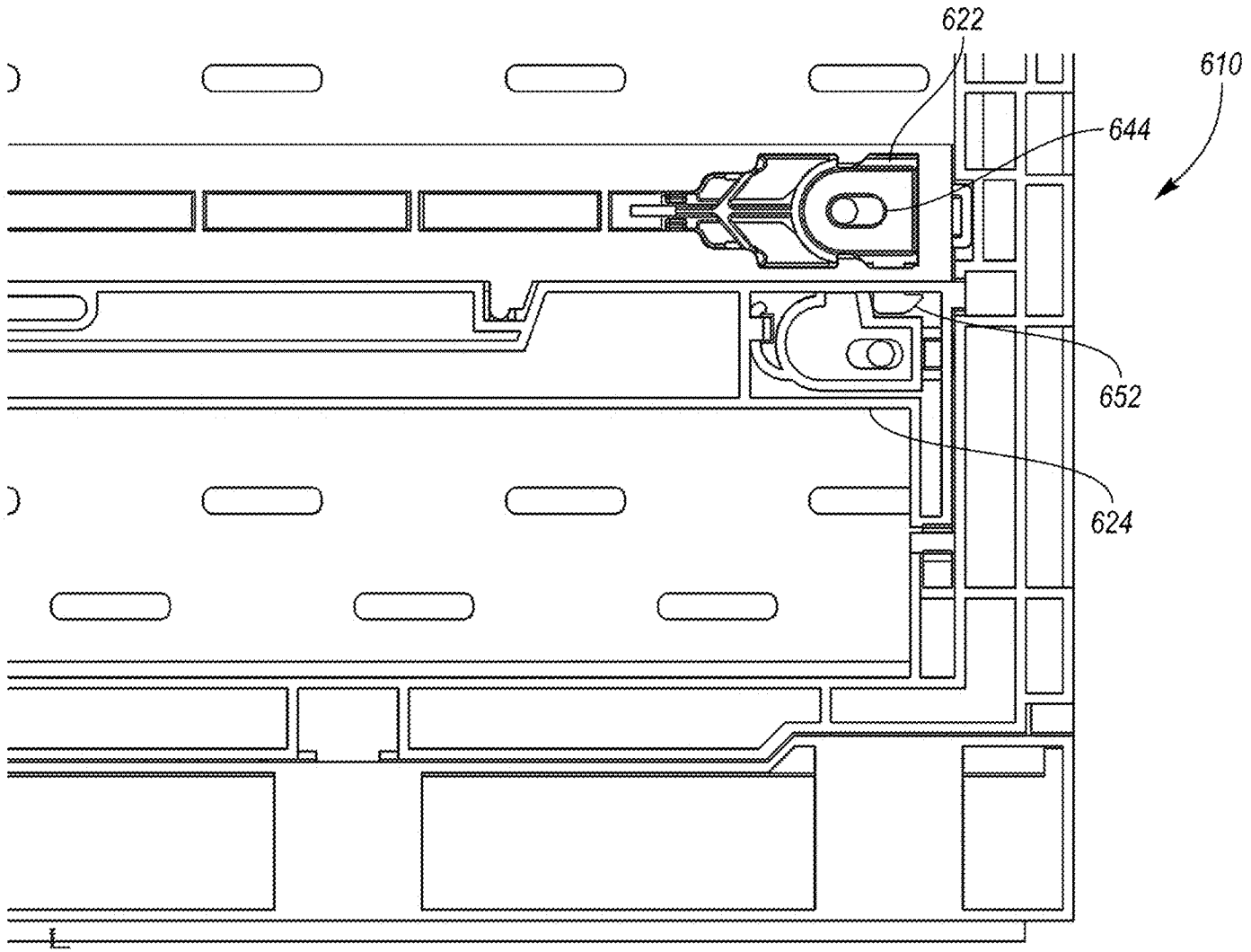
FIG. 64 is an enlarged view of a portion of the front wall of FIG. 63.

In FIG. 62, the latches 644 are released and the upper beam 622 is slid downward in tracks 646 onto the mid beam 624 and latched thereto by a latch, such as lower hook 652 (FIGS. 63 and 64) of latch 644.

Figure 65:
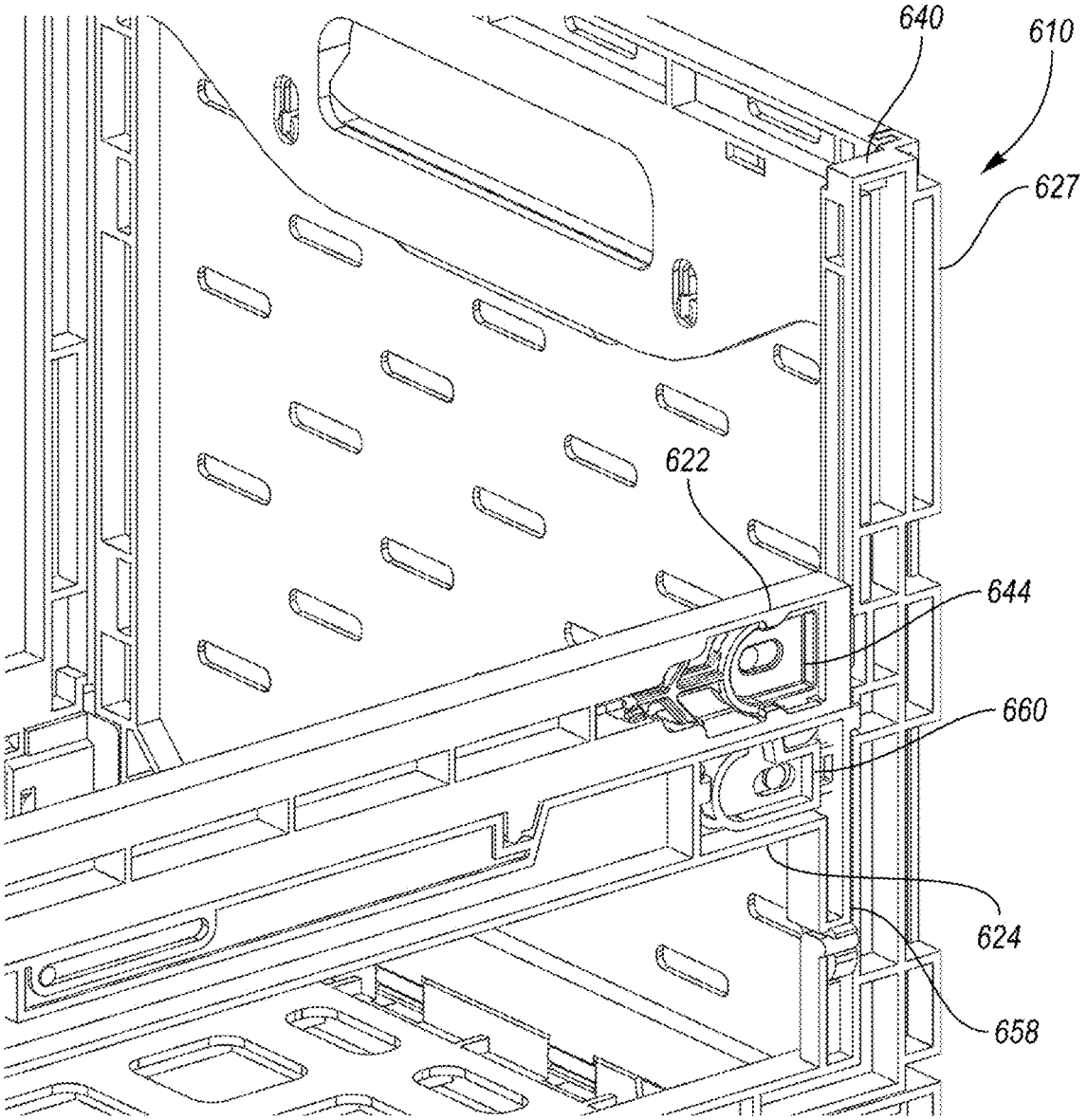
FIG. 65 is an enlarged view of a portion of the front wall of FIG. 62.
Figure 66:
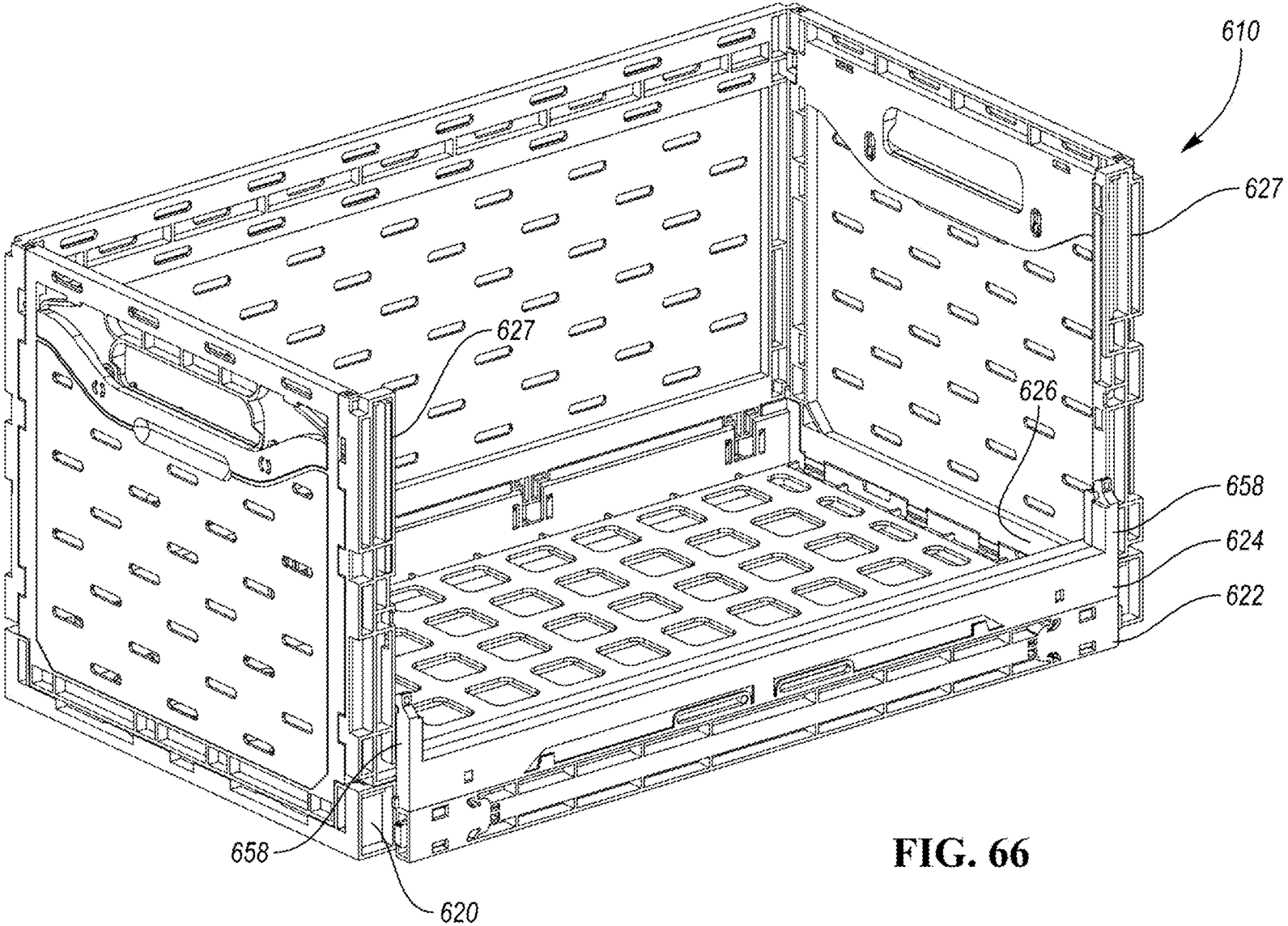
FIG. 66 shows the container of FIG. 59 with the front wall in the fully retracted position.

FIG. 65 is an enlarged view of one end of the front wall 15 of FIG. 62. The latches 660 are then released so that the mid beam 624 can be released from the frame 640 and pivot downward on the arms 658 which are pivotably connected to the vertical portions 627 of the frame 640 as shown in FIG. 66. The upper beam 622 and mid beam 624 are pivoted downward flush against the horizontal portion 626 of the frame 640 and the flange 620. FIG. 66 shows the container 610 with the front wall 615 in the retracted position. A large opening is defined by the frame 640 through which a consumer could retrieve items in the container 610. Notably, the front wall can be moved from the deployed, closed position (FIG. 59) to the fully retracted, open position (FIG. 66) even when an identical container 610 is stacked on the container 610.

Figure 67:
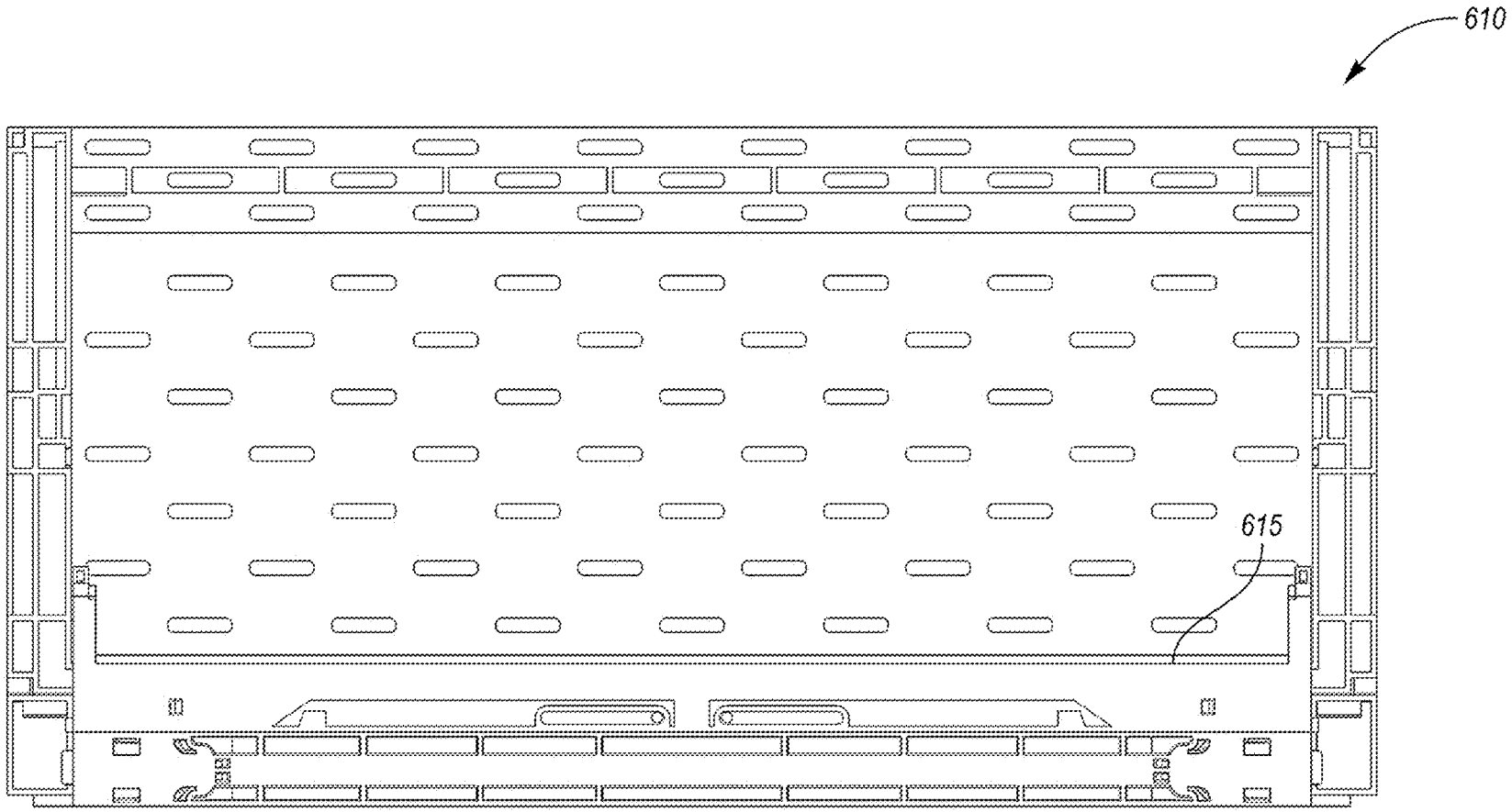
FIG. 67 is a front view of the container of FIG. 66.
Figure 68:
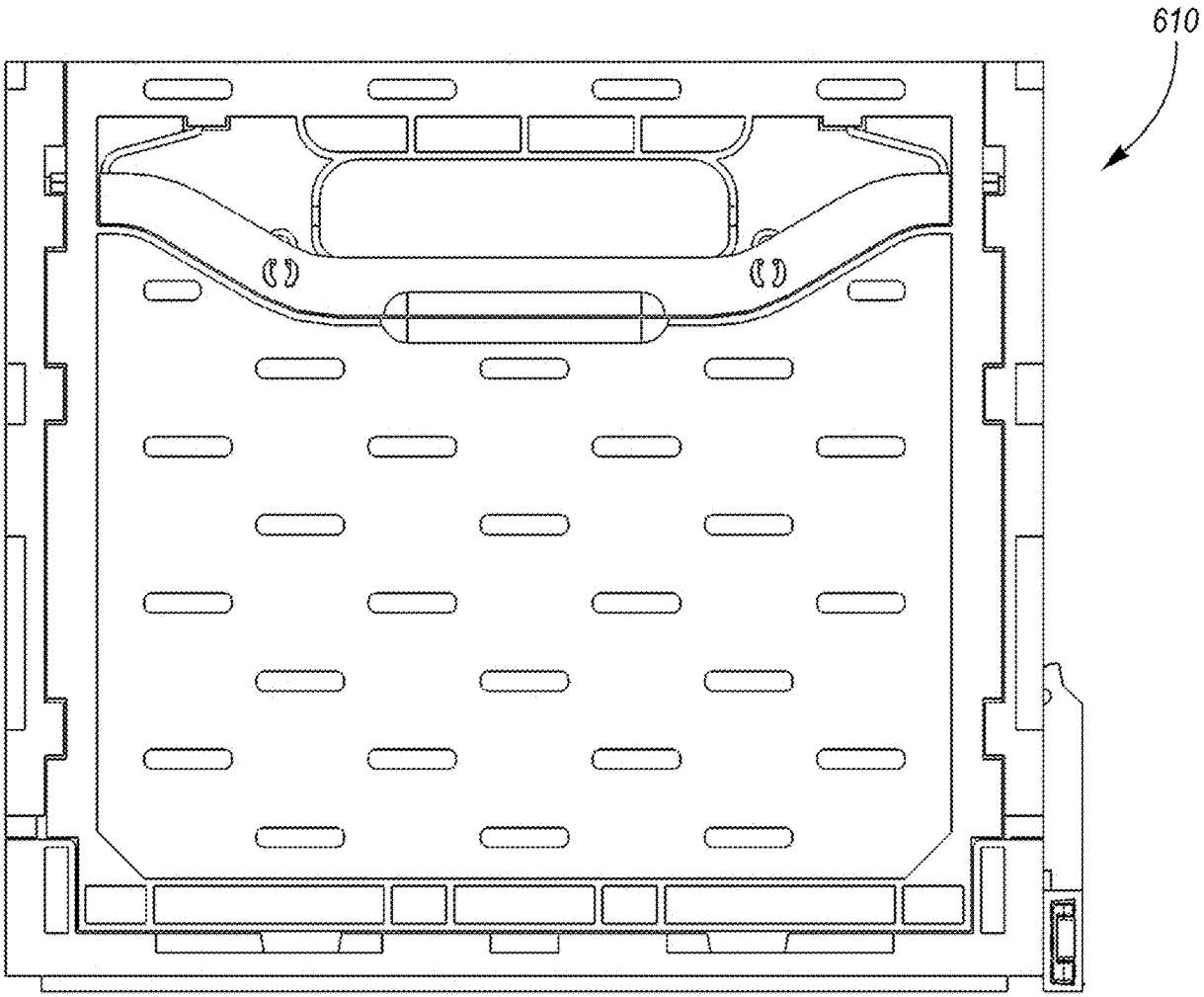
FIG. 68 is an end view of the container of FIG. 66.

FIG. 67 is a front view of the container 610 of FIG. 66. FIG. 68 is an end view of the container 610 of FIG. 66.

Figure 69:
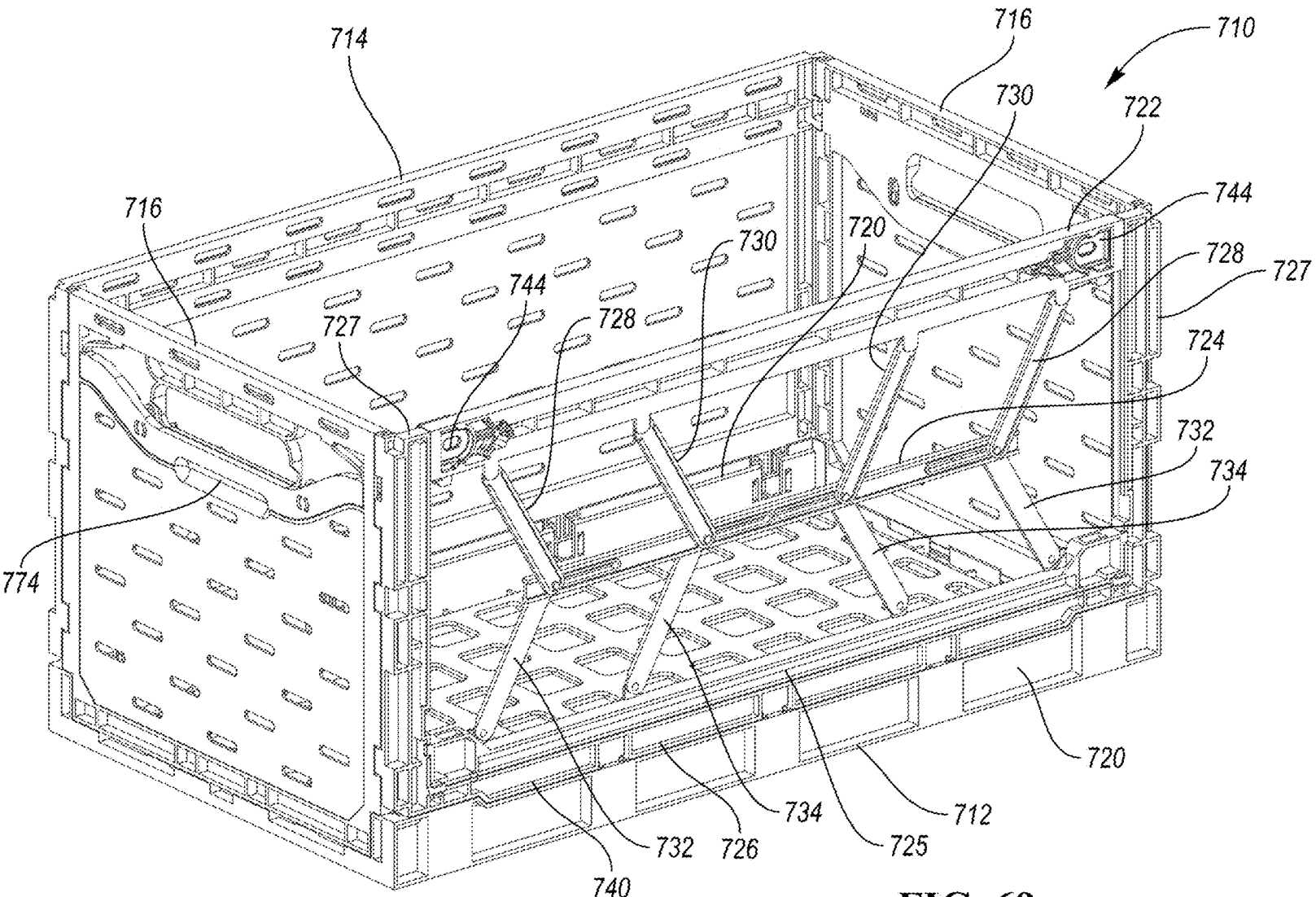
FIG. 69 shows a collapsible container according to an eight embodiment.

A collapsible container 710 according to an eighth embodiment is shown in FIG. 69. The collapsible container 710 includes a base 712. A rear wall 714 and a front wall 715 (or "first wall") are pivotably connected to front and rear upstanding flanges 720 at front and rear edges of the base 712. A pair of opposed end walls 716 extend upward from hinges pivotably connecting them to end edges of the base 712. Each end wall 716 includes a handle opening 718 therethrough.

The front wall 715 includes a U-shaped frame 740 secured to the end walls 716 by latches 742 mounted to the end walls 716 and releasable by a latch release handle 774. The U-shaped frame 740 includes a lower horizontal portion 726 and vertical portions 727 extending upward from opposite ends of the lower horizontal portion 726. The lower horizontal portion 726 is hingeably connected to the front upstanding flange 720.

The container 710 is a collapsible container, i.e. the walls 714, 715, 716 can be collapsed onto the base 712 when empty for efficient shipping and storage. In this embodiment, the end walls 716 are hingeably connected to the base 712 in a plane lower than are the front wall 715 and rear wall 714 and the end walls 716 are between the front wall 715 and the rear wall 714, so the end walls 716 would be collapsed onto the base 712 first (in either order), and then the front wall 715 and the rear wall 714 (in either order) would be collapsed onto the end walls 716.

The front wall 715 is also retractable. In the front wall 715, an upper beam 722 is slidably connected to both of the vertical portions 727 of the frame 740. Latches 744 selectively secure the upper beam 722 in place at the upper ends of the vertical portions 727 of the frame 740 as shown in FIG. 69, which is the deployed, closed position. A mid-beam 724 is suspended below the upper beam 722 as explained below. A lower beam 725 is pivotably connected to the horizontal portion 726 of the frame 740.

A plurality of arms are pivotably and slidably connected to the lower beam 725, the mid-beam 724 and/or the upper beam 722. A pair of upper outer arms 728 and a pair of upper inner arms 730 are pivotably connected to the upper beam 722 and pivotably and slidably connected to the mid-beam 724. The upper outer arms 728 and upper inner arms 730 are positioned on the exterior surface of the mid-beam 724. The upper outer arms 728 and upper inner arms 730 are angled inward as they extend downward from the upper beam 722 in the deployed, closed position shown in FIG. 69.

A pair of lower outer arms 732 and a pair of lower inner arms 734 are pivotably connected to the lower horizontal portion 726 of the frame 740 and pivotably and slidably connected to the mid-beam 724. The lower outer arms 732 are positioned on the interior side of the mid-beam 724 and connected to the lower ends of the upper outer arms 728 through the mid-beam 724. The lower inner arms 734 are positioned on an interior side of the mid-beam 724 and are connected to the lower ends of the upper inner arms 730 through the mid-beam 724. The lower inner arms 734 and the lower outer arms 732 angle inward as they extend upward from the horizontal portion 726 of the frame 740 in the deployed, closed position shown in FIG. 69.

The mid-beam 724 includes a plurality of elongated apertures 736, 738 therethrough. The upper outer arms 728 connect to the lower outer arms 732 through the elongated apertures 736 and are thus slidably and pivotably connected to the mid-beam 724. The upper inner arms 730 connect to the lower inner arms 734 through the elongated apertures 738 and are thus slidably and pivotably connected to the mid-beam 724.

Figure 70:
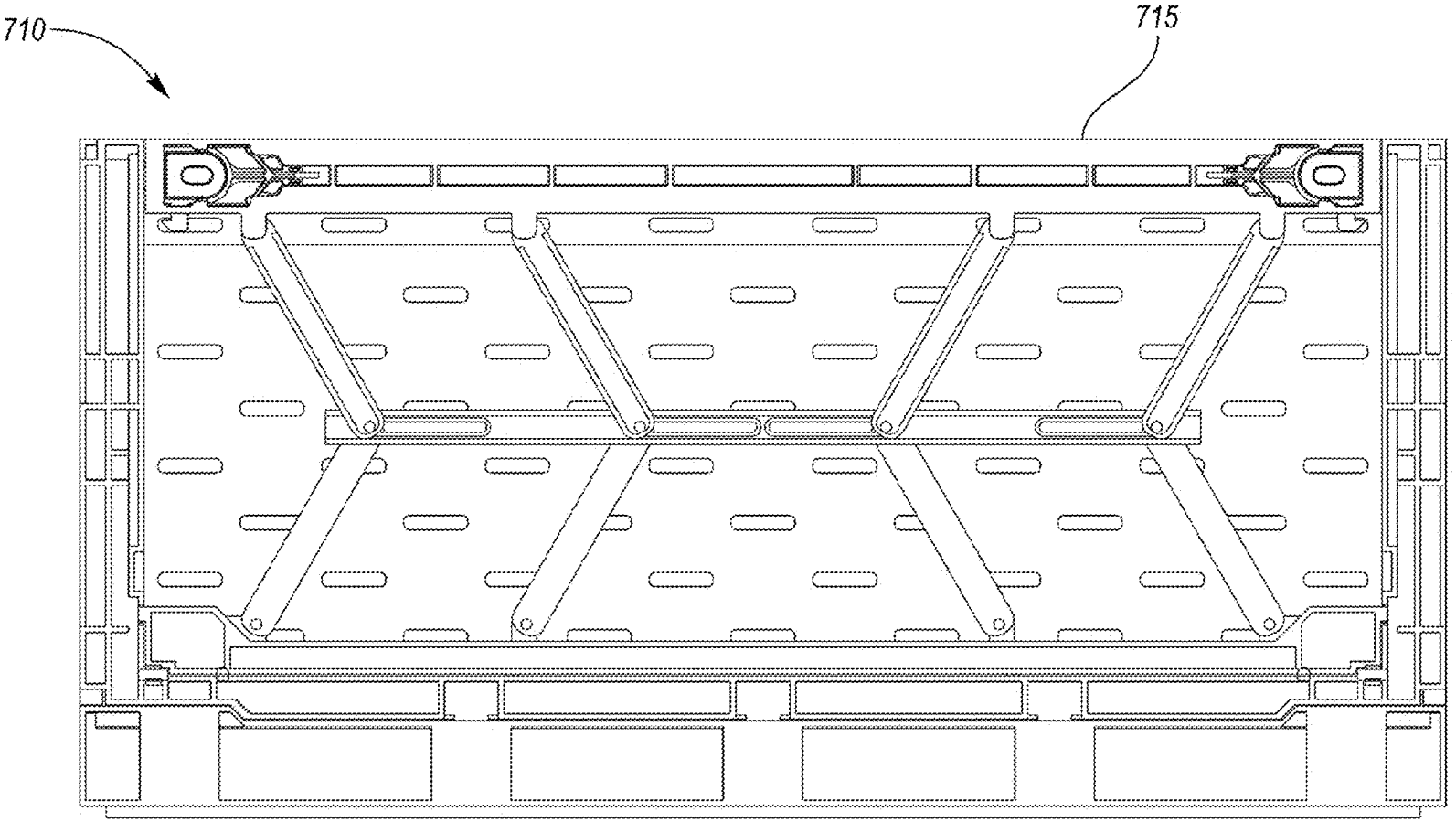
FIG. 70 shows a front view of the container of FIG. 69.
Figure 71:
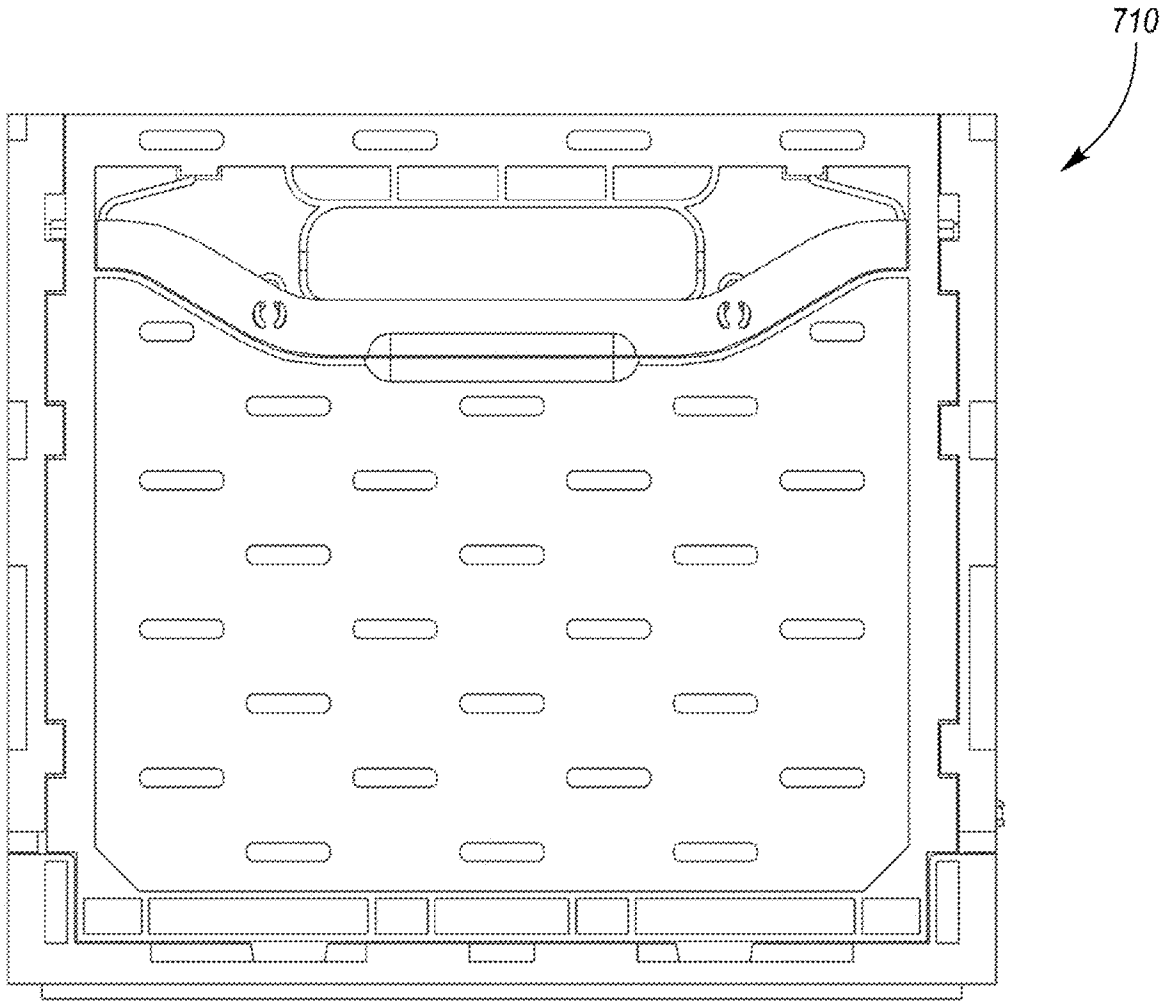
FIG. 71 is an end view of the container of FIG. 69.

FIG. 70 is a front view of the container 710 of FIG. 69, with the front wall 715 in the closed, deployed position. FIG. 71 is an end view of the container 710.

Figure 72:
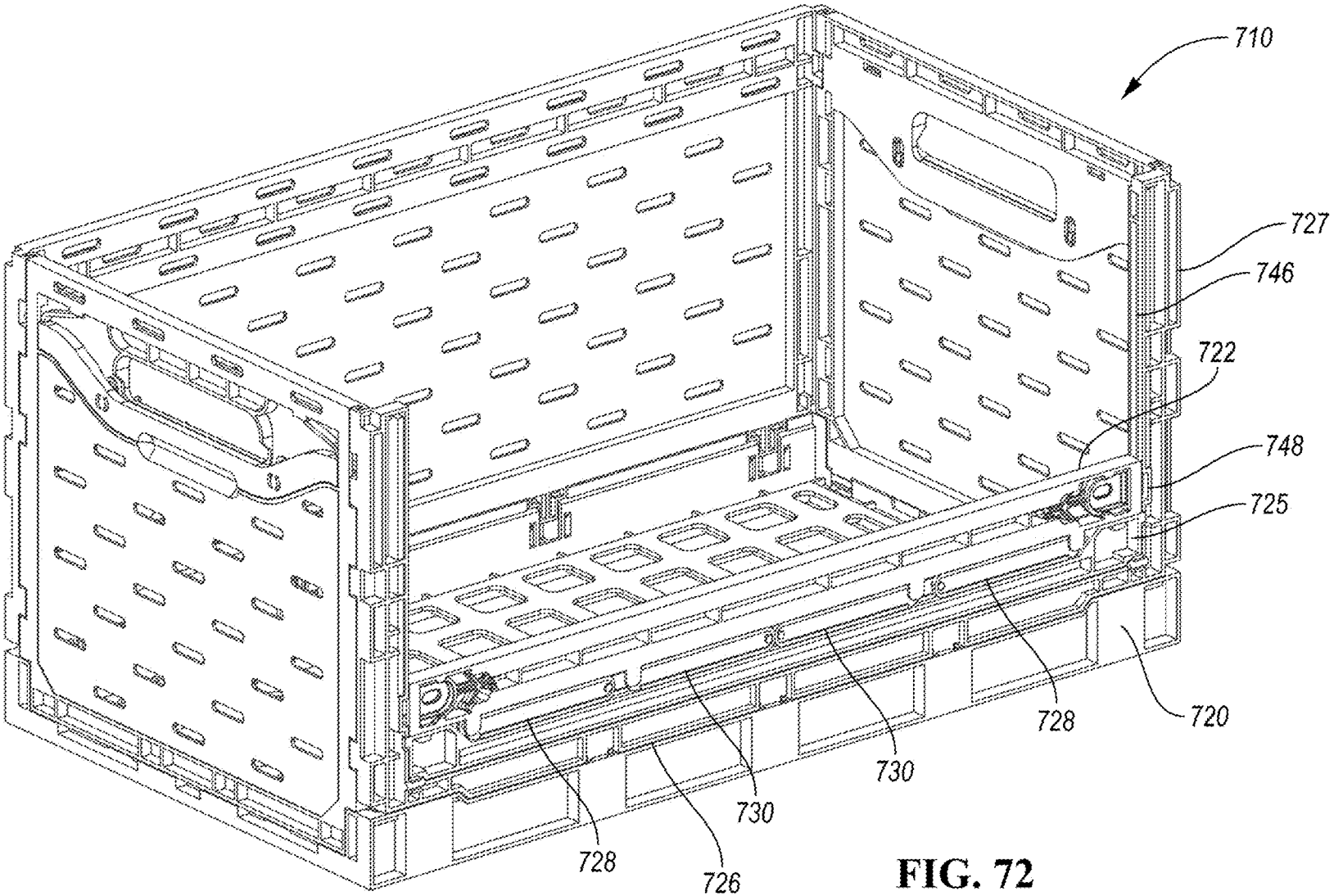
FIG. 72 is a perspective view of the collapsible container of FIG. 69 with the front wall in a partially retracted position.
Figure 73:
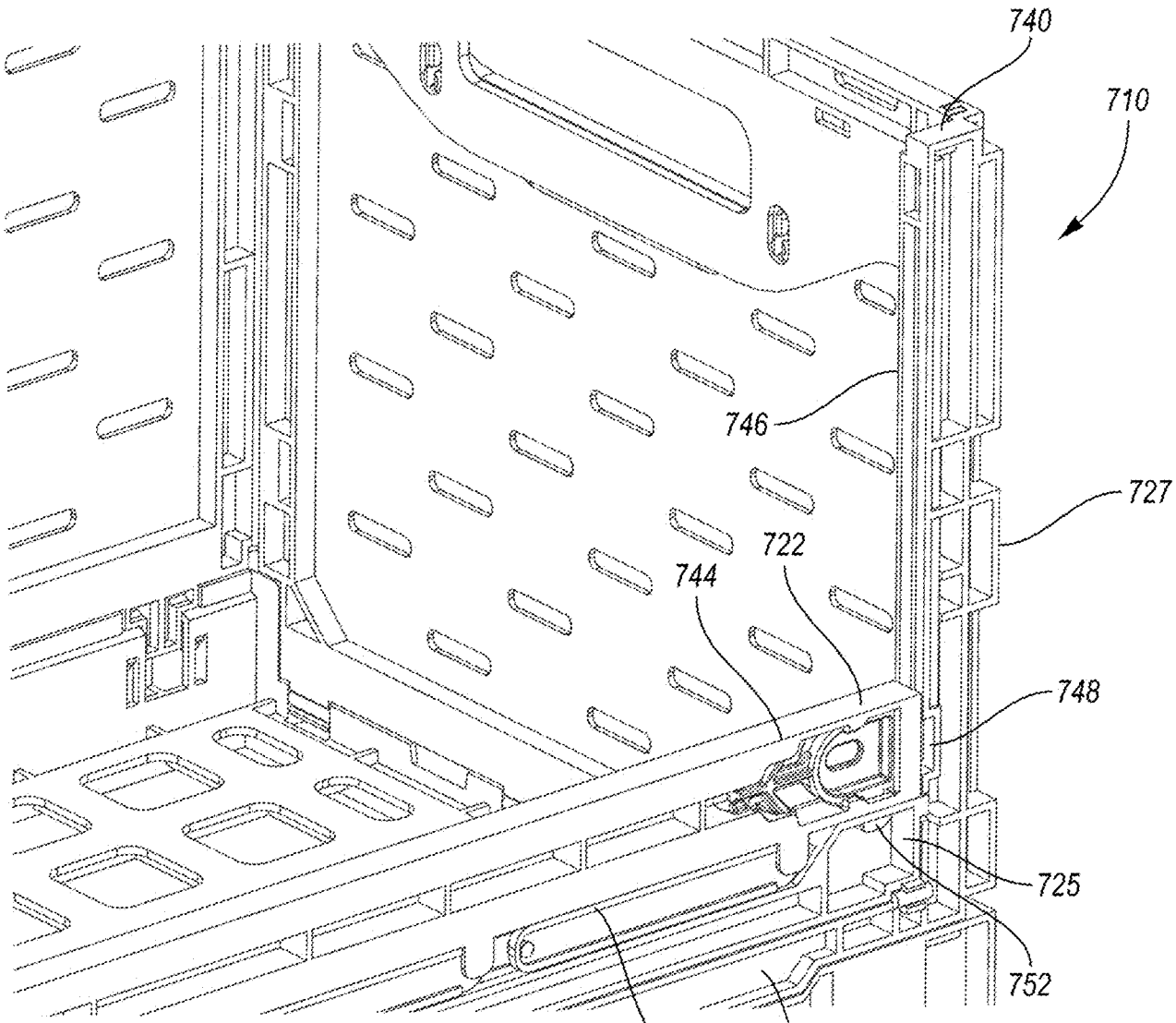
FIG. 73 is an enlarged view of a portion of the front wall of the container of FIG. 72.

FIG. 72-73 shows the front wall 715 in a partially retracted position. The upper beam 722 is slid downward relative to the frame 740. After releasing the latches 744, the upper beam 722 is slid downward in the tracks 746 formed in the vertical portions 727 of the frame 740. The arms 728, 730, 732, 734 pivot and slide until they are in a horizontal plane parallel to the base 712 on either side of the mid-beam 724. The latches 744 are then secured to the lower beam 725 via the latch portion 752 (FIG. 73).

Figure 74:
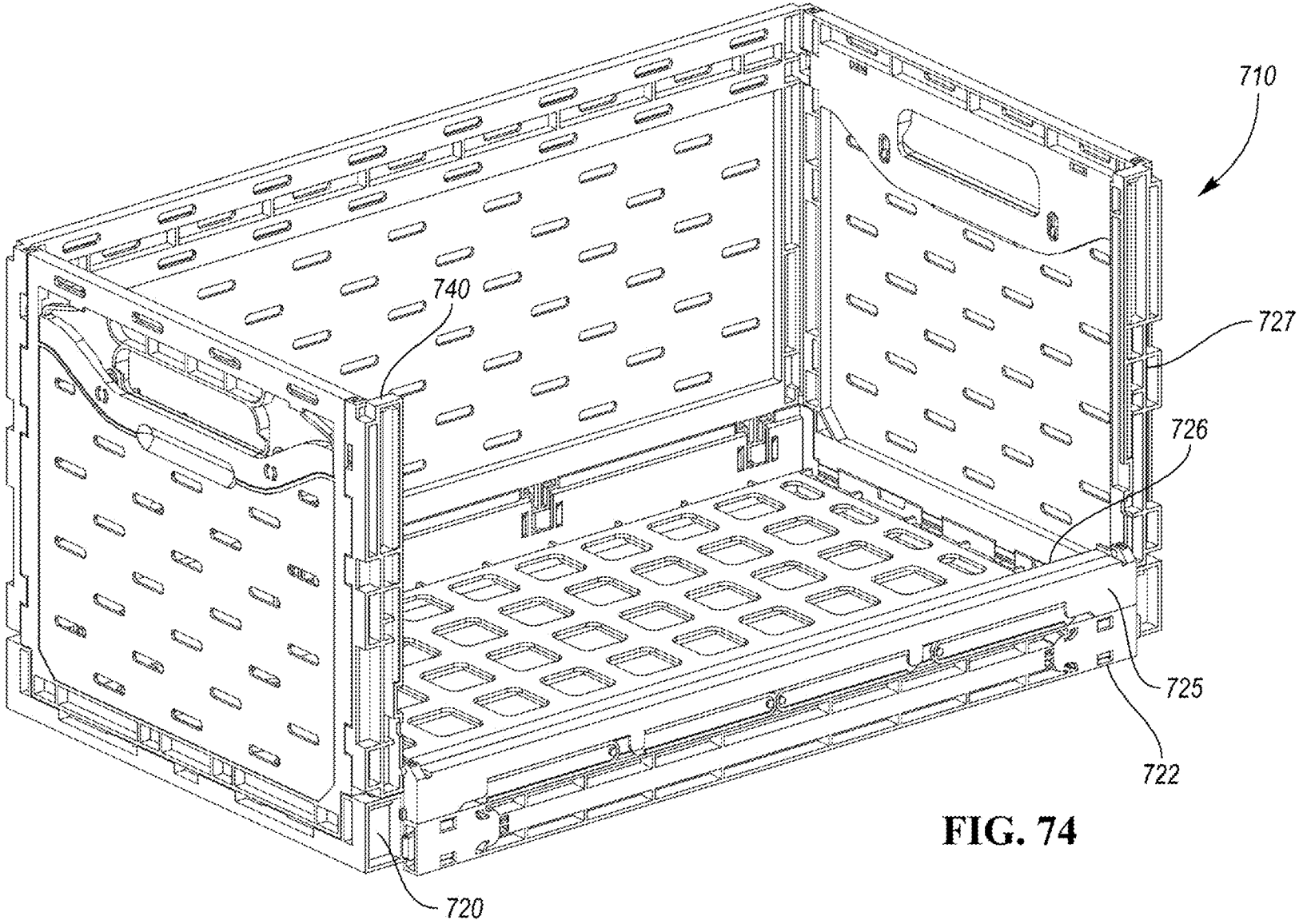
FIG. 74 is a perspective view of a collapsible container of FIG. 69 with the front wall in the fully retracted position.
Figure 75:
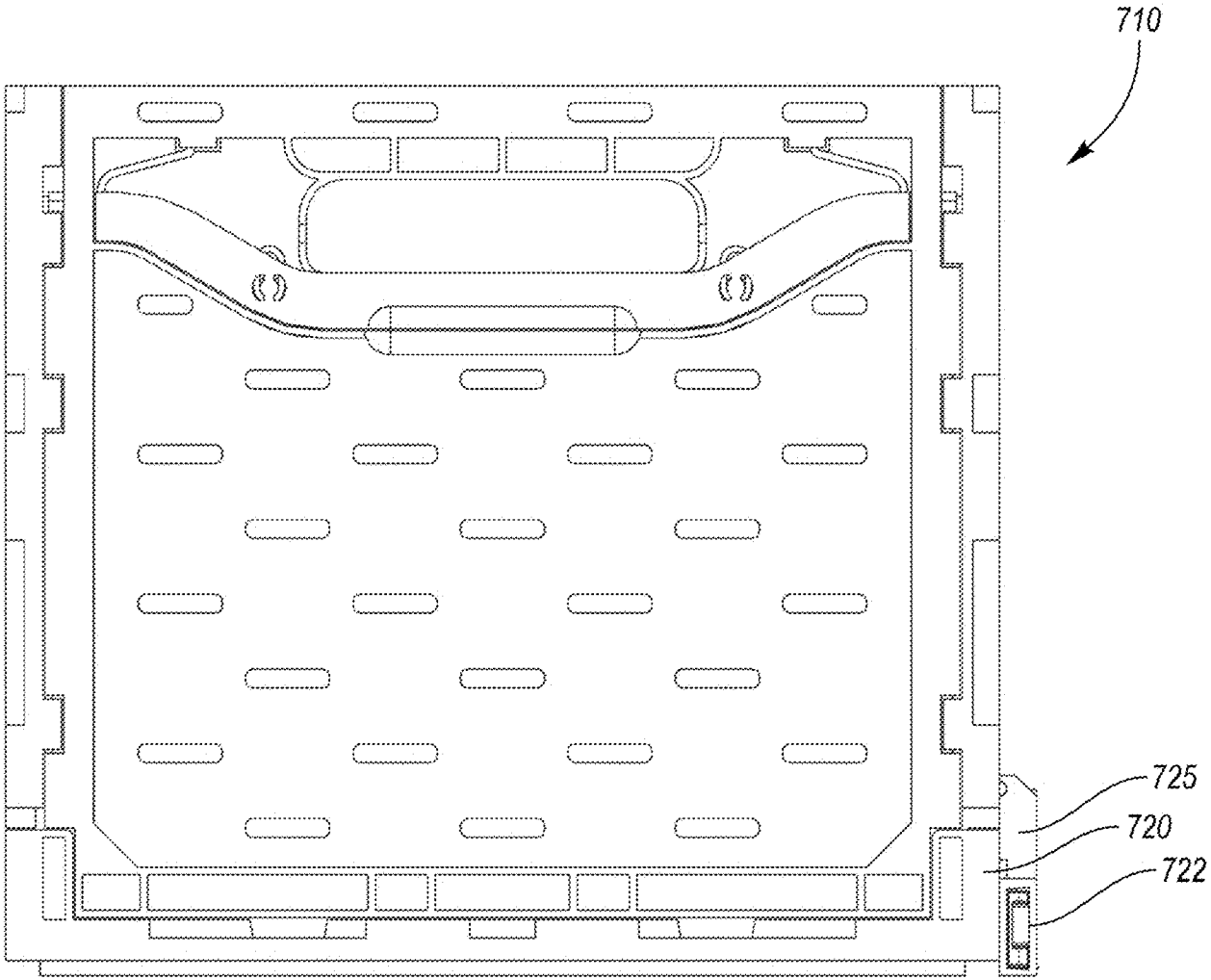
FIG. 75 is an end view of the container of FIG. 74.

When the upper beam 722 is aligned with the opening 748 in the track 746, as shown in FIG. 73, the upper beam 722, mid-beam 724, and lower beam 725 can be pivoted outward and downward as shown in FIG. 74. This is the fully retracted position. The upper beam 722, mid-beam 724, and lower beam 725 are flush with the outer surfaces of the horizontal portion 726 of the frame 740 and the front flange 720 as shown in FIG. 75.

Figure 76:
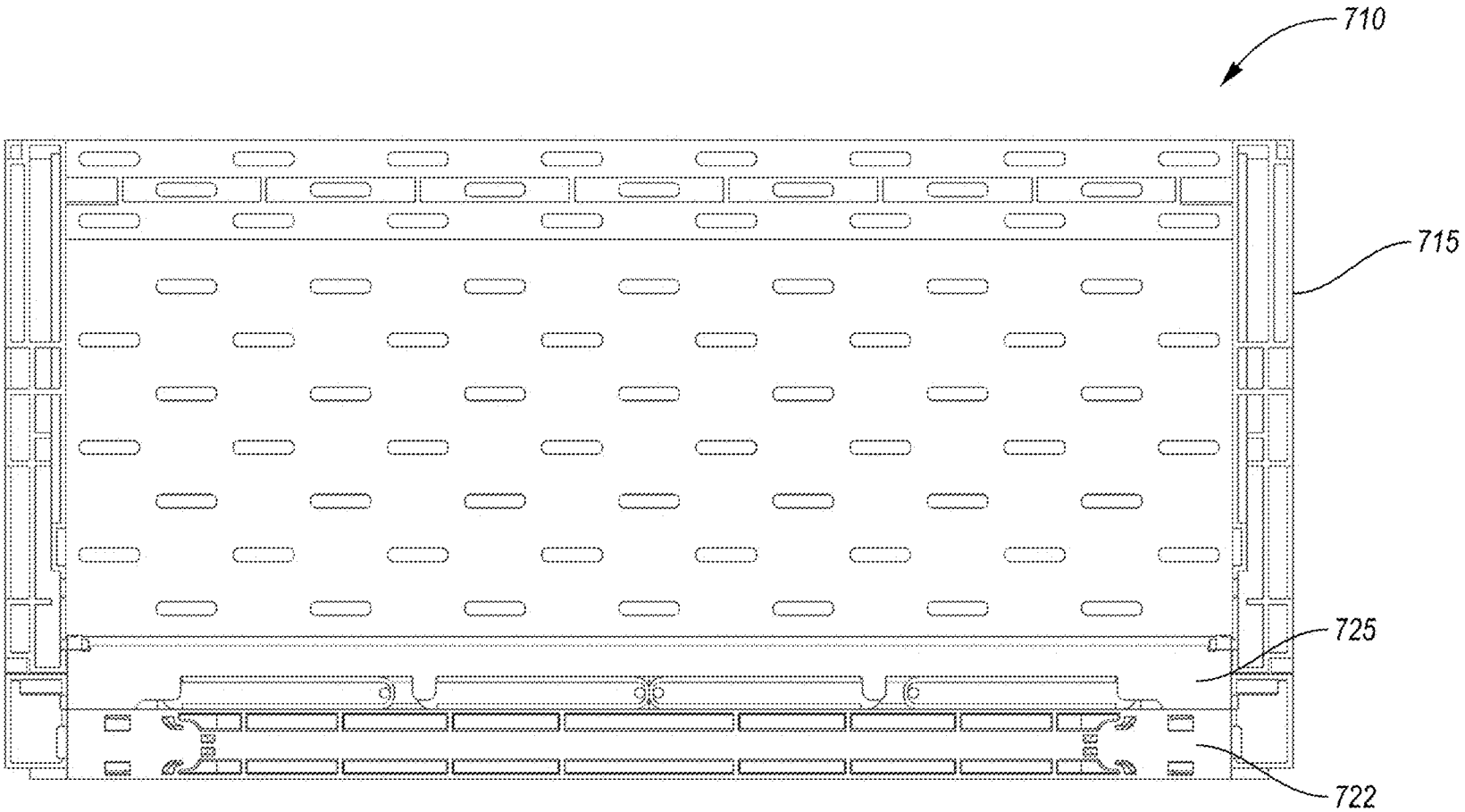
FIG. 76 is a front view of the container of FIG. 74.

In the retracted configuration, goods can be removed from the container 710 even when another loaded container 710 is stacked thereon. Notably, the front wall 715 can be retracted even when another loaded container 710 is already stacked thereon. FIG. 76 is a front view of the container 710 with the front wall 715 in the retracted position.

Figure 77:
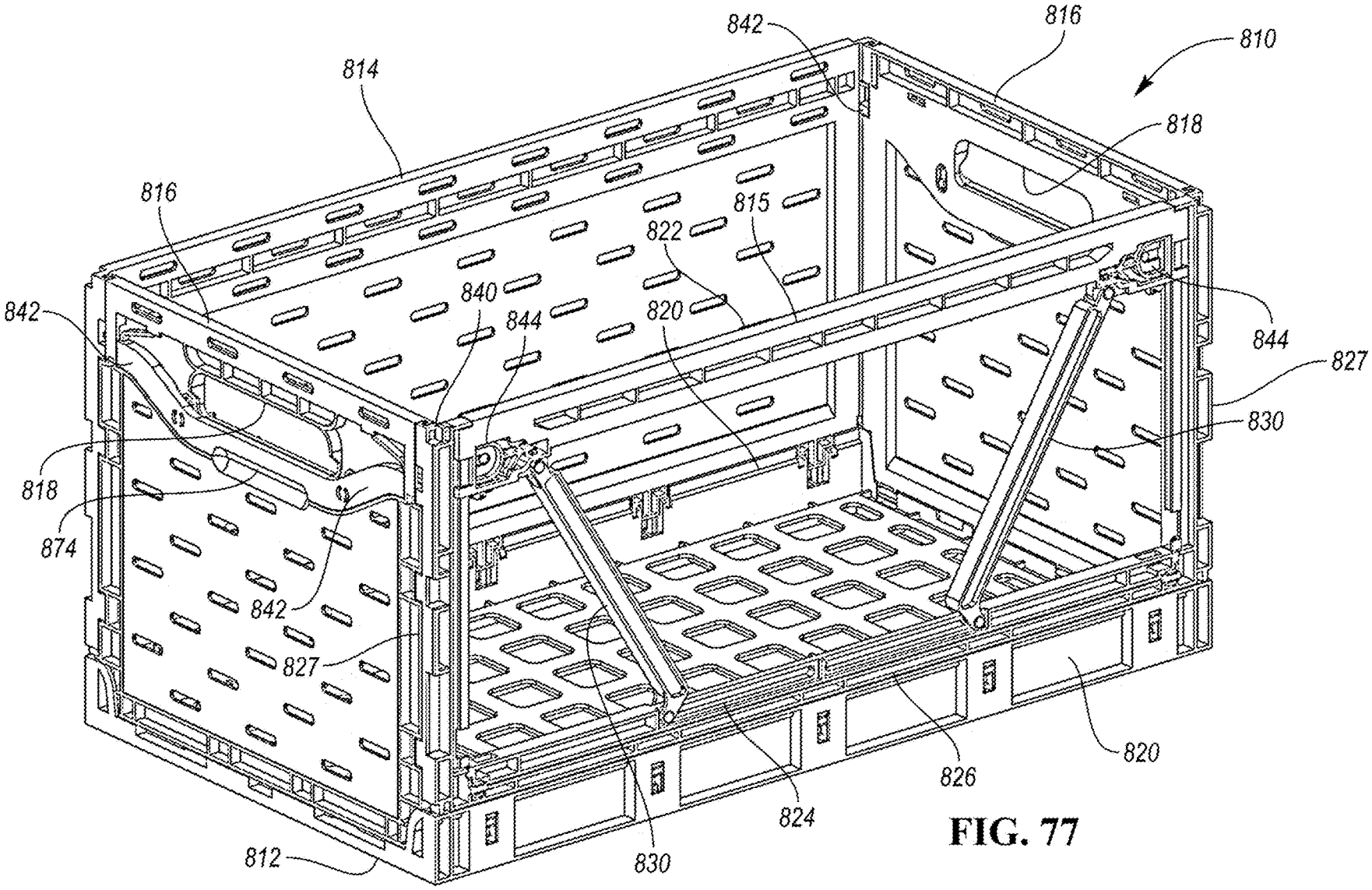
FIG. 77 is a perspective view of a collapsible container according to a ninth embodiment.

A collapsible container 810 according to a ninth embodiment is shown in FIG. 77. The collapsible container 810 includes a base 812. A rear wall 814 and a front wall 815 (or "first wall") are pivotably connected to front and rear upstanding flanges 820 at front and rear edges of the base 812. A pair of opposed end walls 816 extend upward from hinges pivotably connecting them to end edges of the base 812. Each end wall 816 includes a handle opening 818 therethrough.

The front wall 815 includes a U-shaped frame 840 secured to the end walls 816 by latches 842 mounted to the end walls 816 and releasable by lifting a latch release handle 874. The U-shaped frame 840 includes a lower horizontal portion 826 and vertical portions 827 extending upward from opposite ends of the lower horizontal portion 826. The lower horizontal portion 826 is hingeably connected to the front upstanding flange 820.

The container 810 is a collapsible container, i.e. the walls 814, 815, 816 can be collapsed onto the base 812 when empty for efficient shipping and storage. In this embodiment, the end walls 816 are hingeably connected to the base 812 in a plane lower than are the front wall 815 and rear wall 814 and the end walls 816 are between the front wall 815 and the rear wall 814, so the end walls 816 would be collapsed onto the base 812 first (in either order), and then the front wall 815 and the rear wall 814 (in either order) would be collapsed onto the end walls 816.

The front wall 815 is also retractable. In the front wall 815, an upper beam 822 is slidably connected to both of the vertical portions 827 of the frame 840. Latches 844 selectively secure the upper beam 822 in place at the upper ends of the vertical portions 827 of the frame 840 as shown in FIG. 77, which is the deployed, closed position. A lower beam 824 is hingeably connected to the lower horizontal portion 826 of the frame 840.

A plurality of arms 830 are pivotably and slidably connected to the lower beam 824 and pivotably connected to the upper beam 822. In this example, a pair of arms 830 are pivotably connected to the upper beam 822 and pivotably and slidably connected to the lower beam 824. The arms 828 are angled inward toward one another as they extend downward from the upper beam 822 in the deployed, closed position shown in FIG. 77.

Figure 78:
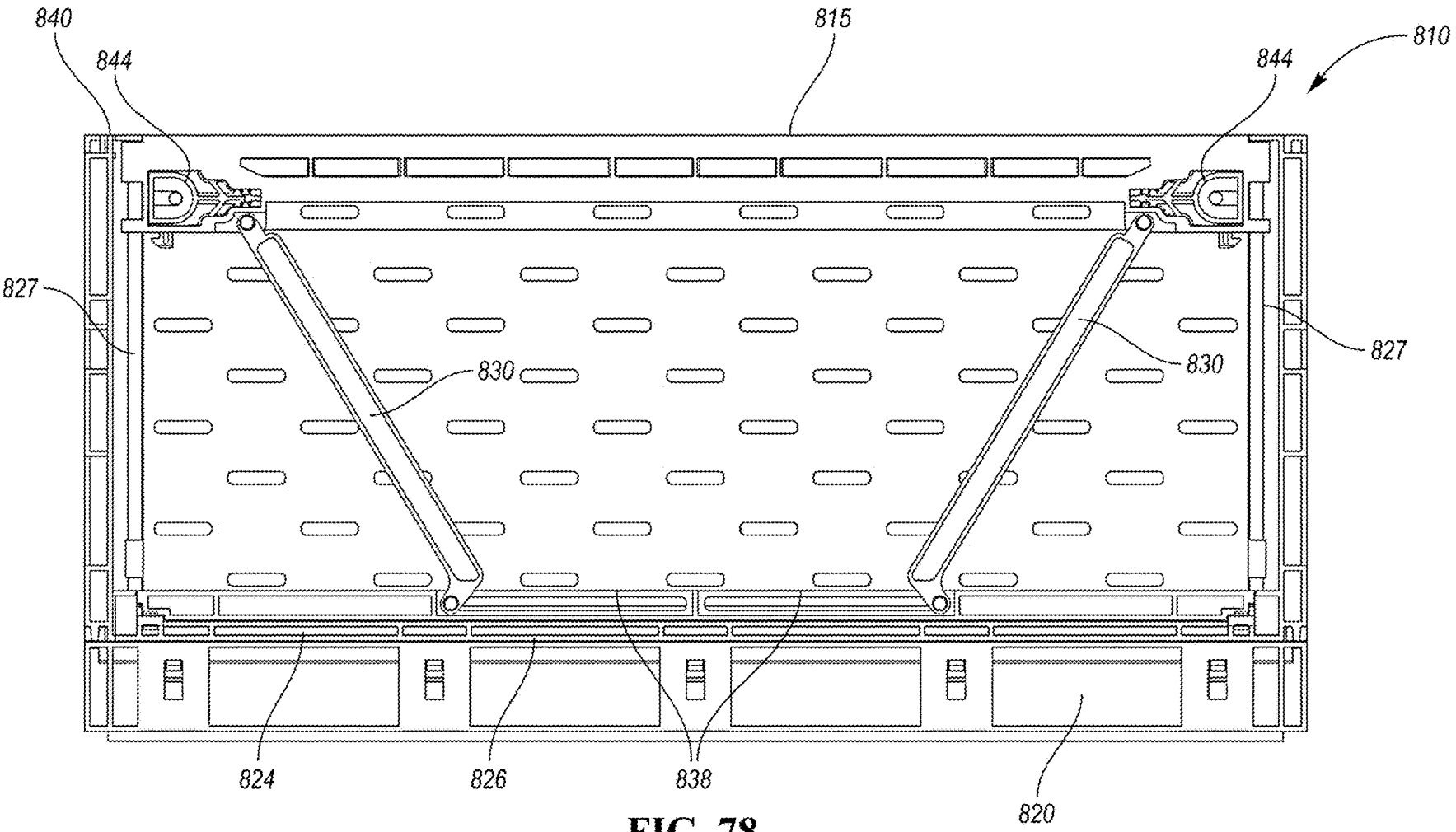
FIG. 78 is a front view of the collapsible container of FIG. 78.

FIG. 78 is a front view of the container of FIG. 77. Lower ends of the arms 828 are spaced apart from one another by a distance greater than a distance between the lower end of each arm 828 and the closer vertical portion. The lower beam 824 includes a pair of horizontal elongated apertures 838 therethrough. The lower ends of the arms 830 have pins captured in the elongated apertures 838 and are thus slidably and pivotably connected to the lower beam 824.

Figure 79:
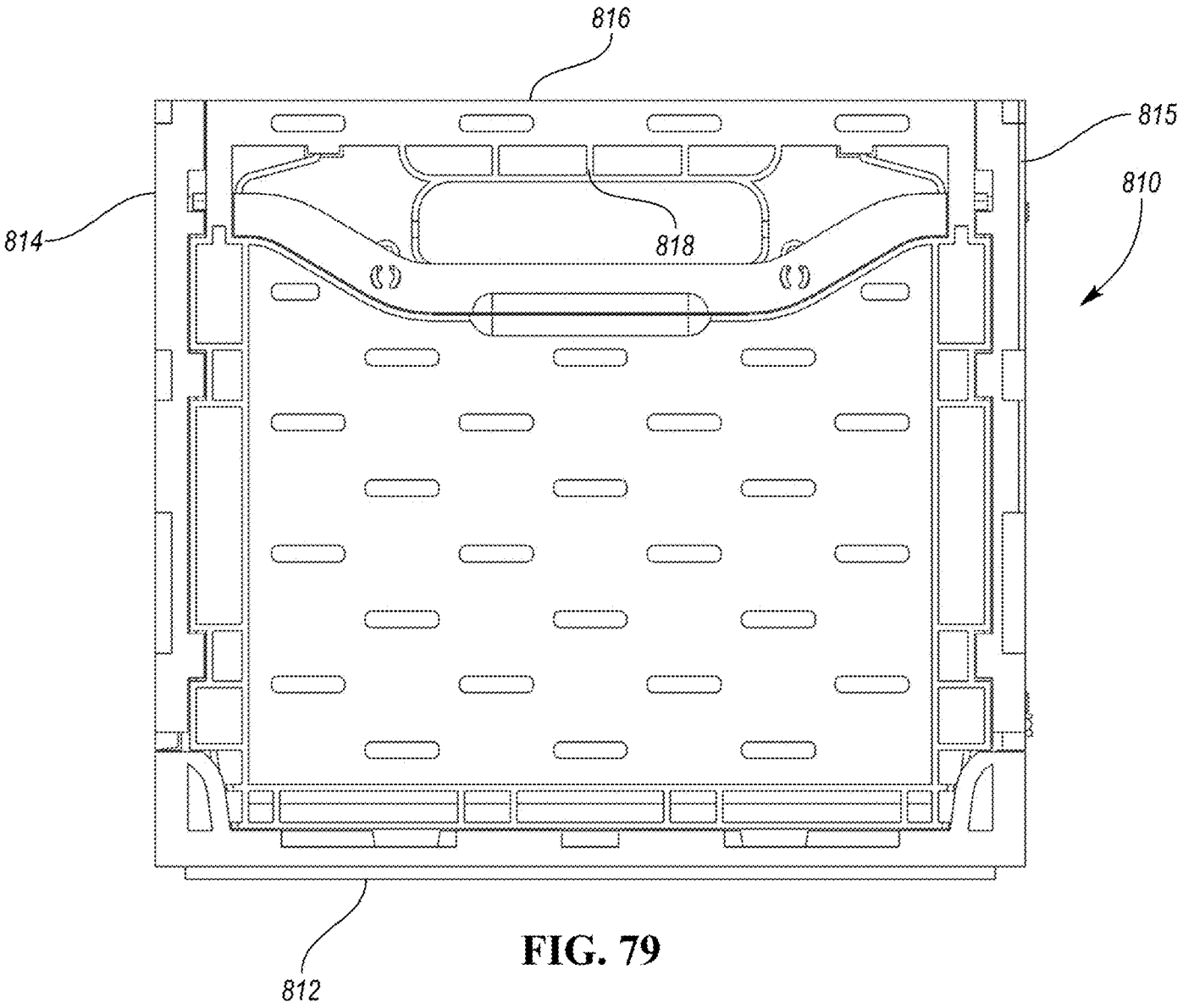
FIG. 79 is an end view of the container of FIG. 77.

FIG. 79 is an end view of the container 810 of FIG. 77.

Figure 80:
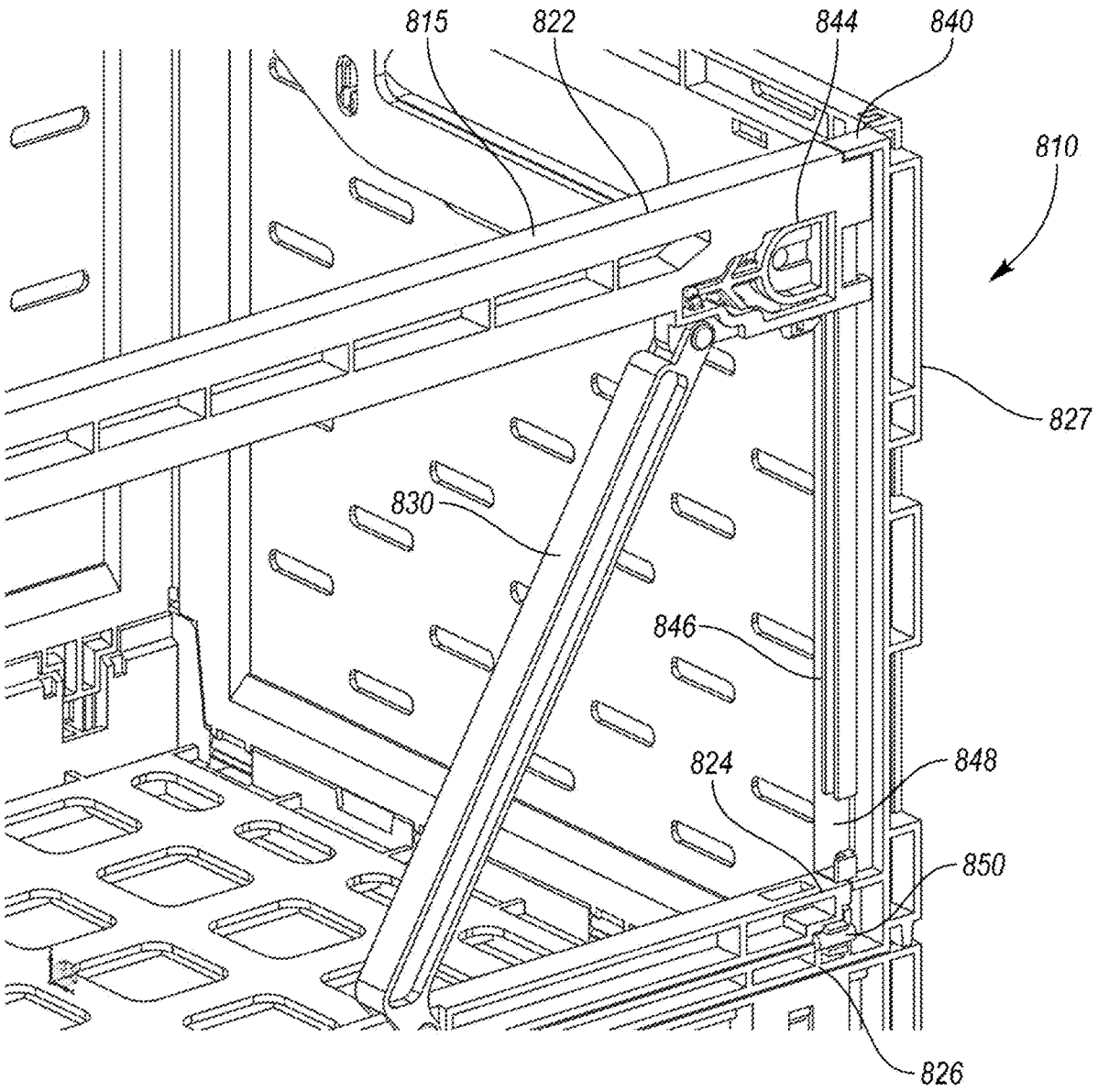
FIG. 80 is an enlarged perspective view one end of the front wall of the container of FIG. 77.

FIG. 80 is an enlarged perspective view of one end of the front wall 815 of FIG. 77. The other end of the front wall 815 would be mirror image. The vertical portion 827 includes a vertical track 846 in which the upper beam 822 is slidably captured. At the bottom of the vertical track 846 is an opening 848 toward the front of the container 810. The lower beam 824 is connected by a hinge 850 to the lower horizontal portion 826 of the frame 840.

Figure 81:
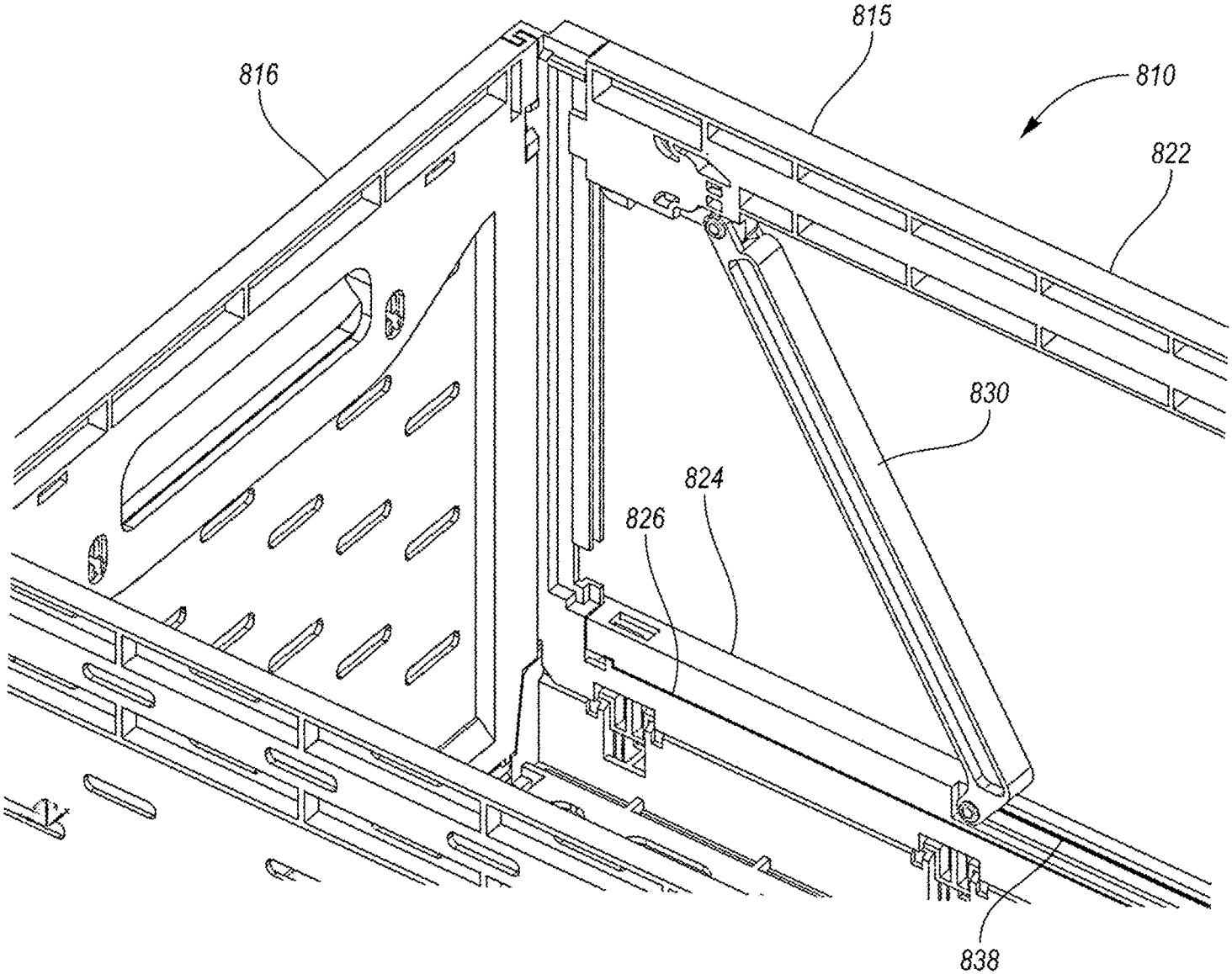
FIG. 81 is an inner view of the inner corner of a front wall of FIG. 80.

FIG. 81 is an inner view of the inner corner of the front wall 815 of FIG. 77.

Figure 82:
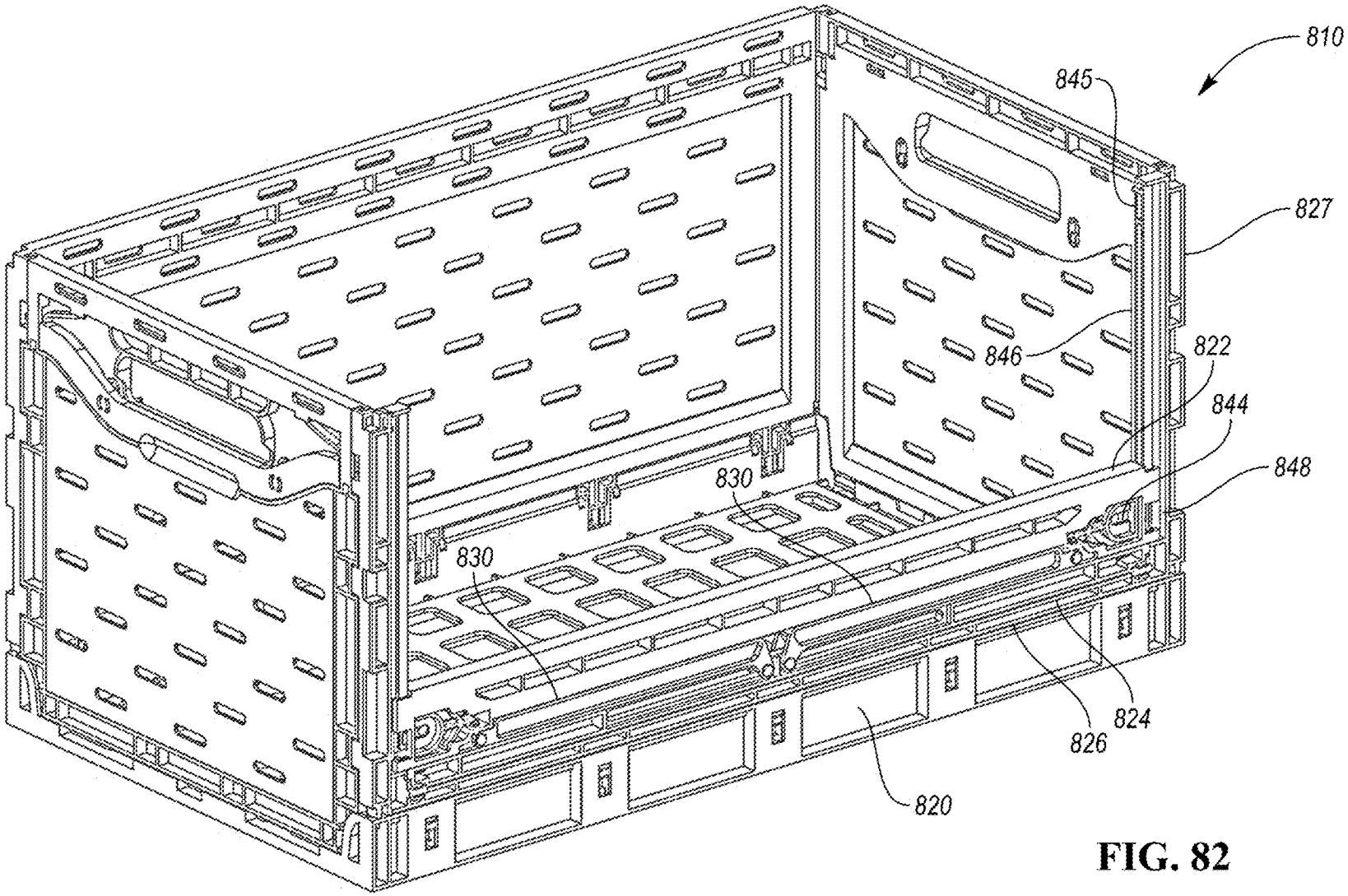
FIG. 82 is a perspective view of a container of FIG. 77 with the front wall in a partially retracted position.

In FIG. 82, the latches 844 have been released from complementary apertures 845 formed in the vertical portions 827 of the frame 840. The upper beam 822 is then slid downward in the tracks 846 formed in the vertical portions 827 of the frame 840. The arms 830 pivot and slide until they are in a horizontal plane (parallel to the base 812) on the lower beam 824.

Figure 83:
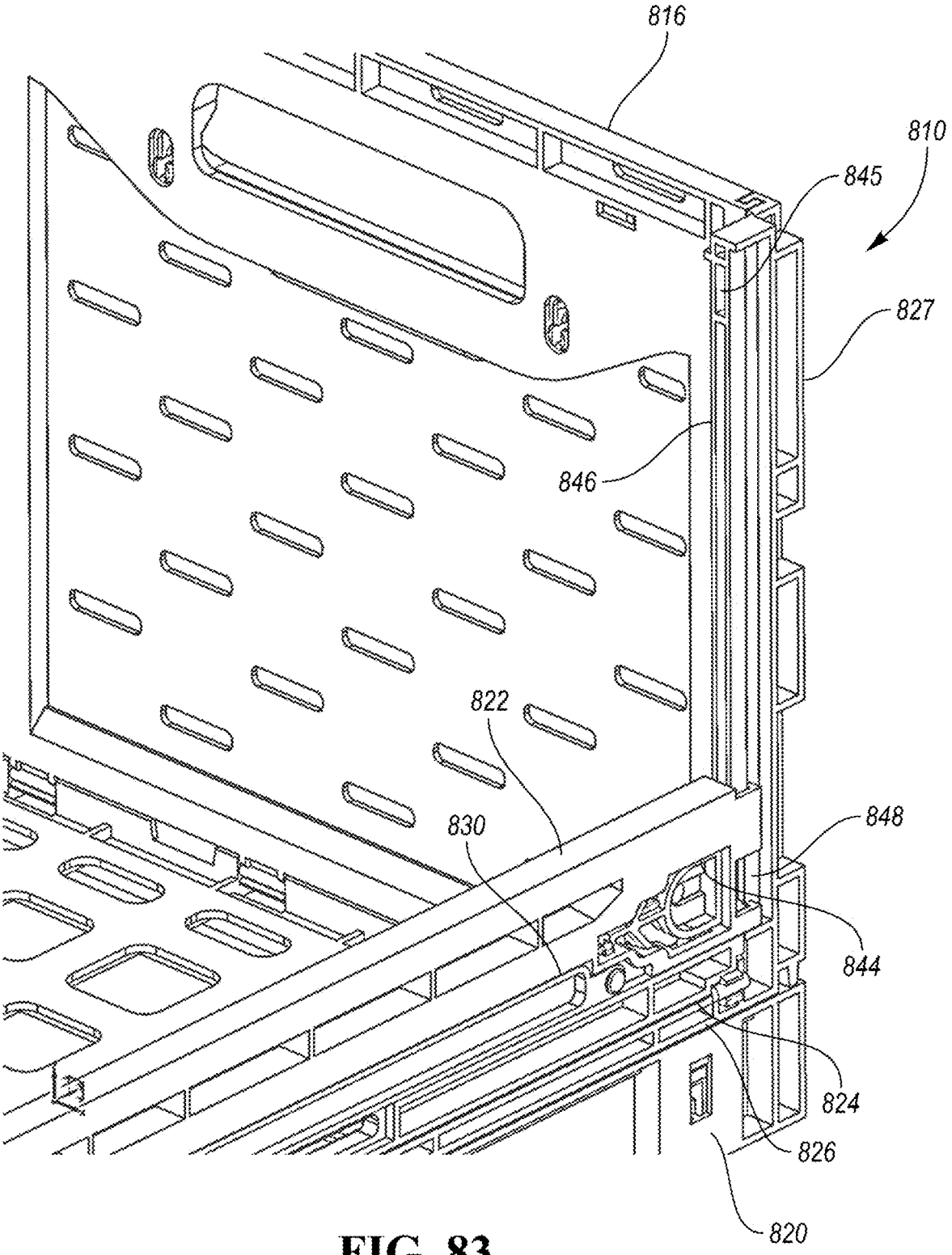
FIG. 83 is an enlarged view of a portion of the front wall of the container of FIG. 82.
Figure 84:
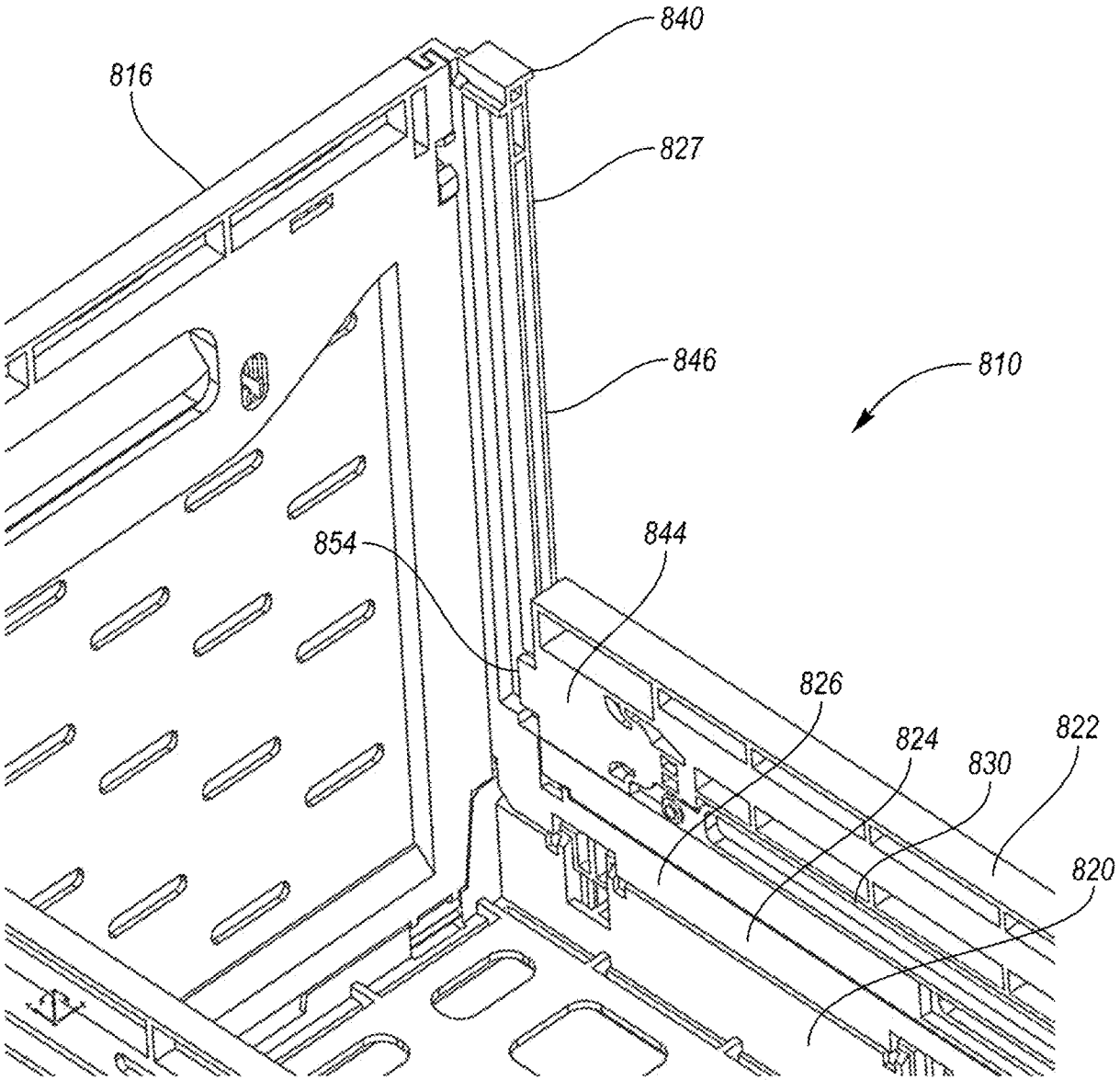
FIG. 84 is an interior perspective view of the portion of the front wall of FIG. 83.

FIGS. 83 and 84 are enlarged views of one end of the front wall 815 of FIG. 82. The latch 844 is slid down in the track 846 until the tab 854 of the upper beam 822 aligns with the opening 848 in the track 846.

Figure 85:
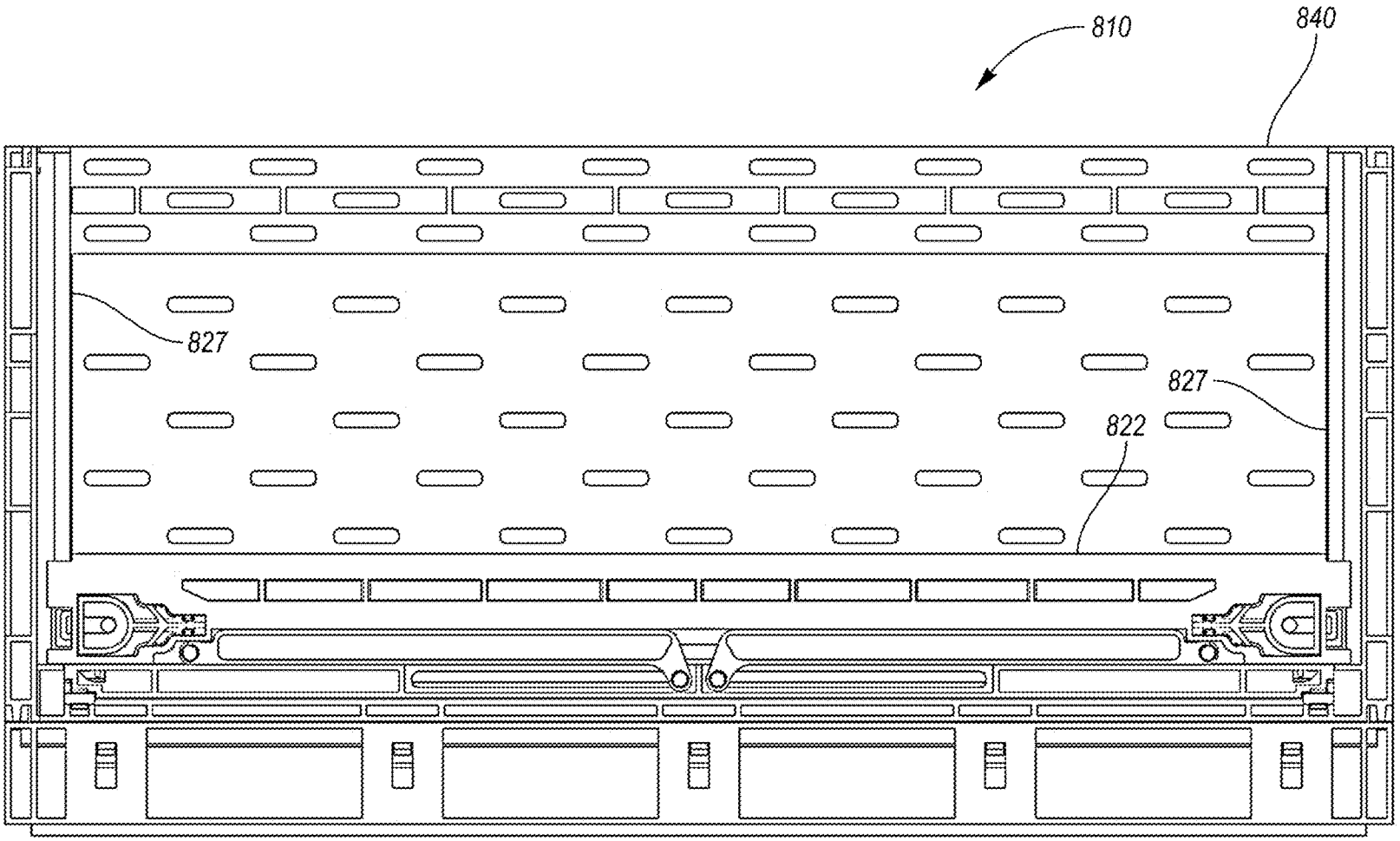
FIG. 85 is a front view of the container of FIG. 82.
Figure 86:
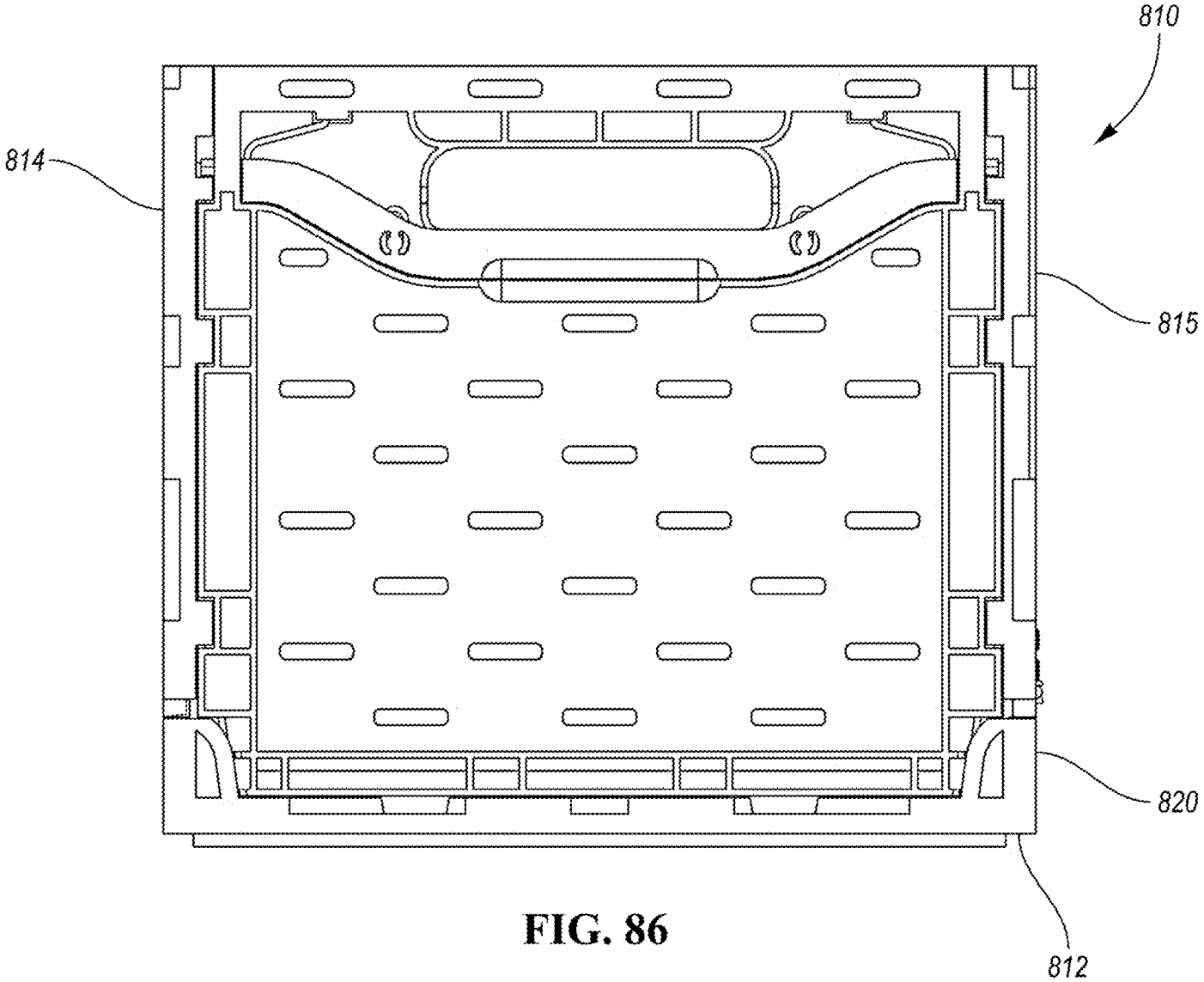
FIG. 86 is an end view of the container of FIG. 82.

FIG. 85 is a front view of the container 810 of FIG. 82. FIG. 86 is an end view of the container 810 of FIG. 82.

Figure 87:
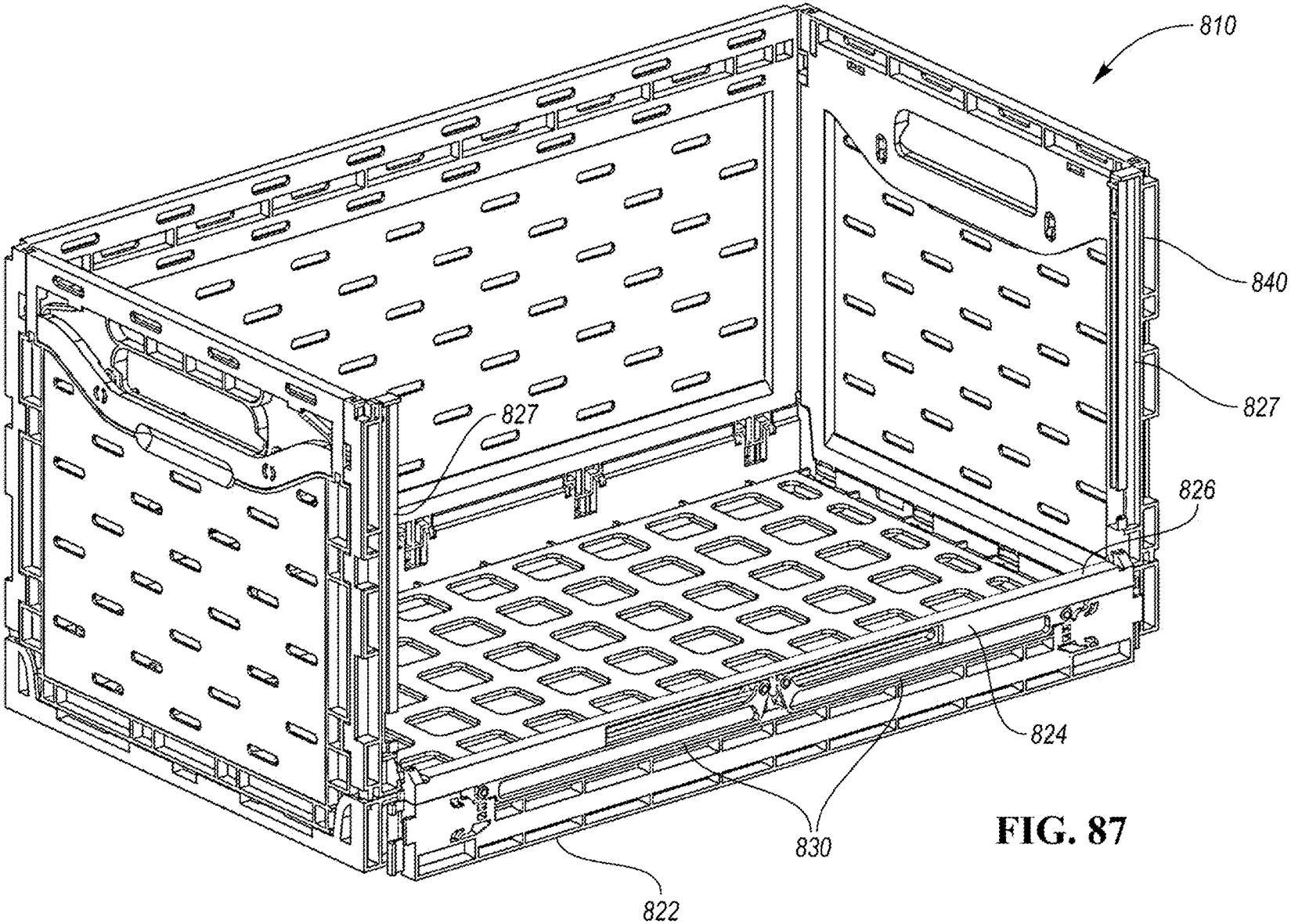
FIG. 87 shows the container of FIG. 82 with the front wall in the fully retracted position.
Figure 88:
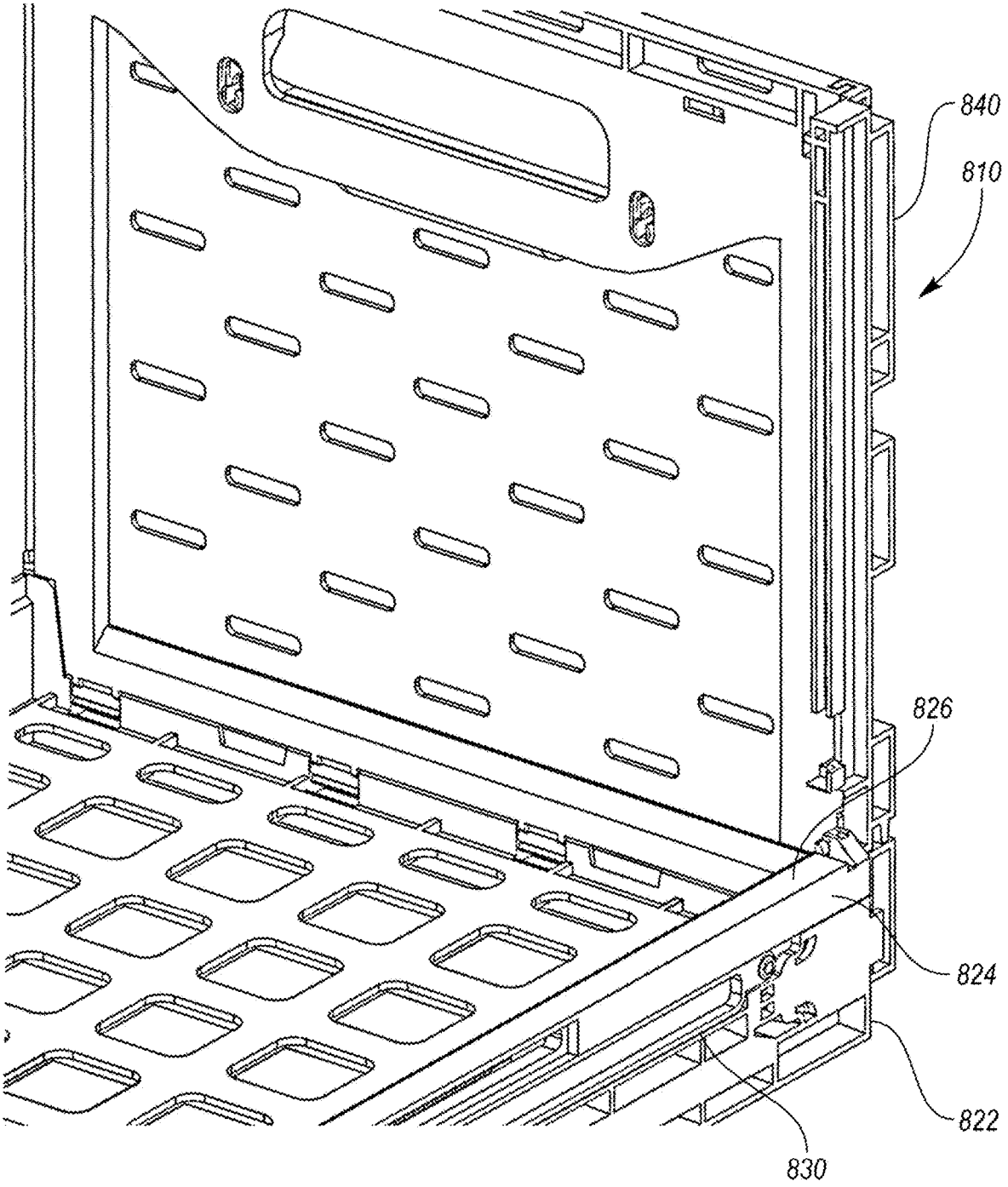
FIG. 88 is an enlarged view of one corner of the front wall of the container of FIG. 87.
Figure 89:
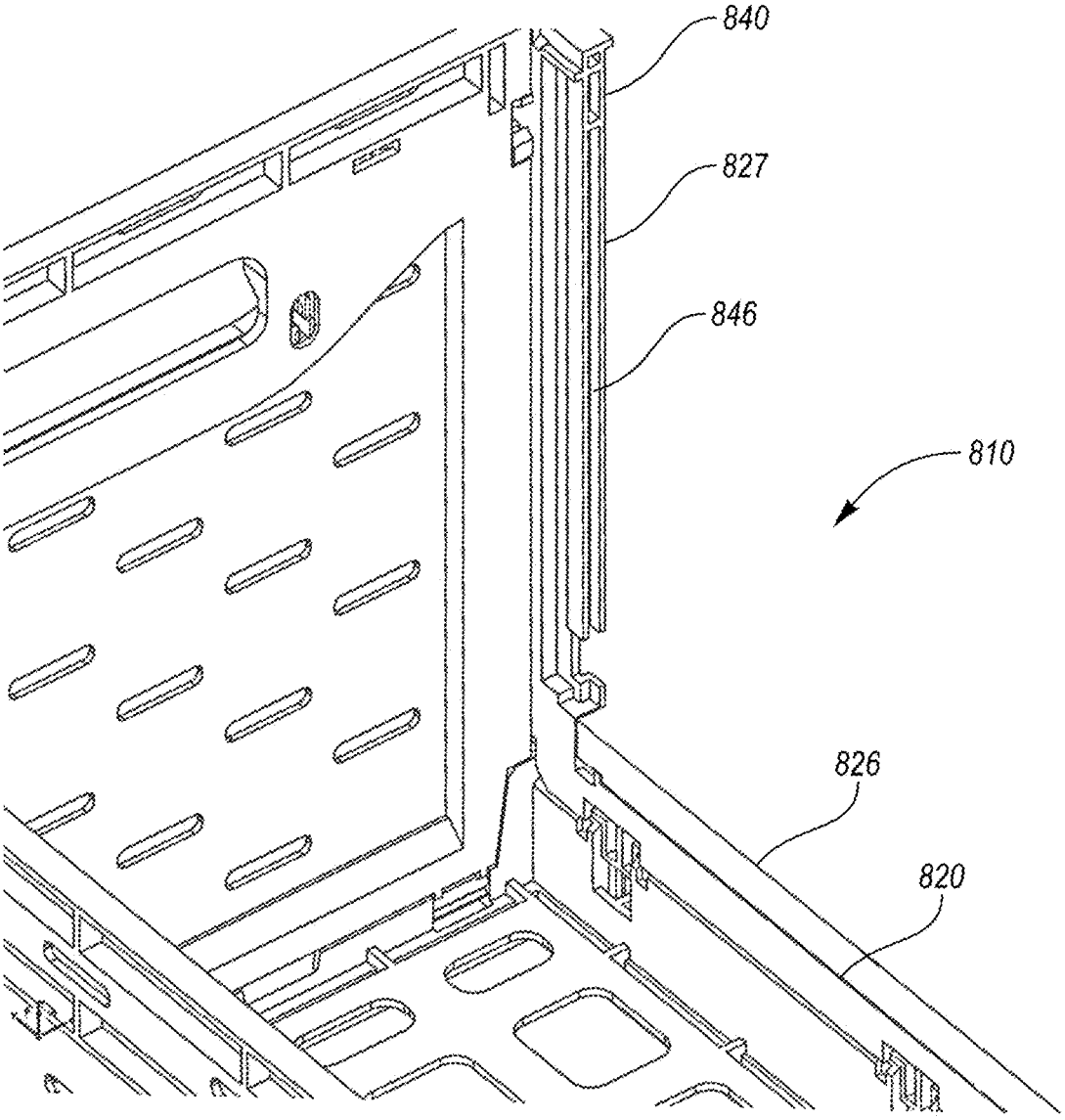
FIG. 89 is an inner view of the corner of the container of FIG. 87.
Figure 90:
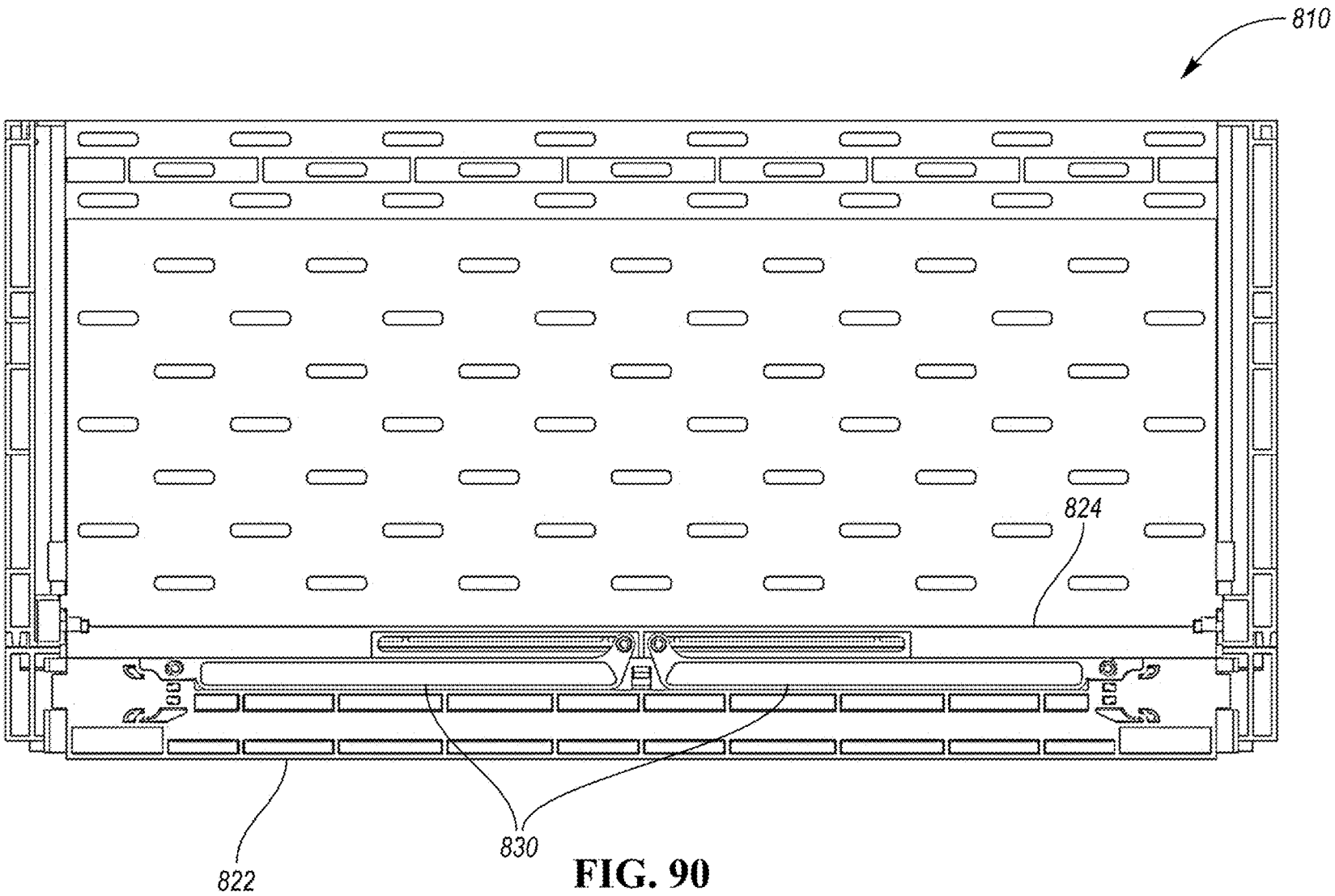
FIG. 90 is a front view of the container of FIG. 87.
Figure 91:
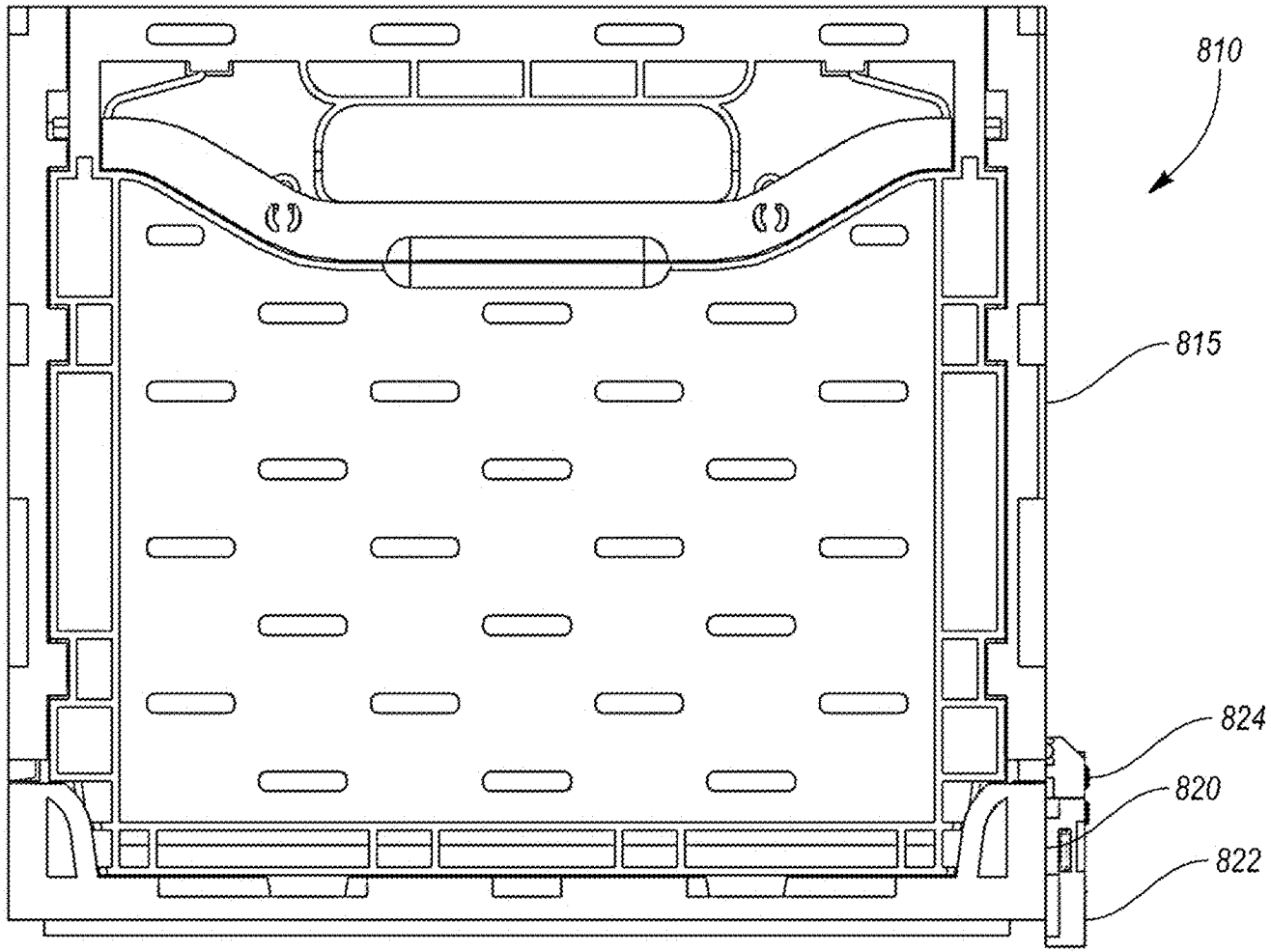
FIG. 91 is an end view of the container of FIG. 87.

As shown in FIG. 87, the upper beam 822, arms 830 and lower beam 824 can then be pivoted outward and downward to the fully retracted position flush against the horizontal portion 826 of the frame 840 and the flange 820. FIG. 88 is an enlarged view of one corner of the front wall 815 of the container 810 of FIG. 87. FIG. 89 is an inner view of the corner of the container 810 of FIG. 87. FIG. 90 is a front view of one end of the container 810 of FIG. 87. FIG. 91 is an end view of the container 810 of FIG. 87, showing the lower beam 824 and upper beam 822 against an outer surface of the front upstanding flange 820.

In the fully retracted configuration, goods can be removed from the container 810 even when another loaded container 810 is stacked thereon. Notably, the front wall 815 can be moved to the retracted position even when another loaded container 810 is already stacked thereon.

Figure 92:
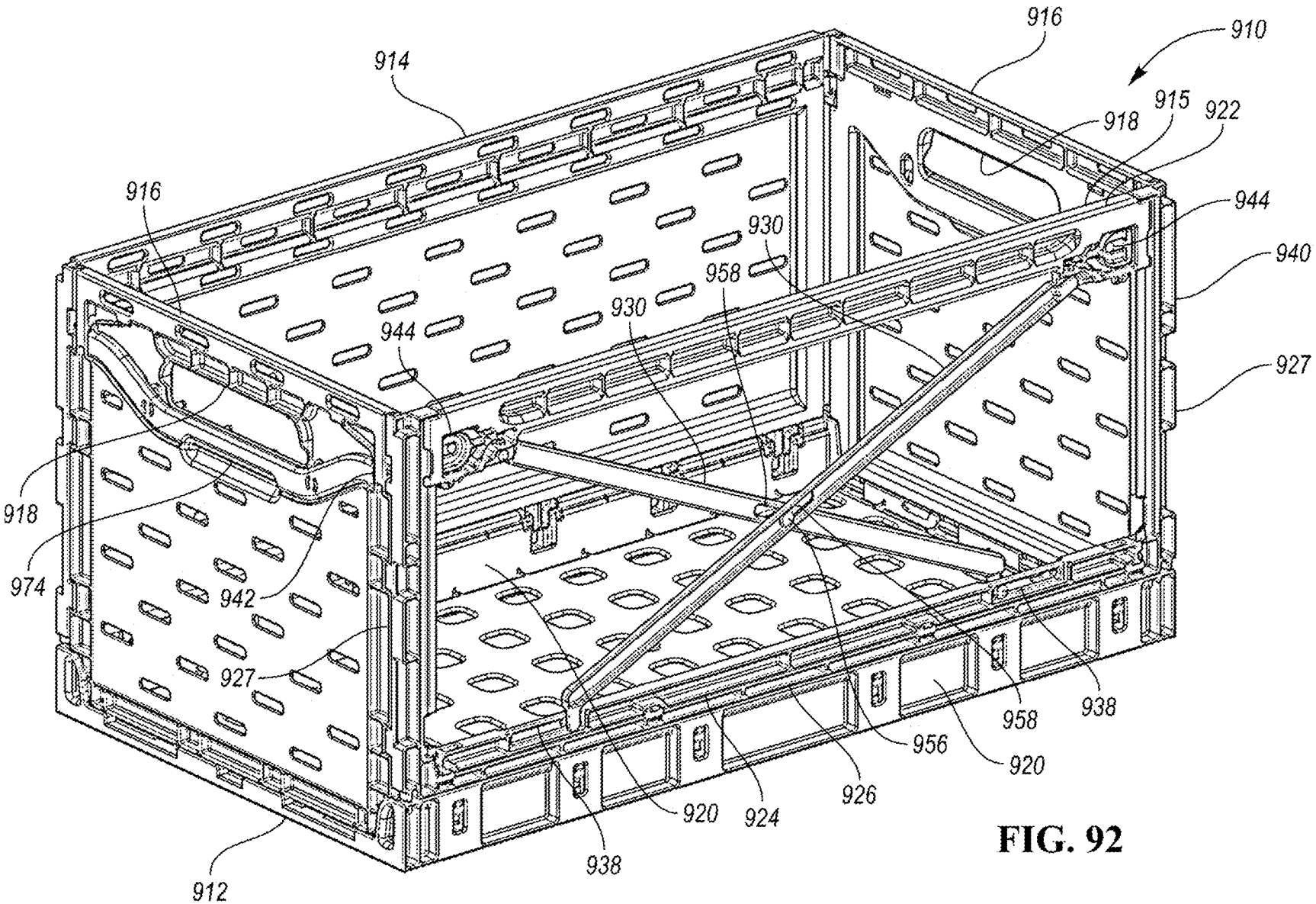
FIG. 92 is a perspective view of a container according to a tenth embodiment.

FIG. 92 shows a container 910 according to a tenth embodiment. The rear wall 914 and end walls 916 may be identical to those of FIG. 77. The collapsible container 910 includes a base 912. The front wall 915 (or "first wall") and rear wall 914 are each pivotably connected to an upstanding flange 920 at a front edge of the base 912 and a rear edge of the base 912, respectively. The front wall 915 and rear wall 914 are longer than the end walls 916.

The front wall 915 includes a U-shaped frame 940 secured to the end walls 916 by latches 942 which can be of a known type. In the example shown, the latches 942 can be released by lifting a latch release handle 974 that is below a handle opening 918 through the end wall 916. The U-shaped frame 940 includes a lower horizontal portion 926 and vertical portions 927 extending upward from opposite ends of the lower horizontal portion 926. The lower horizontal portion 926 is hingeably connected to the front upstanding flange 920.

The container 910 is a collapsible container, i.e. the walls can be collapsed onto the base 912 when empty for efficient shipping and storage. In this embodiment, the end walls 916 are hingeably connected to the base 912 in a plane lower than are the front wall 915 and rear wall 914 and the end walls 916 are between the front wall 915 and the rear wall 914, so the end walls 916 would be collapsed onto the base 912 first (in either order), and then the front wall 915 and the rear wall 914 (in either order) would be collapsed onto the end walls 916. By configuring the end walls 916 to fold first, the latches 942 can be mounted on the end walls 916. As a result, the vertical portions 927 of the U-shaped frame 940 can be narrower and define a wider access opening therebetween, providing improved access to the interior of the container 910 for users when the front wall 915 is in a retracted configuration.

The front wall 915 is retractable. In the front wall 915, an upper beam 922 is slidably connected to both of the vertical portions 927 of the frame 940. Latches 944 selectively secure the upper beam 922 in place at the upper ends of the vertical portions 927 of the frame 940 as shown in FIG. 92, which is the deployed, closed position. A lower beam 924 is hingeably connected to the lower horizontal portion 926 of the frame 940.

A plurality of arms 930 (two, in this example) are pivotably and slidably connected to elongated apertures 938 in the lower beam 924 and pivotably connected to the upper beam 922. The arms 930 cross in the middle of the front wall 915 to form an "X" arrangement. The arms 930 are connected to one another at the intersection by a pivot pin 956 extending through elongated apertures 958 in each arm 930. The pivot pin 956 is slidably captured in both elongated apertures 958.

Figure 93:
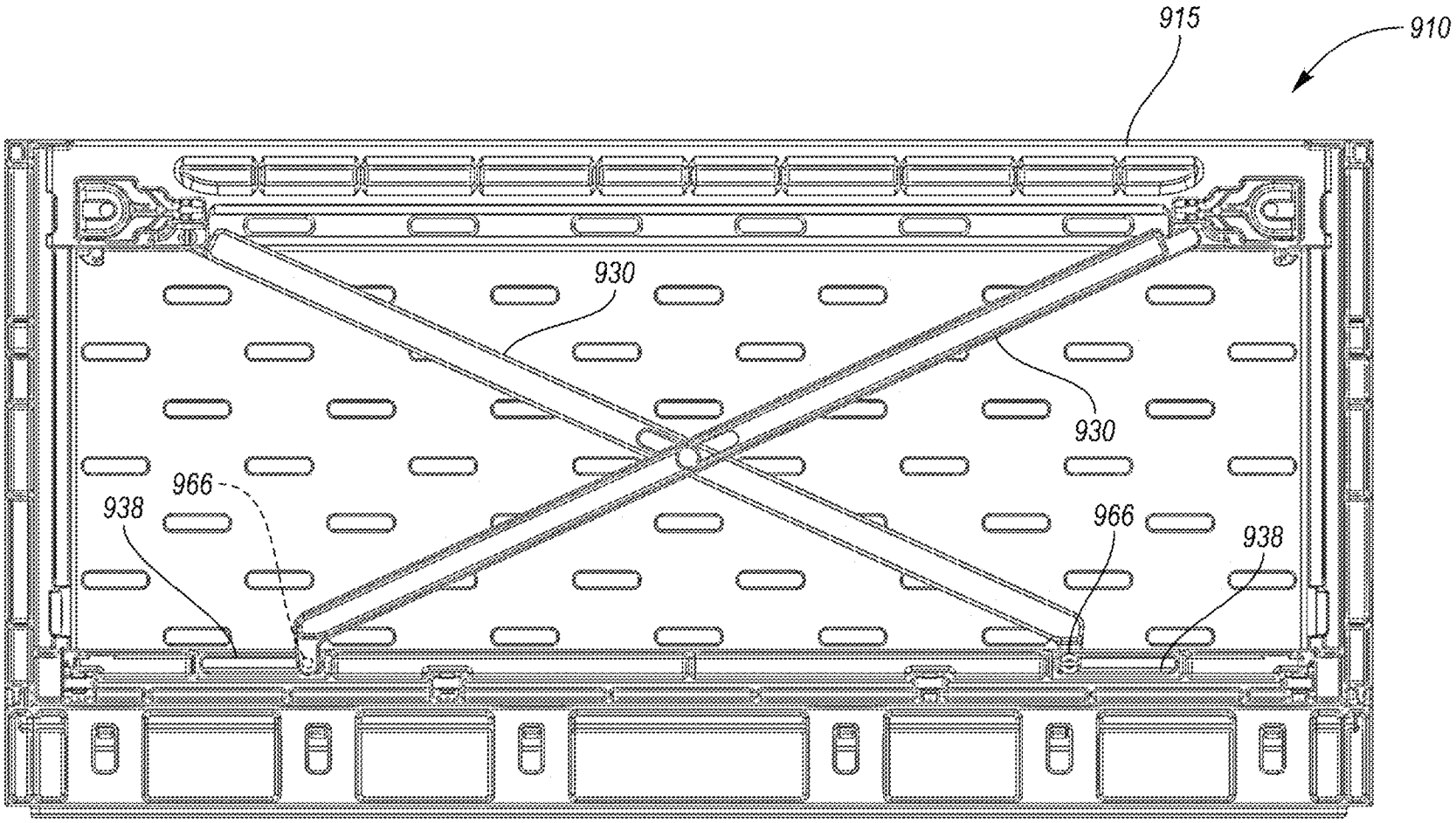
FIG. 93 is a front view of the container of FIG. 92.

FIG. 93 is a front view of the container 910 of FIG. 92. As shown, one of the arms 930 is in front of the other arm 930. The front arm 930 has a pin 966 projecting rearwardly from a lower end thereof that is captured in its associated elongated aperture 938. The rearward arm 930 has a pin 966 projecting forward therefrom that is captured in its associated elongated aperture 938.

Figure 94:
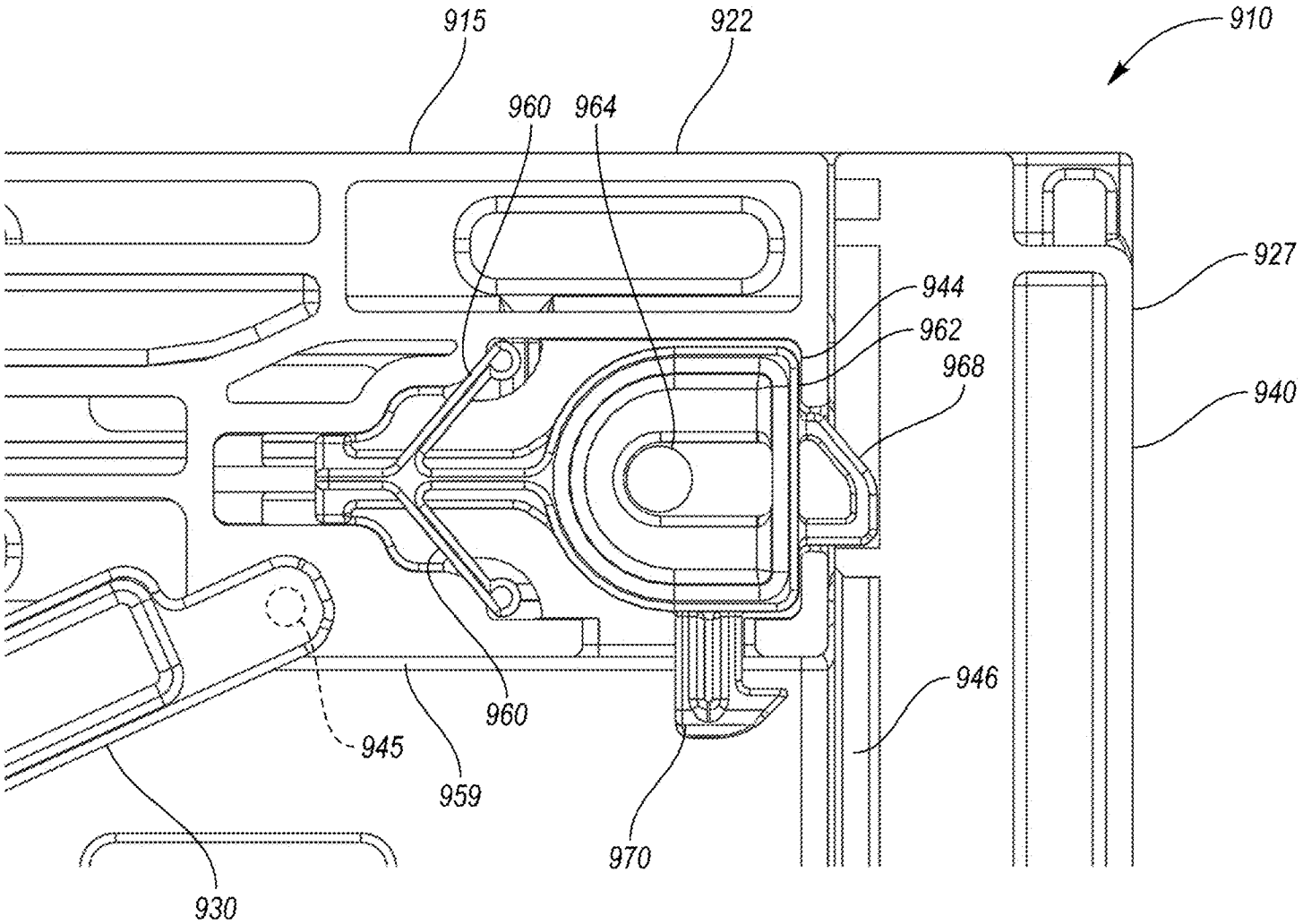
FIG. 94 is an enlarged view of one corner of the front wall of the container of FIG. 93.

FIG. 94 is an enlarged view of one corner of the front wall 915 of the container 910 of FIG. 93, with portions of the front wall 915 broken away for visibility. The other latch 944 would be mirror image. The latch 944 may have an integral spring 960 biased against a portion of the upper beam 922 to bias the latch 944 toward a latched position. A latch body 962 is slidably captured by a pin 964 integrally formed with the upper beam 922 and in the latched position (shown) has an interfering portion 968 that projects into the vertical portion 927 of the frame 940. A lower hook 970 projects downward from the latch body 962. The latch 944 is received in the track 946 on an interior side of the vertical portion 927 of the frame 940 and the upper beam 922 bears against an outer surface of the track 946. The arm 930 is connected to a downwardly projecting portion 959 of the upper beam 922 by a pivot pin 945 just below the latch 944. The other arm 930 (FIG. 93) is secured to the upper beam 922 in the same manner.

Figure 95:
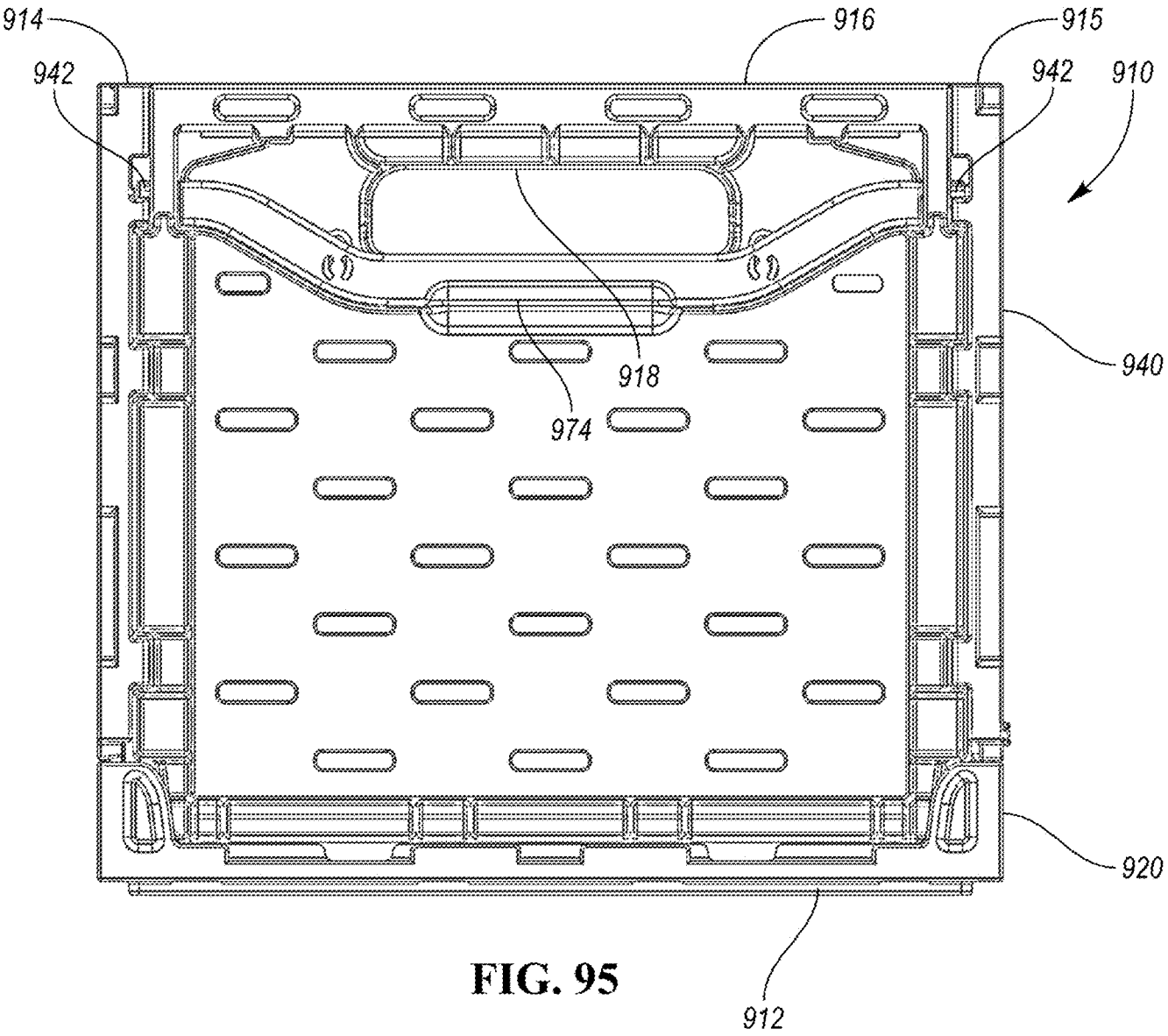
FIG. 95 is an end view of the container of FIG. 92.

FIG. 95 is an end view of the container 910 of FIG. 92.

Figure 96:
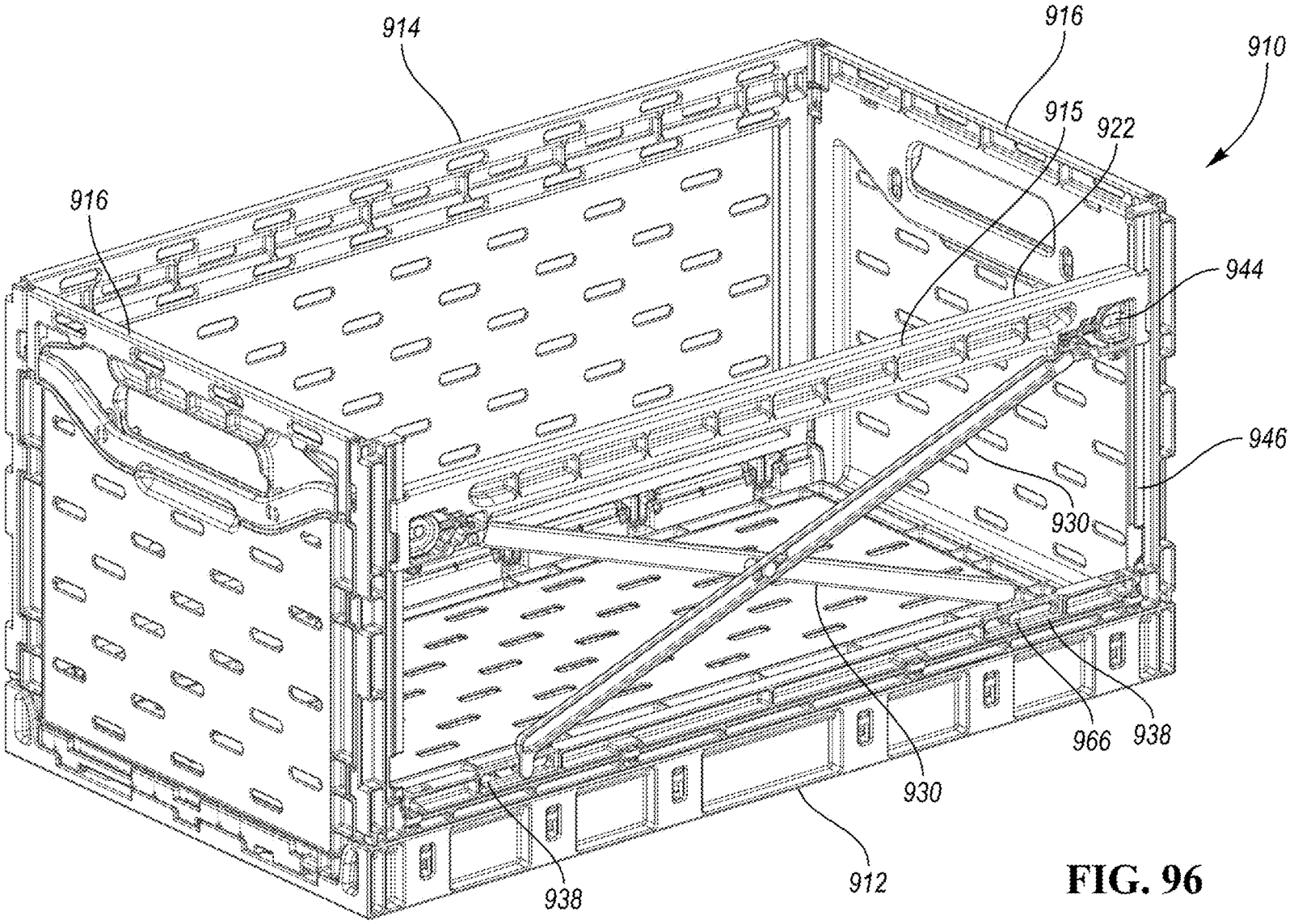
FIG. 96 shows the container of FIG. 92 with the front wall partially retracted.
Figure 97:
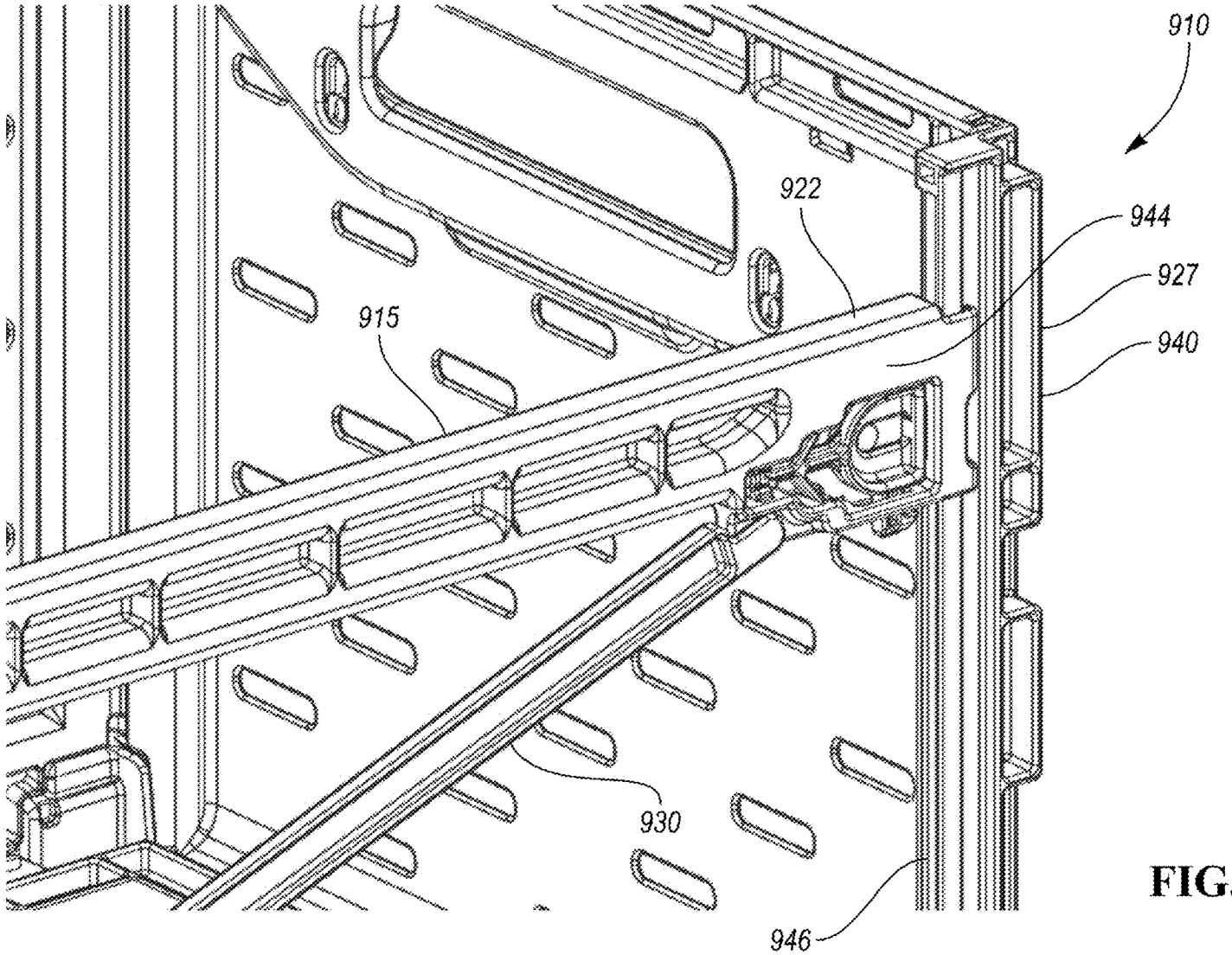
FIG. 97 is an enlarged view of one corner of the front wall of the container of FIG. 96.

In FIG. 96, the front wall 915 is partially retracted. FIG. 97 is an enlarged view of one corner of the front wall 915 of the container 910 of FIG. 96. The latches 944 are released by moving them inward toward one another. The upper beam 922 can then be slid downward with the latches 944 in the tracks 946 in the vertical portions 927 of the frame 940. The arms 930 pivot downward.

Figure 98:
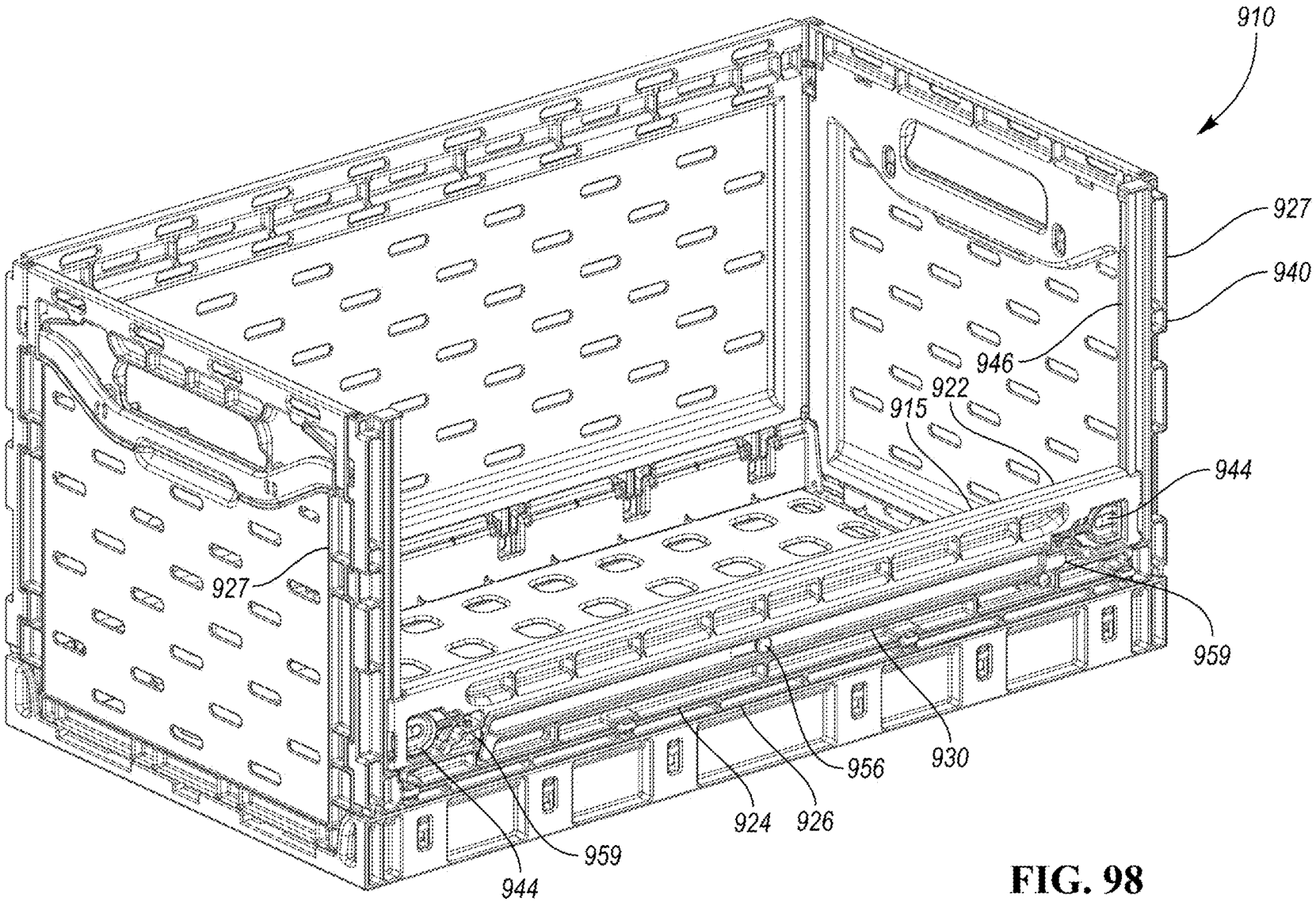
FIG. 98 is a perspective view of the container with the front wall in a further partially retracted position.

FIG. 98 is a perspective view of the container 910 with the front wall 915 in a further partially retracted position. The upper beam 922 is slid downward in the tracks 946 formed in the vertical portions 927 of the frame 940. The arms 930 pivot and slide until they are in a horizontal plane (parallel to the base 912) on top of the lower beam 924, with one arm 930 in front of the other arm 930. The arms 930 (one visible) are received between the downwardly-projecting portions 959 of the upper beam 922.

Figure 99:
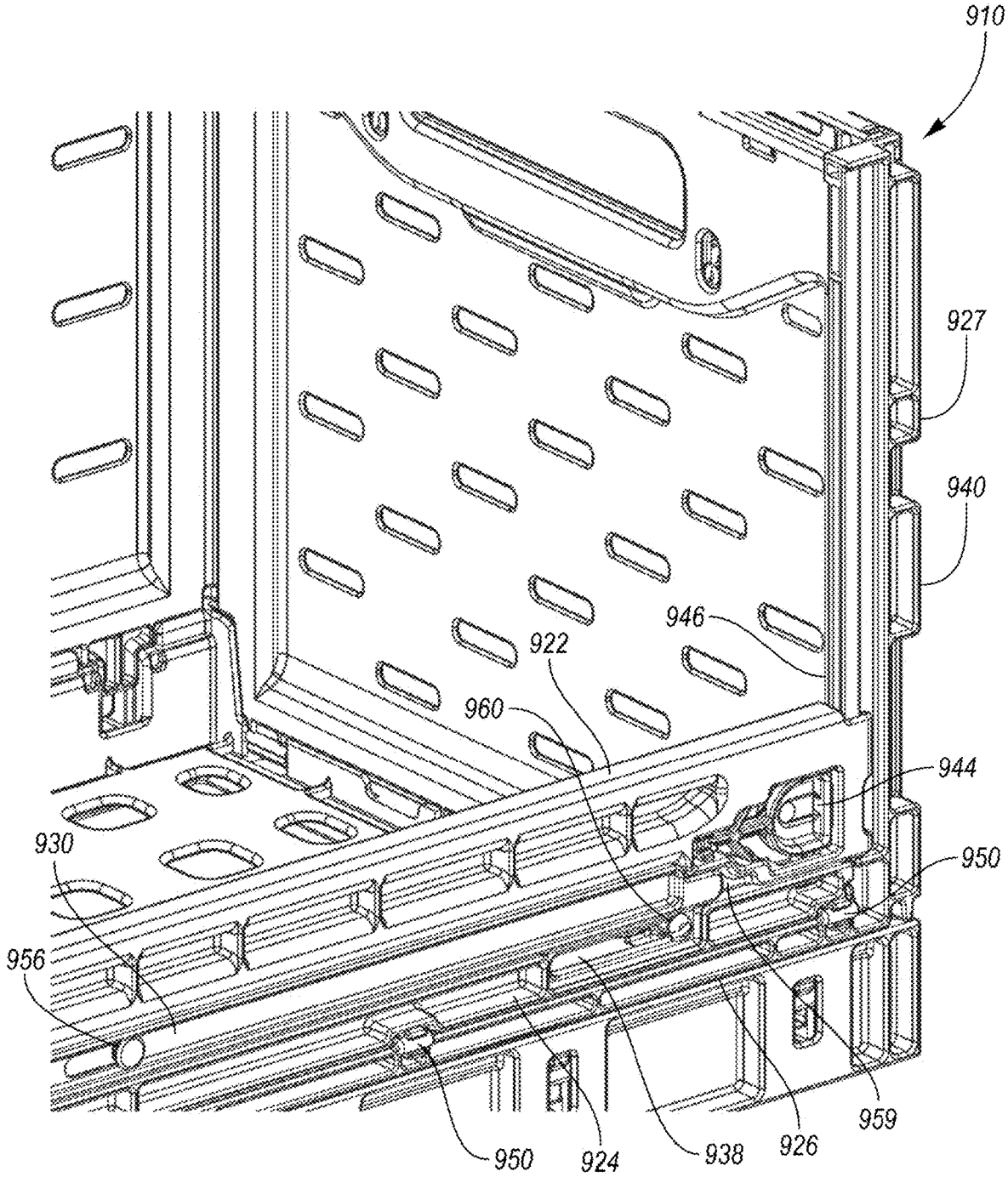
FIG. 99 is an enlarged view of one end of the front wall of FIG. 98.
Figure 100:
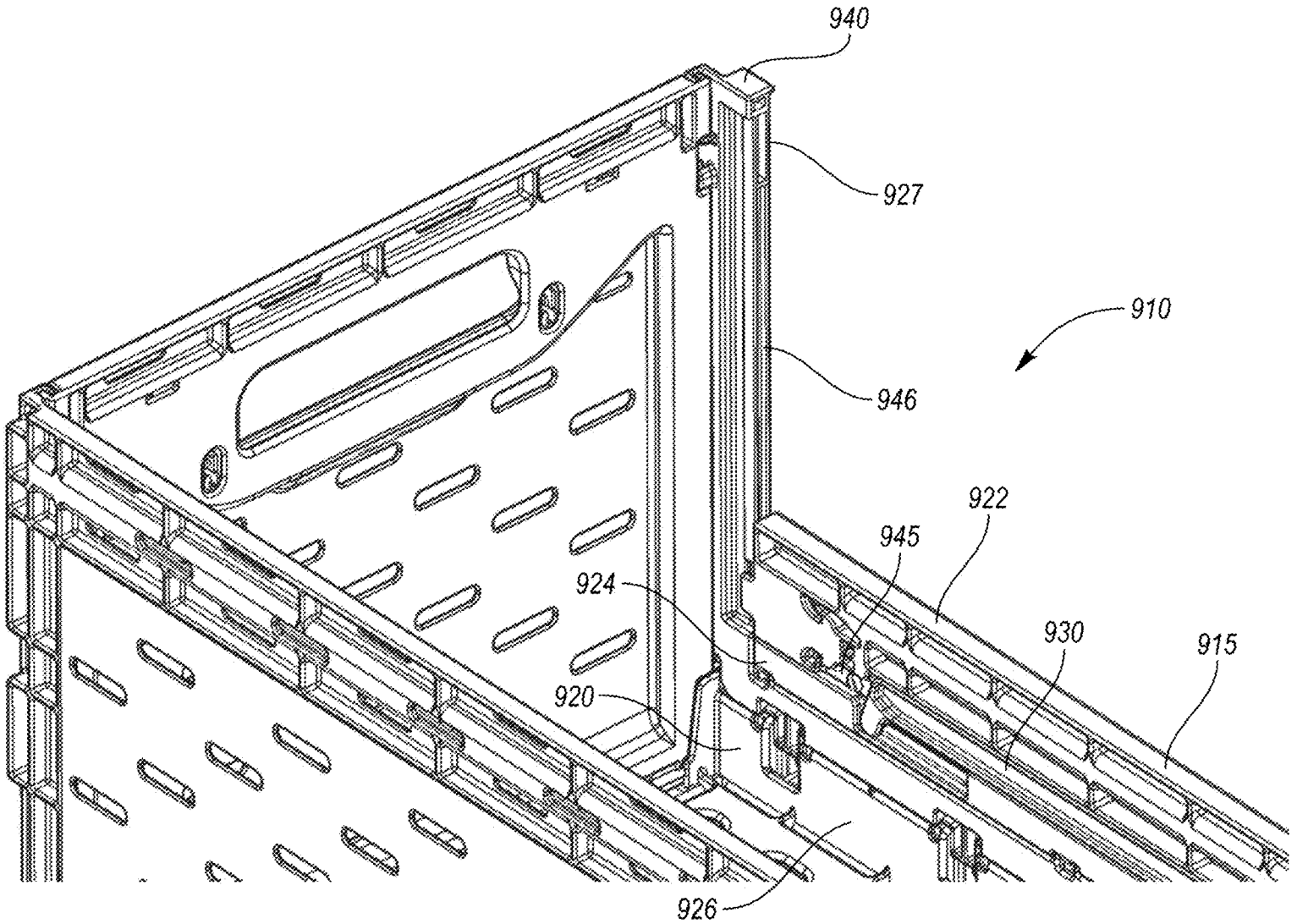
FIG. 100 is an interior view of the end of the front wall of FIG. 99.

FIG. 99 is an enlarged view of one end of the front wall 915 of FIG. 98. Hinges 950 connect the lower beam 924 to the lower horizontal portion 926 of the frame 940. The arms 930 (one visible) are received between the downwardly-projecting portions 959 of the upper beam 922. The pins 966 have been slid to outer ends of the its associated elongated aperture 938. FIG. 100 is an interior view of the end of the front wall 915 of FIG. 99. The other arm 930 is visibly between the upper beam 922 and the lower beam 924.

Figure 101:
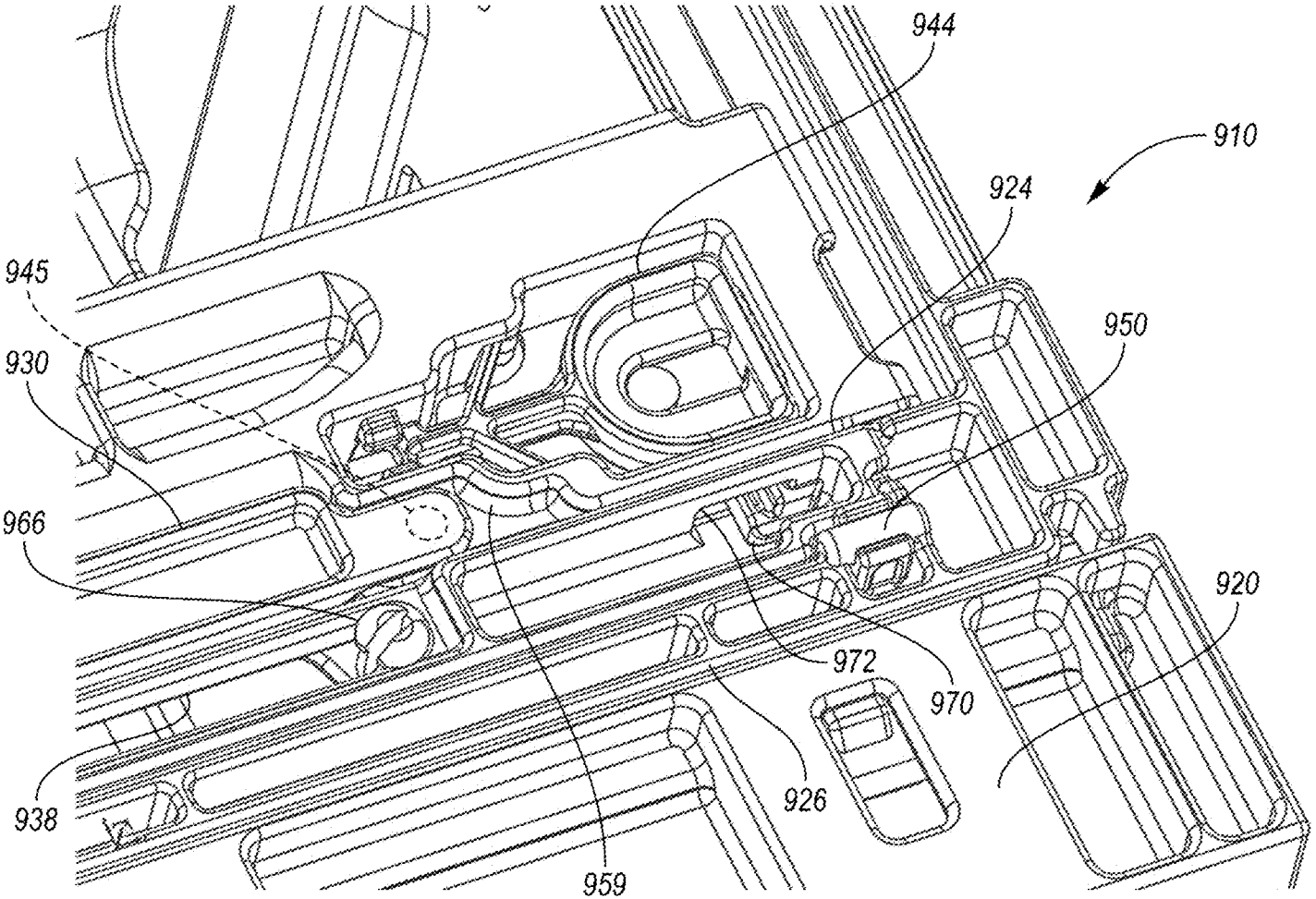
FIG. 101 is a lower perspective view of the end of the front wall of FIG. 99.

FIG. 101 is a lower perspective view of the end of the front wall 915 of FIG. 99. As shown, with the upper beam 922 in the partially retracted position on the lower beam 924, the lower hook 970 snaps into an aperture 972 in the lower beam 924 to secure the upper beam 922 to the lower beam 924. The arms 930 are received between the downwardly-projecting portions 959 (one visible) of the upper beam 922.

Figure 102:
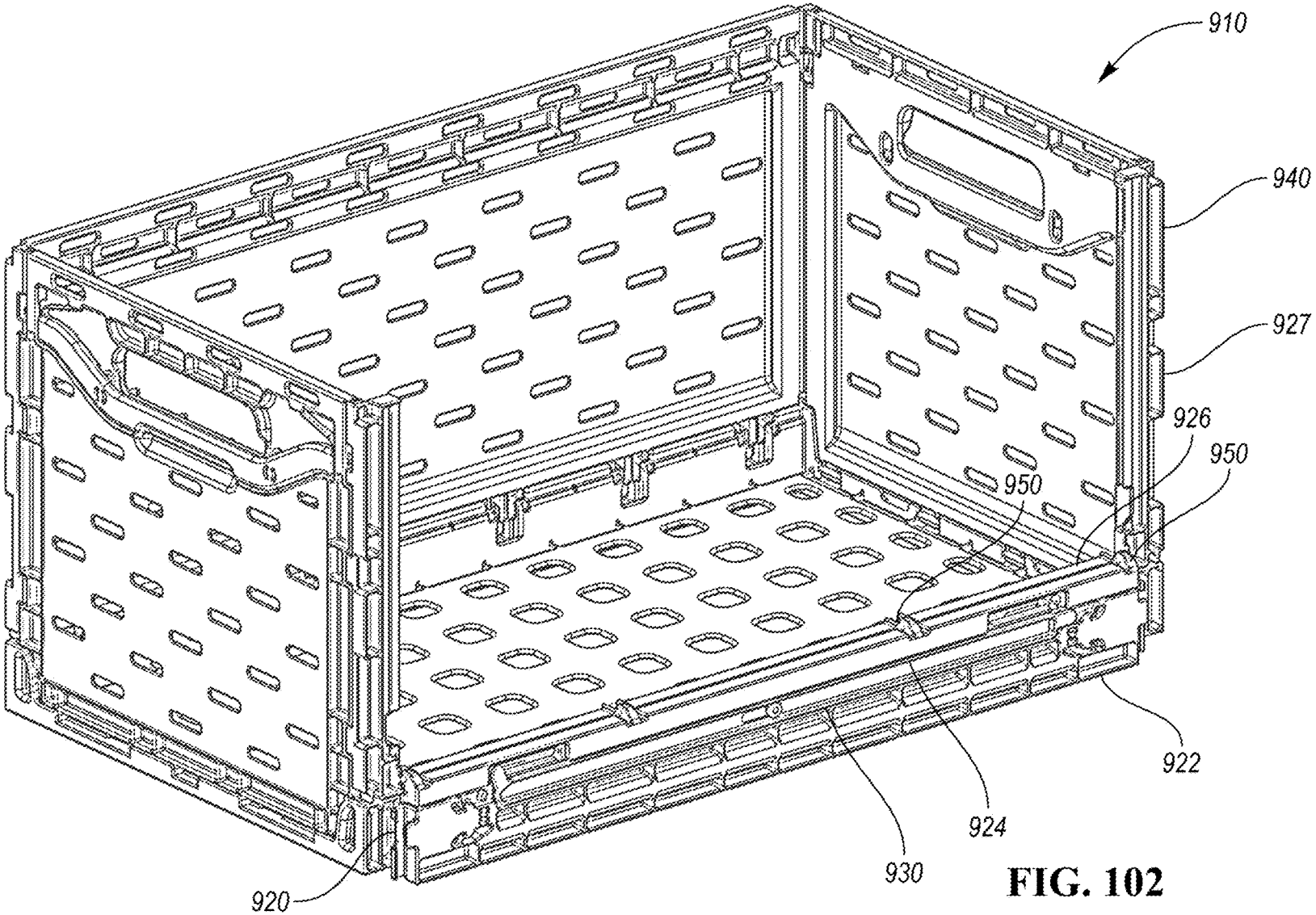
FIG. 102 shows the container of FIG. 92 with the front wall in the fully retracted configuration.
Figure 103:
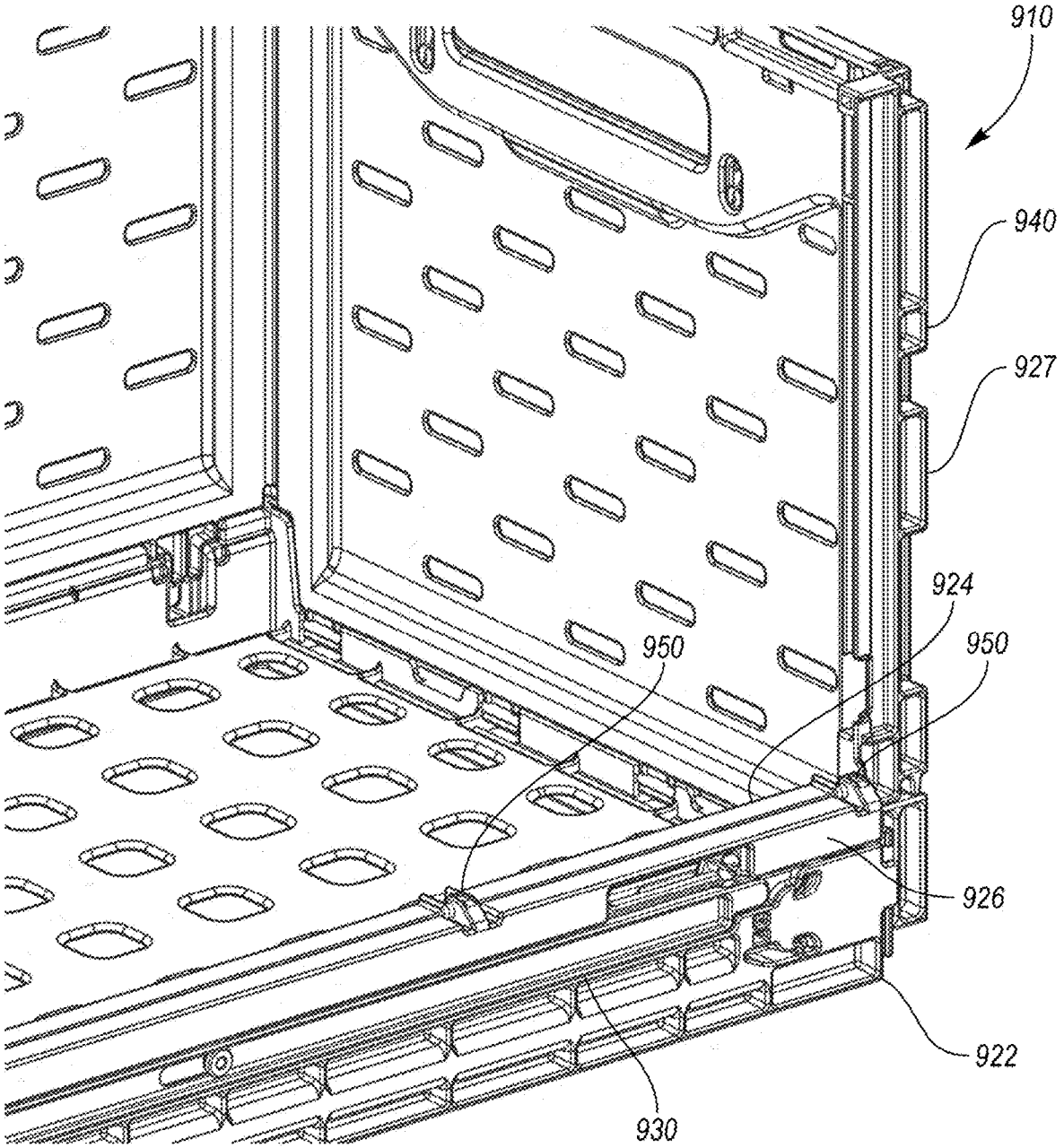
FIG. 103 is an enlarged view of one corner of the front wall of the container of FIG. 102.

As shown in FIG. 102, the upper beam 922, arms 930 and lower beam 924 can then be pivoted outward and downward via hinges 950 to the fully retracted position flush against the horizontal portion 926 of the frame 940 and the flange 920. FIG. 103 is an enlarged view of one corner of the front wall 915 of the container 910 of FIG. 102.

Figure 104:
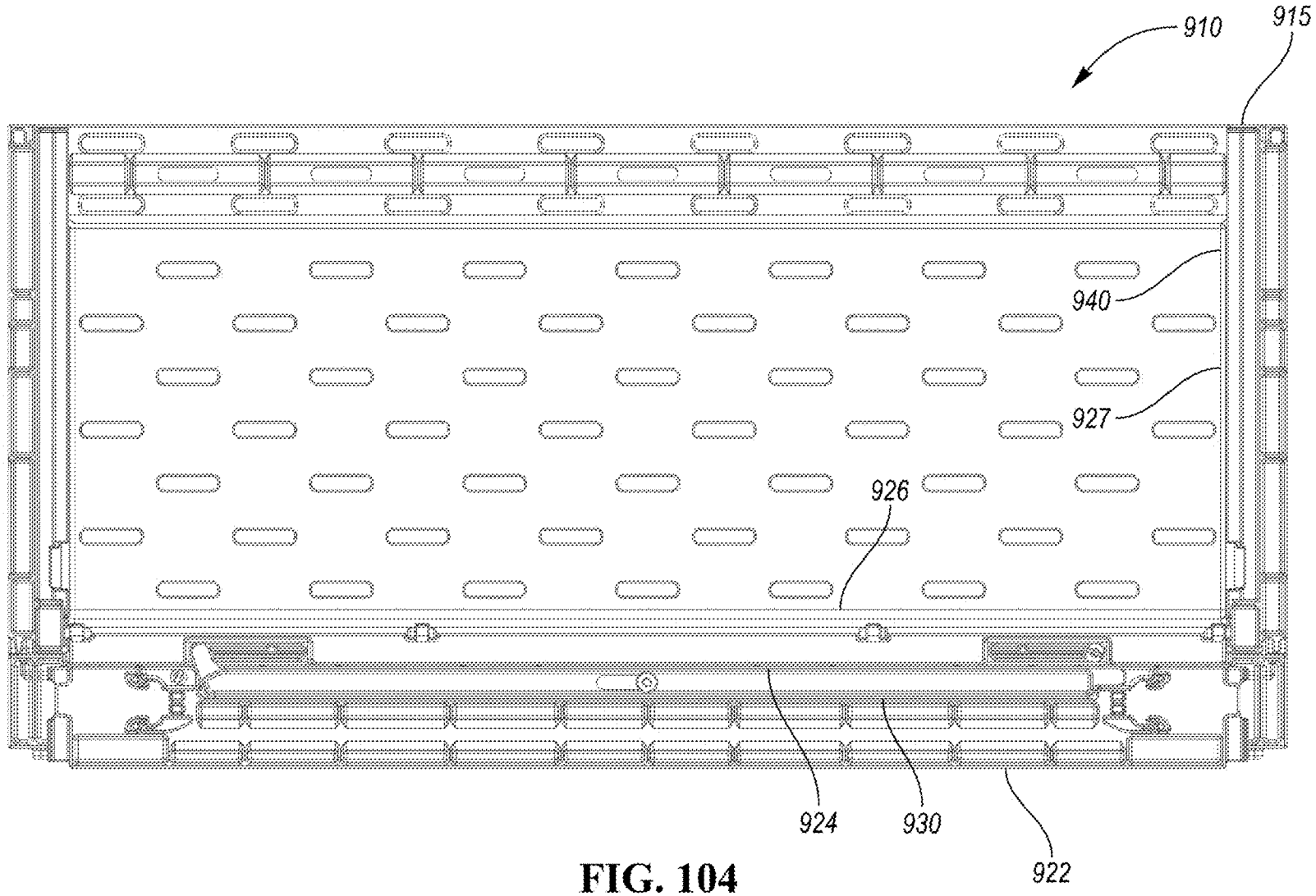
FIG. 104 is a front view of the container of FIG. 102.

FIG. 104 is a front view of the container 910 of FIG. 102. In the fully retracted configuration, goods can be removed from the container 910 even when another loaded container 910 is stacked thereon. Notably, the front wall 915 can be moved to the retracted position even when another loaded container 910 is already stacked thereon. The front wall 915 can also be returned to the closed, deployed position of FIG. 92 even with another loaded container 910 stacked thereon.

Figure 105:
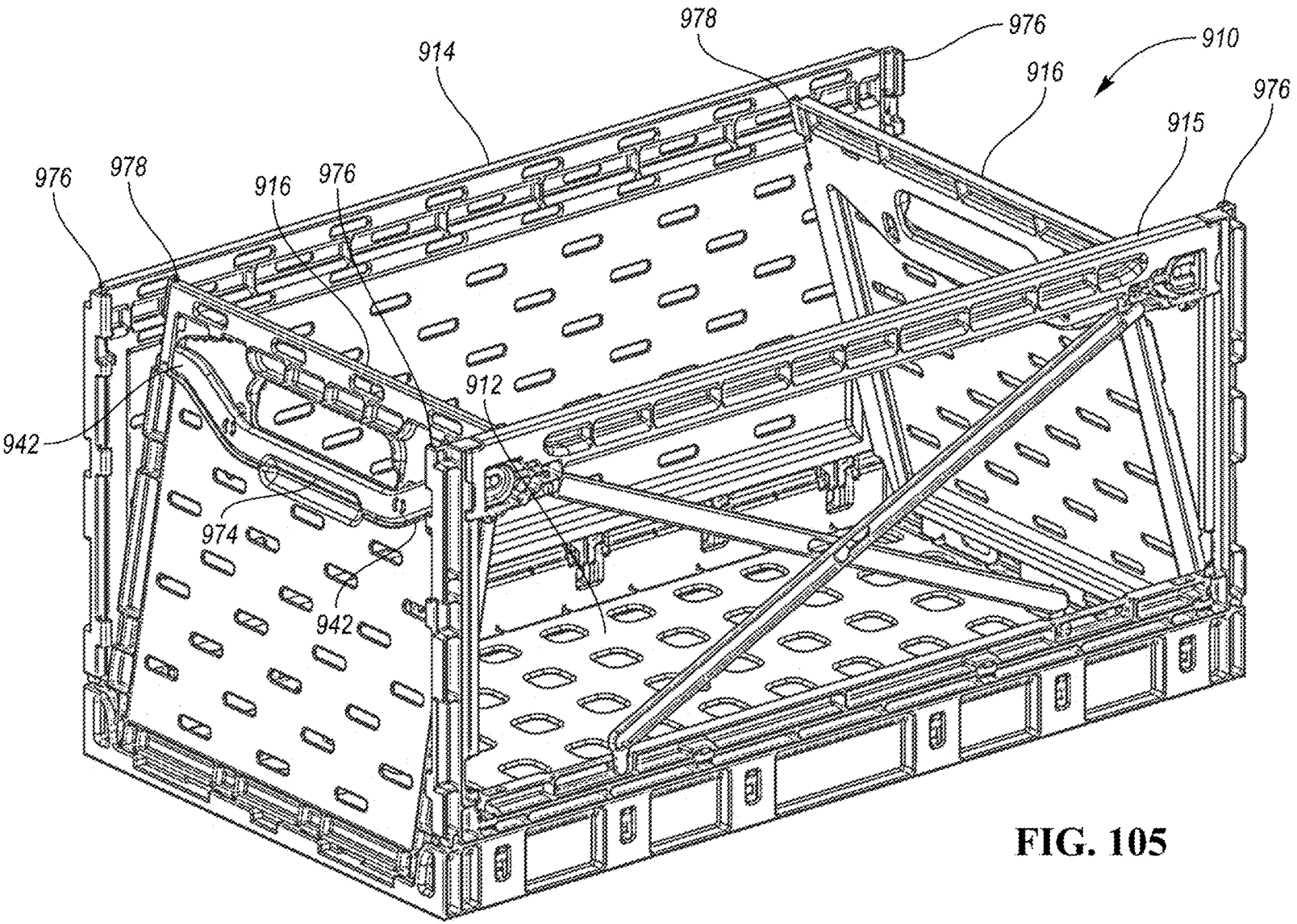
FIG. 105 shows the container of FIG. 92 in a first step for collapsing the container.

When the container 910 is empty, the container 910 can be collapsed as shown in FIGS. 105-108. Referring to FIG. 105, the end walls 916 are first released from the rear wall 914 and front wall 915 by releasing the latches 942 by pulling upward on the latch release handle 974. Complementary interlocking features 976, 978 on the front/rear walls 915, 914 permit the end walls 916 to fold inward onto the base 912. The end walls 916 are pivotably connected to the base 912 at points lower than are the front wall 915 and rear wall 914. By configuring the end walls 916 so that they are collapsed onto the base 912 before the front wall 915 and rear wall 914, the latches 942 that connect the end walls 916 to the front wall 915 and rear wall 914 are moved to the end walls 916. This leaves more room on the front wall 915 so that the opening between the vertical portions 927 is greater, leaving more room for a user to remove items from the container 910.

Figure 106:
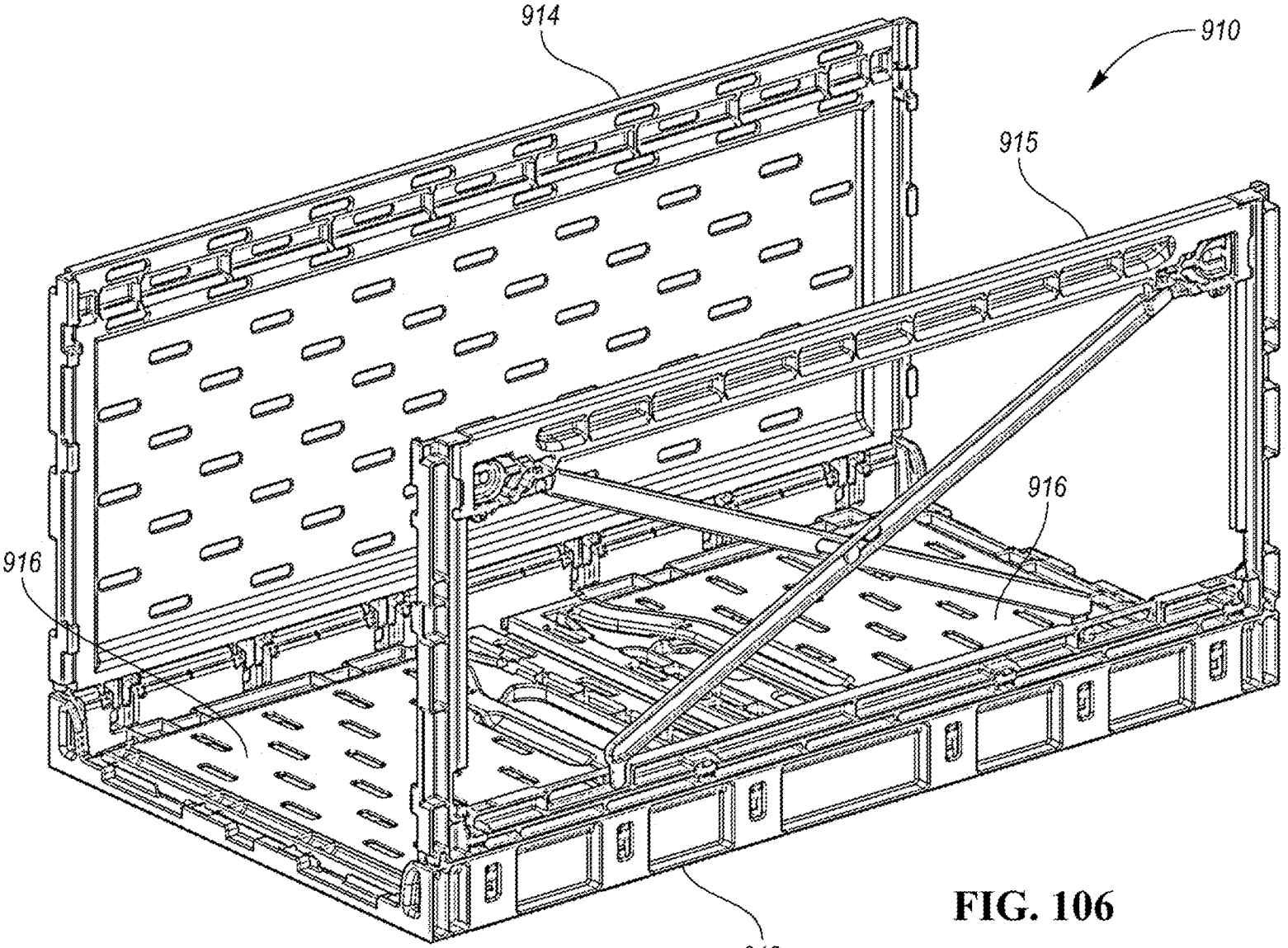
FIG. 106 shows the container of FIG. 92 in a second step for collapsing the container.
Figure 107:
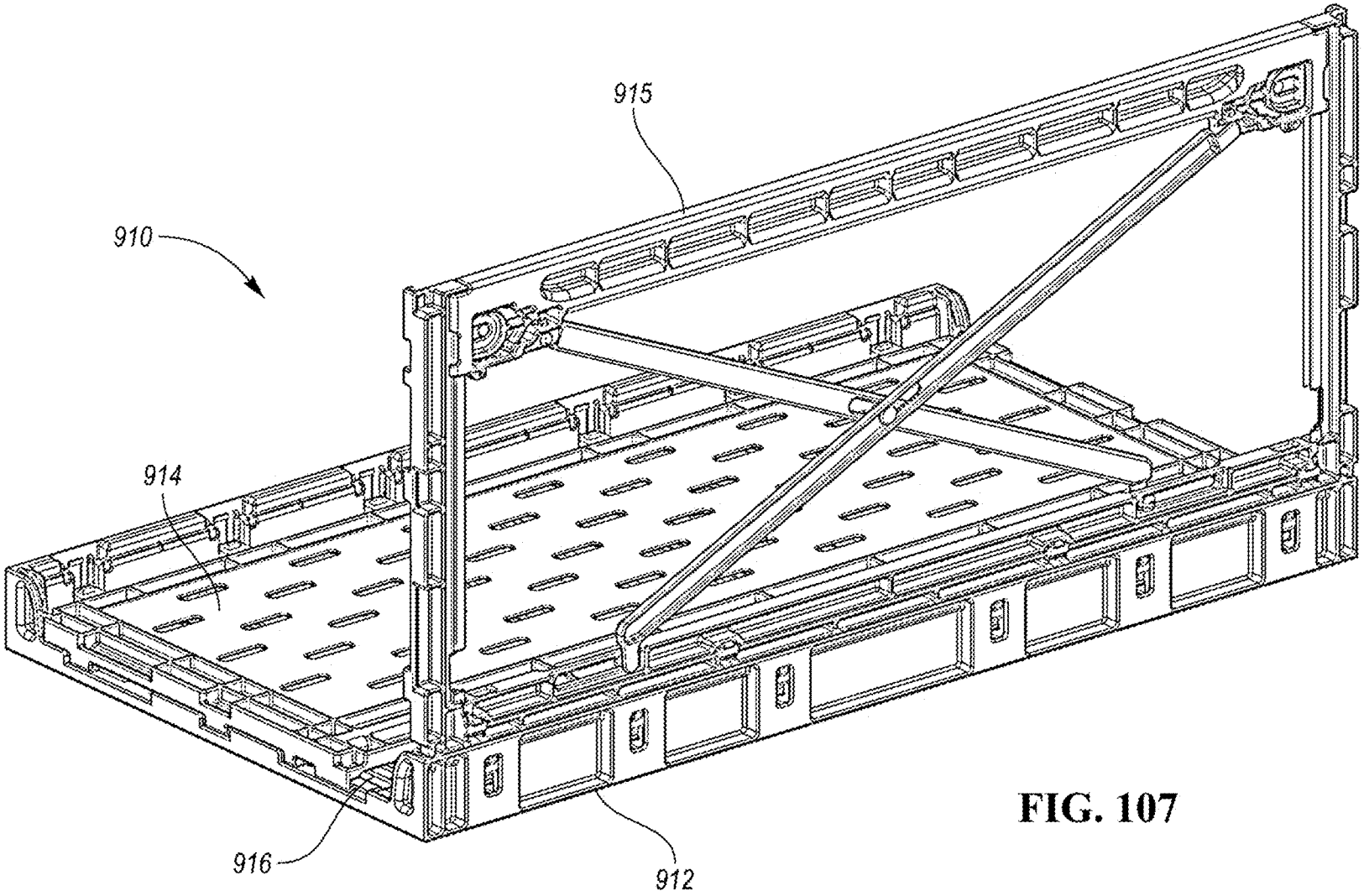
FIG. 107 shows the container of FIG. 92 in a third step for collapsing the container.
Figure 108:
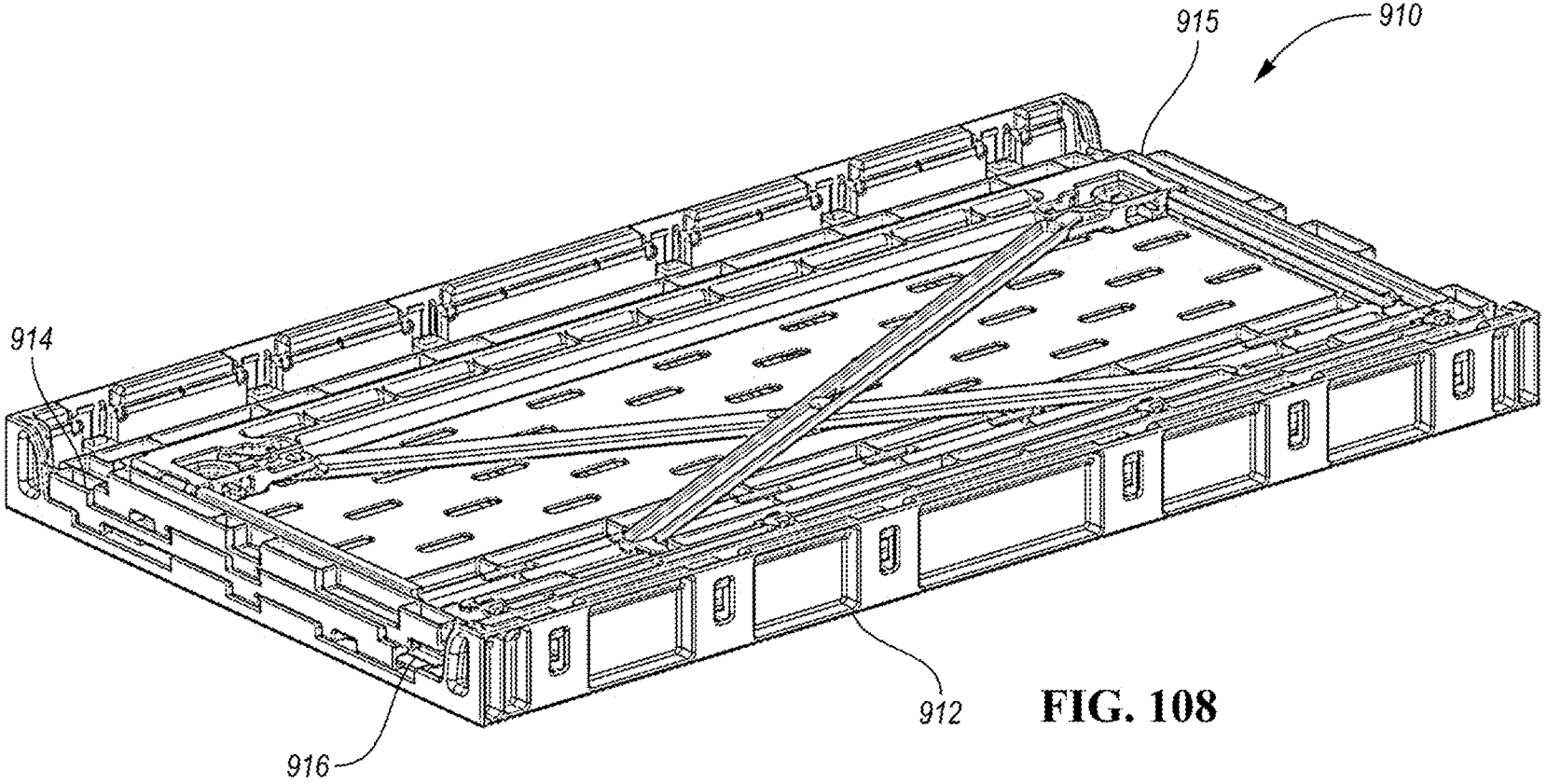
FIG. 108 shows the container of FIG. 92 fully collapsed.

FIG. 106 shows the container 910 with the end walls 916 collapsed directly onto the base 912. As shown in FIG. 107, the rear wall 914 can then be collapsed onto the end walls 916. Either the front wall 915 or the rear wall 914 can be collapsed before the other. FIG. 108 shows the container 910 with all of the walls 916, 915, 914 fully collapsed onto the base 912 for efficient storage and shipping when empty.

Each of the components described herein with respect to every embodiment may be injection molded of a suitable polymer.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A collapsible container comprising:

a base; and a plurality of walls pivotably connected to edges of the base and collapsible onto the base, the plurality of walls including a first wall;

the first wall including a frame having a lower horizontal portion and a pair of upstanding vertical portions extending upward from the lower horizontal portion to define an access opening therebetween, the first wall including an upper beam slidably coupled to the vertical portions and movable between a first position away from the lower horizontal portion of the frame and a second position proximate the lower horizontal portion of the frame, the first wall including a mid-beam coupled to the upper beam, wherein the mid-beam is spaced away from the upper beam and spaced away from the lower horizontal portion of the frame when the upper beam is in the first position.

2. The collapsible container of claim 1 wherein the mid-beam is slidably coupled to the vertical portions of the frame.

3. The collapsible container of claim 1 further including arms pivotably connected to the upper beam and to the mid-beam.

4. The collapsible container of claim 1 further including arms pivotably connected to the mid-beam and the lower horizontal portion of the frame.

5. The collapsible container of claim 1 further including a lower beam hingeably connected to the lower horizontal portion of the frame.

6. The collapsible container of claim 5 wherein the lower beam, the mid-beam and the upper beam are pivotable outward relative to the lower horizontal portion of the frame.

7. The collapsible container of claim 6 wherein upper beam is selectively connectable to the mid-beam.

8. The collapsible container of claim 1 wherein the plurality of walls includes a pair of opposed walls pivotable onto the base and wherein the first wall is collapsible onto the pair of opposed walls.

9. The collapsible container of claim 8 wherein the base includes a pair of opposed short edges and a pair of opposed long edges, wherein the pair of opposed walls are pivotably connected to the base at the short edges and wherein the first wall is pivotably connected at one of the opposed long edges.

10. The collapsible container of claim 1 wherein the upper beam has a U-shaped portion having a door pivotably mounted therein.

11. A collapsible container comprising:

a base; and a plurality of walls pivotably connected to the base, the plurality of walls are pivotable inward from an upright position to a collapsed position on the base, the plurality of walls including a first wall;

the first wall including a frame having a lower horizontal portion and a pair of upstanding vertical portions extending upward from the lower horizontal portion to define an access opening therebetween, the first wall including an upper beam slidably coupled to the vertical portions and slidable from a first position away from the lower horizontal portion of the frame to a second position proximate the lower horizontal portion of the frame, wherein the upper beam is pivotable outward relative to the lower horizontal portion of the frame from the second position.

12. The collapsible container of claim 11 further including a latch securing the upper beam lower horizontal portion of the frame when the upper beam is in the second position.

13. The collapsible container of claim 11 further including a vertical track formed on each of the vertical portions of the frame, wherein the upper beam is slidably captured by the vertical tracks, wherein the vertical tracks each include an opening proximate the second position of the upper beam, wherein the openings are configured to permit the upper beam to pivot out of the vertical tracks from the second position.

14. The collapsible container of claim 11 further including a lower beam and a hinge connecting the lower beam to the lower horizontal portion of the frame, wherein the lower beam and the upper beam are pivotable about the hinge relative to the lower horizontal portion of the frame from the second position.

15. The collapsible container of claim 12 wherein the plurality of walls includes a pair of opposed walls pivotable directly onto the base and wherein the first wall is collapsible onto the pair of opposed walls.

16. The collapsible container of claim 15 wherein the base includes a pair of opposed short edges and a pair of opposed long edges, wherein the pair of opposed walls are pivotably connected to the base at the short edges and wherein the first wall is pivotably connected at one of the opposed long edges.

17. The collapsible container of claim 16 wherein the pair of opposed walls have handle openings therethrough.

18. The collapsible container of claim 11 wherein the upper beam is pivotable outward and downward relative to the lower horizontal portion of the frame from the second position.

19. The collapsible container of claim 18 wherein the upper beam is pivotable outward and downward to a position against the lower horizontal portion of the frame.

20. The collapsible container of claim 11 further including:

a lower beam slidably coupled to the vertical portions of the frame; and a latch securing the upper beam to the lower beam when the upper beam is in the second position.

21. The collapsible container of claim 20 wherein the upper beam and the lower beam are pivotable together outward and downward relative to the lower horizontal portion of the frame.

22. A collapsible container comprising:

a base;

a plurality of walls pivotably connected to the base, the plurality of walls including a first wall and a pair of opposed walls, wherein the pair of opposed walls are collapsible onto the base and wherein the first wall is collapsible onto the pair of opposed walls; and the first wall including a frame having a lower horizontal portion and a pair of upstanding vertical portions extending upward from the lower horizontal portion to define an access opening therebetween, the first wall including an upper beam slidably coupled to the vertical portions and slidable from a first position away from the lower horizontal portion of the frame to a second position proximate the lower horizontal portion of the frame.

23. The collapsible container of claim 22 further including a first arm pivotably connected to the upper beam and a second arm pivotably connected to the upper beam and pivotably connected to the first arm.

24. The collapsible container of claim 23 wherein the first arm is pivotably and slidably secured to the second arm.

25. The collapsible container of claim 24 wherein the upper beam is pivotable outward and downward to a position against the lower horizontal portion of the frame.

26. The collapsible container of claim 23 further including a lower beam hingeably connected to the lower horizontal portion and wherein the first arm and the second arm are pivotably secured to the lower beam.

27. The collapsible container of claim 22 further including a pair of latches selectively securing the upper beam to the vertical portions of the frame.

28. The collapsible container of claim 22 wherein the upper beam is pivotable outward and downward to a position against the lower horizontal portion of the frame.

29. A collapsible container comprising:

a base;

a plurality of walls pivotably connected to the base, the plurality of walls including a first wall and a pair of opposed walls;

the first wall including a frame having a lower horizontal portion and a pair of upstanding vertical portions extending upward from the lower horizontal portion to define an access opening therebetween, the first wall including an upper beam slidably coupled to the vertical portions and movable between a first position away from the lower horizontal portion of the frame and a second position proximate the lower horizontal portion of the frame;

a first arm pivotably connected to the upper beam; and a second arm pivotably connected to the upper beam and pivotably connected to the first arm, wherein the first arm is pivotably and slidably secured to the second arm.

30. The collapsible container of claim 29 further including a pair of latches selectively securing the upper beam to the vertical portions of the frame.

31. The collapsible container of claim 30 wherein the upper beam is pivotable outward and downward to a position against the lower horizontal portion of the frame.

32. The collapsible container of claim 29 further including:

a lower beam slidably coupled to the vertical portions of the frame; and a latch securing the upper beam to the lower beam when the upper beam is in the second position.

33. The collapsible container of claim 32 wherein the upper beam is pivotable outward and downward to a position against the lower horizontal portion of the frame.

* * * * *